US006717557B2

(12) United States Patent
Ishizuka

(10) Patent No.: US 6,717,557 B2
(45) Date of Patent: Apr. 6, 2004

(54) DRIVING APPARATUS AND DRIVING METHOD OF AN AC TYPE PLASMA DISPLAY PANEL HAVING AUXILIARY ELECTRODES

(75) Inventor: Mitsuhiro Ishizuka, Tokyo (JP)

(73) Assignee: NEC Corporation (JP)

( * ) Notice: Subject to any disclaimer, the term of this patent is extended or adjusted under 35 U.S.C. 154(b) by 152 days.

(21) Appl. No.: 09/778,447

(22) Filed: Feb. 7, 2001

(65) Prior Publication Data

US 2001/0011975 A1 Aug. 9, 2001

(30) Foreign Application Priority Data

Feb. 7, 2000 (JP) ..... 2000-029663

(51) Int. Cl.[7] ..... G09G 3/28
(52) U.S. Cl. ..... 345/60
(58) Field of Search ..... 345/60, 61, 62, 345/63, 37, 41, 67, 68; 315/169.1, 169.3, 169.4; 313/582, 583, 584, 585

(56) References Cited

U.S. PATENT DOCUMENTS 6,262,532 B1 * 7/2001 Park et al. ..... 313/585
6,344,714 B1 * 2/2002 Su et al. ..... 313/582
6,414,656 B1 * 7/2002 Hong ..... 345/60
6,479,933 B1 * 11/2002 Chen ..... 313/582

FOREIGN PATENT DOCUMENTS

JP 2801893 7/1998 ..... G09G/3/28

* cited by examiner

*Primary Examiner*—Chanh Nguyen
(74) *Attorney, Agent, or Firm*—Hayes Soloway P.C.

(57) ABSTRACT

An AC type plasma display is provided with first and second substrates disposed oppositely. Scan electrodes and sustainment electrodes are provided alternately at an opposite face side to the second substrate in the first substrate, the scanning and sustainment electrodes extending in a row direction. Data electrodes are provided at an opposite face side to the first substrate in the second substrate, the data electrodes extending in a column direction. Auxiliary electrodes are provided at all of spaces between the scan electrodes and the sustainment electrodes. The auxiliary electrodes extend in a row direction.

17 Claims, 110 Drawing Sheets

DRIVING APPARATUS AND DRIVING METHOD OF AN AC TYPE PLASMA DISPLAY PANEL HAVING AUXILIARY ELECTRODES

BACKGROUND OF THE INVENTION

1. Field of the Invention

The present invention relates to an AC type plasma display used for a flat type television and information representing display; and a driving apparatus of the display and a driving method of the display. More particularly, the present invention relates to an AC type plasma display for restricting incorrect discharge and a driving apparatus of the display and a driving method of the display.

2. Description of the Related Art

In general, a plasma display panel (hereinafter, abbreviated as PDP) has a number of features including thin structure, flickering-free, large display contrast ratio, possible comparatively large screen, high response speed, spontaneous light emitting type, possible multiple color light emission by use of a phosphor. Thus, recently, in the field of computer associated display device and in the field of color image display or the like, a PDP becomes more popular. This PDP is divided into two types: an AC type in which an electrode is covered with an dielectric to indirectly cause operation in an AC discharge and a DC type in which an electrode is exposed in a discharge space to cause operation in a DC discharge state, depending on its operating system. Further, this AC type PDP is divided into a memory operation type using a discharge cell memory as a driving system and a refresh operation type that does not use such memory as a driving system. The luminescence of the PDP is proportional to discharge count, that is, the number of pulse voltage repetitions. About the above refresh type, when a display capacity increases, the luminescence is lowered. Thus, such a PDP is mainly used as a PDP with its small display capacity.

FIG. 1 is a schematic perspective view illustrating a configuration of one display cell of a conventional AC memory operation type PDP.

Two insulation substrates 1 and 2 made of glass are provided at the conventional AC memory operation type PDP. The insulation substrate 1 serves as a rear substrate, and the insulation substrate 2 serves as a front substrate.

Transparent scan electrodes 3 and transparent sustainment electrodes 4 are provided at an opposite side to the insulation substrate 1 in the insulation substrate 2. The scan electrode 3 and the sustainment electrode 4 extend in horizontal direction (transverse direction) of the panel. In addition, trace electrodes 5 and 6 are disposed so as to be overlapped respectively on the scan electrode 3 and the sustainment electrode 4. The trace electrodes 5 and 6 are metallic, for example, and are provided in order to reduce an electrode resistance value between each of these electrodes and an external driving apparatus. Further, there are provided an dielectric layer 12 covering the scan electrode 3 and the sustainment electrode 4 and a protective layer 13 comprising a magnesium oxide or the like, for protecting the dielectric layer 12 from discharge.

Data electrodes 7 orthogonal to the scan electrodes 3 and the sustainment electrodes 4 are provided at an opposite face to the insulation electrode 2 in the insulation electrode 1. Therefore, the data electrode 7 extends in vertical direction (longitudinal direction) of the panel. In addition, bulkheads 9 for partitioning display cells in horizontal direction are provided. Further, a dielectric layer 14 covering the data electrode 7 is provided, and phosphor layers 11 for converting the ultraviolet rays generated by discharge of a discharge gas into a visible light 10 are formed on each of the side face of the bulkheads 9 and on the surface of the dielectric layer 14. Discharge gas spaces 8 are allocated by the bulkheads 9 in a space between the insulation substrates 1 and 2. In this discharge gas space 8, a discharge gas comprising helium, neon, xenon or the like, or a mixture containing these is charged.

FIG. 2 is a block diagram depicting driving circuits in a conventional AC memory operation type DPD. In addition, FIG. 3A is a circuit diagram depicting driving circuits on the scan electrode 3 side; FIG. 3B is a circuit diagram depicting driving circuits on the sustainment electrode 4 side; and FIG. 3C is a circuit diagram depicting a data driver 28.

There are provided display cells that emit light at a cross point between the scan electrode 3 and sustainment electrode 4 provided in parallel to each other and the data electrodes 7 orthogonal to the electrodes 3 and 4. Therefore, one scan electrode, one sustainment electrode, and one data electrode are provided in one display cell. Thus, the number of display cells on the entire screen is "n+m", where the number of scanning and sustainment electrodes is "n", and the number of data electrodes is "m".

In addition, a removal portion of a respective one of the scan electrodes 3 and sustainment electrodes 4 is provided at the end in the horizontal direction of the display panel in a conventional PDP, and a driving circuit is connected to this removal portion.

A scan pulse driver 21 for outputting scan pulses to each of the scan electrodes 3 is provided as a driving circuit at the scan electrode 3 side. In addition, a reset driver 30 for outputting reset pulses common to all of the scan electrodes 3; a sustainment driver 23 for outputting sustainment pulses; an erasing driver 24 for applying erasing pulses; a scan base driver 25 for outputting scan base pulses; and a scan voltage driver 26 for outputting a scan voltage are connected to a scan pulse driver 21.

On the other hand, a sustainment driver 27 for applying sustainment pulses to the entirety of the sustainment electrode 4 is provided as a driving circuit at the sustainment electrode 4 side.

Further, a removal portion of the data electrodes 7 is provided at the end in the vertical direction of the display panel in a conventional PDP, and to this removal portion, a data driver 28 is connected as a driving circuit.

A controller 29 for switching operation of each driver according to a video signal is provided.

An operation of a conventional PDP configured as described above will be described hereinafter. FIG. 4 is a timing chart showing a method of driving the conventional PDP.

In FIG. 4, periods 1-f and 1-(f+1) are reset periods of a sub-field of a respective one of the frames "f" and "f+1 ". In these reset periods, respective rectangular wave reset pulses Ppr-s and Ppr-c are applied to the entirety of the scan electrodes S and the entirety of the sustainment electrodes C.

In the reset periods 1-f and 1-(f+1), reset discharge is generated in a discharge space in the vicinity of a gap between the scan electrode and the sustainment electrode of all display cells, depending on a positive polarity rectangular wave applied to the scan electrode and a negative polarity rectangular wave applied to the sustainment electrode. In this manner, the generation of active particles which makes it easy to generate discharge of display cells is performed. At the same time, the negative polarity wall charge is accumulated on the scan electrode S, and the positive electrode wall charge is accumulated on the sustainment C. However, these wall charges are almost eliminated by self-erasing discharge in a subsequent fall of the pulse.

Then, the erasing pulse Pe-s is applied to the entire of the scan electrodes S, whereby the wall charges which are not erased by self-discharge are completely erased.

In FIG. 4, periods 2-f and 2-(f+1) are addressing periods of a sub-field of a respective one of the frames "f" and "f+1". In these addressing periods 2-f and 2-(f+1), the entirety of the sustainment electrodes C is maintained to a GND level. In addition, a negative polarity scan pulse Psc-s is applied to a scan electrode Si in a row in which writing is to be performed, and a positive polarity data pulse Pd is applied to a data electrode D. As a result, both of these pulses are applied, and an opposite discharge is generated in a selected display cell. With this discharge being a trigger, a planer discharge is generated as a writing discharge between a sustainment electrode Ci and a scan electrode Si. Thus, a negative charge is accumulated on the scan electrode Si, and a positive charge is accumulated on the sustainment electrode Ci.

On the other hand, a gap between electrodes is large between the sustainment electrode Ci-1, which is positioned on the upper side of the scan electrode Si, and the scan electrode Si in other display cells, and thus, a planar discharge is not generated. In this way, writing discharge is generated at only a cross point between the scan electrode Si to which the scan pulse Psc-s is applied and the data electrode D to which a data pulse Pd is applied.

In FIG. 4, periods 3-f and 3-(f+1) are sustainment periods of a sub-field of a respective one of the frames "f" and (f+1). In these sustainment periods 3-f and 3-(f+1), a sustainment pulse Psus-c is applied to the sustainment electrodes C, and then, the respective negative polarity sustainment pulses Psus-s and Psus-c are applied alternately to the scan electrodes S and the sustainment electrodes C.

In a display cell selectively written in the addressing period 2-f or 2-(f+1), the negative charge is accumulated on the scan electrodes S, and the positive charge is charge on the sustainment electrodes C. Thus, by applying the first sustainment pulse Psus-c, the negative polarity sustainment pulse voltage for the sustainment electrodes C and the wall charge voltage are weighted each other, a potential difference between electrodes exceeds a minimum discharge voltage, and a discharge is generated. Once the discharge is generated, a wall charge is disposed so as to cancel the voltage applied to each electrode. Therefore, a negative charge is accumulated on the sustainment electrodes C, and a positive charge is accumulated on the scan electrodes S.

In the next sustainment pulse, a negative voltage pulse is applied to the side of the scan electrodes S, and weighting relevant to a wall charge is generated in the scan electrodes S, a potential difference between the electrodes exceeds a minimum discharge voltage, and a discharge is generated. Then, in the sustainment periods 3-f and 3-(f+1), the sustainment pulses Psus-c and Psus-s are repeatedly applied, whereby the light emission of a selected display cells is sustained.

One sub-field of the frame "f" is configured in accordance with the steps from the periods 1-f to 3-f, and this sub-field is repeatedly formed in required times to configure the frame "f". In addition, one sub-field of the frame "f+1" is configured in accordance with the steps from the periods 1-(f+1) to 3-(f+1), and this sub-field is repeatedly formed in required times to configure a frame "f+1".

In this conventional PDP driving method, a scan electrode and a sustainment electrode are always used in pair. Thus, in the case where writing is performed for a display cell in the n-th line, in order to restrain diffusion of discharge to display cells in the adjacent the (n−1)-th line and the (n+1)-th line, it is required to set a gap between electrodes on which a discharge is not performed generally (such as between the n-th line scan electrode and the (n−1)-th line sustainment electrode) to be larger than compared with that between electrodes on which a discharge is performed. For example, when a gap between discharge electrodes is set to 50 to 100 micrometers, it is required to set a gap between non-discharge electrodes to 250 to 400 micrometers. In this case, even if an attempt is made to reduce a pixel pitch in order to increase display resolution, a gap between non-charge electrodes cannot be reduced. Thus, there has been a problem that an area for electrodes itself may be reduced, and the light emission luminescence is lowered. In addition, the number of scan drivers must be the same as that of scanning lines. Thus, when the resolution in vertical direction is increased, a required number of drivers increases, which increases circuit cost. Hereinafter, such a PDP is referred to as a first prior art.

Because of this, there is proposed a plasma display for switching a portion targeted for performing sustainment and light emission every frame and a driving method thereof (Japanese Patent No. 2801893). Hereinafter, this conventional plasma display is referred to as a second prior art. FIG. 5 is a schematic view illustrating a light emission portion in the scanning period of a frame "f" in the second prior art; FIG. 6 is a schematic view illustrating a light emission portion in the sustainment period of a frame "f" in the second prior art; FIG. 7 is a schematic view illustrating a light emission portion in the scanning period of a frame "f+1" in the second prior art; and FIG. 8 is a schematic view illustrating a light emission portion in the sustainment period of a frame "f+1" in the second prior art.

In the second prior art, at the frame "f", as shown in FIG. 5, writing is performed for an addressing period by planar discharge between the scan electrode Si-1 and the sustainment electrode Ci-1 with an opposite discharge generated between the scan electrode Si-1 and the data electrode D being a trigger, for example. As shown in FIG. 6, in the subsequent sustainment periods, sustainment voltages are applied alternately between the scan electrode Si-1 and the sustainment electrode Ci-1, and sustainment and light emission are performed, thereby causing display.

In addition, at the frame "f+1", as shown in FIG. 7, writing is performed for an addressing period by a planer discharge between the scan electrode Si and the sustainment electrode Ci-1 with an opposite discharge generated between the scan electrode Si and the data electrode D being a trigger, for example. As shown in FIG. 8, sustainment voltage is applied alternately between the scan electrode Si and the sustainment electrode Ci-1 in the subsequent sustainment period, and sustainment and light emission are performed, thereby causing display.

In the second prior art, all the gaps between electrodes may become discharge gaps. Thus, in order to generate a stable planar discharge in a gap between electrodes to be performed discharge (for example, a gap between the scan electrode Si-1 and the sustainment electrode Ci-1 in the frame "f"), the sustainment electrodes C are divided into an odd number sustainment electrode group Codd and an even number sustainment electrode group Ceven. In displaying the frame "f", as shown in FIG. 5, a positive pulse is applied to the odd number sustainment electrode group Codd, whereby a potential difference from the scan electrode S is increased. On the other hand, a negative pulse is applied to the even number sustainment electrode group Ceven, whereby a potential difference from the scan electrode S is reduced. In addition, in displaying the frame "f+1", as shown in FIG. 7, a pulse having its polarity reverse from the frame f is applied to each of the sustainment electrode groups. In the second prior art, a gap between electrodes in which planer discharge is thus performed is selected.

In addition in a sustainment period as well, as shown in FIG. 6 and FIG. 8, a phase of a sustainment pulse to be applied is changed so that a potential in gap between electrodes on which a sustainment discharge is not performed is the same as another potential.

According such second prior art, all the gaps between electrodes become discharge gaps, that is, all the gaps between electrodes are equal to each other. Thus, a decrease in an electrode area in the case where resolution is increased becomes smaller, and a decrease in a light emission luminescence becomes smaller. In addition, because of interlace driving method, in which light emission portions are changed for each frame, the display capacity in vertical direction can be increased without increasing the number of drivers.

However, according to the second prior art, all the gaps between electrodes become gaps between discharge electrodes. In a sustainment period, an electrode on which no discharge is to be generated has the same sustainment wave forms. Therefore, as shown in FIG. 5 and FIG. 6, for example, in the case where, in displaying the frame "f", a discharge is performed between the scan electrode Si-1 and the sustainment electrode Ci-1 and a discharge is not performed between the scan electrode Si and the sustainment electrode Ci, if sustainment discharge is repeated, the charge on the sustainment electrode Ci-1 gradually diffuses on the side of the scan electrode Si, and an incorrect discharge may be generated between the scan electrode Si and the sustainment electrode Ci. In addition, as shown in FIG. 8, in displaying the frame "f+1" as well, a similar incorrect discharge may occur.

Such an incorrect discharge is likely to occur when a sustainment voltage increases. Thus, there is a problem that the sustainment voltage setting range must be narrowed. In addition, it is required to apply two types of sustainment pulses with their different phases each other to the scan electrode and the sustainment electrode, thus causing an increased circuit cost.

SUMMARY OF THE INVENTION

It is an object of the present invention to provide an AC type plasma display capable of improving resolution in vertical direction, and capable of expanding an operating voltage range with a low background illumination and a good dark site contrast; a driving apparatus of the display and a driving method of the display.

An AC type plasma display according to one aspect of the present invention comprises: first and second substrate disposed oppositely; scan electrodes and sustainment electrodes provided alternately at an opposite face side to the second substrate in the first substrate, the scanning and sustainment electrodes extending in a row direction; data electrodes provided at an opposite face side to first substrate in the second substrate, the date electrodes extending in a column direction; and auxiliary electrodes provided at all of spaces between the scan electrodes and the sustainment electrodes, the auxiliary electrodes extending in a row direction.

In the present invention, auxiliary electrodes that extend in row direction are provided between all the scan electrodes and the sustainment electrodes. Thus, a signal to be applied to an auxiliary electrode is properly changed, whereby incorrect discharge can be prevented from occurring on interlace display.

If a signal to be applied to auxiliary electrodes (bias potential and driving signal) is switched between an odd number and an even number during addressing period between first and second frames, a portion at which an addressing discharge is generated is switched by each frame, and interlace display is performed. Thus, a gap between electrodes, i.e., between all the scan electrodes and the sustainment electrodes contributes to light emission, and high resolution display can be performed. In addition, if a bias potential is applied to an auxiliary electrode at which addressing is not performed, incorrect discharge is prevented, making it possible to expand a margin of an operating voltage.

In addition, if a signal supplied to an auxiliary electrode during addressing period is switched between a bias potential and a driving signal applied to a sustainment electrode, there is no need to apply a scan pulse to an auxiliary electrode, and a driving device is simplified, thereby making it possible to ensure cost reduction. In addition, a bias potential can be controlled independently, thus facilitating its optimization, and an operating voltage margin is expanded more significantly.

Further, if a potential of one auxiliary electrode is held to a bias potential in a sustainment period, reducing a potential difference between an auxiliary electrode and each of the scanning and sustainment electrodes adjacent to the auxiliary electrode. Thus, incorrect discharge between these electrodes is more unlikely to occur.

According to another aspect of the present invention, a driving device which drives the AC type plasma display comprises: a driving portion connected to the sustainment electrodes, scan electrodes, and auxiliary electrodes; and a controller. The controller controls operation of the driving portion to, in each sub-field that configures a first frame, hold a potential of auxiliary electrodes disposed at descending odd numbers at an arbitrary bias potential between a sustainment voltage applied to the sustainment electrodes during a sustainment discharge and a grounding potential at least during an addressing period, and apply a signal identical to a driving signal to be applied to one electrode selected from the group comprising the sustainment electrodes and scan electrodes to the auxiliary electrode disposed at the descending even numbers, and in each sub-field that configures a second frame, hold a potential of the auxiliary electrode disposed at even numbers at the arbitrary bias potential at least during the addressing period, and apply the signal identical to a driving signal to be applied to the one electrode to the auxiliary electrode disposed at odd numbers.

According to another aspect of the present invention, a driving method of the AC type plasma display comprises the steps of: holding a potential of auxiliary electrodes disposed at descending odd numbers at an arbitrary bias potential between a sustainment voltage applied to the sustainment electrodes during a sustainment discharge and a grounding potential at least during an addressing period, and applying a signal identical to a driving signal to be applied to one electrode selected from the group comprising the sustainment electrodes and scan electrodes to the auxiliary electrode disposed at the descending even numbers, in each sub-field that configures a first frame; and holding a potential of the auxiliary electrode disposed at even numbers at the arbitrary bias potential at least during the addressing period, and applying the signal identical to a driving signal to be applied to the one electrode to the auxiliary electrode disposed at odd numbers, in each sub-field that configures a second frame.

BRIEF DESCRIPTION OF THE DRAWINGS

FIG. 37A and FIG. 37B are views each showing movement of the charge in the period shown in FIG. 13, wherein FIG. 37A is a schematic view illustrating a distribution of charges during discharge, and FIG. 37B is a schematic view showing a distribution of the charge after discharge;

FIG. 38A and FIG. 38B are views each showing movement of the charge in the period shown in FIG. 14, wherein FIG. 38A is a schematic view illustrating a distribution of charges during discharge, and FIG. 38B is a schematic view showing a distribution of the charge after discharge;

FIG. 39A and FIG. 39B are views each showing movement of the charge in the period shown in FIG. 15, wherein FIG. 39A is a schematic view illustrating a distribution of charges during discharge, and FIG. 39B is a schematic view showing a distribution of the charge after discharge;

FIG. 40A and FIG. 40B are views each showing movement of the charge in the period shown in FIG. 16, wherein FIG. 40A is a schematic view illustrating a distribution of charges during discharge, and FIG. 40B is a schematic view showing a distribution of the charge after discharge;

FIG. 41A and FIG. 41B are views each showing movement of the charge in the period shown in FIG. 17, wherein FIG. 41A is a schematic view illustrating a distribution of charges during discharge, and FIG. 41B is a schematic view showing a distribution of the charge after discharge;

FIG. 42A and FIG. 42B are views each showing movement of the charge in the period shown in FIG. 18, wherein FIG. 42A is a schematic view illustrating a distribution of charges during discharge, and FIG. 42B is a schematic view showing a distribution of the charge after discharge;

FIG. 43A and FIG. 43B are views each showing movement of the charge in the period shown in FIG. 19, wherein FIG. 43A is a schematic view illustrating a distribution of charges during discharge, and FIG. 43B is a schematic view showing a distribution of the charge after discharge;

FIG. 44A and FIG. 44B are views each showing movement of the charge in the period shown in FIG. 20, wherein FIG. 44A is a schematic view illustrating a distribution of charges during discharge, and FIG. 44B is a schematic view showing a distribution of the charge after discharge;

FIG. 45A and FIG. 45B are views each showing movement of the charge in the period shown in FIG. 21, wherein FIG. 45A is a schematic view illustrating a distribution of charges during discharge, and FIG. 45B is a schematic view showing a distribution of the charge after discharge;

FIG. 46A and FIG. 46B are views each showing movement of the charge in the period shown in FIG. 22, wherein FIG. 46A is a schematic view illustrating a distribution of charges during discharge, and FIG. 46B is a schematic view showing a distribution of the charge after discharge;

FIG. 47A and FIG. 47B are views each showing movement of the charge in the period shown in FIG. 23, wherein FIG. 47A is a schematic view illustrating a distribution of charges during discharge, and FIG. 47B is a schematic view showing a distribution of the charge after discharge;

FIG. 48A and FIG. 48B are views each showing movement of the charge in the period shown in FIG. 24, wherein FIG. 48A is a schematic view illustrating a distribution of charges during discharge, and FIG. 48B is a schematic view showing a distribution of the charge after discharge;

FIG. 81A and FIG. 81B are views each showing movement of the charge in the period shown in FIG. 57, wherein FIG. 81A is a schematic view illustrating a distribution of charges during discharge, and FIG. 81B is a schematic view showing a distribution of the charge after discharge;

FIG. 82A and FIG. 82B are views each showing movement of the charge in the period shown in FIG. 58, wherein FIG. 82A is a schematic view illustrating a distribution of charges during discharge, and FIG. 82B is a schematic view showing a distribution of the charge after discharge;

FIG. 83A and FIG. 83B are views each showing movement of the charge in the period shown in FIG. 59, wherein FIG. 83A is a schematic view illustrating a distribution of charges during discharge, and FIG. 83B is a schematic view showing a distribution of the charge after discharge;

FIG. 84A and FIG. 84B are views each showing movement of the charge in the period shown in FIG. 60, wherein FIG. 84A is a schematic view illustrating a distribution of charges during discharge, and FIG. 84B is a schematic view showing a distribution of the charge after discharge;

FIG. 85A and FIG. 85B are views each showing movement of the charge in the period shown in FIG. 61, wherein FIG. 85A is a schematic view illustrating a distribution of charges during discharge, and FIG. 85B is a schematic view showing a distribution of the charge after discharge;

FIG. 86A and FIG. 86B are views each showing movement of the charge in the period shown in FIG. 62, wherein FIG. 86A is a schematic view illustrating a distribution of charges during discharge, and FIG. 86B is a schematic view showing a distribution of the charge after discharge;

FIG. 87A and FIG. 87B are views each showing movement of the charge in the period shown in FIG. 63, wherein FIG. 87A is a schematic view illustrating a distribution of charges during discharge, and FIG. 87B is a schematic view showing a distribution of the charge after discharge;

FIG. 88A and FIG. 88B are views each showing movement of the charge in the period shown in FIG. 64, wherein FIG. 88A is a schematic view illustrating a distribution of charges during discharge, and FIG. 88B is a schematic view showing a distribution of the charge after discharge;

FIG. 89A and FIG. 89B are views each showing movement of the charge in the period shown in FIG. 65, wherein FIG. 89A is a schematic view illustrating a distribution of charges during discharge, and FIG. 89B is a schematic view showing a distribution of the charge after discharge;

FIG. 90A and FIG. 90B are views each showing movement of the charge in the period shown in FIG. 66, wherein FIG. 90A is a schematic view illustrating a distribution of charges during discharge, and FIG. 90B is a schematic view showing a distribution of the charge after discharge;

FIG. 91A and FIG. 91B are views each showing movement of the charge in the period shown in FIG. 67, wherein FIG. 91A is a schematic view illustrating a distribution of charges during discharge, and FIG. 91B is a schematic view showing a distribution of the charge after discharge;

FIG. 92A and FIG. 92B are views each showing movement of the charge in the period shown in FIG. 68, wherein FIG. 92A is a schematic view illustrating a distribution of charges during discharge, and FIG. 92B is a schematic view showing a distribution of the charge after discharge;

FIGS. 101A to 101C are views showing movement of the charge in a period during a sustainment period in the first driving method, wherein FIG. 101A is a timing chart specifying a driving period, FIG. 101B is a schematic view showing a distribution of charges during discharge, and FIG. 101C is a schematic view showing a distribution of charges after discharge;

FIGS. 109A and 109B are views showing movement of the charge in a period during a reset period in the first driving method, wherein FIG. 109A is a timing chart specifying a driving period, and FIG. 109B is a schematic view illustrating a distribution of charges during discharge; and FIGS. 110A and 110B are views showing movement of the charge in a period during a reset period in the third driving method, wherein FIG. 110A is a timing chart specifying a driving period, and FIG. 110B is a schematic view illustrating a distribution of charges during discharge.

DESCRIPTION OF THE PREFERRED EMBODIMENT

Figure 1:
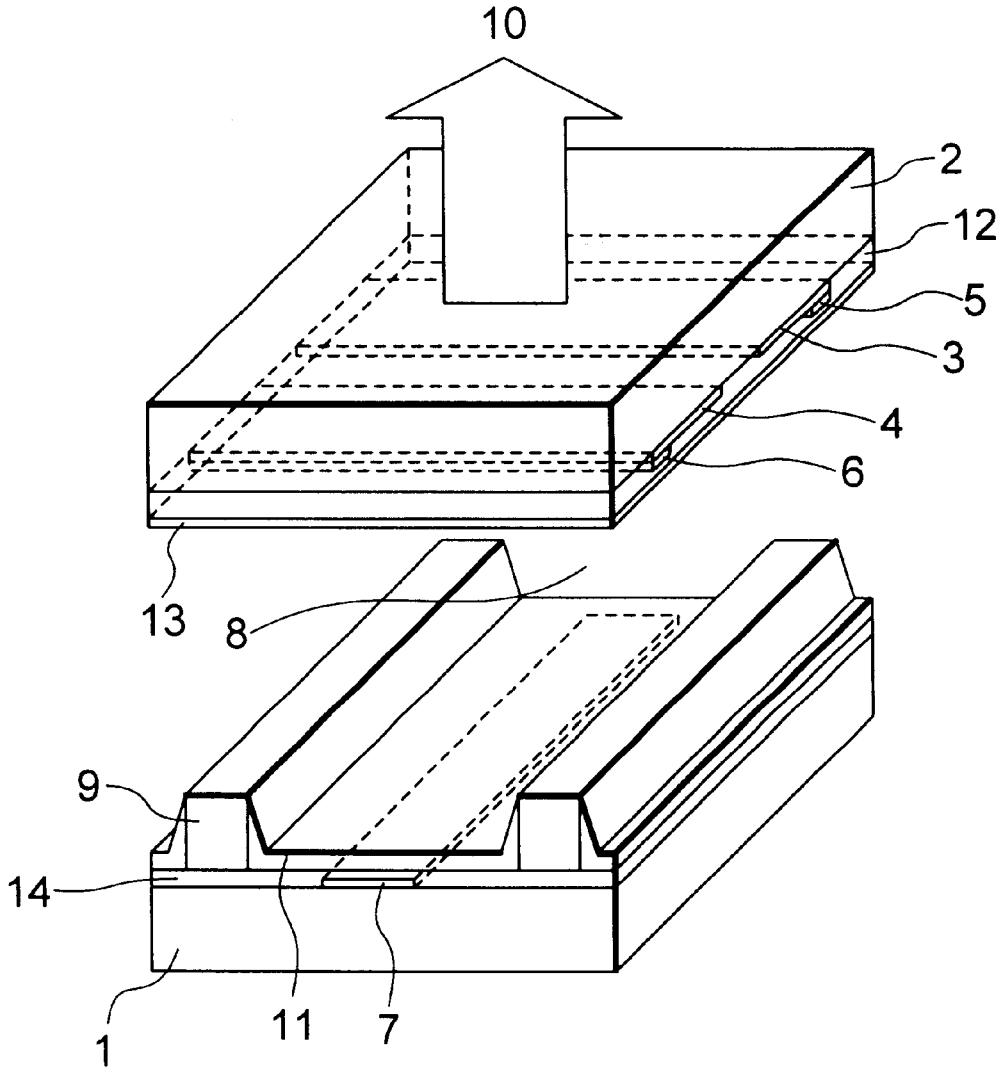
FIG. 1 (PRIOR ART)
FIG. 1 is a schematic perspective view illustrating a configuration of one display cell of a conventional AC memory operation type PDP.
Figure 2:
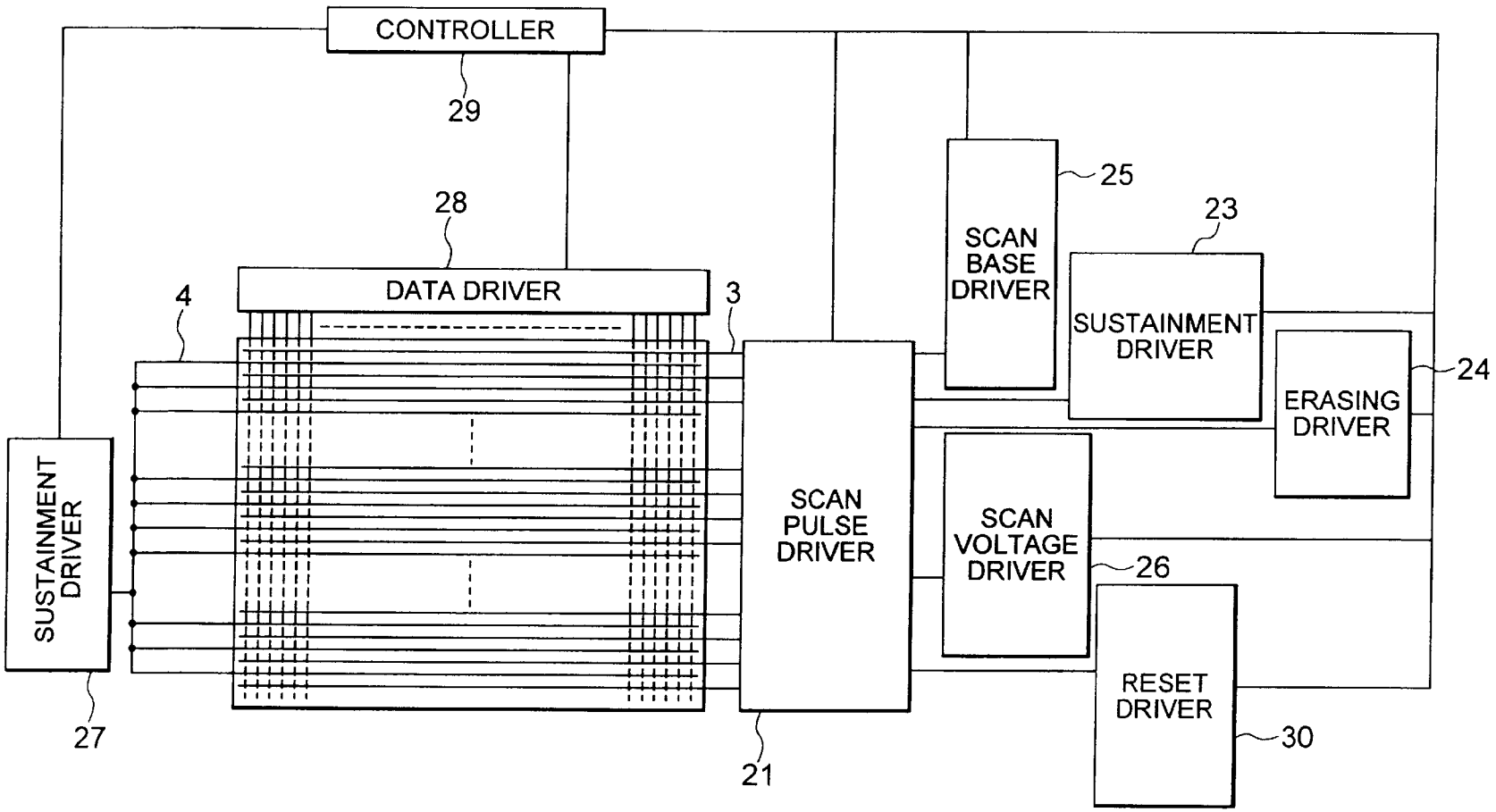
FIG. 2 (PRIOR ART)
FIG. 2 is a block diagram depicting driving circuits in a conventional AC memory operation type PDP.
Figure 3A:
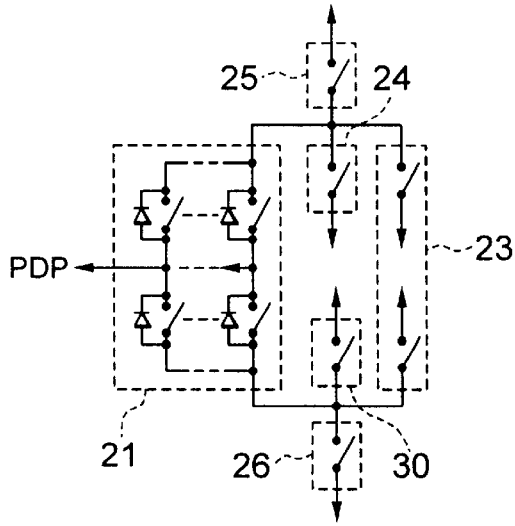
FIG. 3A (PRIOR ART)
FIG. 3A is a circuit diagram depicting driving circuits on a scan electrode 3 side.
Figure 3B:
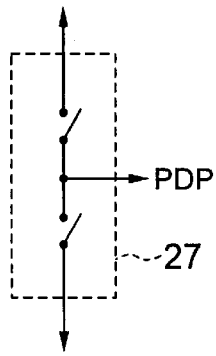
FIG. 3B (PRIOR ART)
FIG. 3B is a circuit diagram depicting driving circuits on a sustainment electrode 4 side.
Figure 3C:
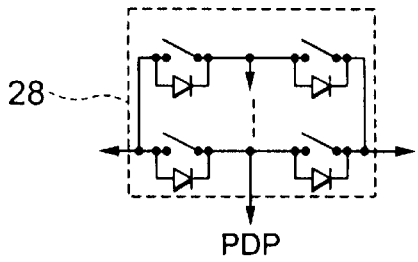
FIG. 3C (PRIOR ART)
FIG. 3C is a circuit diagram showing a data driver 28.
Figure 4:
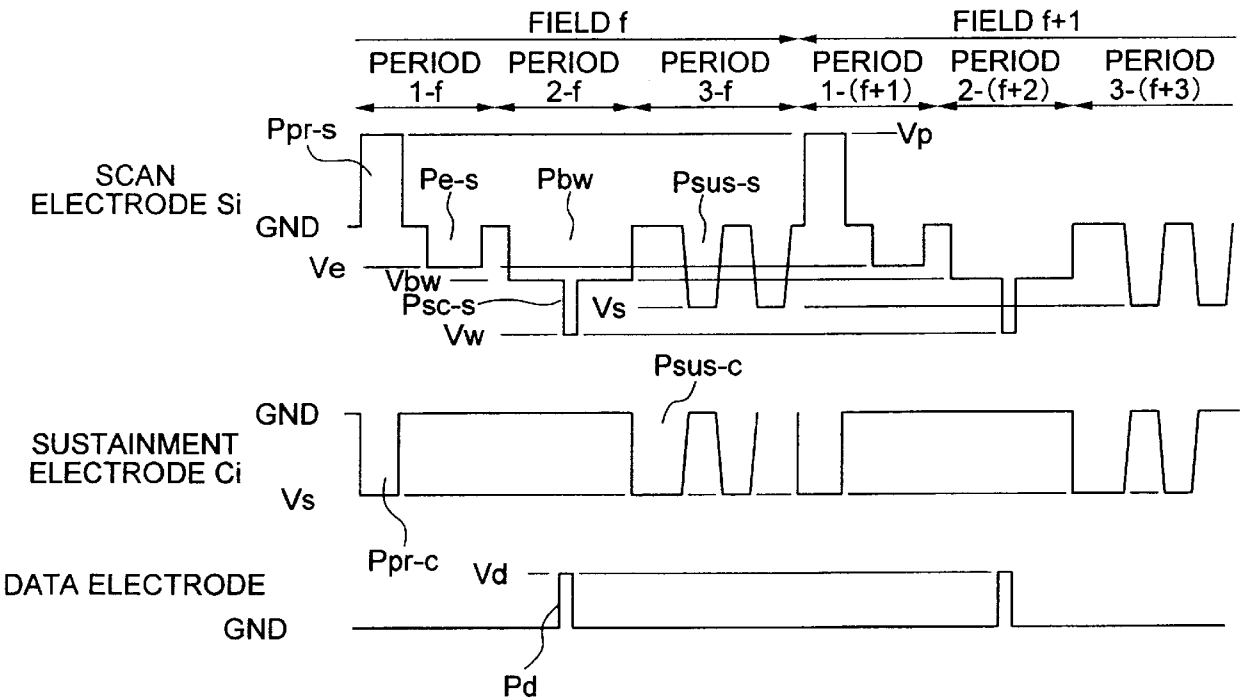
FIG. 4 (PRIOR ART)
FIG. 4 is a timing chart showing a method for driving a conventional PDP.
Figure 5:
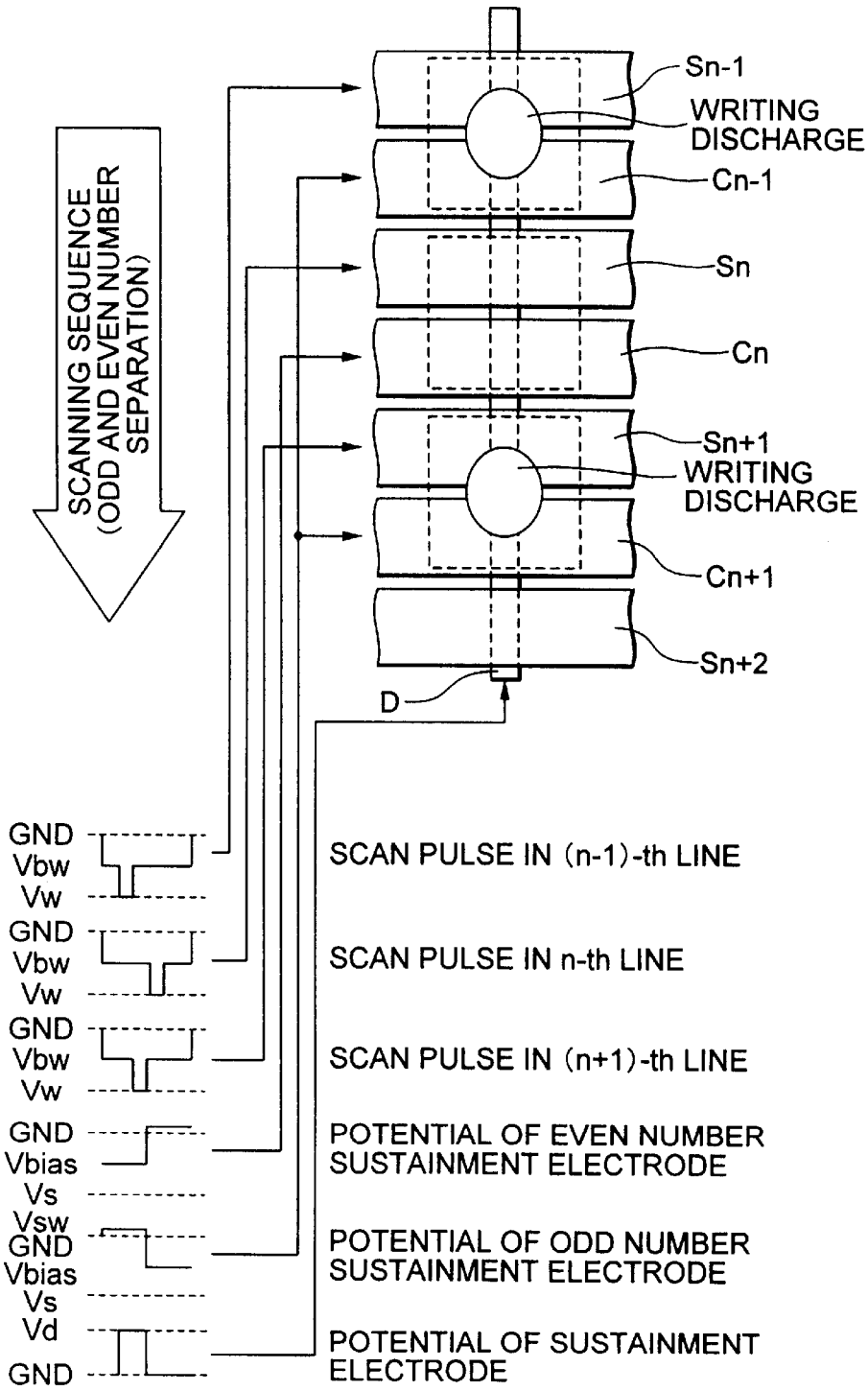
FIG. 5 (PRIOR ART)
FIG. 5 is a schematic view showing a light emission portion of the scanning period of a frame "f" in a second prior art.
Figure 6:
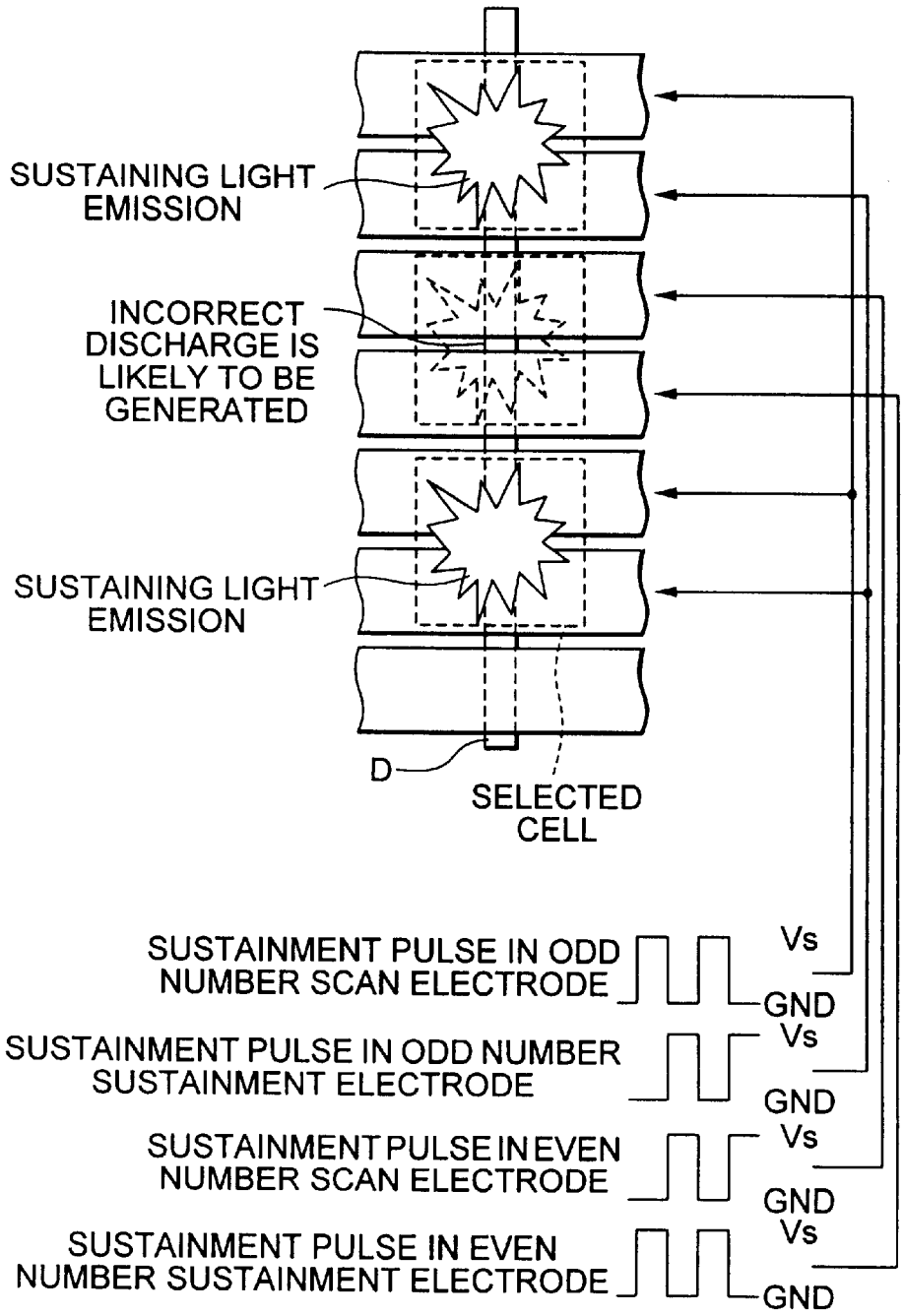
FIG. 6 (PRIOR ART)
FIG. 6 is a schematic view illustrating a light emission portion of the sustainment period of the frame "f" in the second prior art.
Figure 7:
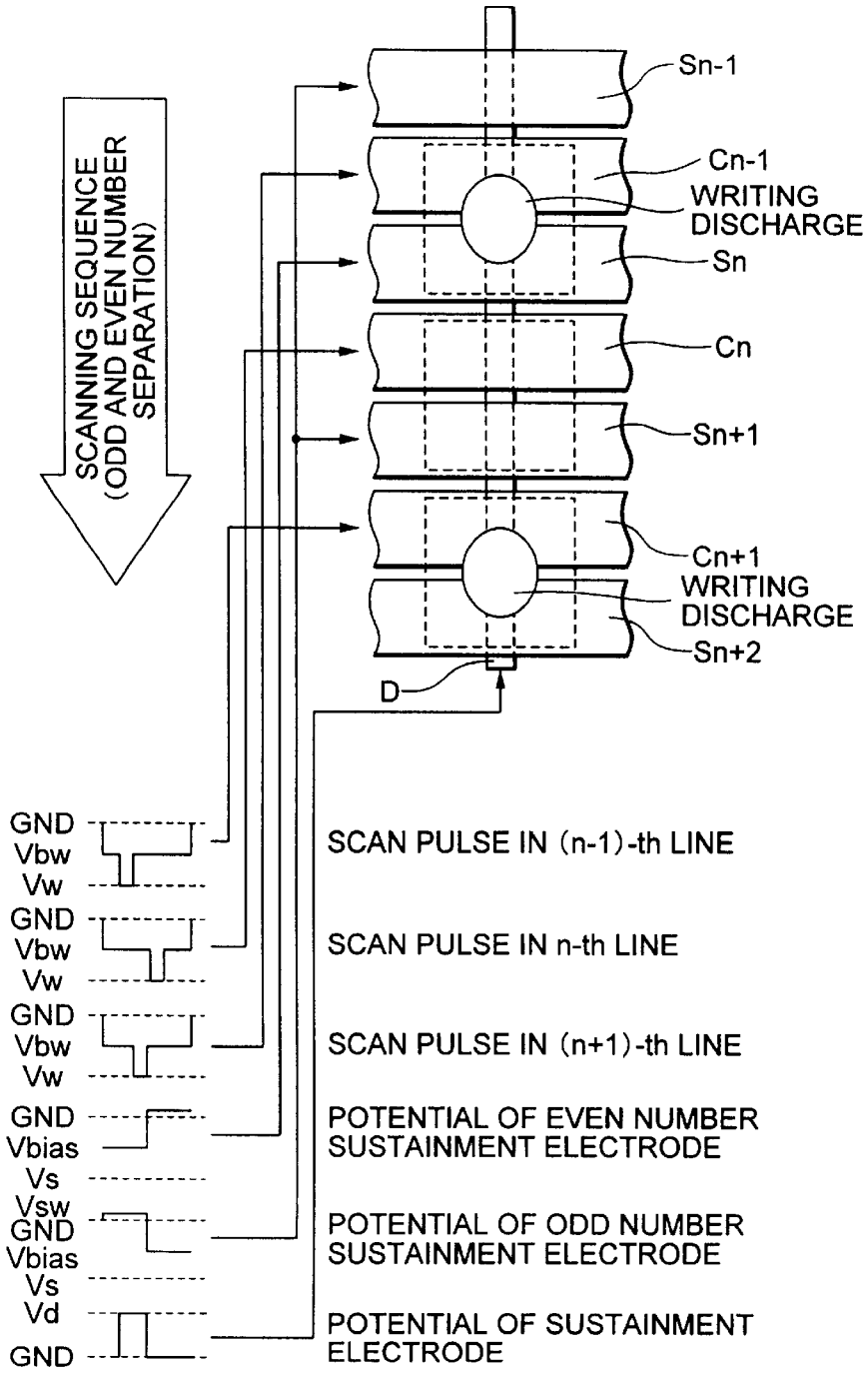
FIG. 7 (PRIOR ART)
FIG. 7 is a schematic view illustrating a light emission portion during the scanning period of a frame "f+1" in the second prior art.
Figure 8:
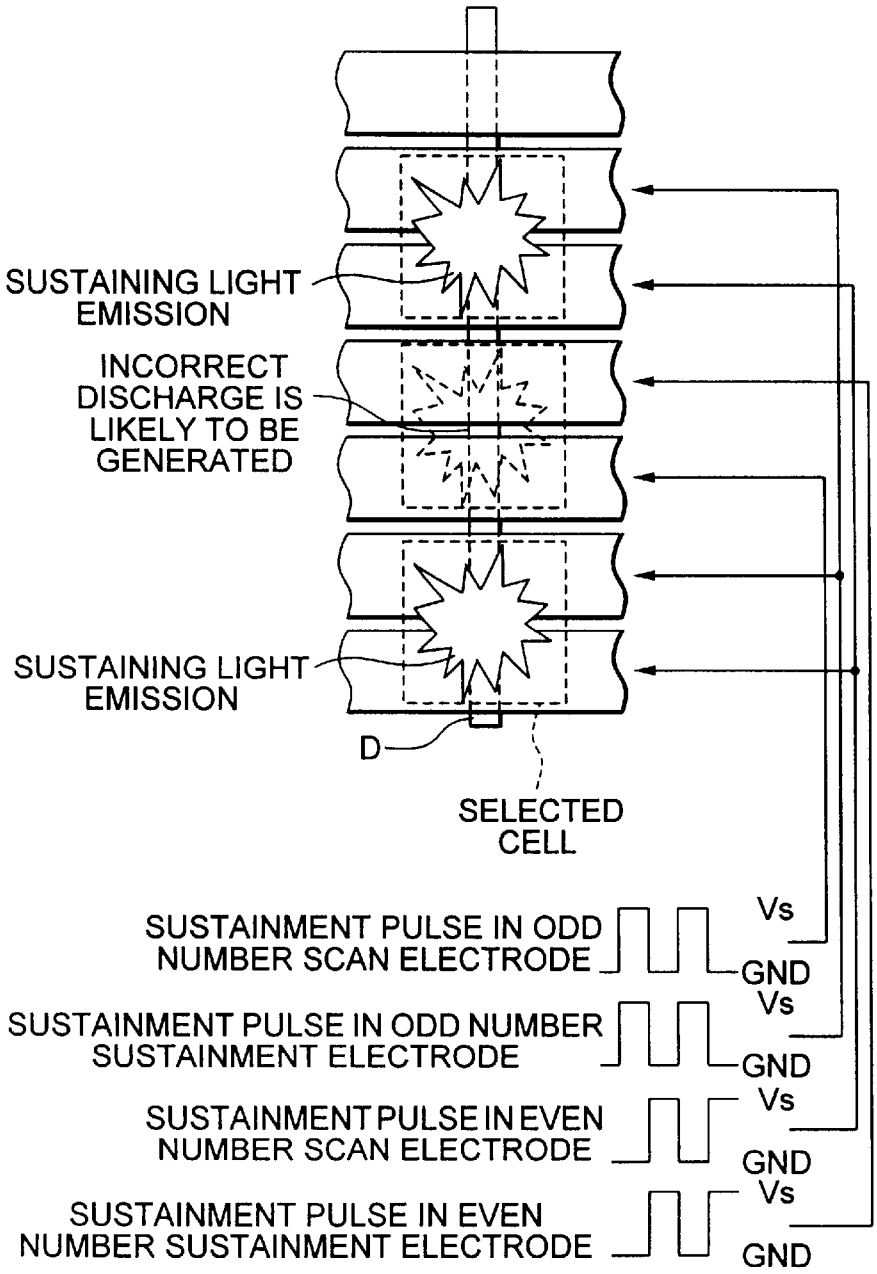
FIG. 8 (PRIOR ART)
FIG. 8 is a schematic view illustrating a light emission portion during the sustainment period of a frame "f+1" in the second prior art.
Figure 9:
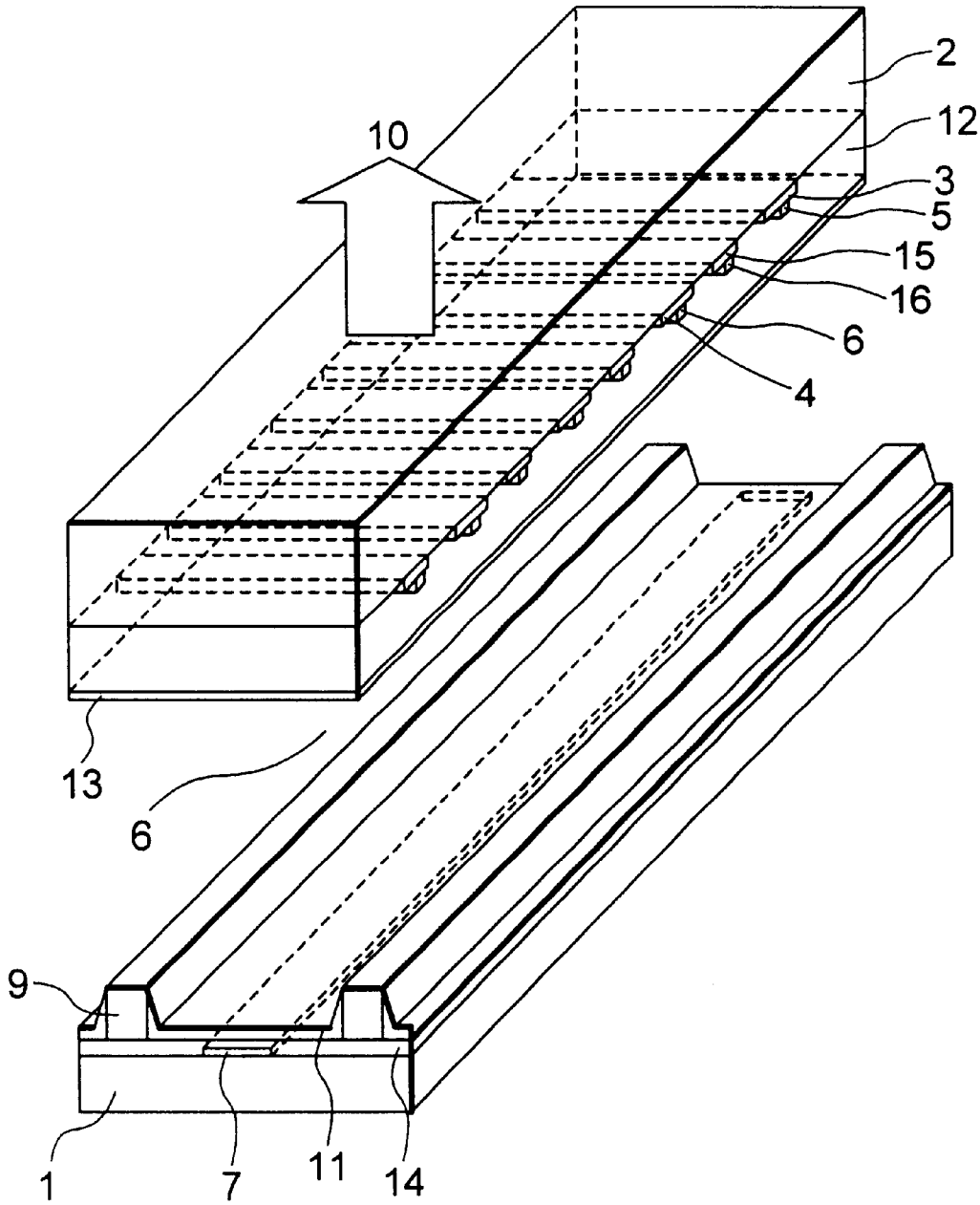
FIG. 9 is a schematic perspective view illustrating a configuration of a display cell of an AC type plasma display according to a first embodiment of the present invention.

Hereinafter, preferred embodiments of the present invention will be specifically described with reference to the accompanying drawings. FIG. 9 is a schematic perspective view illustrating a configuration of display cells of an AC type plasma display according to a first embodiment of the present invention.

In the first embodiment, two insulation substrates 1 and 2 each made of glass, for example, are provided. The insulation substrate 1 is provided as a rear substrate, and the insulation substrate 2 is provided as a frontal substrate.

Transparent scan electrodes 3 and transparent sustainment electrodes 4 are provided at the opposite face side to the insulation substrate 1 in the insulation substrate 2, and transparent electrodes 15 are provided between each scan electrode 3 and each sustainment electrode 4. The scan electrodes 3, sustainment electrodes 4, and auxiliary electrodes 15 extend in a horizontal direction (transverse direction) of the panel. In addition, trace electrodes 5, 6 and 16 are disposed so as to be overlapped on the scan electrodes 3, sustainment electrodes 4 and auxiliary electrodes 15, respectively. The trace electrodes 5, 6 and 16 are metallic, for example, and are provided to reduce an electrode resistance value between each electrode and an external driving device. Further, there is provided a dielectric layer 12 covering the scan electrodes 3, sustainment electrodes 4 and auxiliary electrodes 15 and a protective layer 13 made of magnesium or the like, for example, for protecting the dielectric layer 12 from discharge.

Data electrodes 7 orthogonal to the scan electrodes 3 and the sustainment electrodes 4 are provided at the opposite face side to the insulation substrate 2 in the insulation substrate 1. Therefore, the data electrode 7 extends a vertical direction (longitudinal direction) of the panel. In addition, bulkheads 9 for partitioning display cells in horizontal direction are provided. Further, a dielectric layer 14 covering the data electrodes 7 is provided, and phosphor layers 11 for converting the ultraviolet rays generated by discharge of the discharge gas into a visible light 10 is formed on the side face of the bulkheads 9 and on the surface of the dielectric layer 14. Further, discharge gas spaces 8 are allocated by the bulkheads 9 in a space between the insulation substrates 1 and 2, and discharge gas comprising helium, neon or xenon, or these mixture gas is charged in the discharge gas spaces 8.

Figure 10:
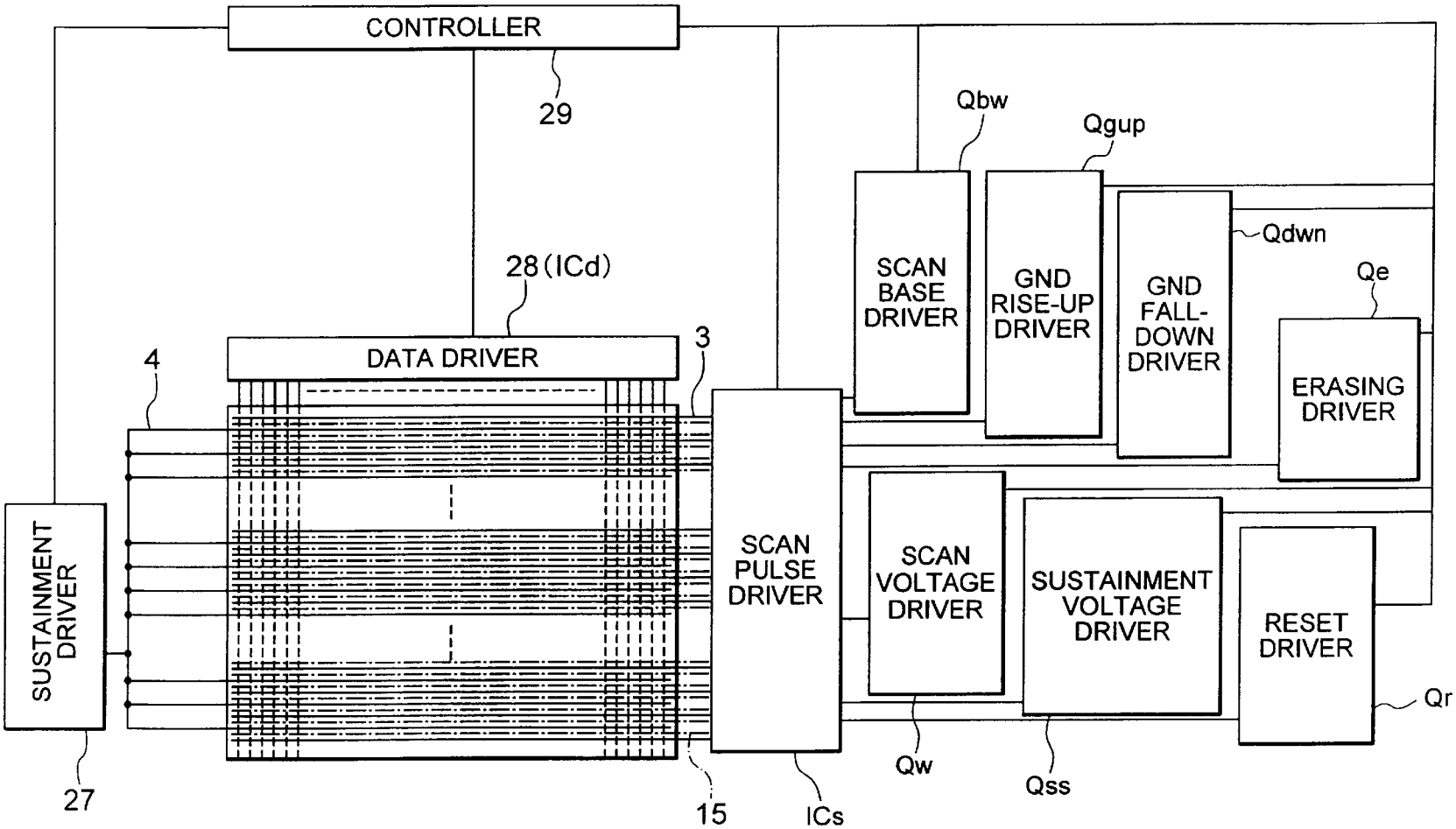
FIG. 10 is a block diagram depicting driving circuits in the AC type plasma display according to the first embodiment of the present invention.
Figure 11A:
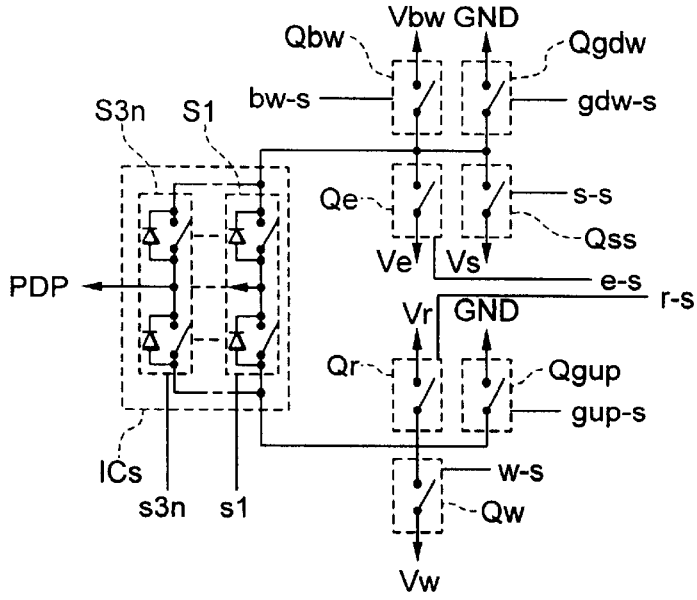
FIG. 11A is a circuit diagram depicting driving circuits on the scan electrode 3 and auxiliary electrode 15 side in the first embodiment.
Figure 11B:
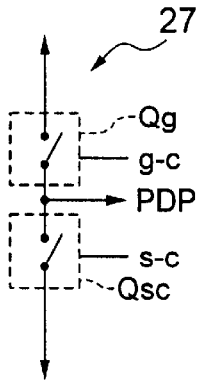
FIG. 11B is a circuit diagram depicting driving circuits on the sustainment electrode 4 side in the first embodiment.
Figure 11C:
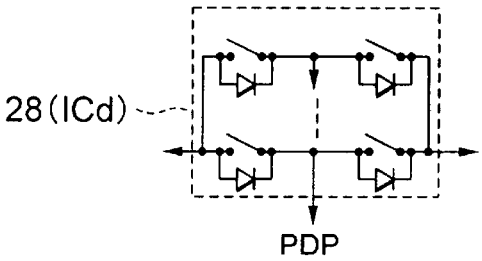
FIG. 11C is a circuit diagram depicting a data driver 28.

FIG. 10 is a block diagram depicting driving circuits in an AC type plasma display according to the first embodiment. FIG. 11A is a circuit diagram depicting driving circuits on the scan electrode 3 and auxiliary electrode 15 side; FIG. 11B is a circuit diagram depicting driving circuits on the sustainment electrode 4 side; and FIG. 11C is a circuit diagram depicting a data driver 28.

Two removal portions for a respective one of the scan electrodes 3, sustainment electrodes 4 and auxiliary electrodes 15 are provided at both end in the horizontal direction of a display panel in the AC type plasma display according to the first embodiment, and driving circuits are connected to the removal portions.

As a driving circuit at the scan electrode 3 and auxiliary electrode 15 side, there is provided with a scan pulse driver ICs outputting a scan pulse to a respective one of the scan electrode 3 and auxiliary electrode 15. Scan pulse driver Ics incorporates line drivers S1 to S3*n* for driving a respective electrode. In addition, to the scan pulse driver ICs, there are connected a reset driver Qr for outputting a reset pulse common to all of the scan electrodes 3 and auxiliary electrodes 15; a sustainment voltage driver Qs for outputting a sustainment voltage pulse; an erasing driver Qe for applying an erasing pulse; a GND fall-down driver Qdwn for falling down to a GND level; a GND rise-up driver Qgup for rising up to a GND; a scan base driver Qbw for outputting a scan base pulse; and a scan voltage driver Qw for outputting a scan voltage.

On the other hand, as a driving circuit at the sustainment electrode 4 side, there are provided with a GND driver Qg for setting the entirety of the sustainment electrodes 4 to the GND level and a sustainment voltage driver Qsc for applying a sustainment pulse.

Further, a removal portion for the data electrodes 7 is provided at an end in the vertical direction of a display panel in the AC type plasma display panel according to the first embodiment, and a data driver 28 is connected to the removal portion as a driving circuit.

In addition, as control signals in the scan electrode and auxiliary electrode side drivers, there are provided with: a reset driver control signal "r-s"; a sustainment voltage driver control signal "s—s"; an erasing driver control signal "e-s"; a GND fall-down driver control signal "gdw-s"; a GND rise-up driver control signal "gup-s"; a scan base driver control signal "bw-s"; a scan voltage driver control signal "w-s"; and control signals "s1" to "s3*n*" for line drivers S1 to S3*n*. Further, there are provided with a GND driver control signal g-c and a sustainment voltage driver control signal s-c as control signals in the sustainment electrode side drivers. These control signals are outputted from a controller 29 for switching operation of each driver according to a video signal.

In FIG. 11A to FIG. 11C, drivers are represented using switches. These drivers may be composed of elements represented by a bipolar transistor or a field effect transistor (FET) or the like without being limited to a physical switch.

Figure 12:
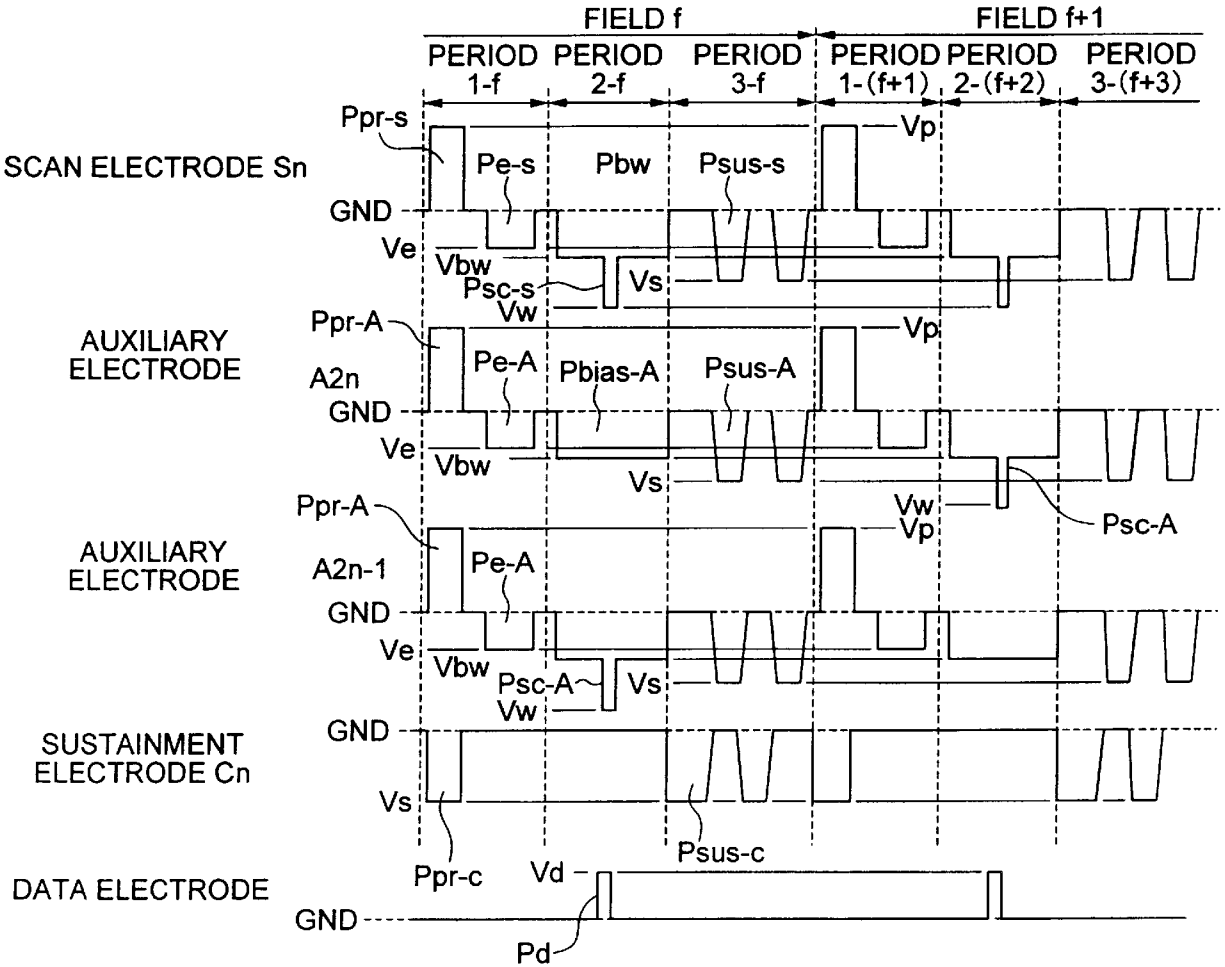
FIG. 12 is a timing chart illustrating a driving method of an AC type plasma display according to the first embodiment.

An operation of the first embodiment will be described hereinafter. FIG. 12 is a timing chart showing a driving method of the AC type plasma display according to the first embodiment. FIG. 13 to FIG. 24 are timing charts each specifying each period. FIG. 25 to FIG. 36 are schematic views each depicting an operation of driving circuits at each period. In addition, FIG. 37 to FIG. 48 are views each showing movement of the charge at each period, wherein FIG. 37A to FIG. 48A are schematic views each showing a distribution of charges during discharge, and FIG. 37B to FIG. 48B are schematic views each showing a distribution of charges after discharge. In each of FIG. 25 to FIG. 36, there are shown driving circuits connected to electrodes Cn-1, A2*n*-2, Sn, A2*n*-1, Cn, A2*n* and Sn+1 based on FIG. 10 and FIG. 11A to FIG. 11C. In addition, in a timing chart shown in FIG. 13 to FIG. 24, a portion indicated by thick line is a corresponding timing (driving period).

Figure 13:
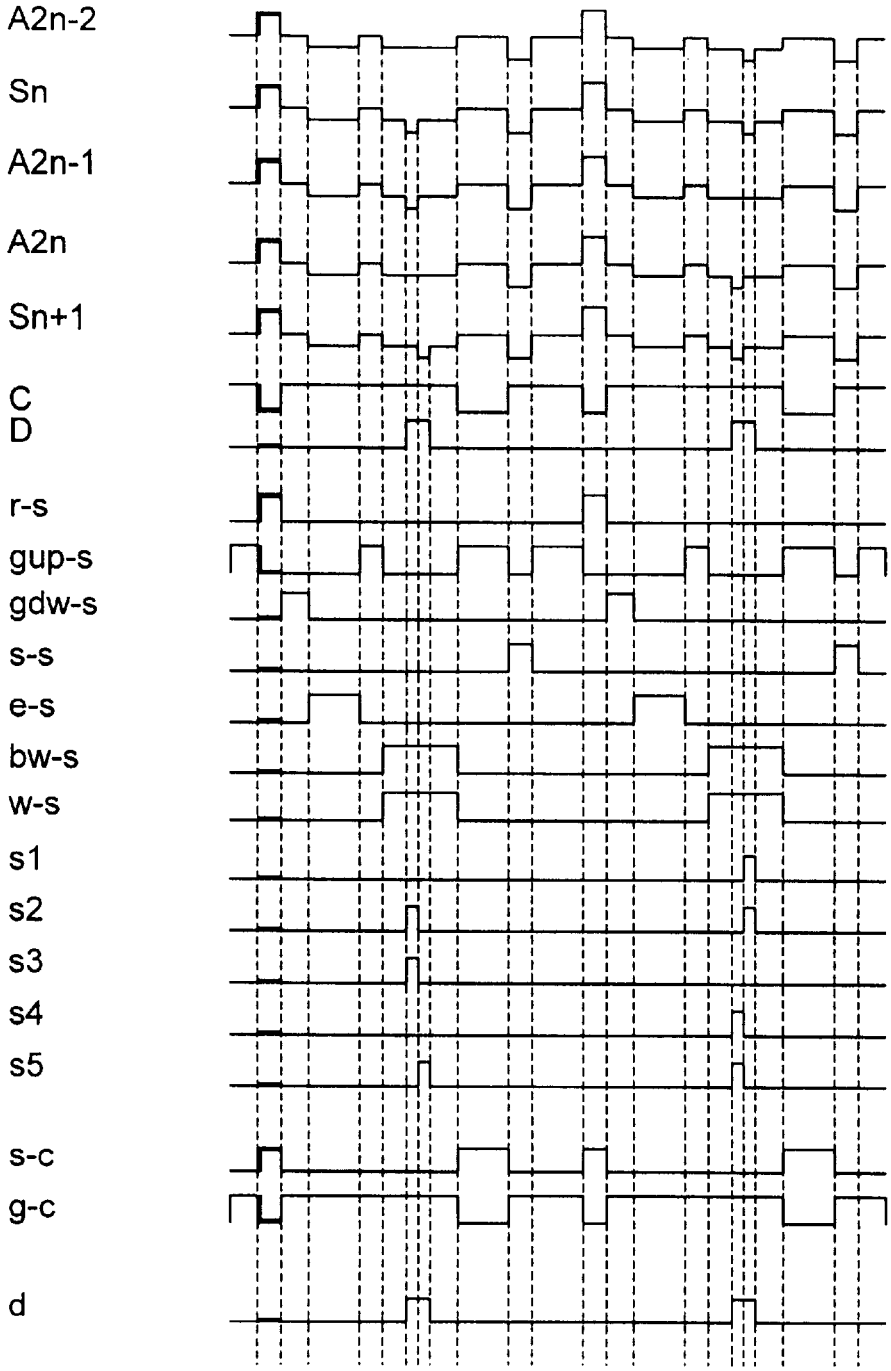
FIG. 13 is a timing chart specifying a period in the driving method of the first embodiment.
Figure 25:
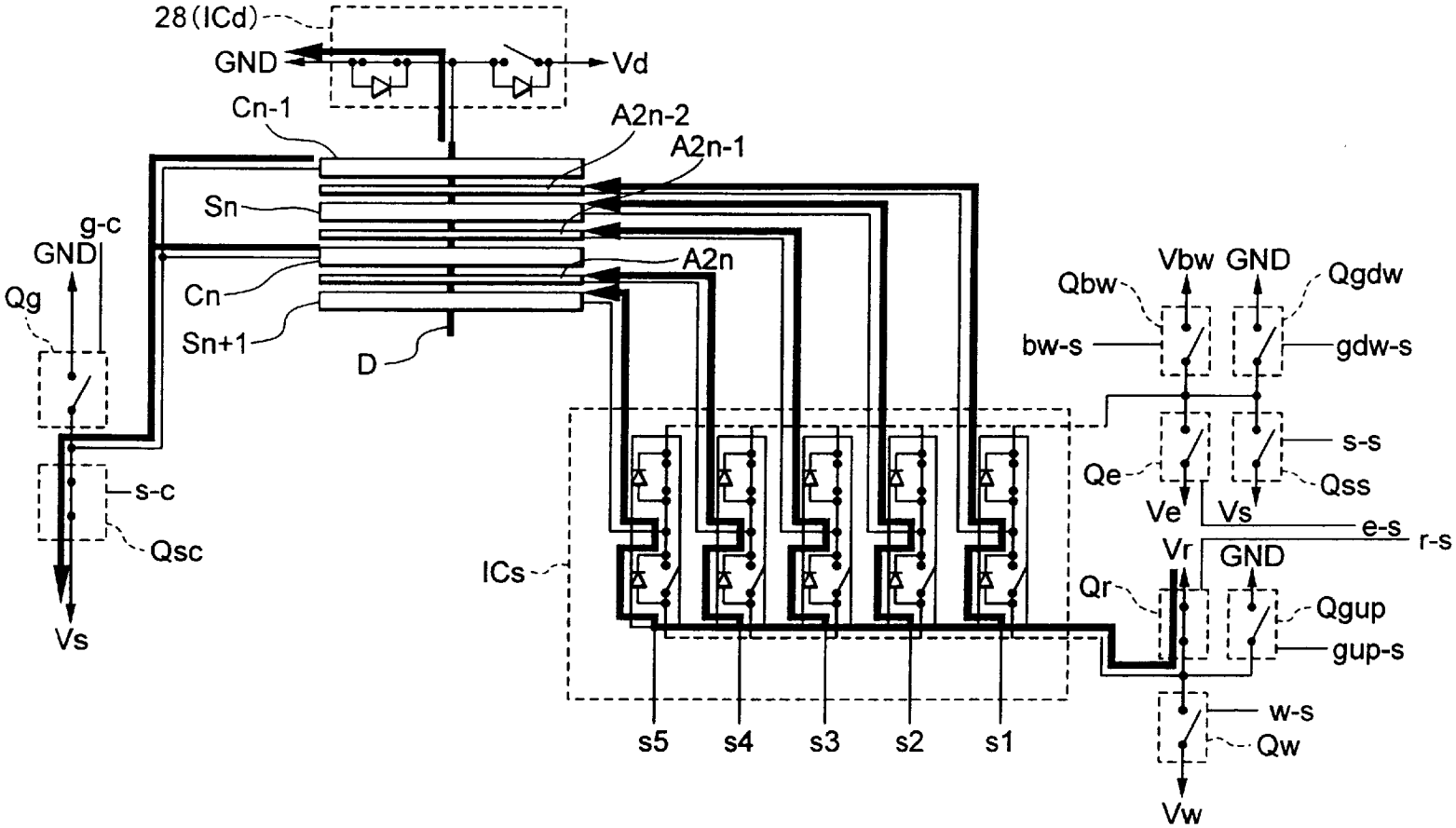
FIG. 25 is a schematic view depicting an operation of driving circuits in the period shown in FIG. 13.
Figure 37A:
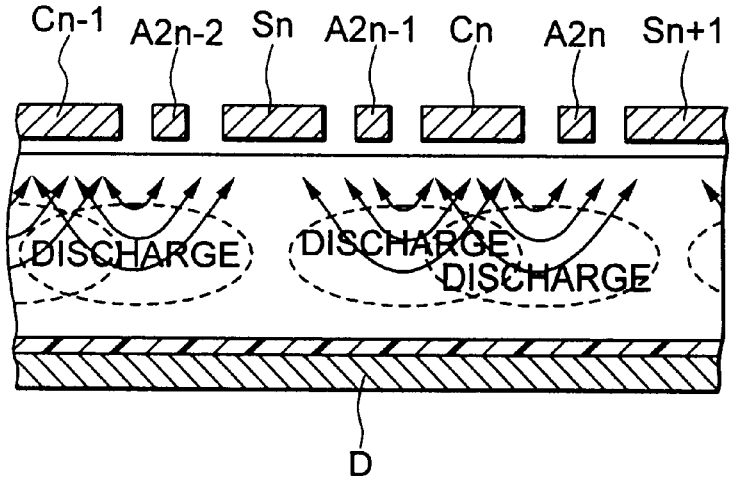
Figure 37B:
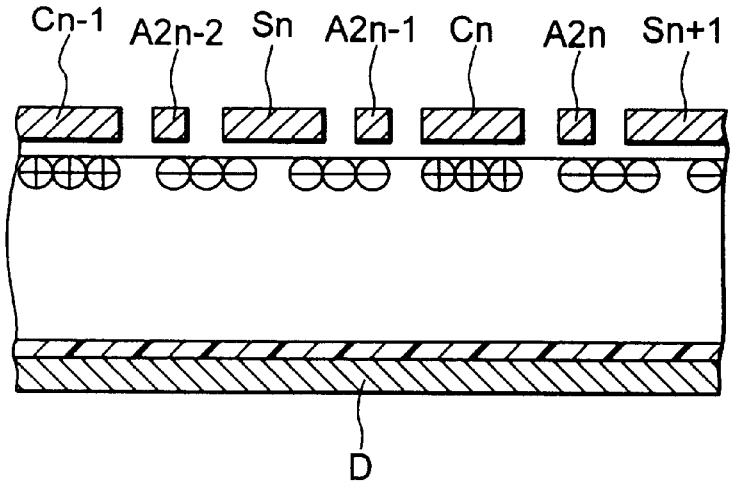

A period 1-f in FIG. 12 is a reset period of a sub-field of a frame "f". During this reset period 1-f, as shown in FIG. 12 and FIG. 13, each of the reset pulses Ppr-s, Ppr-A and Ppr-c is applied to the entirety of the scan electrode S, auxiliary electrode A and sustainment electrode C, respectively. By these reset pulses, as shown in FIG. 37A, a reset discharge is generated between the adjacent scan electrode S and sustainment electrode C. In this manner, the generation of active particles, which makes it easy to generate discharge of display cells, is performed. Then, a space charge generated by the reset discharge is accumulated as a negative polarity wall charge on the scan electrode S and auxiliary electrode A and as a positive polarity wall charge on the sustainment electrode C, as shown in FIG. 37B, so as to cancel the voltage applied to each electrode. During this period, as shown in FIG. 13 and FIG. 25, the signal "r-s", which is inputted to the reset driver Qr on the scan electrode and auxiliary electrode side, and the signal "s-c", which is inputted to the sustainment voltage driver Qsc on the sustainment electrode side, are set to high level, whereby the drivers Qr and Qsc are turned ON. Then, the reset pulse is applied to each of the scan electrodes, auxiliary electrodes, and sustainment electrodes.

Figure 14:
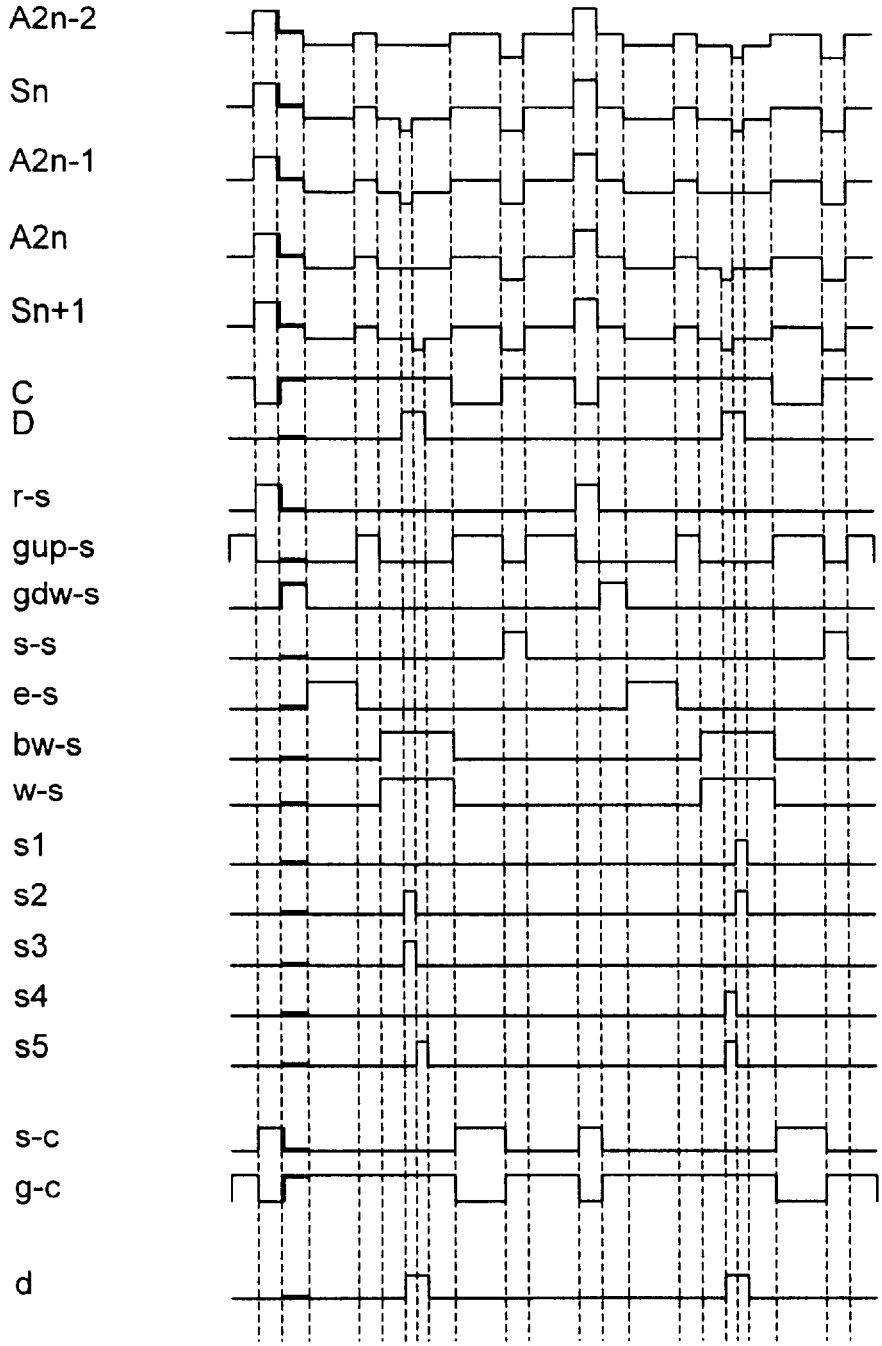
FIG. 14 is a timing chart specifying a next period to the period shown in FIG. 13 in the driving method of the first embodiment.
Figure 26:
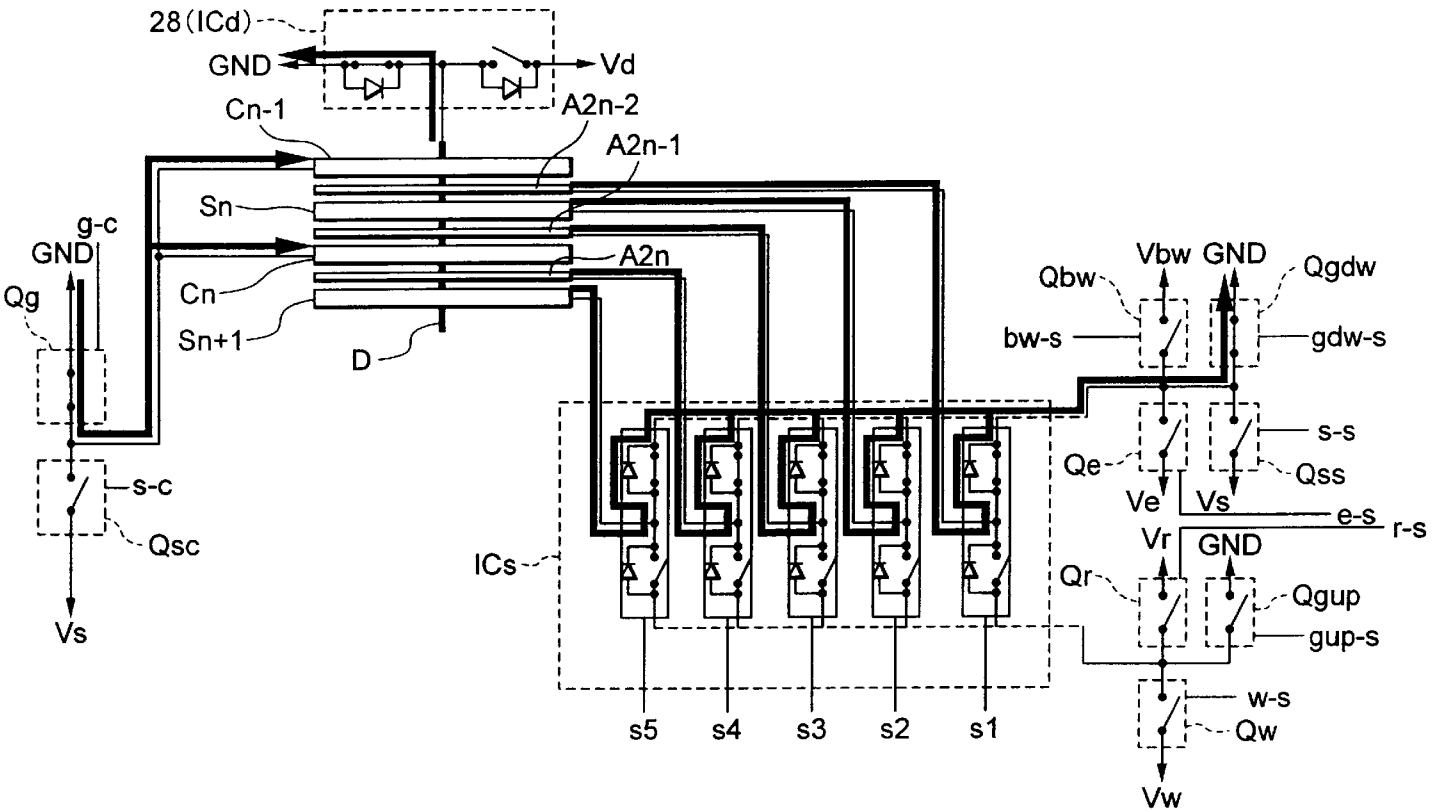
FIG. 26 is a schematic view depicting an operation of driving circuits in the period shown in FIG. 14.
Figure 38A:
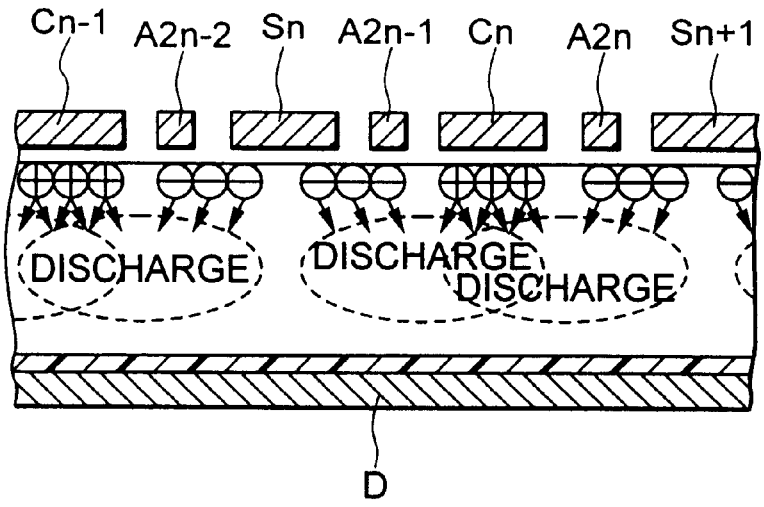
Figure 38B:
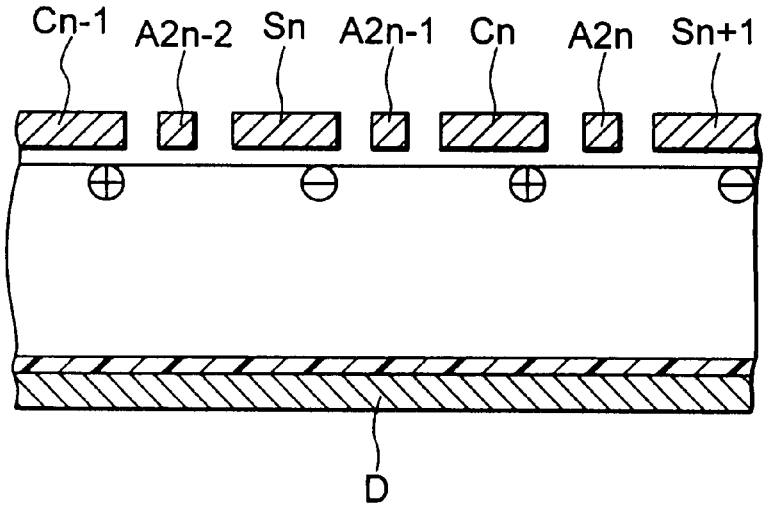

Then, during a reset period 1-f, as shown in FIG. 12 and FIG. 14, when the reset pulses are fallen down, a potential difference caused by the wall charge exceeds a discharge start voltage. As shown in FIG. 38A, a discharge is generated. This discharge is called self-erasing discharge. At this time, there is no potential difference between voltages externally applied to the respective scan electrode S and sustainment electrode C. Thus, as shown in FIG. 38B, almost of the wall charge is eliminated by the self-erasing discharge. During this period, as shown in FIG. 14 and FIG. 26, the signal "gdw-s", which is inputted to the GND fall-down driver Qdwn on the scan electrode and auxiliary electrode side, and the signal "g-c", which is inputted to the GND driver Qg on the sustainment electrode side, are set to high level, whereby the drivers Qdwn and Qg are turned ON. Therefore, the scan electrodes, auxiliary electrodes, and sustainment electrodes are held at a GND potential.

Figure 15:
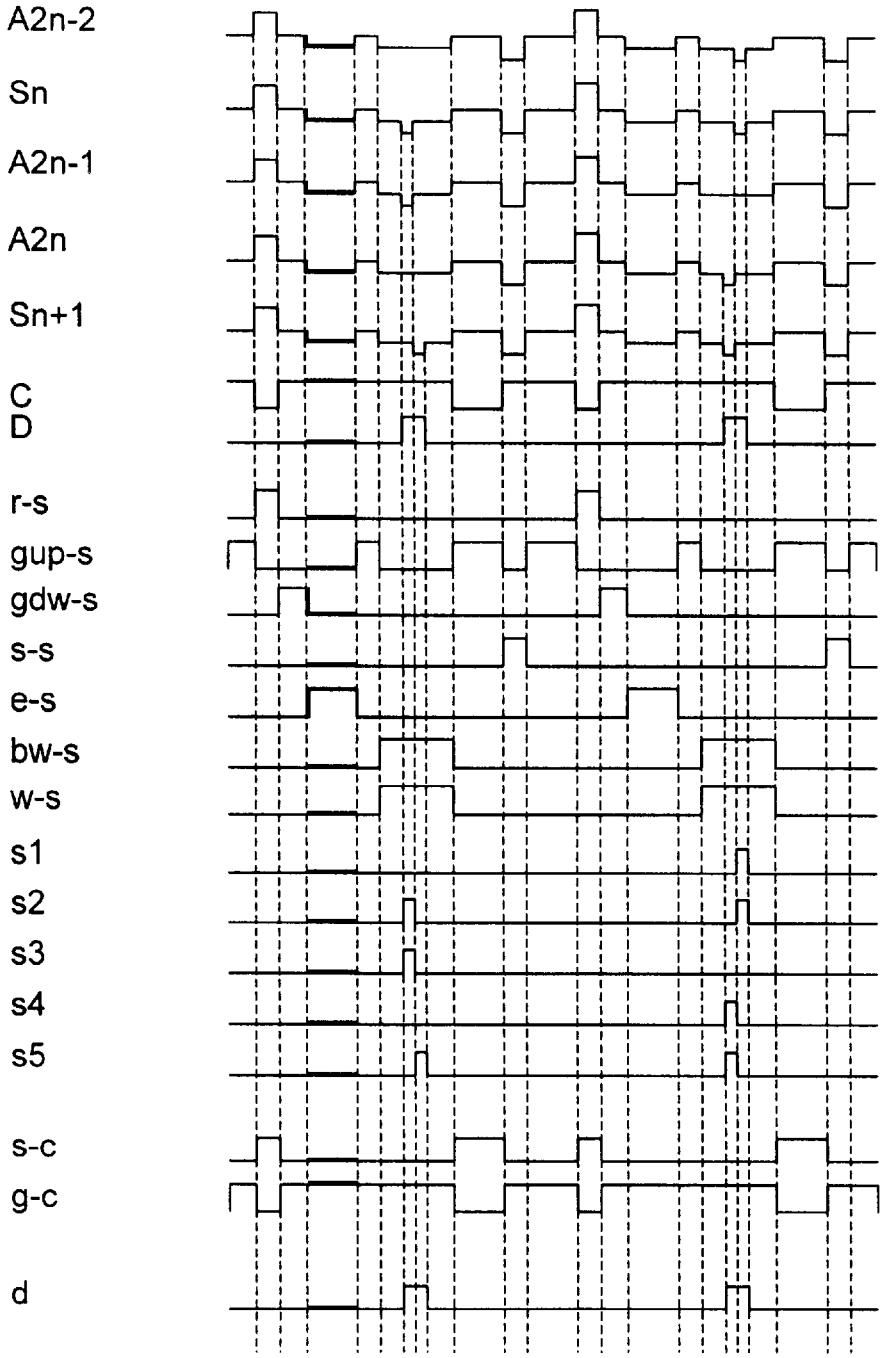
FIG. 15 is a timing chart specifying a next period to the period shown in FIG. 14 in the driving method of the first embodiment.
Figure 27:
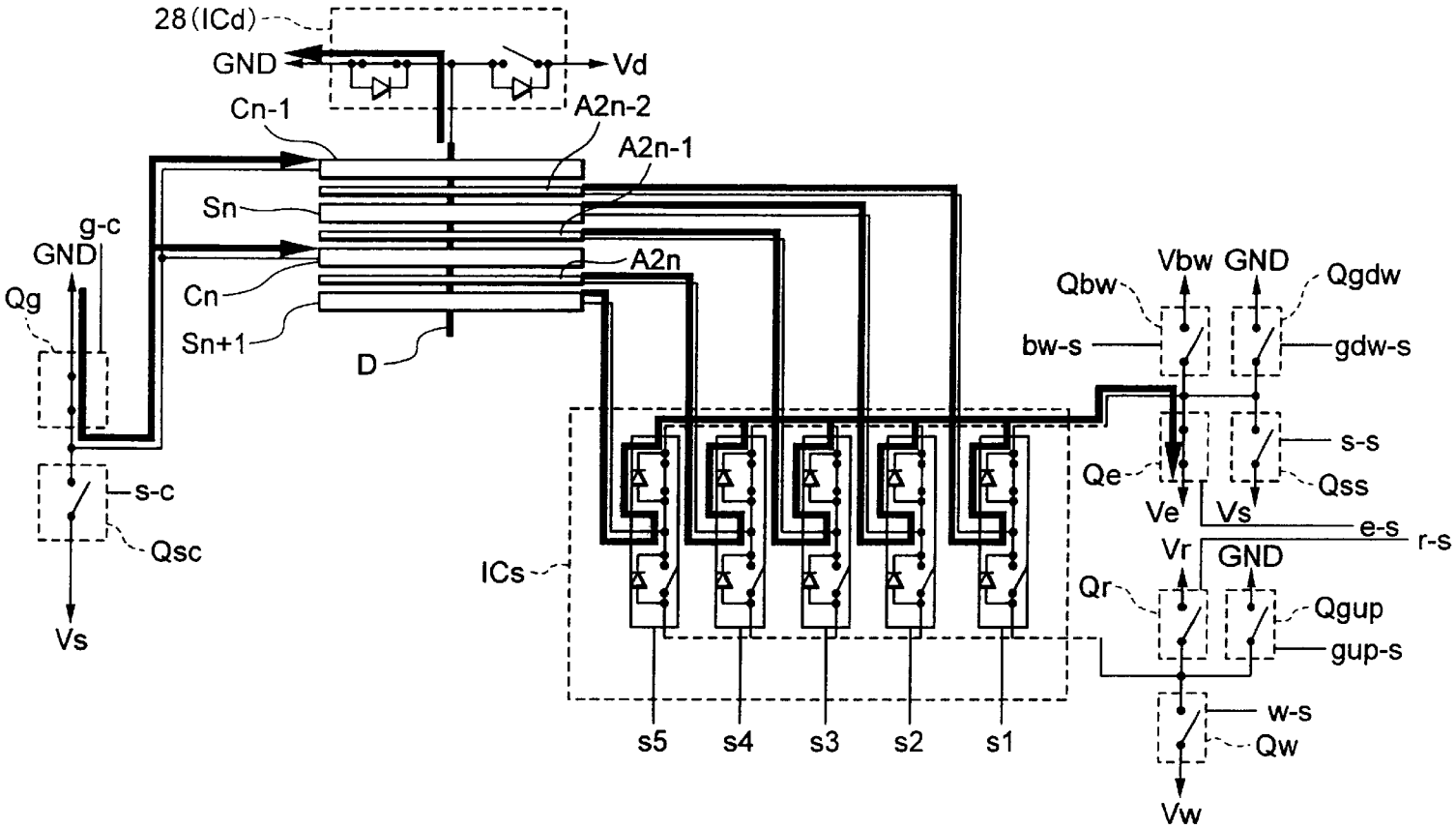
FIG. 27 is a schematic view depicting an operation of driving circuits in the period shown in FIG. 15.
Figure 39A:
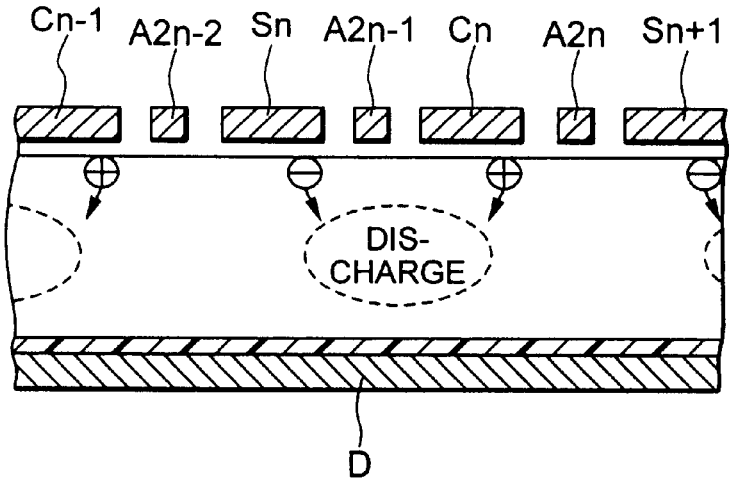
Figure 39B:
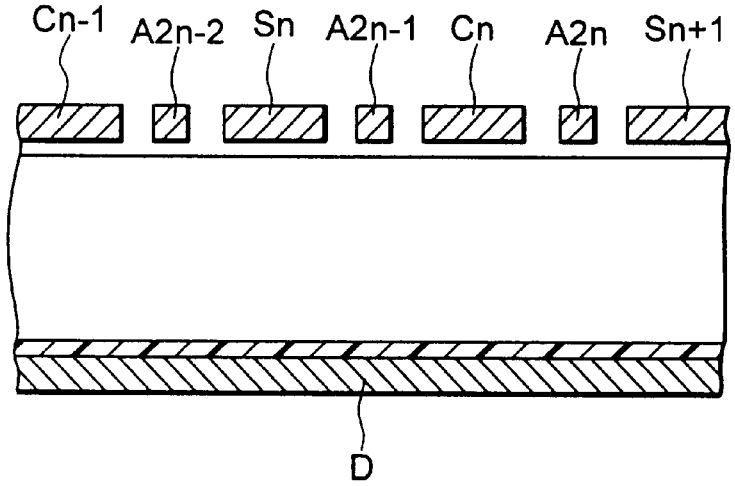

Further, during a reset period 1-f, as shown in FIG. 12 and FIG. 15, erasing pulses Pe-s and Pe-A are applied to the entirety of the scan electrode S and auxiliary electrode A, respectively. As a result, as shown in FIG. 39A, a weak discharge is generated. As shown in FIG. 39B, a wall charge that has not erased due to the self-erasing discharge is completely erased. During this period, as shown in FIG. 15 and FIG. 27, the signal "e-s", which is inputted to the erasing driver Qe on the scan electrode and auxiliary electrode side, is set to high level, whereby the driver Qe is turned ON, and the erasing pulse is applied to each of the scan electrodes and auxiliary electrodes.

Figure 16:
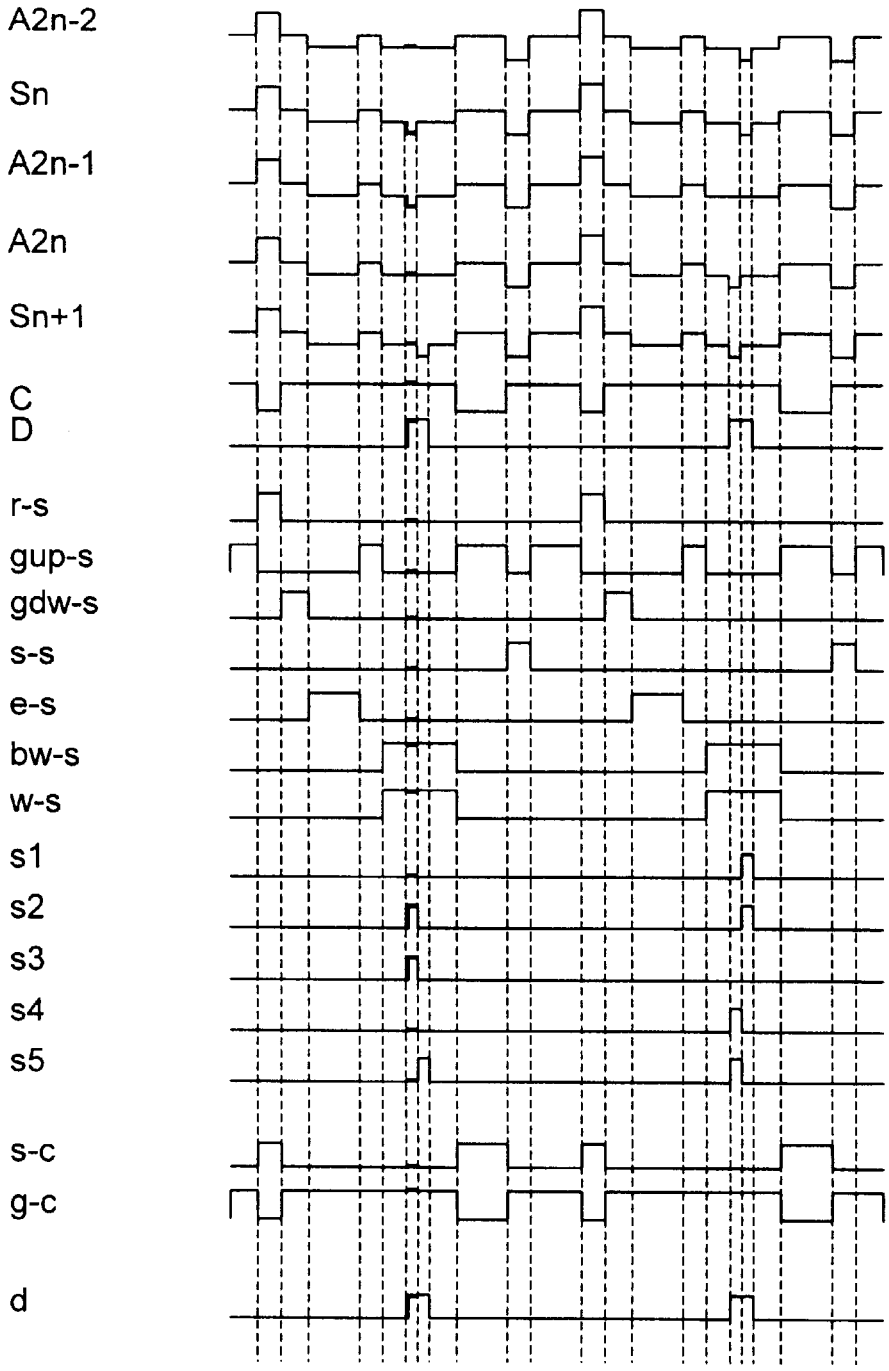
FIG. 16 is a timing chart specifying a next period to the period shown in FIG. 15 in the driving method of the first embodiment.

The period 2-f in FIG. 12 is an addressing period of a sub-field of a frame "f". During this addressing period 2-f, as shown in FIG. 12 and FIG. 16, the entirety of the sustainment electrode C is held at a GND level, and an auxiliary electrode A2*n* disposed at the upper side of each scan electrode S is held at a bias potential. The bias potential is intermediate between a scan voltage Vw and the reference voltage GND. This bias voltage may be the same as a scan pulse voltage described later.

Figure 40A:
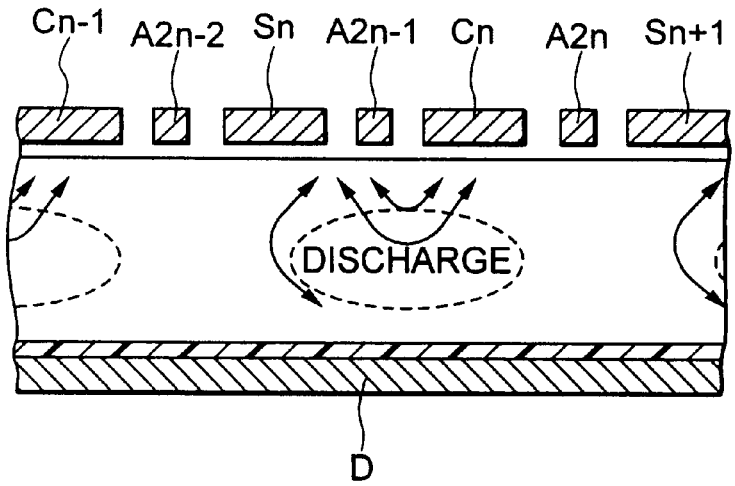
Figure 40B:
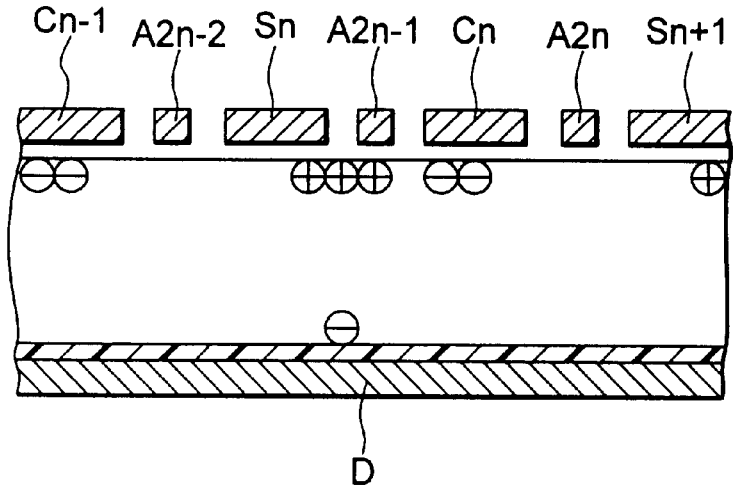

In addition, negative polarity scan pulses Psc-s and Pcs-A are applied respectively to a scan electrode Sn in a row in which writing is performed and an auxiliary electrode A2*n*-1, which is at the lower side of the scan electrode Sn, and a positive polarity data pulse Pd is applied to a data electrode D. As a result, as shown in FIG. 40A, in a selected display cell, an opposite discharge is generated between each of the scan electrode Sn and auxiliary electrode A2*n*-1 and the data electrode D. With this discharge being a trigger, a planar discharge is generated between the sustainment electrode Cn and the auxiliary electrode A2*n*-1, and further, a writing discharge is generated between the sustainment electrode Cn and the scan electrode Cn. Thus, as shown in FIG. 40B, a positive charge is accumulated on the auxiliary electrode A2*n*-1 and on the lower part of the scan electrode Sn, and a negative charge is accumulated on the upper part of the sustainment electrode Cn.

On the other hand, an auxiliary electrode A2*n*-2, which is disposed at the upper side of the scan electrode Sn, is held at a bias potential, as described previously, and thus, a potential difference between the auxiliary electrode A2*n*-2 and the scan electrode Sn is reduced. Even if an opposite discharge is generated between the scan electrode Sn and the data electrode D, a planar discharge is not generated between the scan electrode Sn or auxiliary electrode A2*n*-2 and the sustainment electrode C.

In this manner, a writing discharge is generated only at a cross point between each of the scan electrode Sn to which the scan pulse Pw is applied and auxiliary electrode A2*n*-1, which is disposed at the lower side of the scan electrode, and the data electrode D to which the data pulse Pd is applied.

Figure 28:
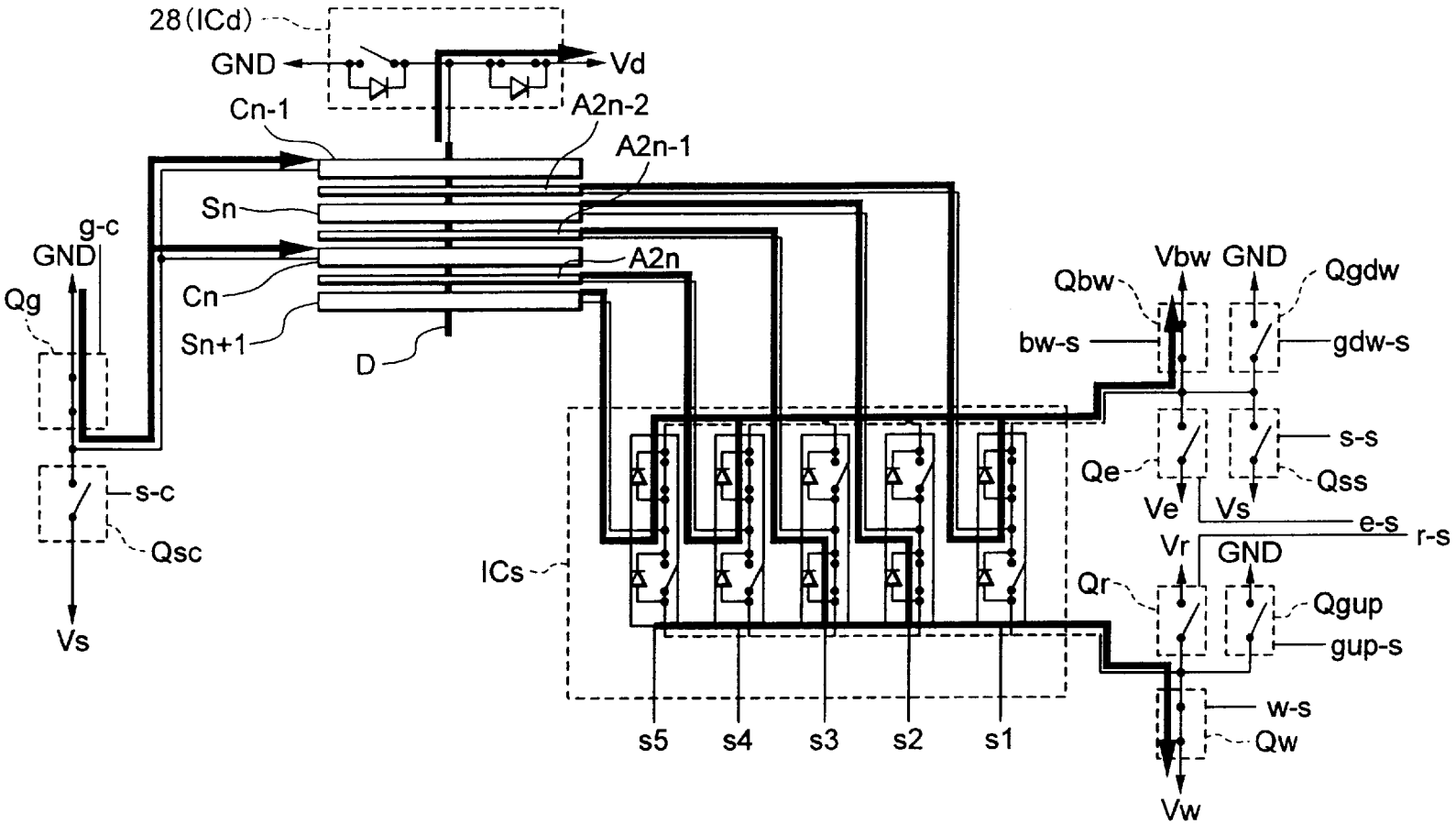
FIG. 28 is a schematic view depicting an operation of driving circuits in the period shown in FIG. 16.

During an addressing period 2-f, a scan base pulse Pbw may be applied to the entirety of the scan electrode S. Due to this scan base pulse Pbw, the amplitude of a scan pulse can be reduced. Thus, when the scan pulses Psc-a and Psc-A rise up, the wall charge formed due to a writing discharge in the scan pulses Psc-s and Psc-A is restricted from being eliminated due to the generation of a self-erasing discharge. During this period, as shown in FIG. 16 and FIG. 28, the signals "bw-s" and "w-s", which are inputted to the scan base driver Qbw and the scan voltage driver "Qw", respectively, are set to high level, whereby the drivers Qbw and Qw are turned ON. In addition, the driver signals s2 and s3 for a scan pulse driver ICs connected to the selected scan electrode Sn and auxiliary electrode A2*n*-1 are set to high level, whereby a fall-down side switches of the drivers S2 and S3 are turned ON. Thus, the scan pulses are applied only to the selected scan electrode Sn and auxiliary electrode A2*n*-1, and the scan base pulses are applied to the other scanning and auxiliary electrodes.

Figure 17:
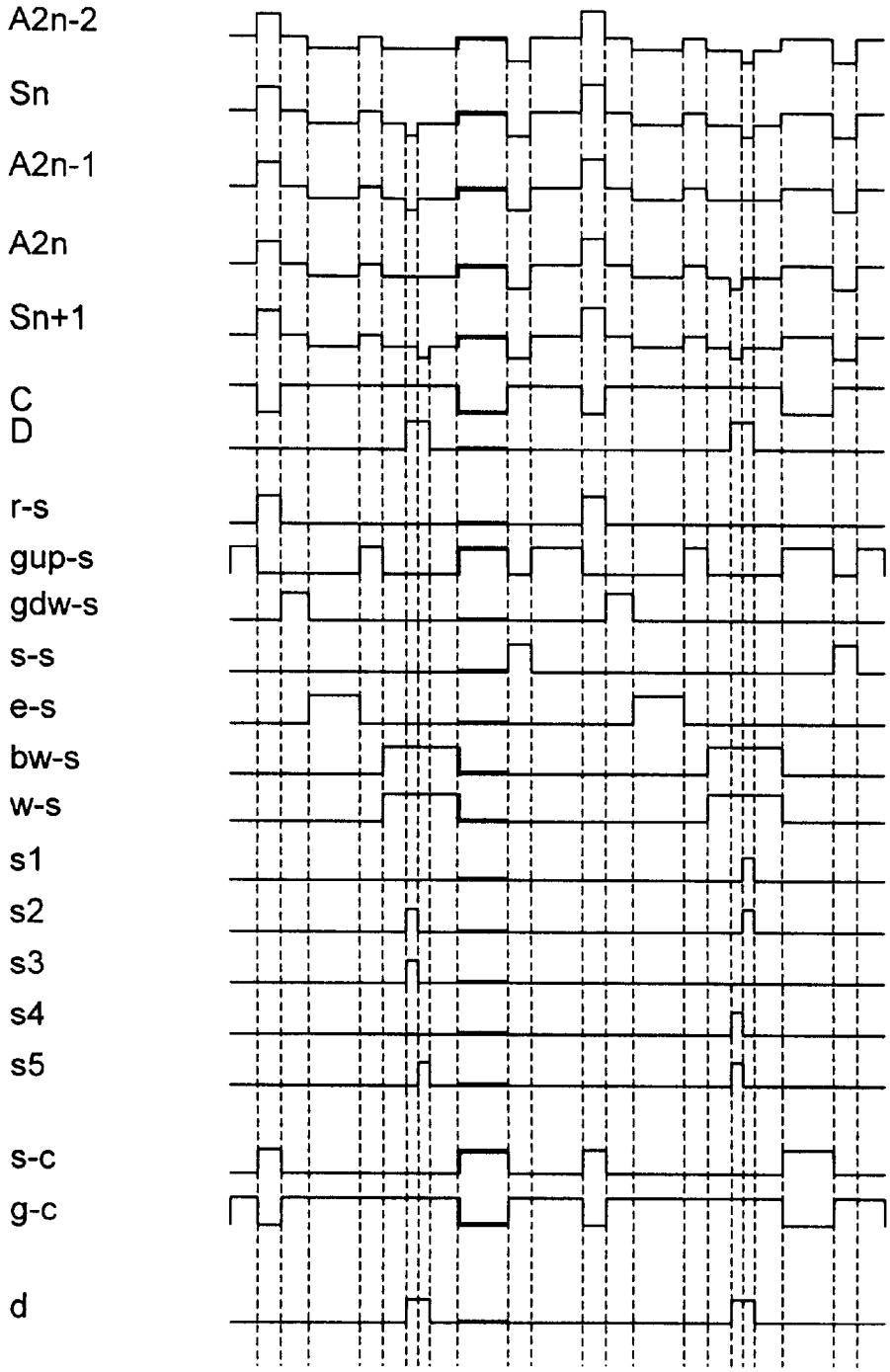
FIG. 17 is a timing chart specifying a next period to the period shown in FIG. 16 in the driving method of the first embodiment.
Figure 29:
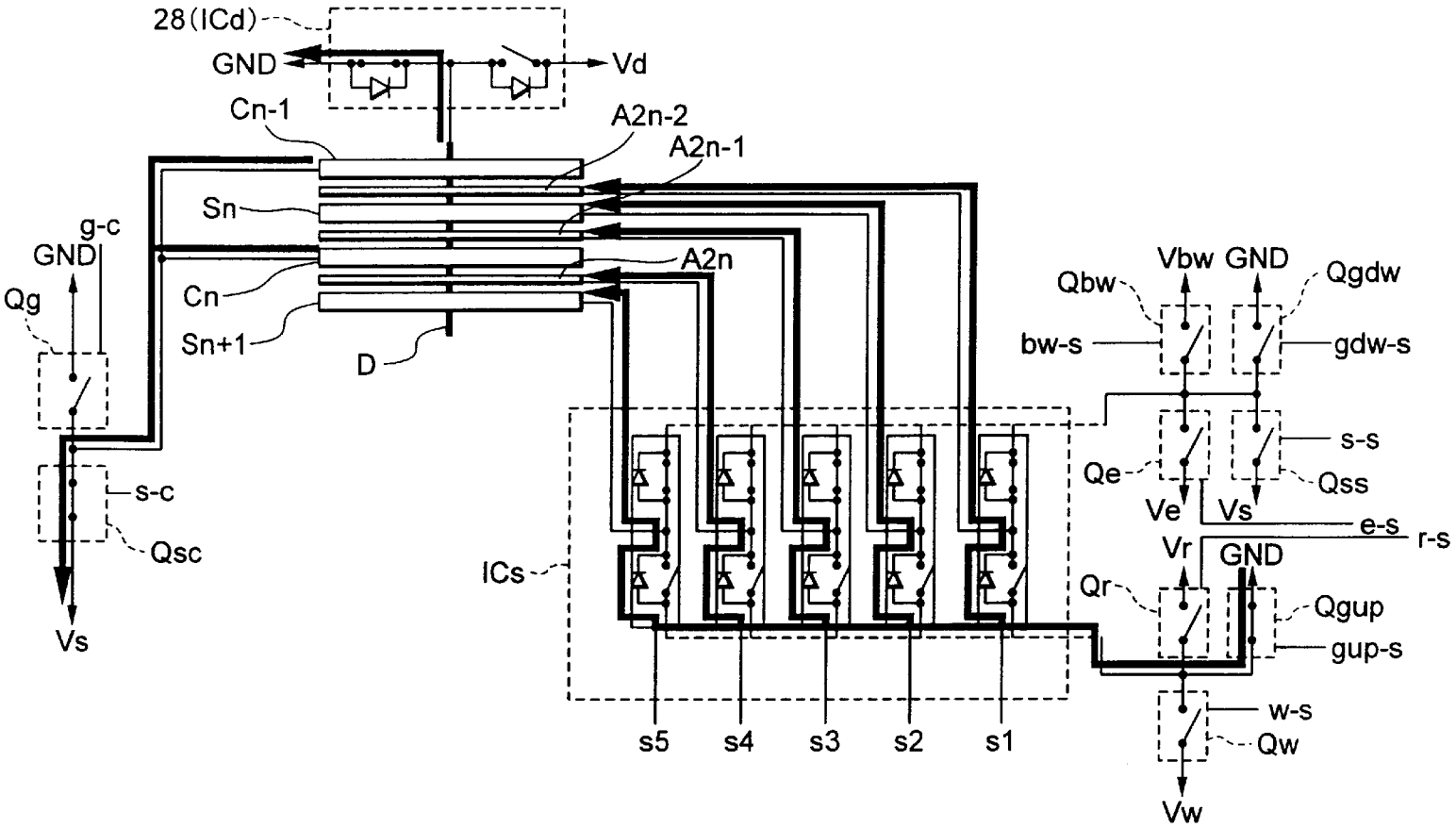
FIG. 29 is a schematic view depicting an operation of driving circuits in the period shown in FIG. 17.
Figure 41A:
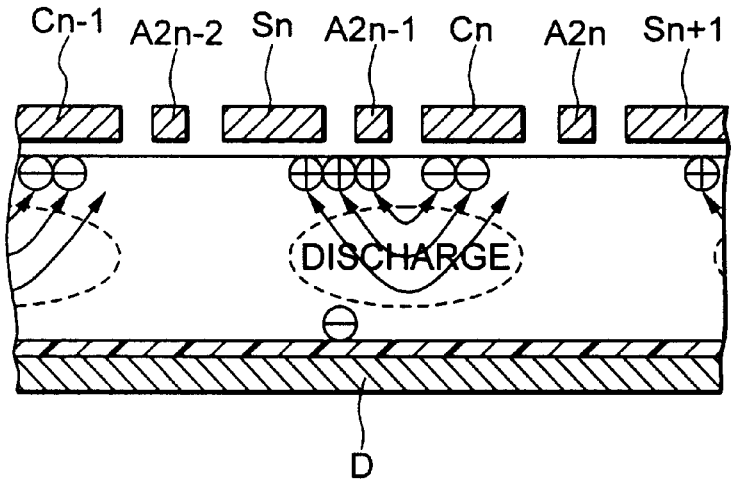
Figure 41B:
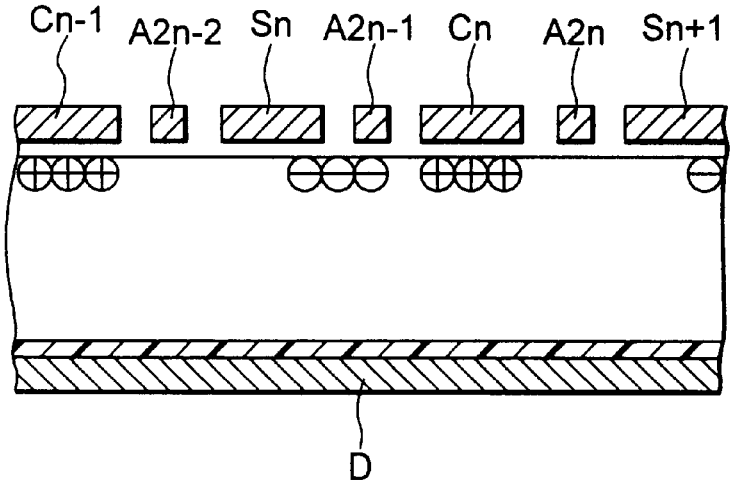

A period 3-f in FIG. 12 is a sustainment period of a sub-field of a frame "f". During this sustainment period 3*f*, as shown in FIG. 12 and FIG. 17, a negative polarity sustainment pulse Psus-c is first applied to the sustainment electrode C. At this time, in display cells selectively written during the addressing period 2-f, the positive charge has been accumulated on each of the scan electrode S and auxiliary electrode A, and the negative charge has been accumulated on the sustainment electrode C. Thus, once the negative polarity sustainment pulse Psus-c is applied to the sustainment electrode C, this voltage is weighted on a voltage caused by the wall charge, and a potential difference between electrodes exceeds a minimum discharge voltage. Therefore, as shown in FIG. 41A, a discharge is generated. Once a discharge is generated, a wall charge is disposed so as to cancel the voltage applied to each voltage. Therefore, as shown in FIG. 41B, a positive charge is accumulated on the sustainment electrode C, and a negative charge is accumulated on each of the scan electrode S and auxiliary electrode A. During this period, as shown in FIG. 17 and FIG. 29, the signal "gup-s", which is inputted to the GND rise-up driver Qgup on the scan electrode and auxiliary electrode side, and a signal "s-c", which is inputted to the sustainment voltage driver Qsc on the sustainment electrode side, are set to high level, whereby the drivers Qgup and Qsc are turned ON, the scanning and auxiliary electrodes are held at a GND voltage, and the sustainment pulse is applied to the sustainment electrode.

Figure 18:
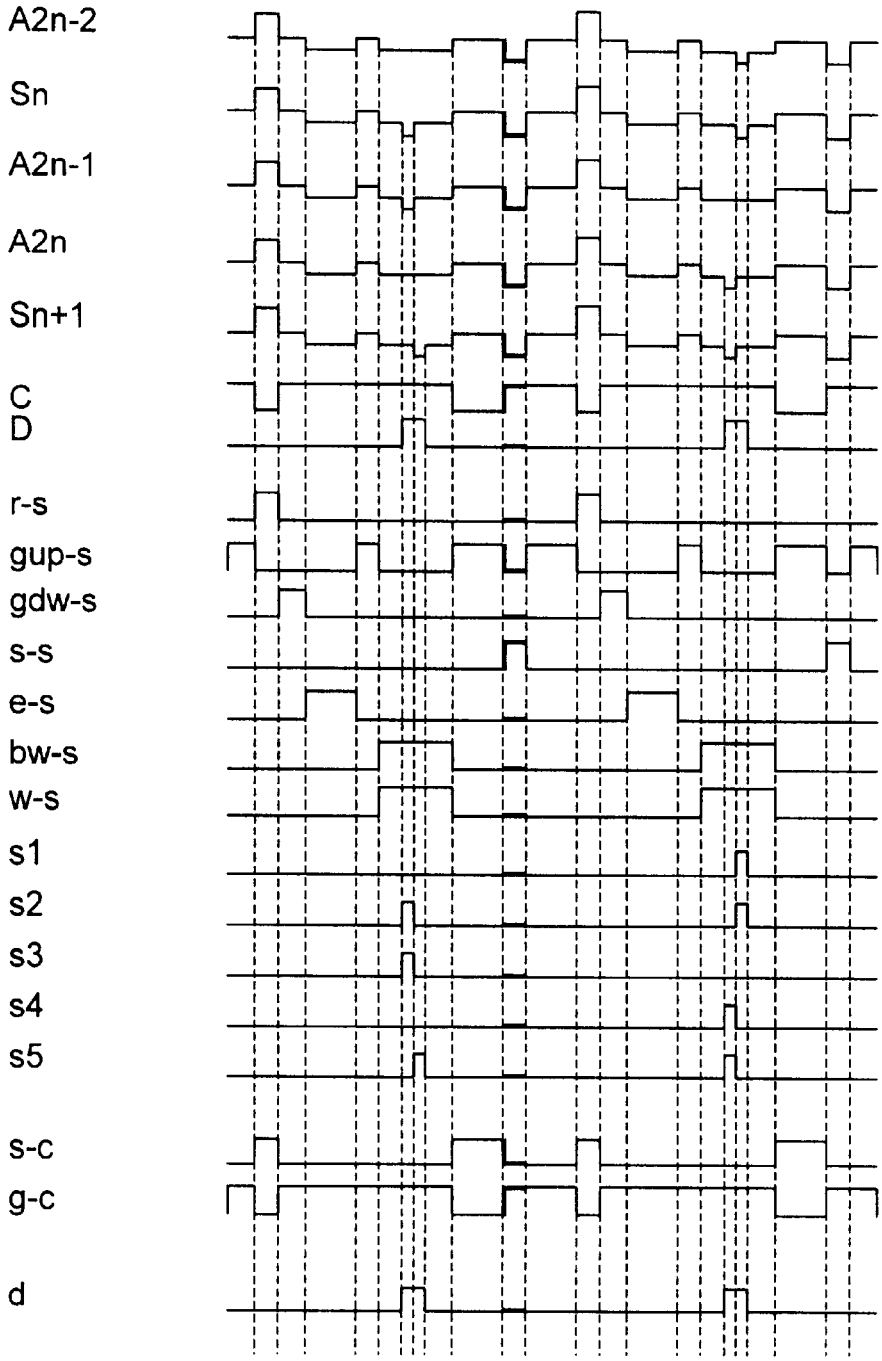
FIG. 18 is a timing chart specifying a next period to the period shown in FIG. 17 in the driving method of the first embodiment.
Figure 30:
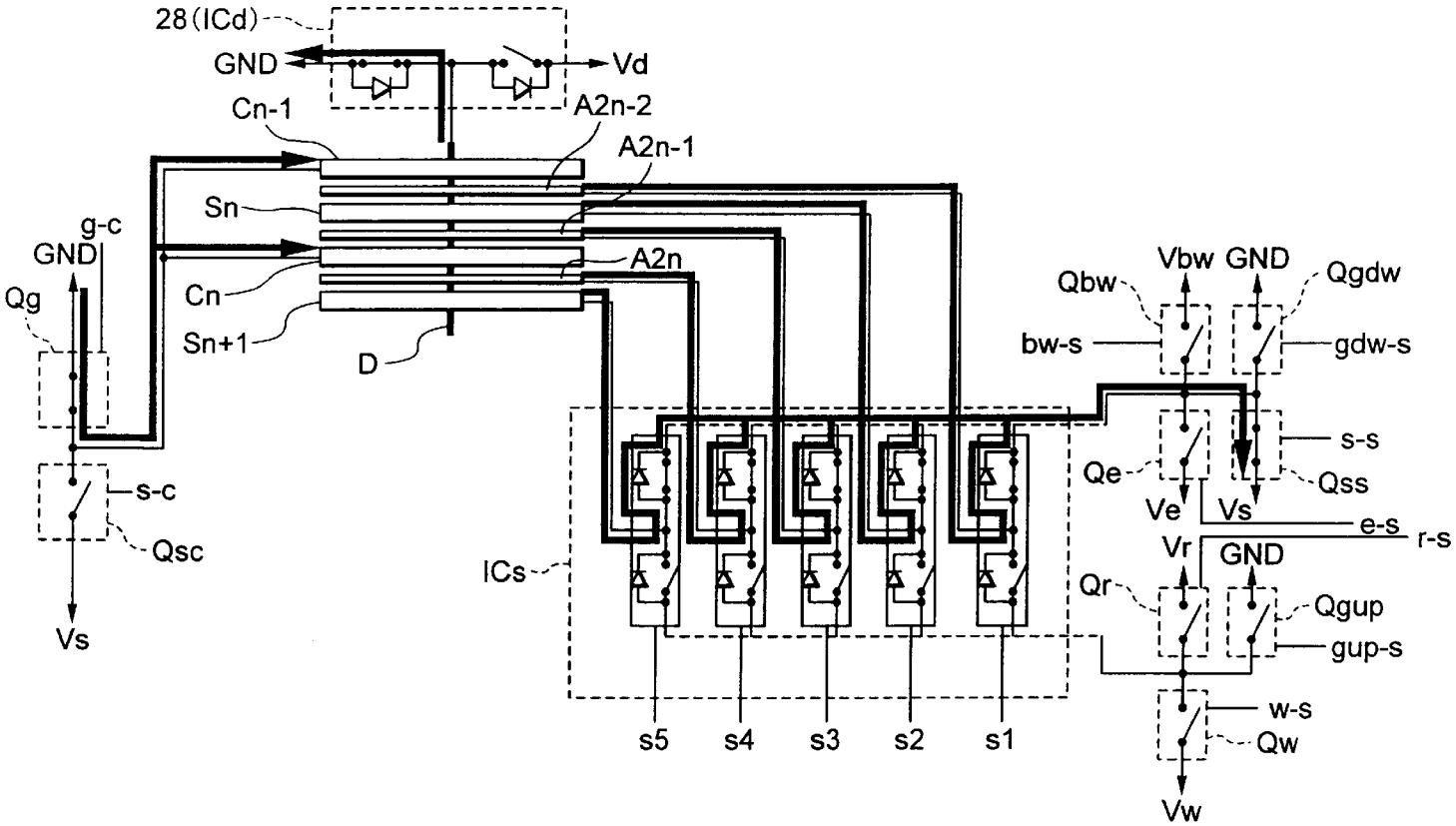
FIG. 30 is a schematic view depicting an operation of driving circuits in the period shown in FIG. 18.
Figure 42A:
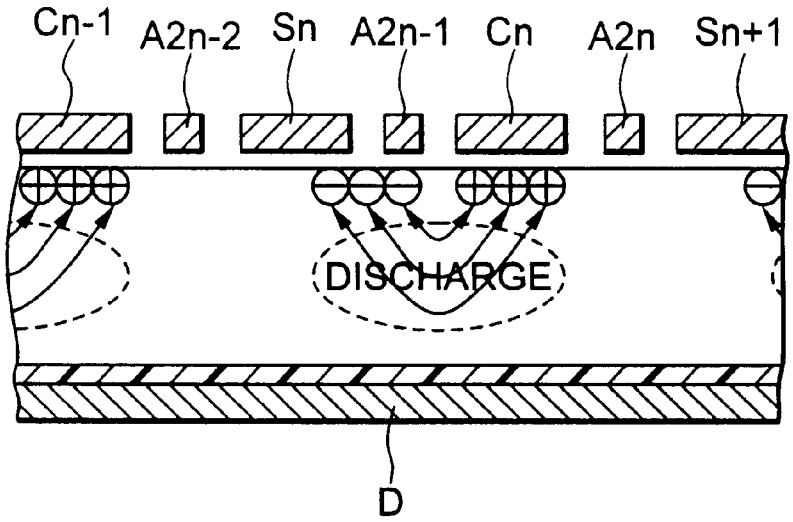
Figure 42B:
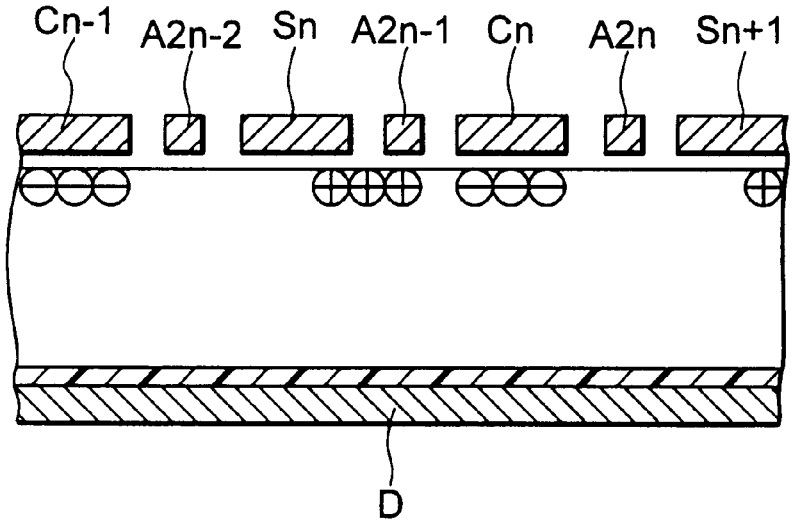

Then, during a sustainment period "3-f", as shown in FIG. 12 and FIG. 18, negative polarity sustainment pulses Psus-s and Psus-A are applied respectively to the scan electrode S and auxiliary electrode A. At this time, in display cells in which discharge has been generated due to application of the sustainment pulse Psus-c, the negative charge has been accumulated on each of the scan electrode S and auxiliary electrode A, and the positive charge has been accumulated on the sustainment electrode C. Thus, once a negative voltage pulse is applied to each of the scan electrode S and auxiliary electrode A, a potential difference between electrodes exceeds a minimum discharge voltage due to weighting with the wall charge. Therefore, as shown in FIG. 42A, a discharge is generated. Once a discharge is generated, a wall charge is disposed so as to cancel the voltage applied to each electrode. Therefore, as shown in FIG. 42B, a negative charge is accumulated on the sustainment electrode C, and a positive charge is accumulated on each of the scan electrode S and auxiliary electrode A. Then, during a sustainment period 3-f, the sustainment pulses Psus-c, Psus-s, and Psus-A are repeatedly applied, whereby the light emission in selected display cells is sustained. During this period, as shown in FIG. 18 and FIG. 30, the signal "s—s", which is inputted to the sustainment voltage driver Qs on the scan electrode and auxiliary electrode side, and the signal "g-c", which is inputted to the GND driver Qg on the sustainment electrode side, are set to high level, whereby the drivers Qs and Qg are turned ON, the sustainment pulses are applied to the scan electrode and auxiliary electrode, and the sustainment electrode is held at a GND potential.

Then, one sub-field of a frame "f" is formed in accordance with the steps in the periods 1-f to 3-f, and this sub-field is repeatedly formed to configure the frame "f".

In the next frame "f+1" as well, although one sub-field is configured in accordance with the steps in a reset period 1-(f+1), an addressing period 2-(f+1), and a sustainment period 3-(f+1), a subsequent operation in the period 2-(f+1) is different from a case of the frame "f". In addition, the scanning direction is reversed depending on the frames "f" and "f+1".

Figure 19:
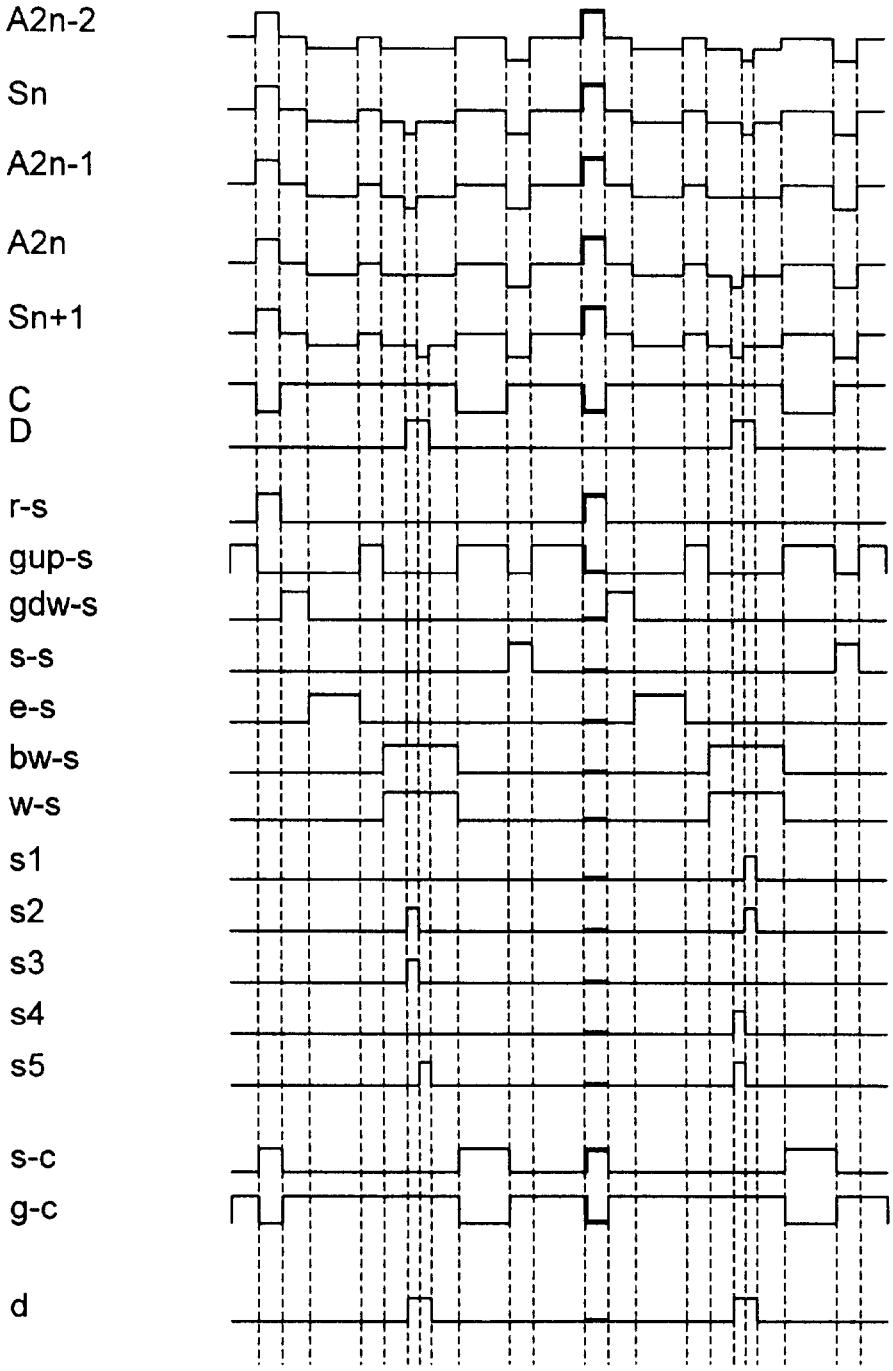
FIG. 19 is a timing chart specifying a next period to the period shown in FIG. 18 in the driving method of the first embodiment.
Figure 31:
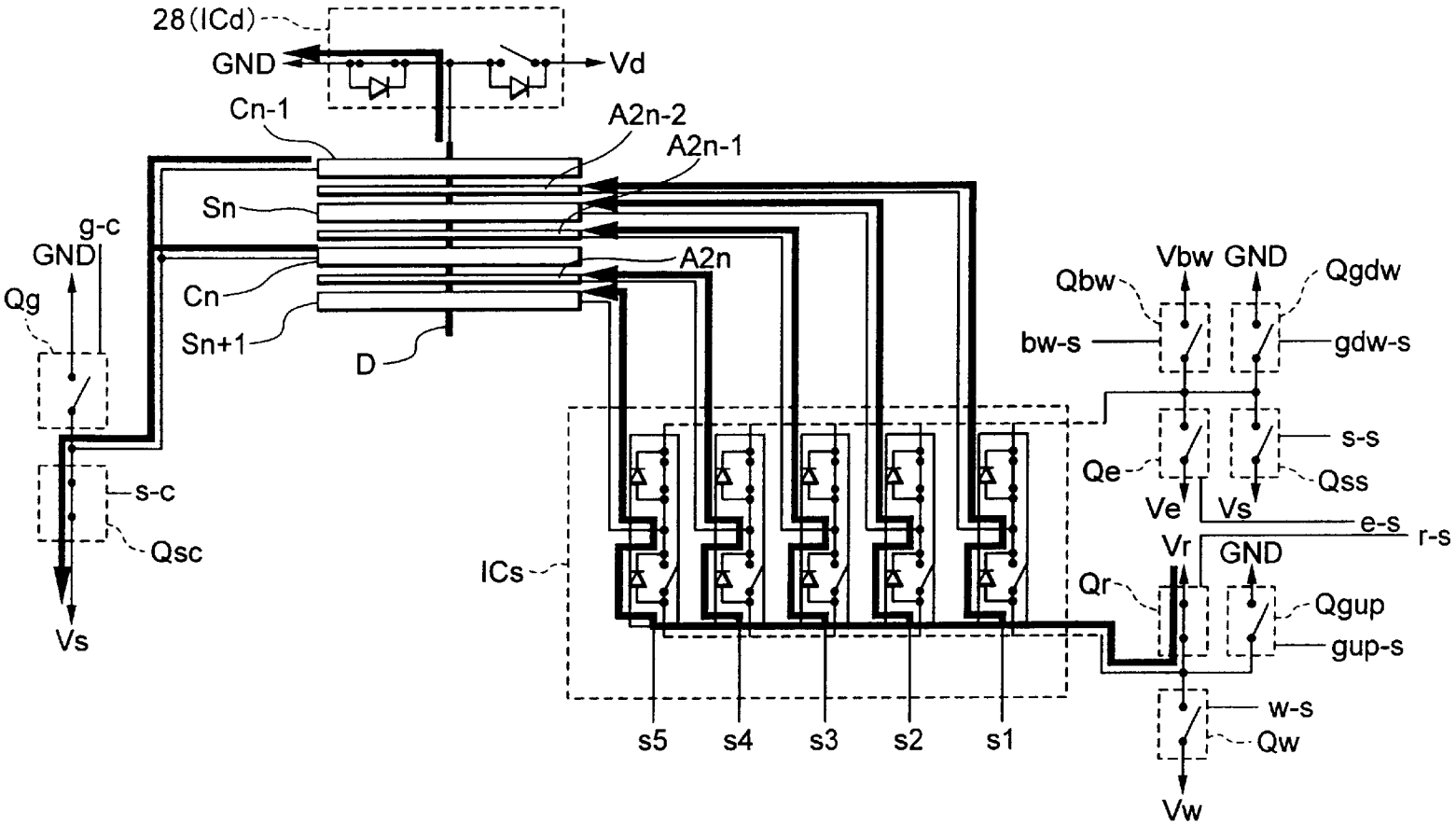
FIG. 31 is a schematic view depicting an operation of driving circuits in the period shown in FIG. 19.
Figure 43A:
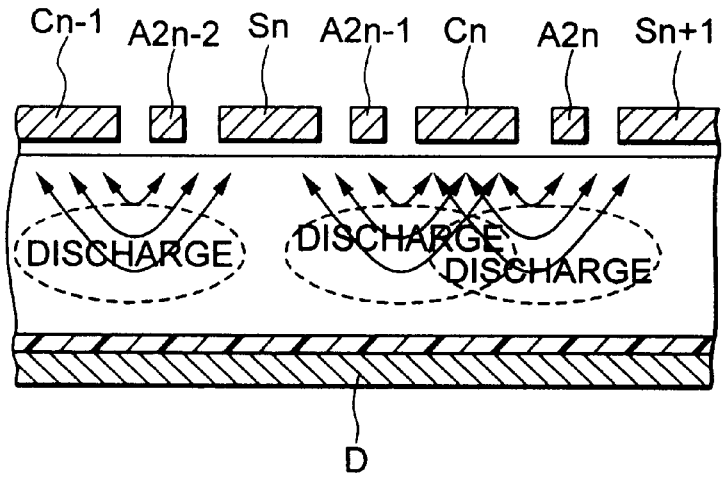
Figure 43B:
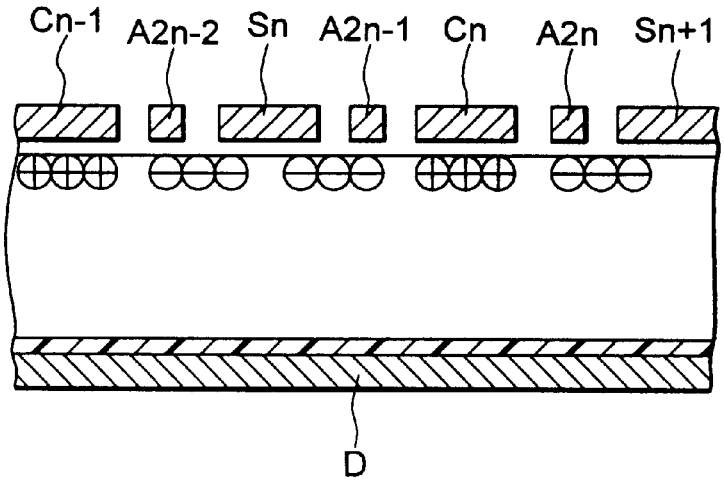

During a reset period 1-(f+1), as in the reset period 1-f, as shown in FIG. 12 and FIG. 19, reset pulses Pdr-s, Pdr-A, and Pdr-c are first applied respectively to the entirety of the scan electrode S, auxiliary electrode A and sustainment electrode C. The reset pulses Pdr-s, Prp-A and Ppr-c are positive in polarity. Due to these reset pulses, as shown in FIG. 43A, a reset discharge is generated between the adjacent scan electrode S and sustainment electrode C. Then, a space charge generated due to the reset discharge is, as shown in FIG. 43B, accumulated as a negative polarity wall charge on each of the scan electrode S and auxiliary electrode A, and accumulated as a positive polarity wall charge on the sustainment electrode C so as to cancel the voltage applied to each electrode. During this period, as shown in FIG. 19 and FIG. 31, the signal "r-s", which is inputted to the reset driver Qr on the scan electrode and auxiliary electrode side, and the signal "s-c", which is inputted to the sustainment driver Qsc on the sustainment electrode side, are set to high level, whereby the drivers Qr and Qsc are turned ON, and the reset pulse is applied to each of the scan electrode, auxiliary electrode, and sustainment electrode.

Figure 20:
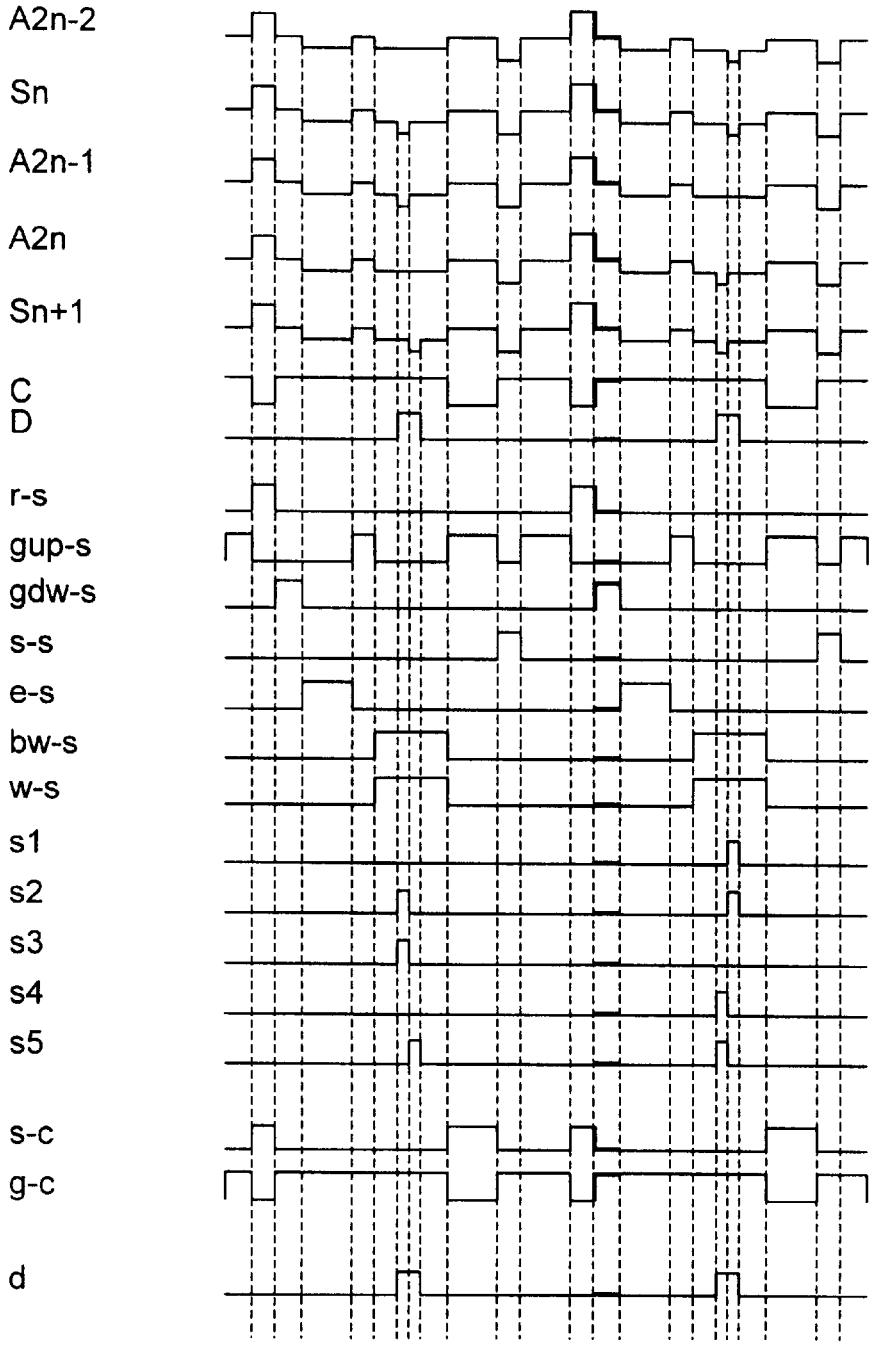
FIG. 20 is a timing chart specifying a next period to the period shown in FIG. 19 in the driving method of the first embodiment.
Figure 32:
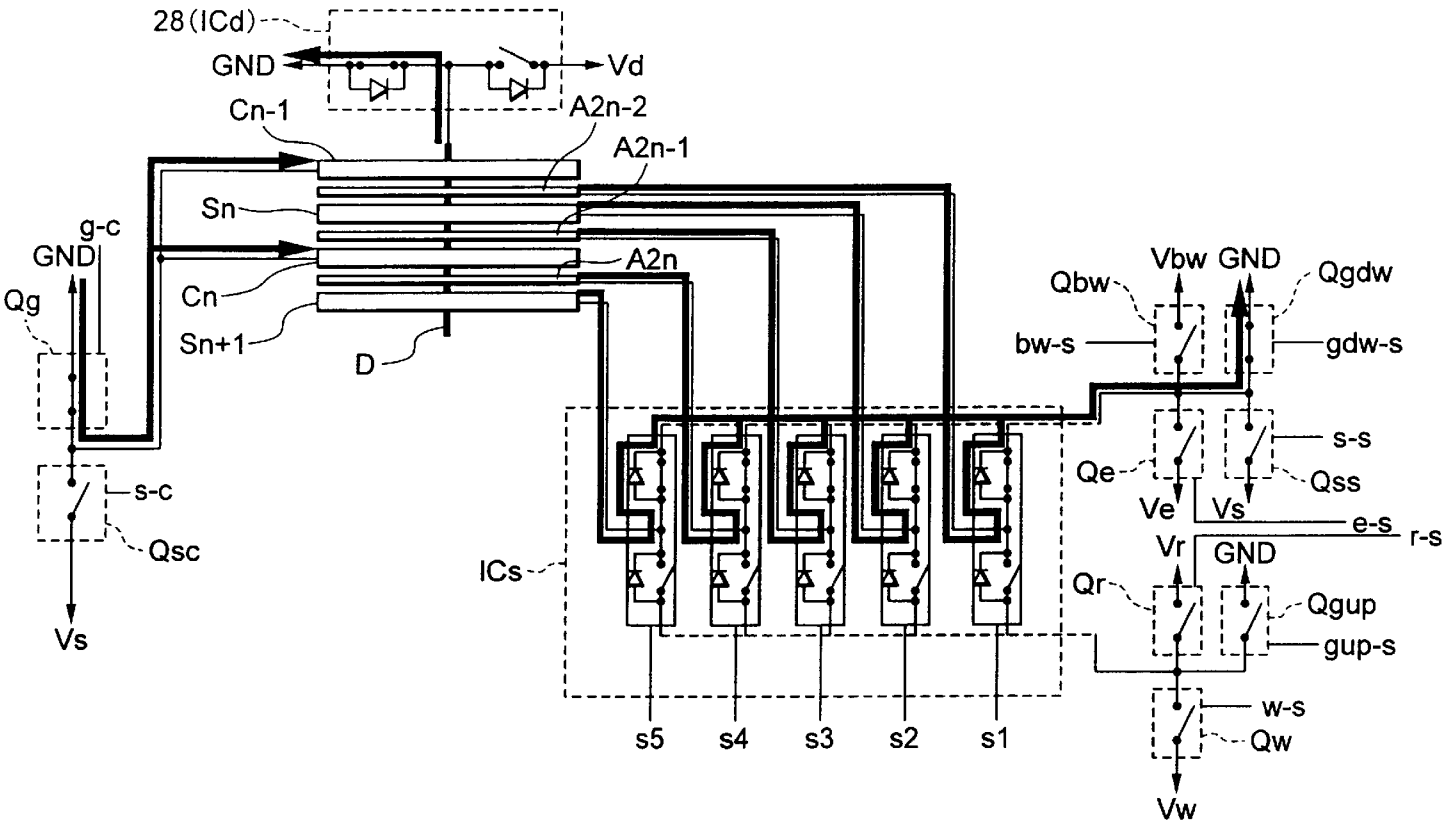
FIG. 32 is a schematic view depicting an operation of driving circuits in the period shown in FIG. 20.
Figure 44A:
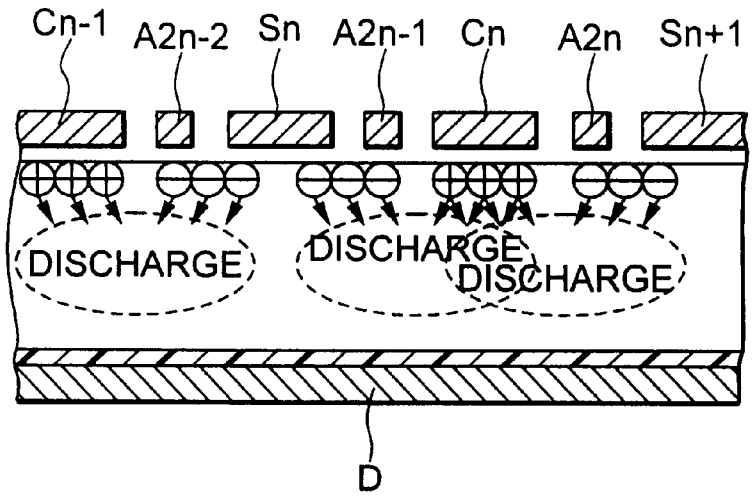
Figure 44B:
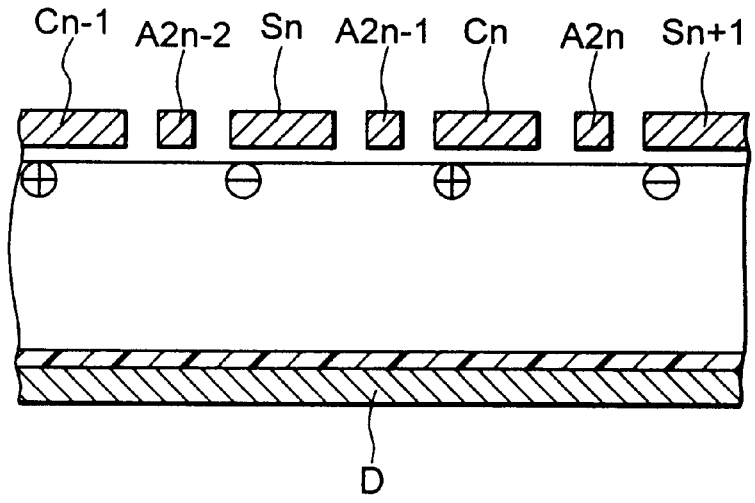

Then, as shown in FIG. 12 and FIG. 20, when the reset pulses are fallen down, a potential difference caused by the accumulated wall charge exceeds a discharge start voltage. As shown in FIG. 44A, a self-erasing discharge then is generated. At this time, there is no potential difference between the voltages externally applied to the scan electrode S and the sustainment electrode C respectively. Thus, as shown in FIG. 44B, almost of the wall charge is eliminated due to the self-erasing discharge. During this period, as shown in FIG. 20 and FIG. 32, the signals "gdw-s", which is inputted to the GND fall-down driver Qdwn on the scan electrode and auxiliary electrode side, and the signal "g-c", which is inputted to the GND driver Qg on the sustainment electrode side, are set to high level, whereby the drivers Qdwn and Qg are turned ON, and the scan electrode, auxiliary electrode, and sustainment electrode are held at a GND potential.

Figure 21:
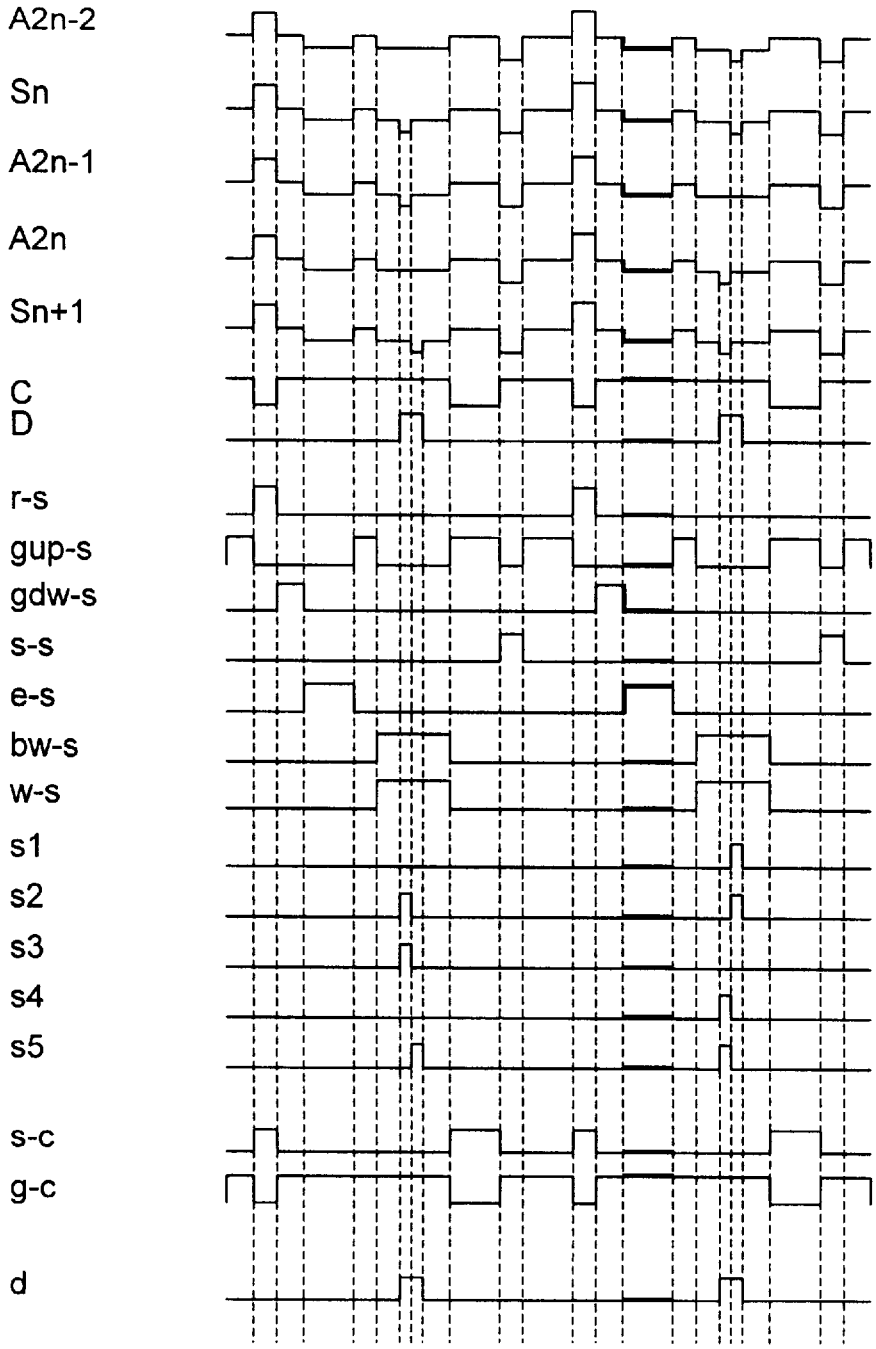
FIG. 21 is a timing chart specifying a next period to the period shown in FIG. 20 in the driving method of the first embodiment.
Figure 33:
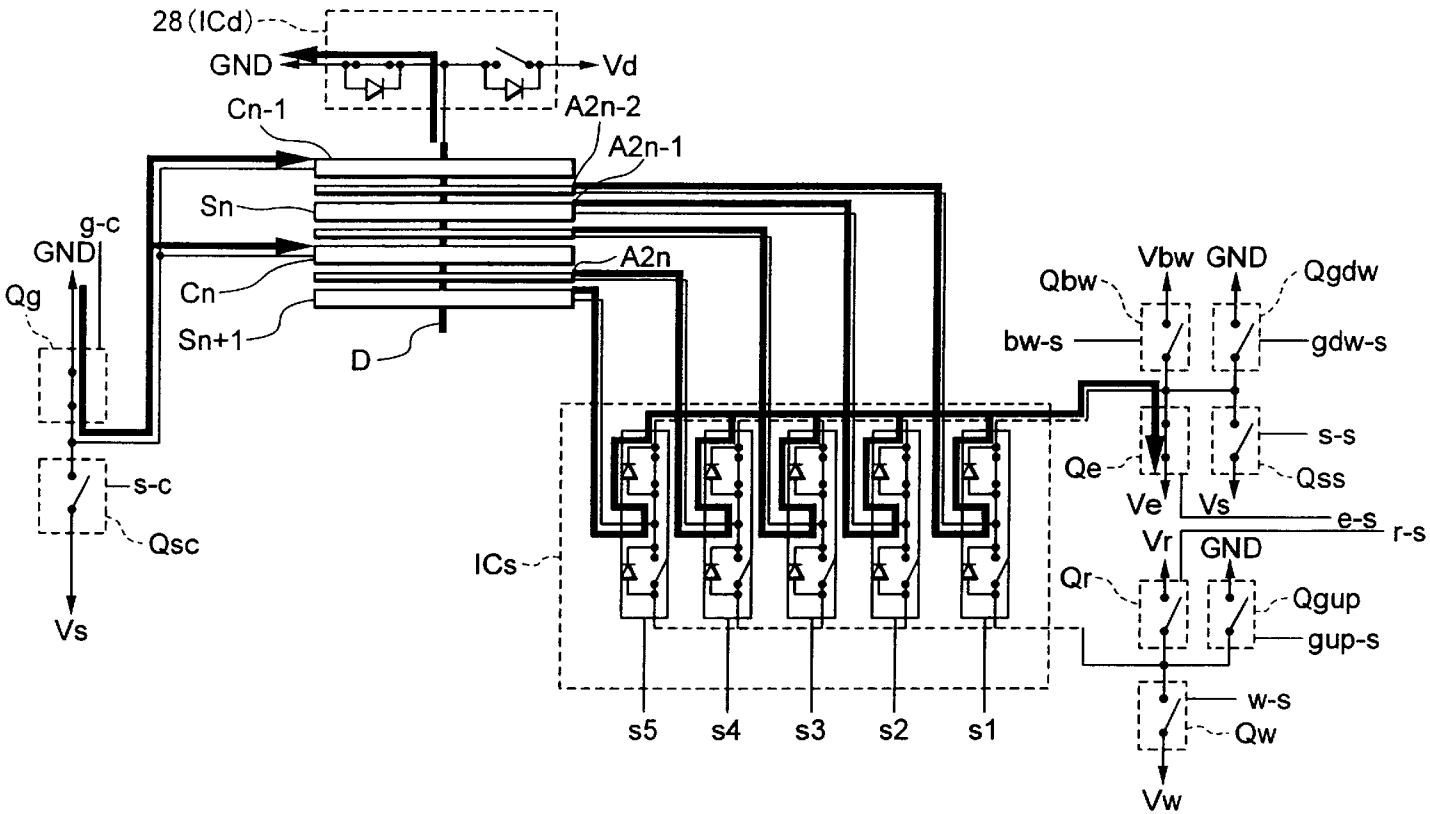
FIG. 33 is a schematic view depicting an operation of driving circuits in the period shown in FIG. 21.
Figure 45A:
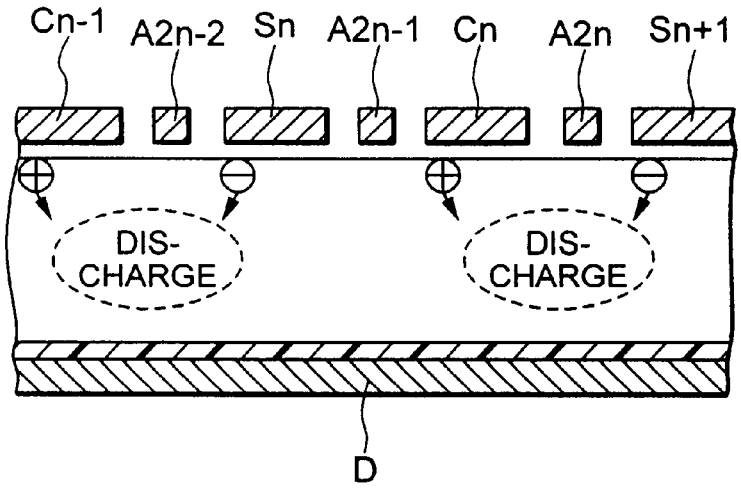
Figure 45B:
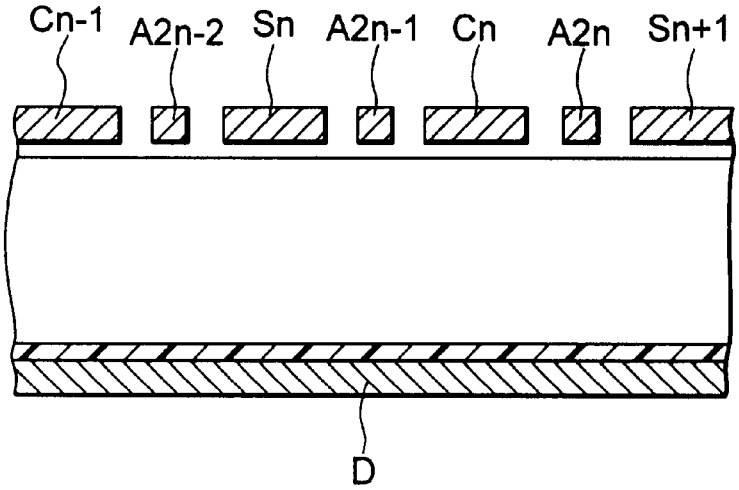

Further, as shown in FIG. 12 and FIG. 21, erasing pulses Pe-s and Pe-A are applied respectively to the entireties of the scan electrode S and auxiliary electrode A. As a result, as shown in FIG. 45A, a weak discharge is generated. As shown in FIG. 45B, the wall charges that have not been erased due to the self-erasing discharge is completely erased. During this period, as shown in FIG. 21 and FIG. 33, the signal "e-s", which is inputted to the erasing driver Qe on the scan electrode and auxiliary electrode side, is set to high level, whereby the driver Qe is turned ON, and the erasing pulse is applied to each of the scan electrode and auxiliary electrode.

Figure 22:
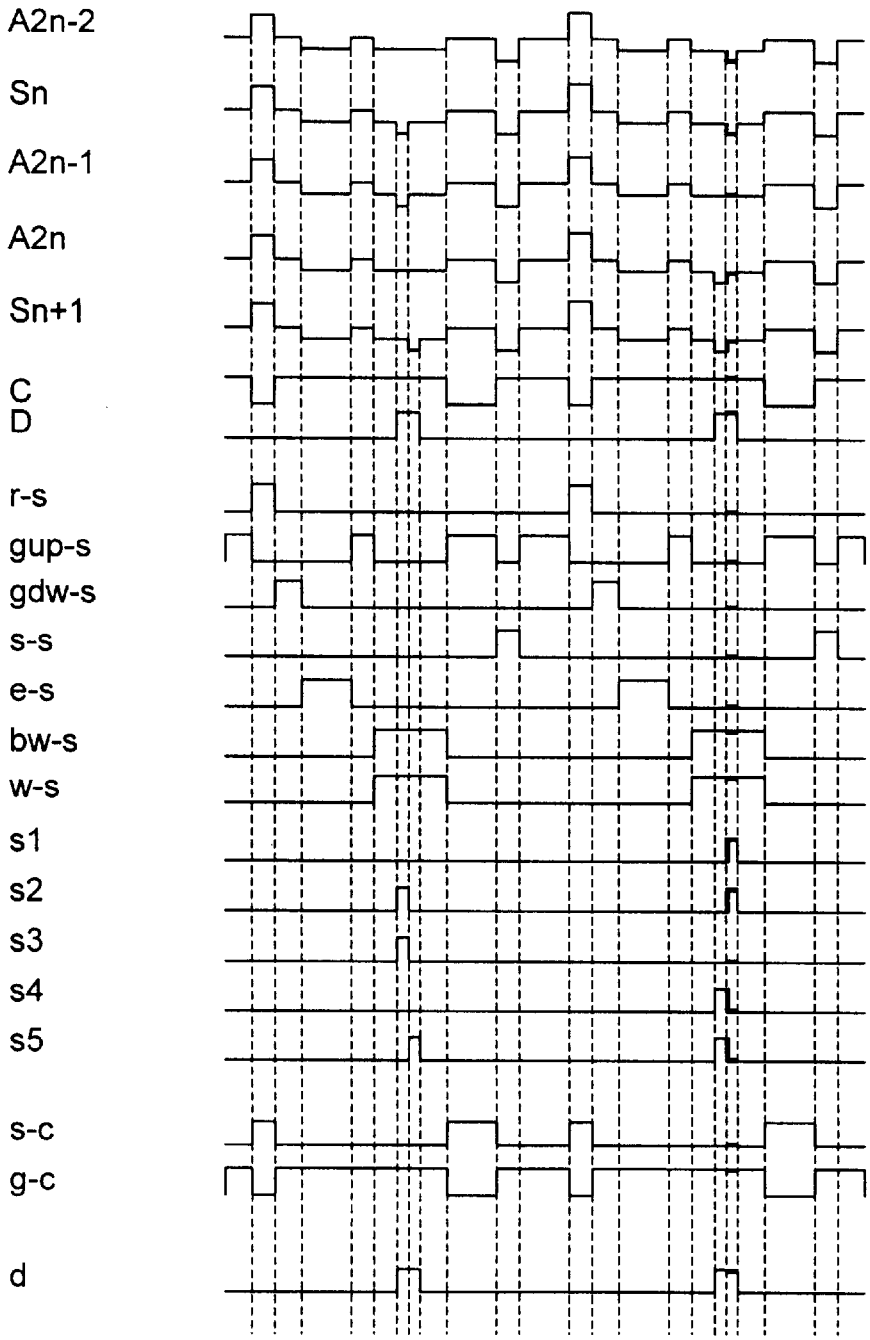
FIG. 22 is a timing chart specifying a next period to the period shown in FIG. 21 in the driving method of the first embodiment.

During the addressing period 2-(f+1), as shown in FIG. 12 and FIG. 22, the entirety of the sustainment electrode C is held at a GND level, and an auxiliary electrode A disposed at the lower side of each scan electrode S is held at a bias potential Vbw.

Figure 46A:
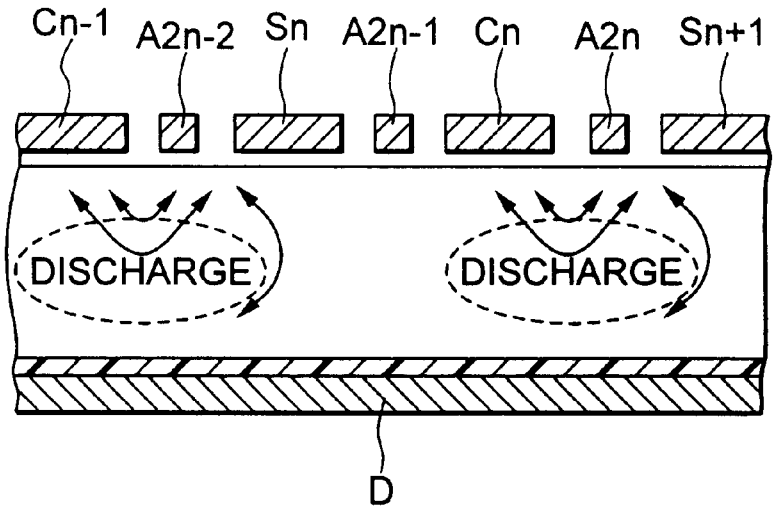
Figure 46B:
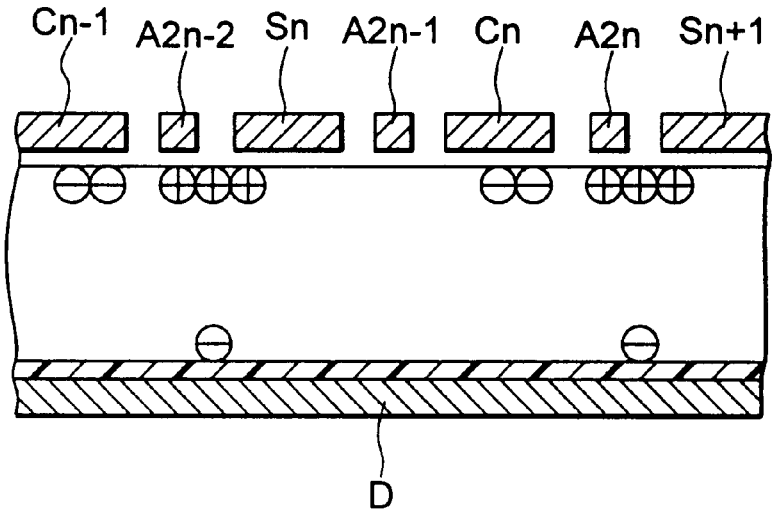

In addition, negative polarity scan pulses Psc-s and Psc-A are applied respectively to a scan electrode Sn in a row in which writing is performed and the adjacent auxiliary electrode A2*n*-2, which is at the upper side of the scan electrode Sn. A positive polarity data pulse Pd is applied to the data electrode D. As a result, as shown in FIG. 46A, in selected display cells, an opposite discharge is generated between each of the scan electrode Sn and auxiliary electrode A2*n*-2 and the data electrode D. With this discharge being a trigger, a planar discharge is generated between a sustainment electrode Cn-1 and the auxiliary electrode A2*n*-2, and further, a writing discharge is generated between the sustainment electrode Cn-1 and the scan electrode Sn. Thus, as shown in FIG. 46B, a positive charge is accumulated on the auxiliary electrode A2*n*-2 and on the upper part of the scan electrode Sn, and a negative charge is accumulated on the sustainment electrode Cn-1.

On the other hand, the auxiliary electrode A2*n*-1, which is disposed at the lower side of the scan electrode Sn, is held at a bias potential Vbw, as described previously. Thus, even if an opposite discharge is generated between the scan electrode Sn and the data electrode D, a planar discharge is not generated between the scan electrode Sn or auxiliary electrode A2*n*-1 and the sustainment electrode C.

Figure 34:
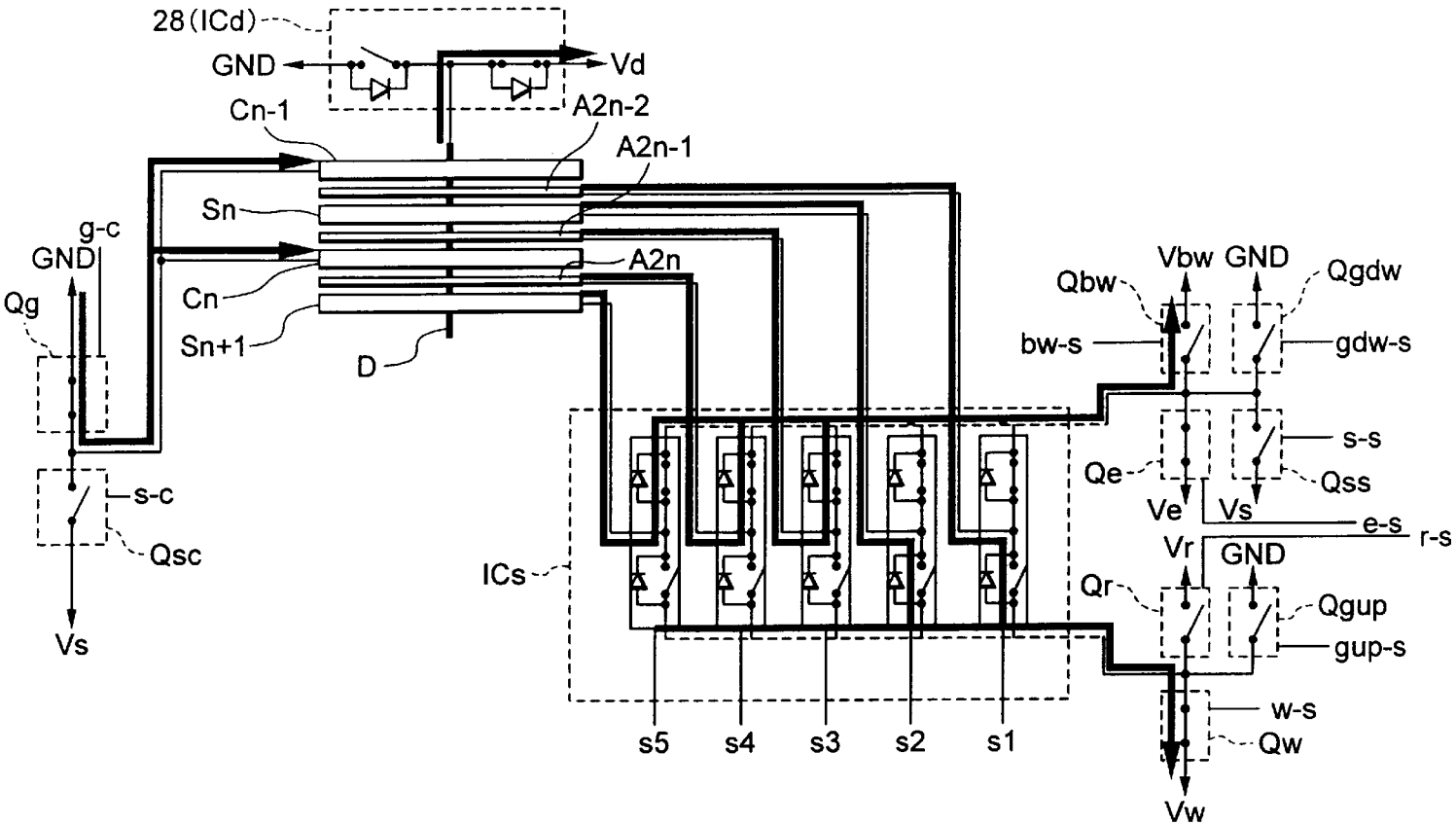
FIG. 34 is a schematic view depicting an operation of driving circuits in the period shown in FIG. 22.

In this manner, a writing discharge is generated only at a cross point between each of the scan electrode Sn to which the scan pulse Pw is applied and auxiliary electrode A2*n*-2, which is disposed at the upper side of the scan electrode, and the data electrode D to which the data pulse Pd is applied. During this period, as shown in FIG. 22 and FIG. 34, the signals "bw-s" and "w-s", which are inputted to the scan base driver Qbw and the scan voltage driver Qw respectively, are set to high level, whereby the drivers Qbw and Qw are turned ON. In addition, the driver signals s2 and S1 of the scan pulse driver ICs, which are connected to the selected scan electrode Sn and auxiliary electrode A2*n*-2, are set to high level, whereby the fall-down side switch of each of the drivers S2 and S1 is turned ON. Thus, the scan pulse is applied only to each of the selected scan electrode Sn and auxiliary electrode A2*n*-2, and the scan base pulse is applied to the other scan electrodes and auxiliary electrodes.

Figure 23:
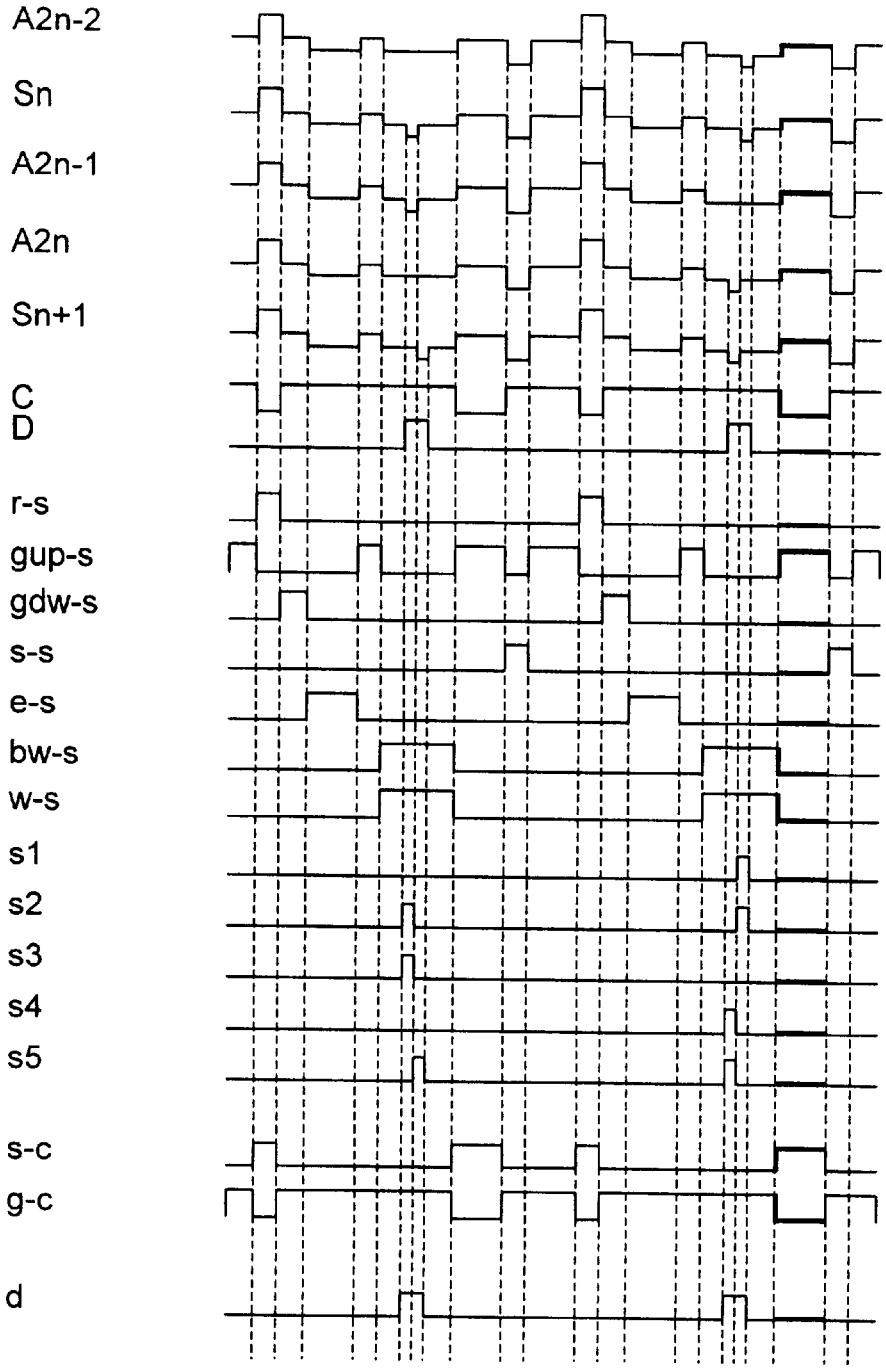
FIG. 23 is a timing chart specifying a next period to the period shown in FIG. 22 in the driving method of the first embodiment.
Figure 35:
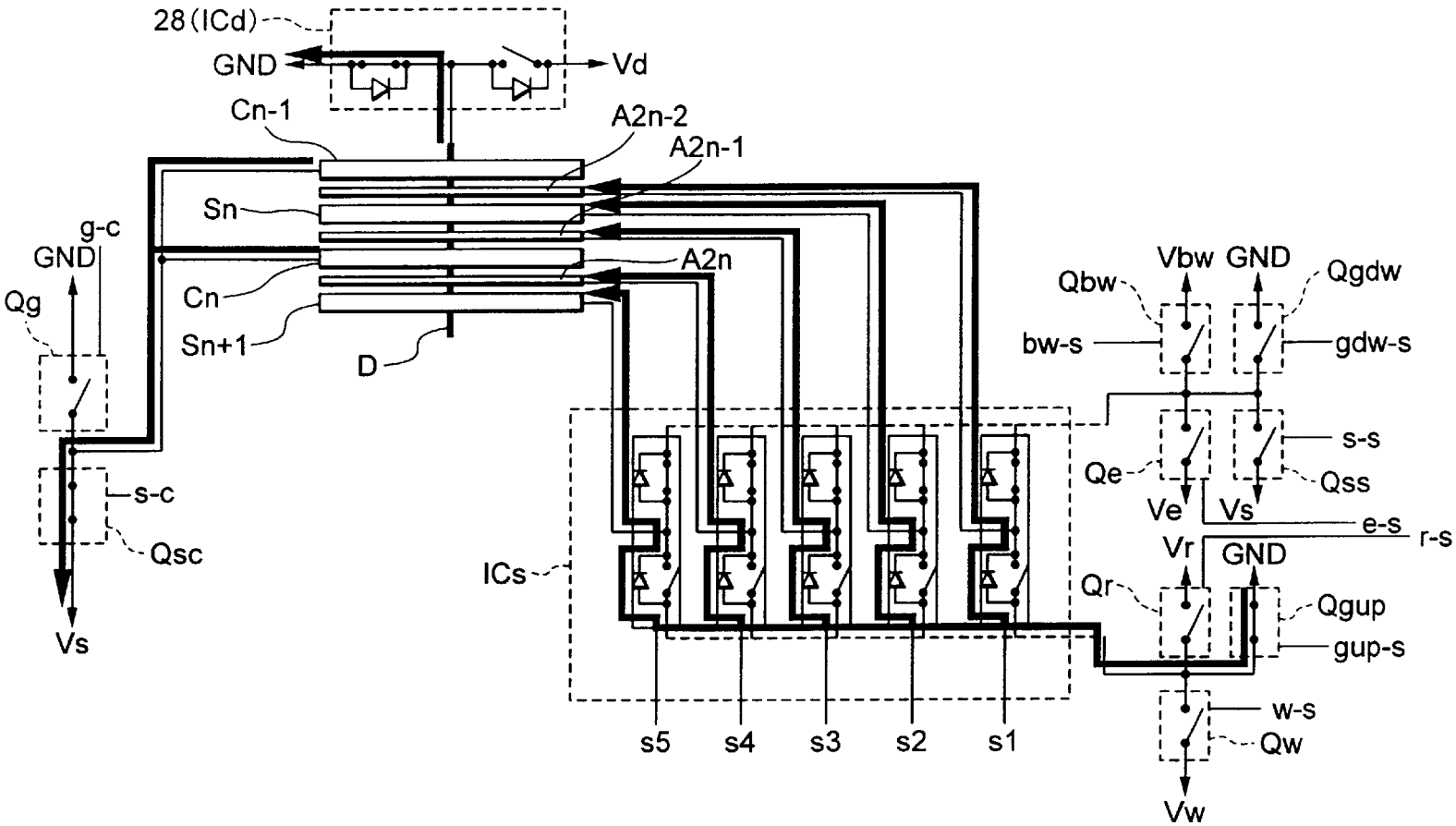
FIG. 35 is a schematic view depicting an operation of driving circuits in the period shown in FIG. 23.
Figure 47A:
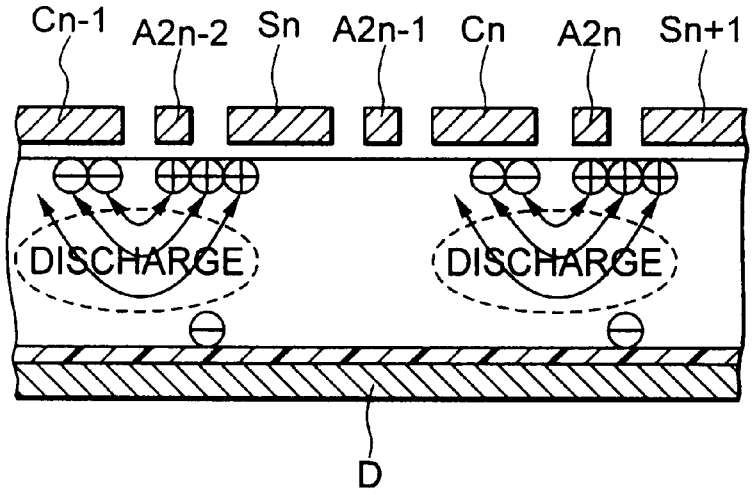
Figure 47B:
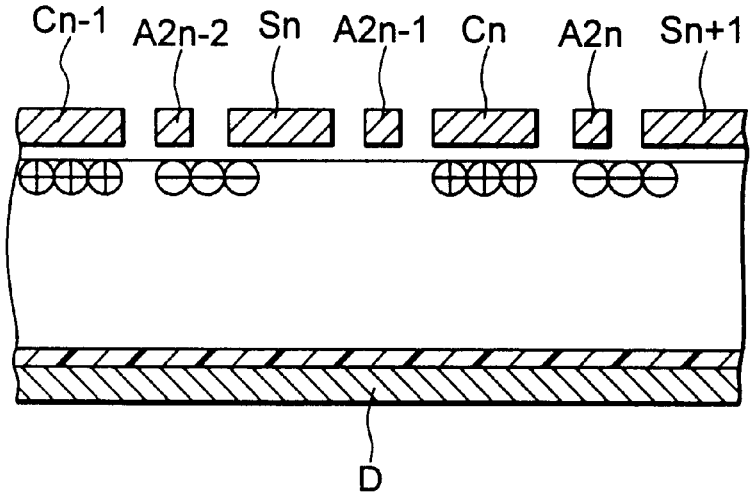
Figure 48A:
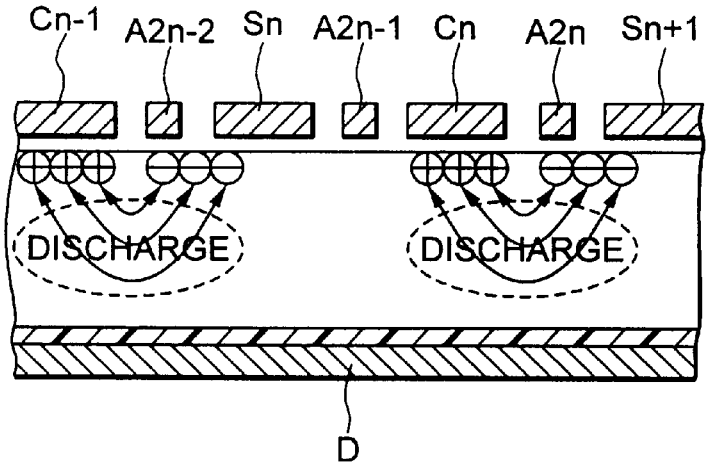
Figure 48B:
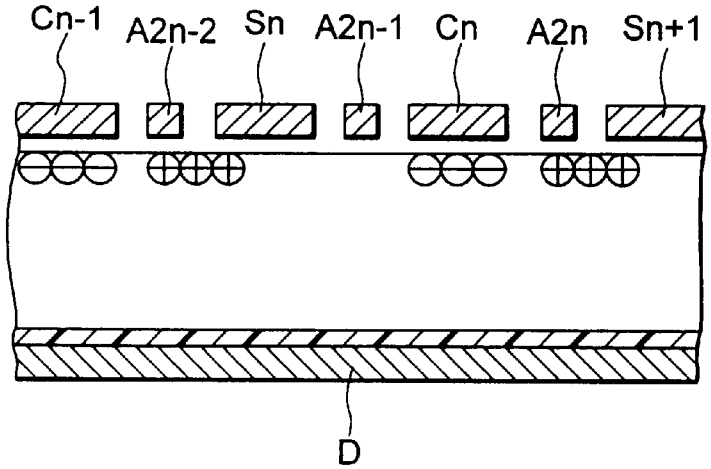

During a sustainment period 3-(f+1), as shown in FIG. 12 and FIG. 23, a negative polarity sustainment pulse Psus-c is first applied to the sustainment electrode C. At this time, in display cells selectively written during the addressing period 2-(f+1), the positive charge has been accumulated on each of the scan electrode S and auxiliary electrode A, and the negative charge has been accumulated on the sustainment electrode C. Thus, once the negative polarity sustainment pulse Psus-c is applied to the sustainment electrode C, this voltage is weighted on a voltage caused by the negative wall charge, and a potential difference between electrodes exceeds a minimum discharge voltage. Then, a discharge is generated, as shown in FIG. 47A. Once a discharge is generated, a wall charge is disposed so as to cancel the voltage applied to each electrode. Therefore, as shown in FIG. 47B, a positive charge is accumulated on the sustainment electrode C, and a negative charge is accumulated on each of the scan electrode S and auxiliary electrode A. During this period, as shown in FIG. 23 and FIG. 35, the signal "gup-s", which is inputted to the GND rise-up driver Qgup on the scan electrode and auxiliary electrode side, and the signal "s-c", which is inputted to the sustainment voltage driver Qsc on the sustainment electrode side, are set to high level, whereby the drivers Qgup and Qsc are turned ON, the scan electrode and auxiliary electrode are held at a GND voltage, and the sustainment pulse is applied to the sustainment electrode.

Figure 24:
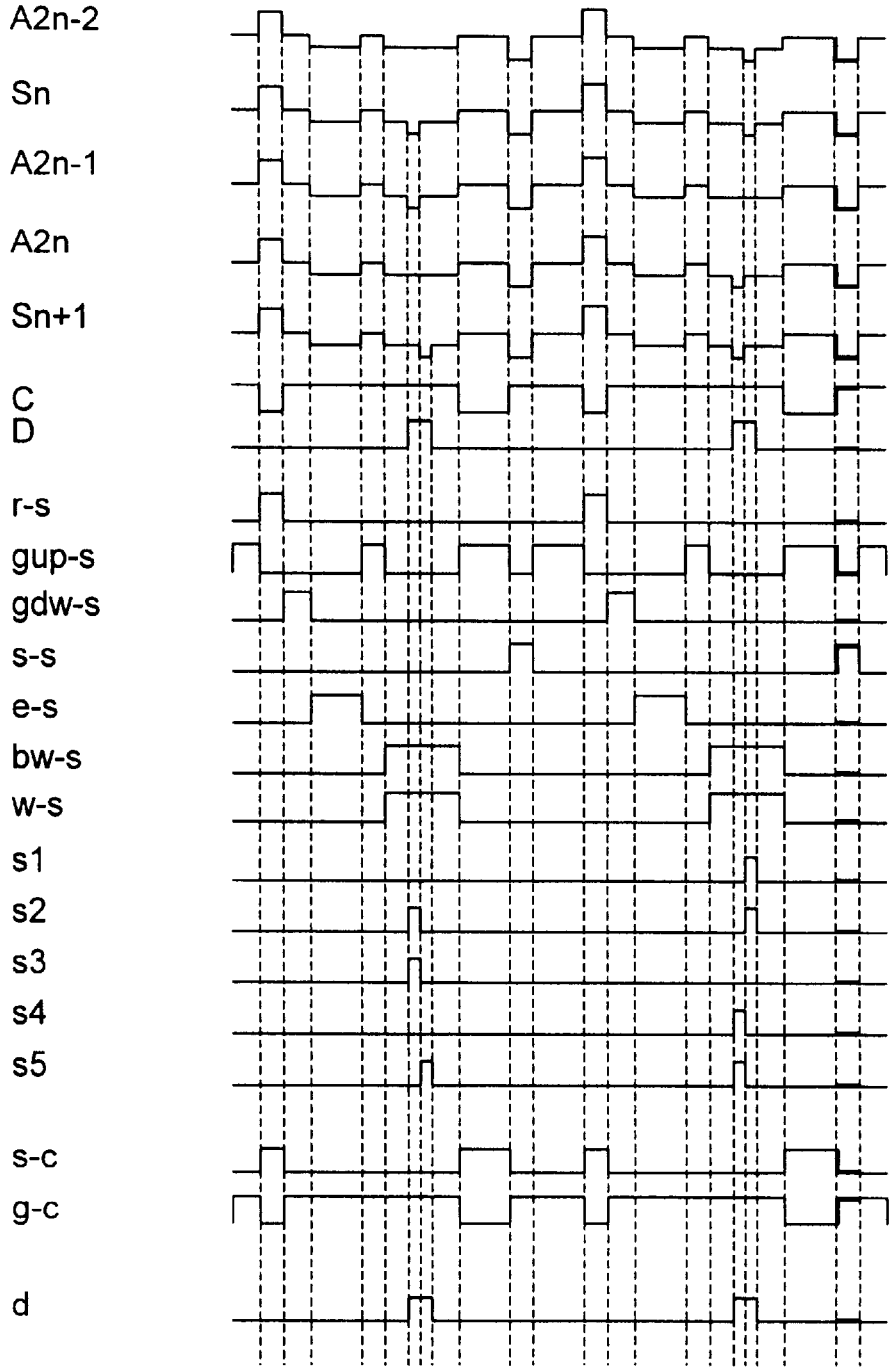
FIG. 24 is a timing chart specifying a next period to the period shown in FIG. 23 in the driving method of the first embodiment.
Figure 36:
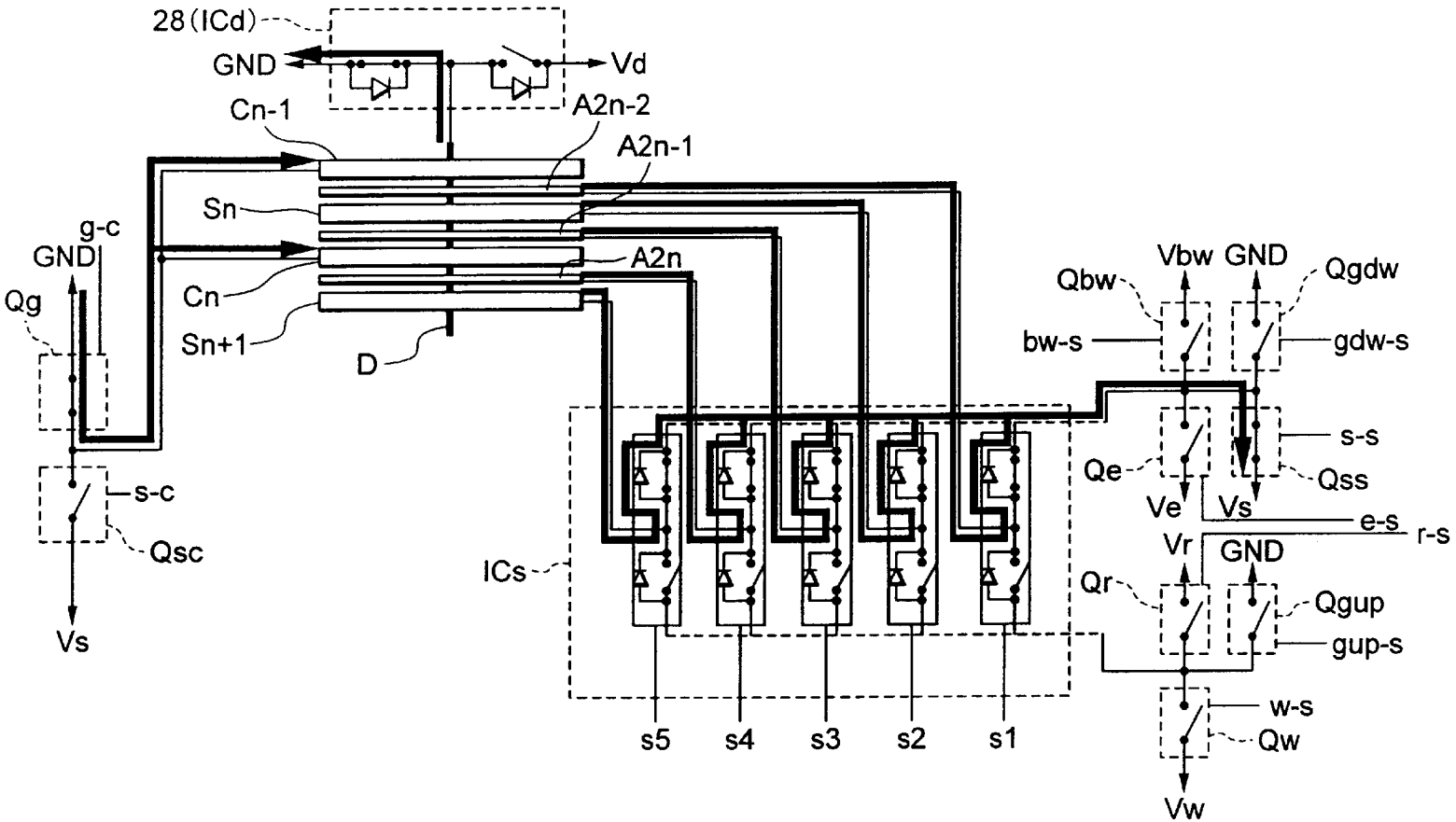
FIG. 36 is a schematic view depicting an operation of driving circuits in the period shown in FIG. 24.

Next, as shown in FIG. 12 and FIG. 24, negative polarity sustainment pulses Psus-s and Psus-A are applied respectively to the scan electrode S and the auxiliary electrode A. At this time, in display cells in which a discharge has been generated due to the application of the sustainment pulse Psus-c, the negative charge has been accumulated on each of the scan electrode S and auxiliary electrode A, and the positive charge has been accumulated on the sustainment electrode C. Thus, once a negative voltage pulse is applied to the scan electrode S and the auxiliary electrode A, a potential difference between the electrodes exceeds a minimum discharge voltage due to the weighting with the negative wall charge. As shown in FIG. 38A, a discharge is generated. Once a discharge is generated, a wall charge is disposed so as to cancel the voltage applied to each electrode. Therefore, as shown in FIG. 38B, a negative charge is accumulated on the sustainment electrode C, and a positive charge is accumulated on each of the scan electrode S and auxiliary electrode A. Then, during the sustainment period 3-(f+1), the sustainment pulses Psus-c, Psus-s, and Psus-A are repeatedly applied, whereby the light emission of selected display cells is sustained. During this period, as shown in FIG. 24 and FIG. 36, the signal "s—s", which is inputted to the sustainment voltage driver Qs on the scan electrode and auxiliary electrode side, and the signal "g-c", which is inputted to the GND driver Qg on the sustainment electrode side, are set to high level, whereby the drivers Qs and Qg are turned ON, the sustainment pulse is applied to each of the scan electrode and auxiliary electrode, and the sustainment electrode is held at a GND level.

Then, one sub-field of the frame "f+1" is configured in accordance with the steps in the periods 1-(f+1) to 3-(f+1), and this sub-field is repeatedly formed to configure the frame "f+1".

Figure 49:
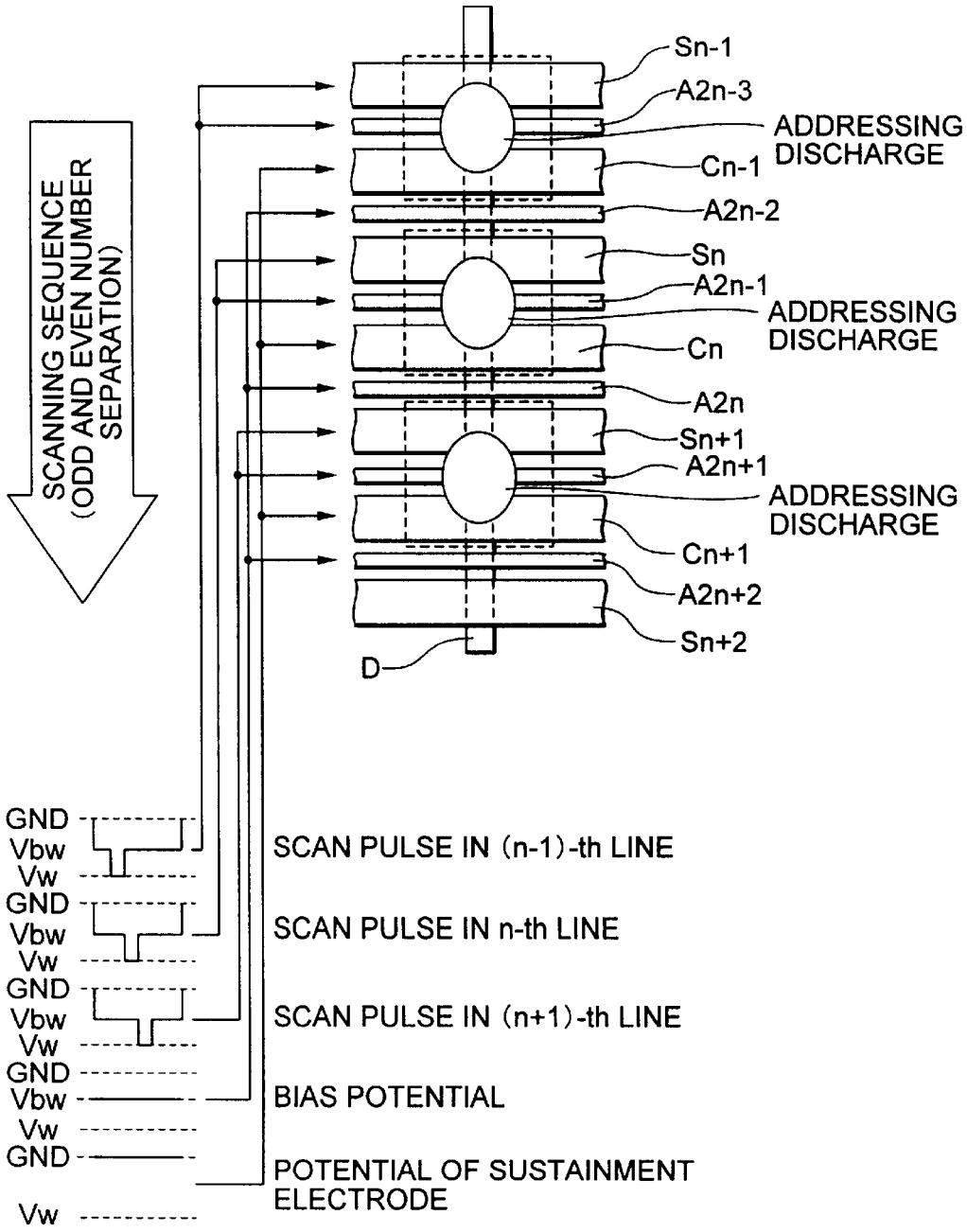
FIG. 49 is a schematic view illustrating a light emission portion during the scanning period in a frame "f" in the first embodiment.
Figure 50:
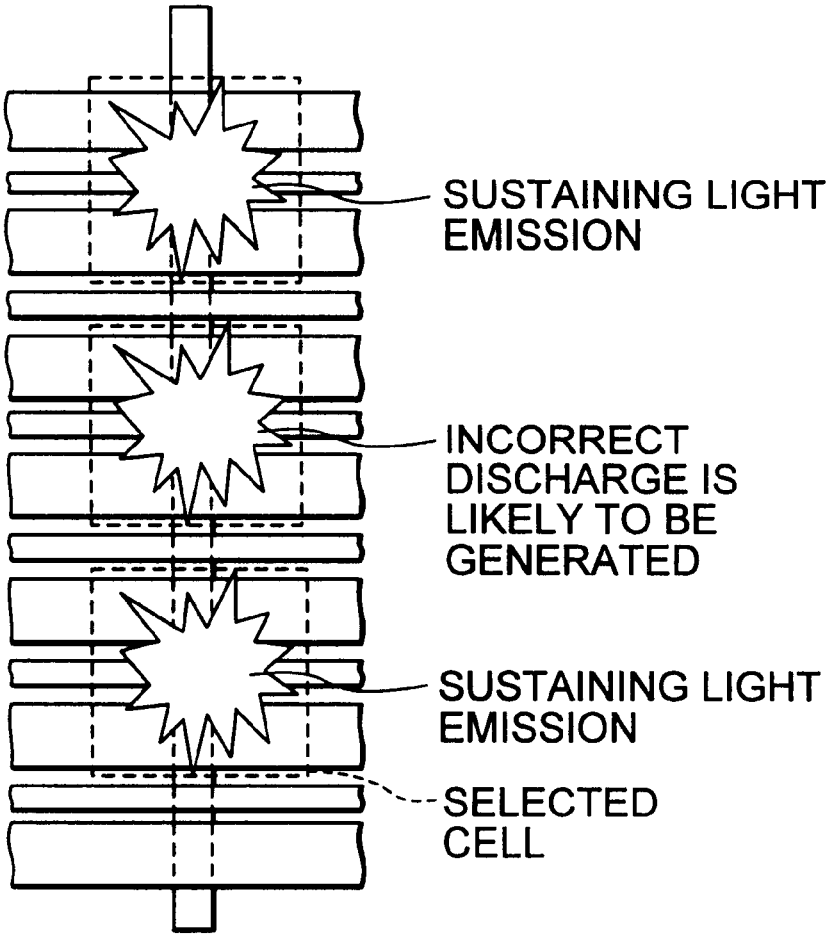
FIG. 50 is a schematic view illustrating a light emission portion during the sustainment period in a frame "f" in the first embodiment.
Figure 51:
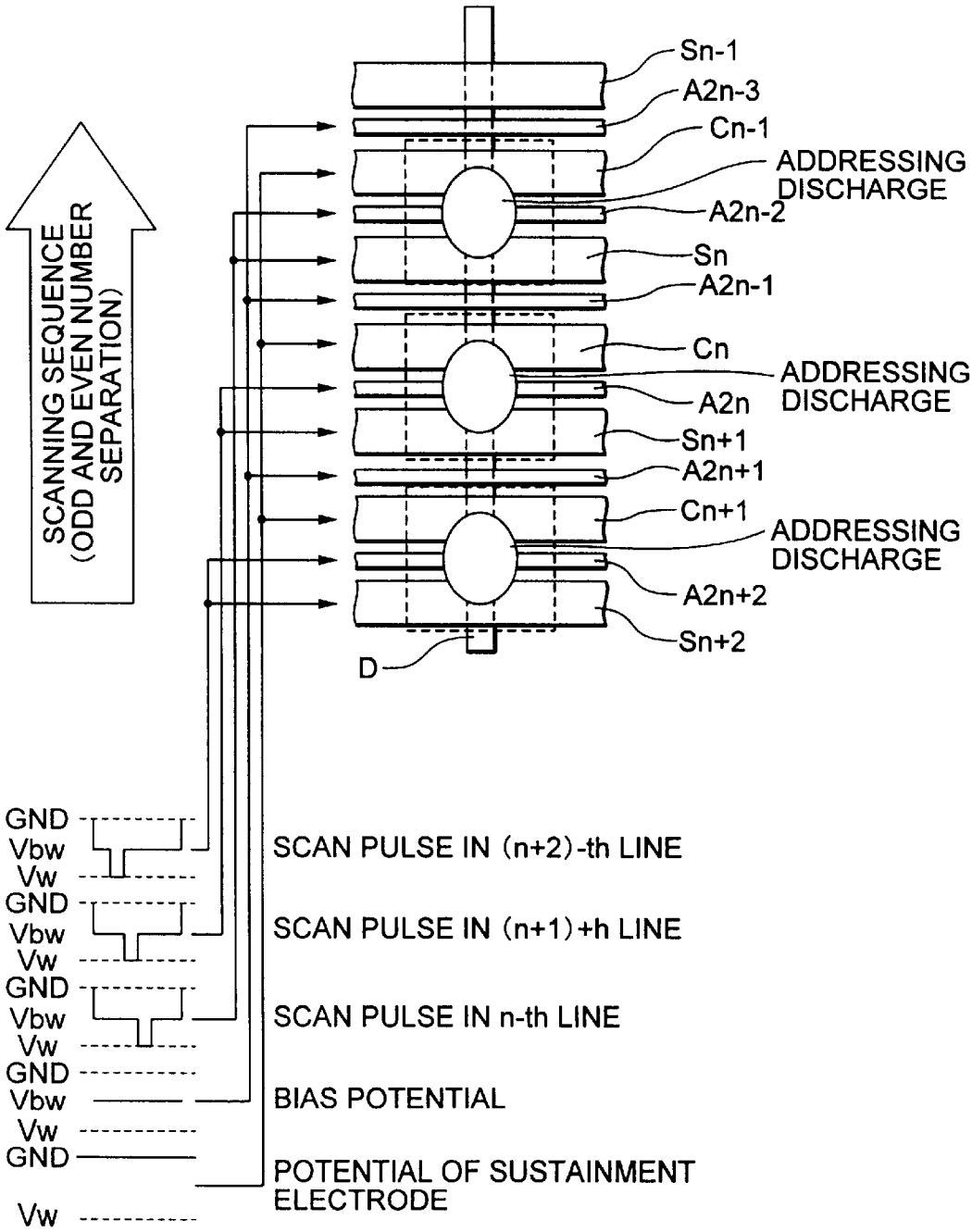
FIG. 51 is a schematic view illustrating a light emission portion during the scanning period in a frame "f+1" in the first embodiment.
Figure 52:
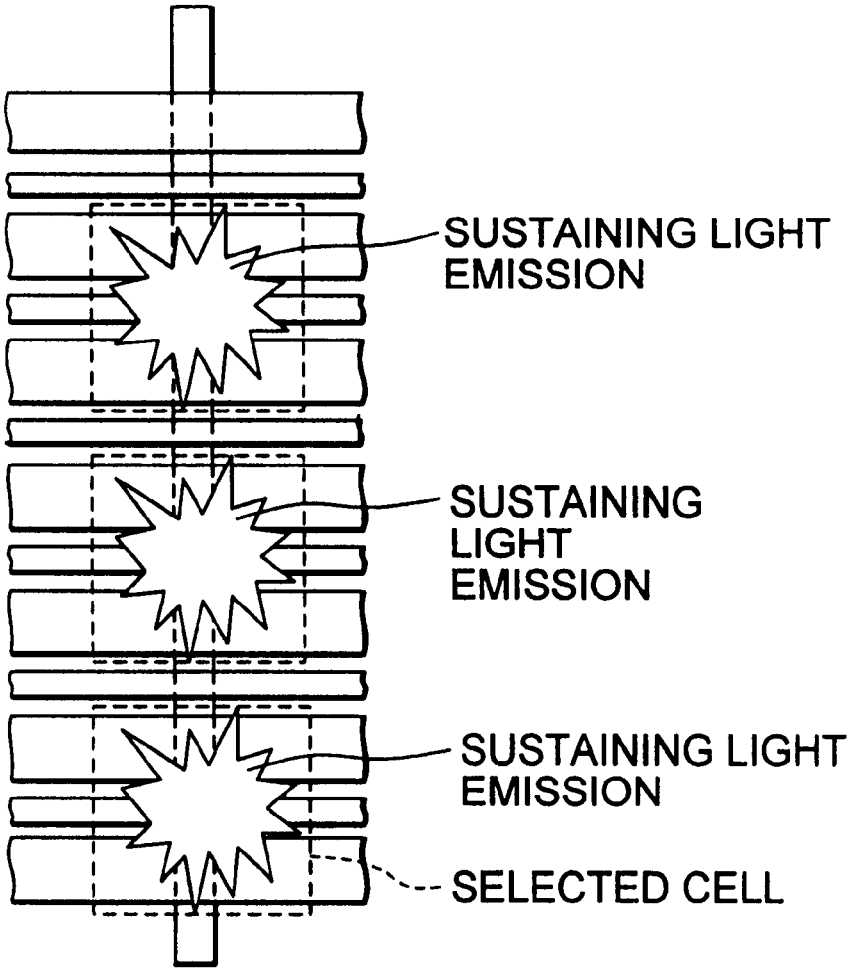
FIG. 52 is a schematic view illustrating a light emission portion during the sustainment period in a frame "f+1" in the first embodiment.
Figure 53:
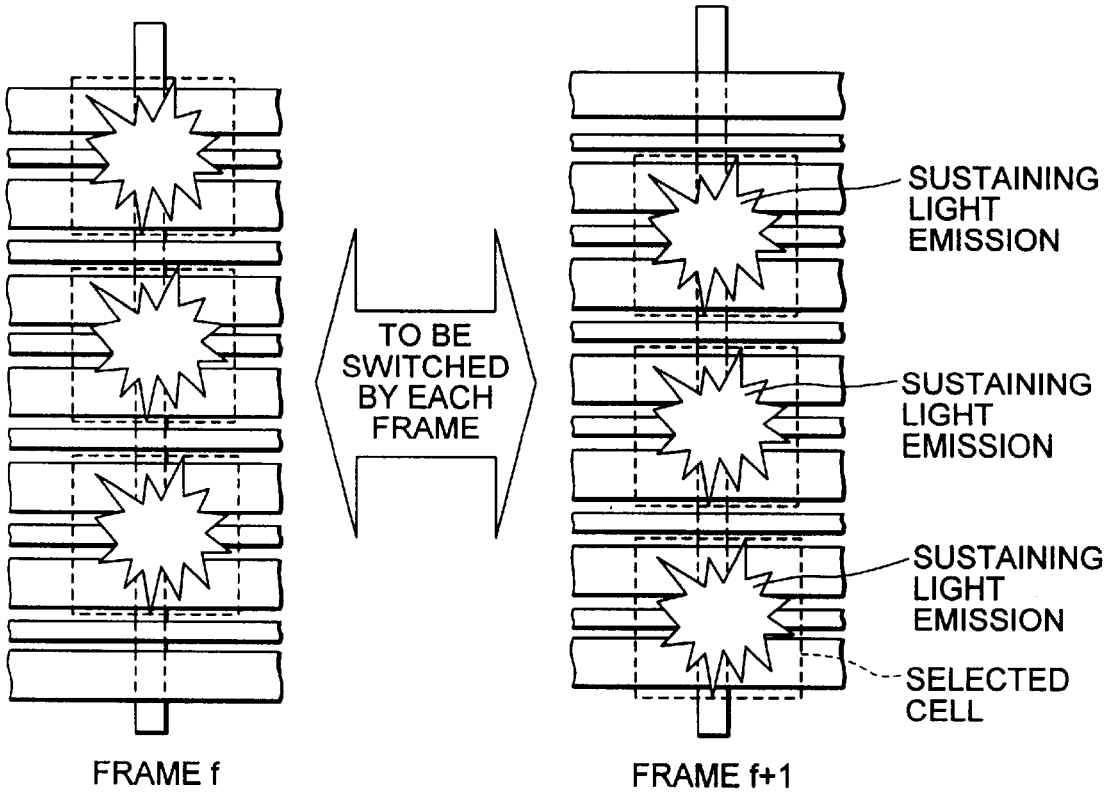
FIG. 53 is a schematic view showing transition of a light emission portion of sustainment light emission between the frame "f" and the frame "f+1"

In this way, in the driving method of the display according to the first embodiment, interlace display may be performed, as shown in FIG. 41, FIG. 42, FIG. 47 and FIG. 48, in which the light emission portions at the frames "f" and "f+1" differs depending on each frame. FIG. 49 is a schematic view illustrating a light emission portion during the scanning period in the frame "f". FIG. 50 is a schematic view illustrating a light emission portion during the sustainment period in the frame "f". FIG. 51 is a schematic view illustrating a light emission portion during the scanning period in the frame "f+1". FIG. 52 is a schematic view illustrating a light emission portion during the sustainment period in the frame "f+1". FIG. 53 is a schematic view illustrating transition of a sustainment light emission portion between the frames "f" and "f+1".

As shown in FIG. 39 and FIG. 41, the scanning direction is reversed depending on the frames "f" and "f+1". As shown in FIG. 39 to FIG. 43, portions at which addressing discharge and sustainment discharge occur are shifted depending on the frames "f" and "f+1". In this manner, in the present embodiment, the frames "f" and "f+1" are repeatedly displayed.

In this manner, in the first embodiment, an auxiliary electrode is provided between each scan electrode and each sustainment electrode. During the addressing period of the frame "f" the potential of the auxiliary electrode A2*n*-1, which is at the lower side of a selected scan electrode Sn, is equalized to that of the scan electrode Sn; the potential of the auxiliary electrode A2*n*-2, which is at the upper side of the scan electrode Sn, is held at a bias potential, which is intermediate of the scan electrode Sn and sustainment electrode Cn-1; and the sustainment electrode C is held at a GND level. On the other hand, during the addressing period of the frame "f+1", the potential of the auxiliary electrode A2*n*-2 is equalized to that of the scan electrode Sn; the potential of the auxiliary electrode A2*n*-1 is held at a bias potential, which is intermediate of the scan electrode Sn and sustainment electrode Cn; and the sustainment electrode C is held at a GND level. As a result, a portion at which an addressing discharge is generated can be switched by each frame. Therefore, interlace display can be performed.

Thus, in the first embodiment, a portion that does not contribute to light emission in the first prior art is also light emitted by each frame, a panel non-emission portion is eliminated from the aspect of human vision, and a high resolution display is obtained. In addition, the potential of an auxiliary electrode on which addressing selection is not performed is provided as a bias potential, which is intermediate of the scan electrode and sustainment electrode, thereby making it possible to restrict incorrect light emission at an electrode pair at which a sustainment discharge is not performed at that frame (for example, an electrode pair comprising a scan electrode Sn and auxiliary electrode A2*n*-2, and a scan electrode Cn-1 at the frame "f"). Thus, an operating voltage margin can be increased as compared with the second prior art.

In the driving method according to the first embodiment, although a reset pulse is generated as a rectangular wave, and a reset discharge is generated in a strong discharge form, such pulse may be generated as a saw tooth shaped wave or a round wave, and the reset discharge may be generated in a weak discharge form. In addition, the wave for resetting and erasing may be in a saw tooth shape wave or round wave as well as rectangular wave. Further, a sustainment-erasing period may be provided after the sustainment period, whereby the sustainment erasing pulse may be added to each electrode during this period.

Figure 54:
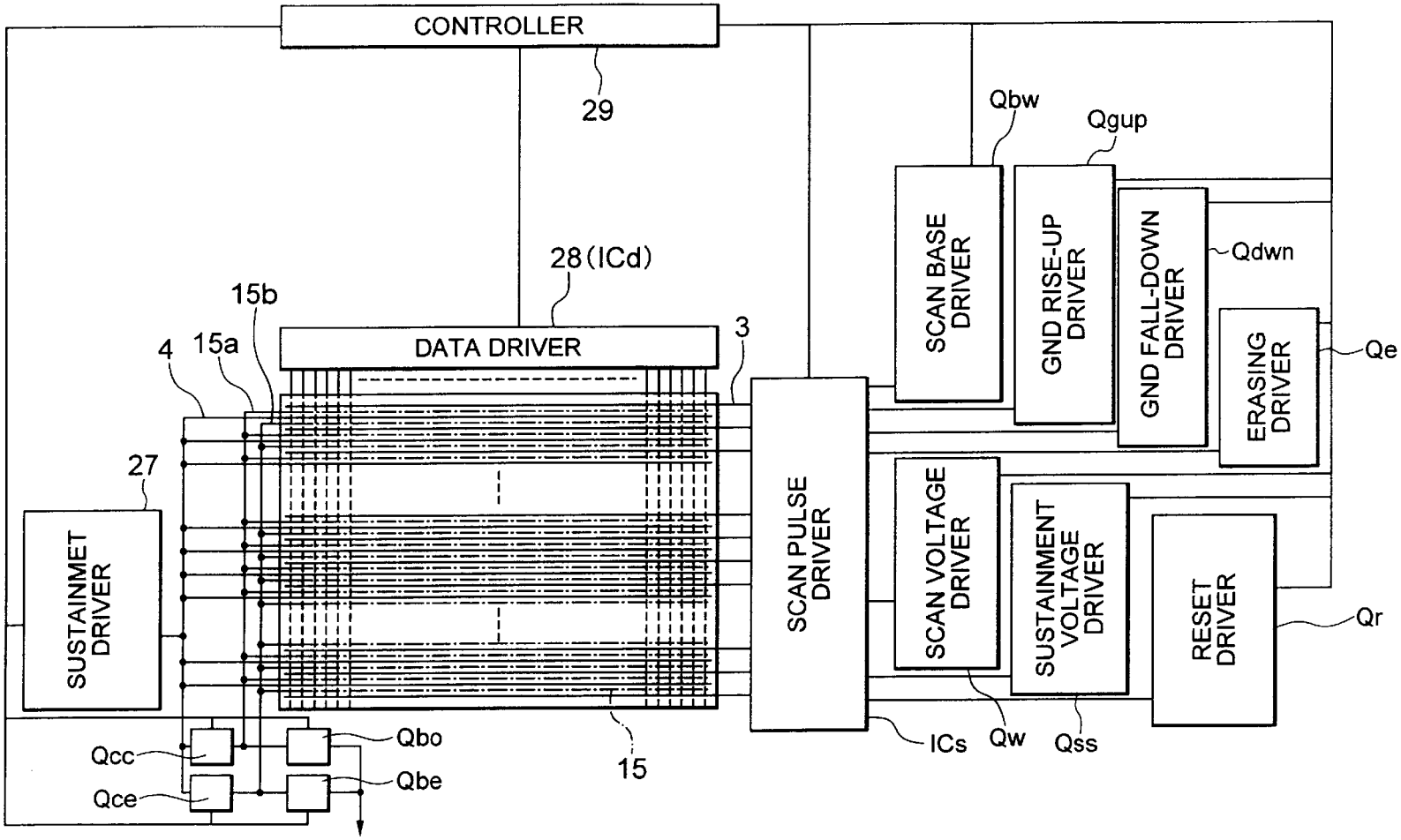
FIG. 54 is a block diagram showing driving circuits in an AC type plasma display according to a second embodiment of the present invention.
Figure 55A:
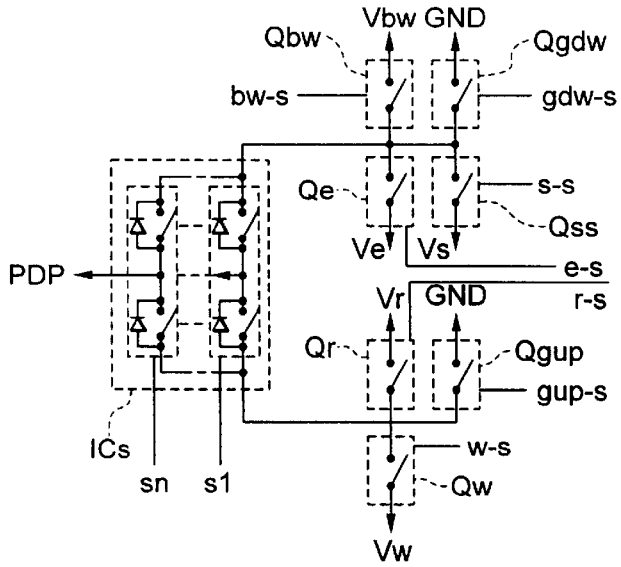
FIG. 55A is a circuit diagram depicting driving circuits on a scan electrode 3 side in the second embodiment.
Figure 55B:
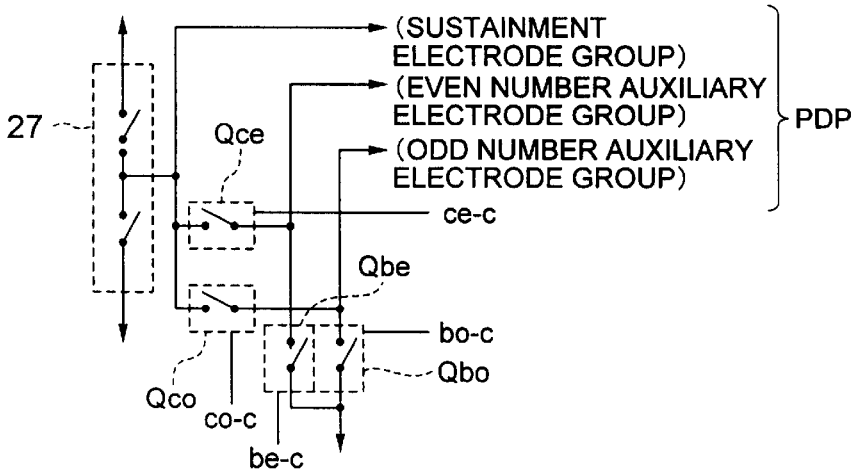
FIG. 55B is a circuit diagram depicting driving circuits on a sustainment electrode 4 and auxiliary electrode 15 side in the second embodiment.

A second embodiment of the present invention will be described hereinafter. The second embodiment is similar to the first embodiment in configuration of display cells, but is different in configuration of driving circuits. FIG. 54 is a block diagram depicting driving circuits in an AC type plasma display according to the second embodiment of the present invention. In addition, FIG. 55A is a circuit diagram depicting driving circuits on the scan electrode 3 side; FIG. 55B is a circuit diagram depicting driving circuits on the sustainment electrode 4 and auxiliary electrode 15 side; and FIG. 55C is a circuit diagram depicting a data driver 28.

In the second embodiment, the scan electrode 3 and the sustainment electrode 4 are connected to the scan pulse driver ICs and the sustainment driver 27 respectively, as in the first embodiment. On the other hand, the auxiliary electrodes 15 are divided into odd numbers and even numbers, and connected in common on a glass substrate, for example. In this manner, an odd number auxiliary electrode group 15*a* and an even number auxiliary electrode group 15*b* are configured. In addition, unlike the first embodiment, the removal portion of each of the odd number and even number auxiliary electrode groups 15*a* and 15*b* is provided on the sustainment electrode 4 side. An odd number bias driver Qbo for holding an odd number auxiliary electrode group 15*a* at a bias potential is provided between the odd number auxiliary electrode group 15*a* and a ground. An even number bias driver Qbe for holding the even number auxiliary electrode group 15*b* at a bias potential is provided between the even number auxiliary electrode group 15*b* and a ground. In addition, an odd number connection driver Qco is connected between the odd number auxiliary electrode group 15*a* and the sustainment electrodes 4 connected in common, and an even number connection driver Qce is connected between the even number auxiliary electrode group 15*b* and the sustainment electrodes 4 connected in common. Further, control signals of these include: a control signal "bo-c" for the odd number bias driver Qbo; a control signal "be-c" for the even number bias driver Qbe; a control signal "co-c" for the odd number connection driver Qco; and a control signal "ce-c" for the even number connection driver Qce.

Figure 55C:
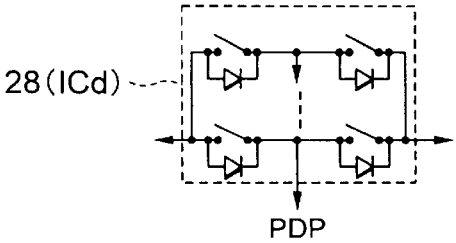
FIG. 55C is a circuit diagram depicting a data driver 28 in the second embodiment.

In FIG. 55A to FIG. 55C, although drivers are represented using switches, these drivers may be composed of elements represented by a bipolar transistor or FET as well as physical switch.

Figure 56:
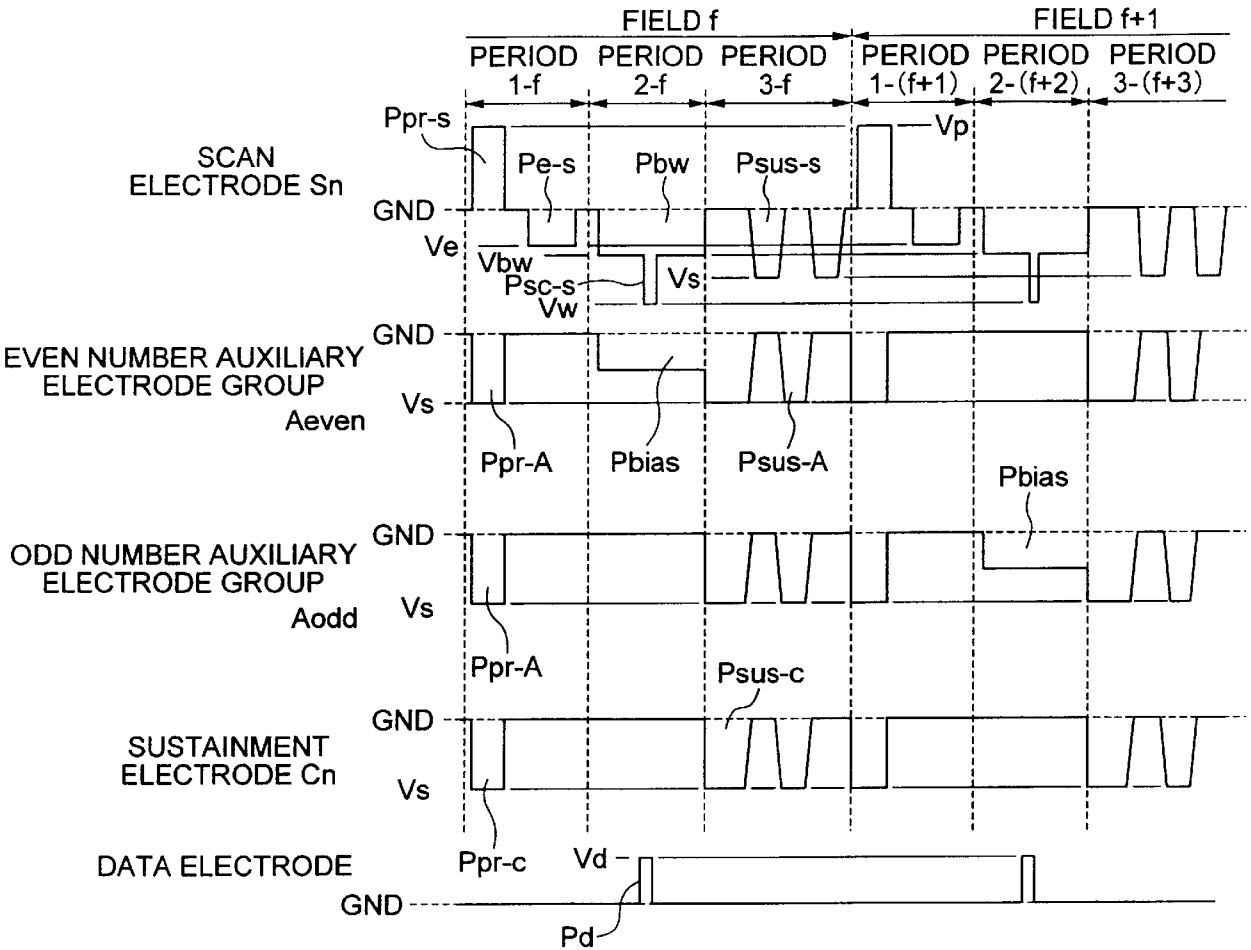
FIG. 56 is a timing chart depicting a driving method of the AC type plasma display according to the second embodiment.

An operation of a second embodiment will be described hereinafter. FIG. 56 is a timing chart illustrating a driving method of an AC type plasma display according to the second embodiment. FIG. 57 to FIG. 68 are timing charts each specifying each period; and FIG. 69 to FIG. 80 are schematic views each depicting an operation of the driving circuits at each period. In addition, FIG. 81 to FIG. 92 are views each showing movement of the charge at each period, wherein FIG. 81A to FIG. 92A are schematic views each showing a distribution in charges during discharge; and FIG. 81B to FIG. 92B are schematic views each showing a distribution of charges after discharge. In the timing chart shown in each of FIG. 57 to FIG. 68, a portion shown in thick line corresponds to a corresponding timing (drive period).

In the driving method, during an addressing period of a sub-field that configure a frame "f", the potential of an odd number auxiliary electrode group Aodd is held at a bias potential, and the potential of an even number auxiliary electrode group Aeven is held at a potential equal to that of the sustainment electrode group. On the other hand, during the addressing period of each sub-field for the frame "f+1", the potential of the even number auxiliary electrode group Aeven is held at the bias potential, and the potential of an odd number auxiliary electrode group Aodd is held at the potential equal to that of the sustainment electrode group. During the other period, the potential waveform of each auxiliary electrode group is equalized to that of the sustainment electrode C.

Figure 57:
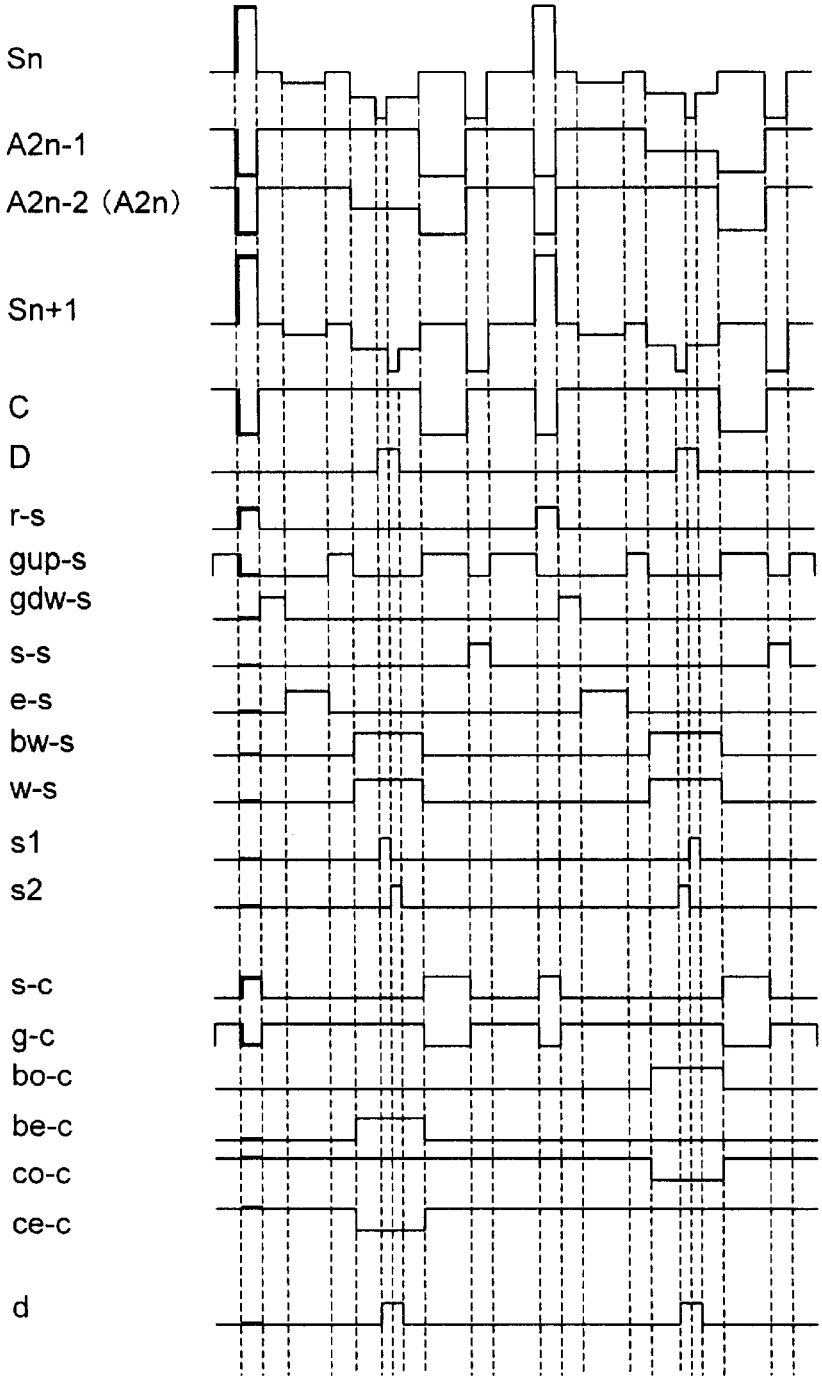
FIG. 57 is a timing chart specifying a period in the driving method of the second embodiment.
Figure 69:
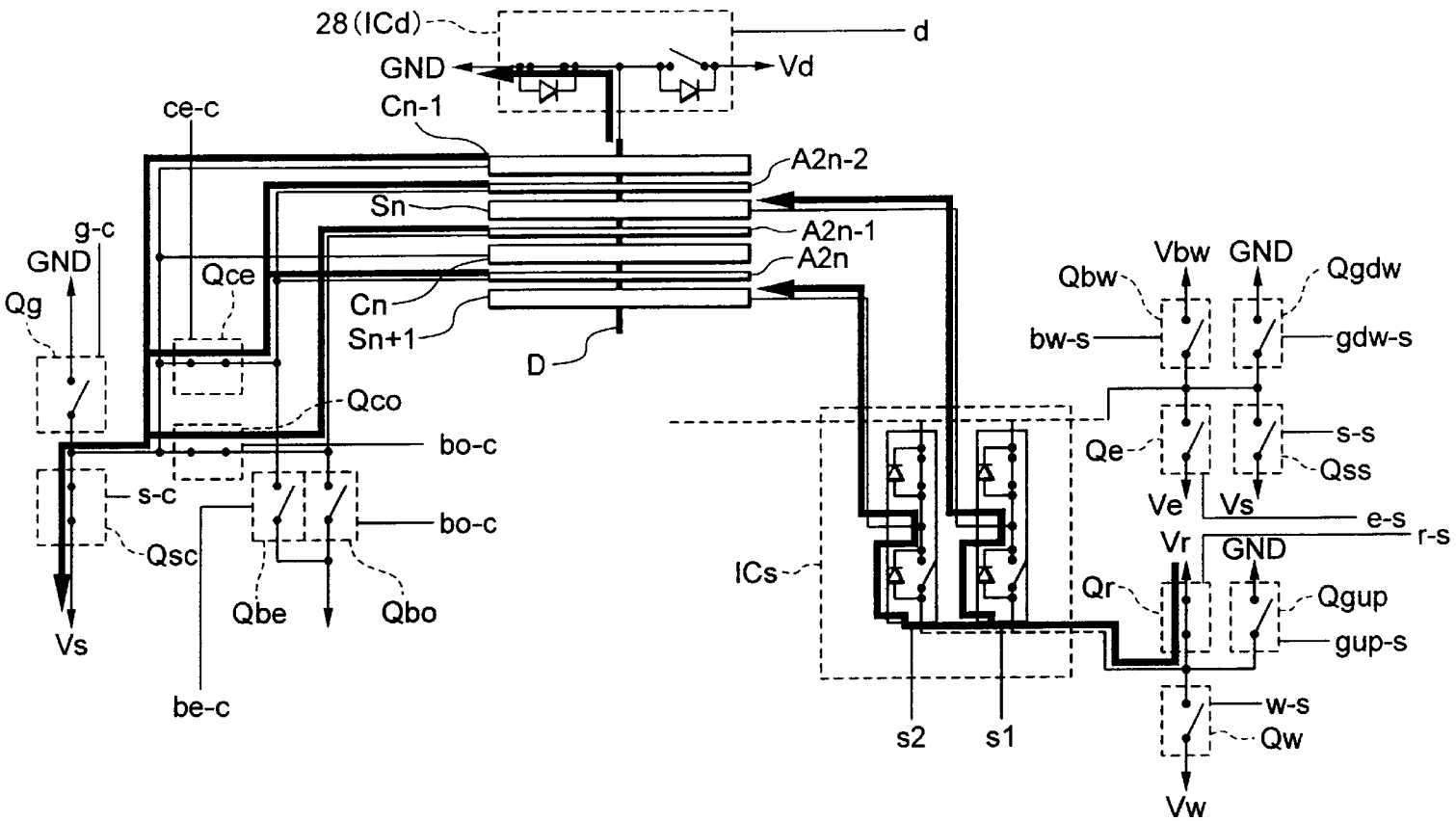
FIG. 69 is a schematic view depicting an operation of driving circuits in the period shown in FIG. 57.
Figure 81A:
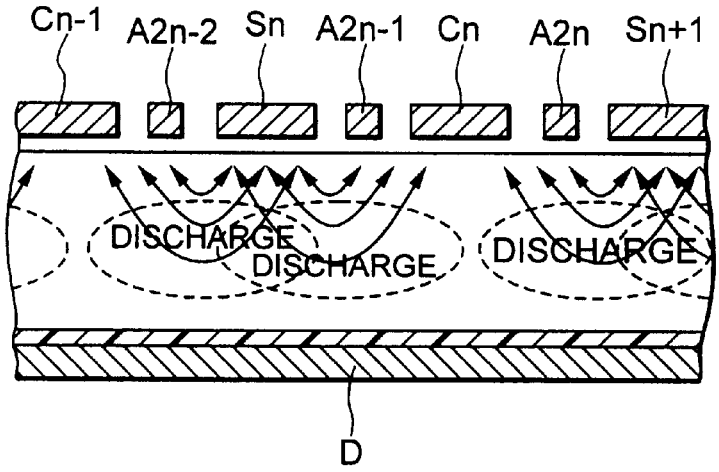
Figure 81B:
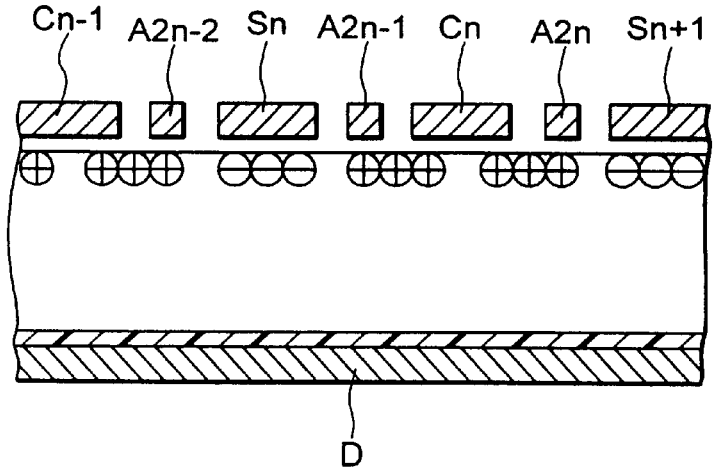

During a reset period "1-f", as shown in FIG. 56 and FIG. 57, reset pulses Ppr-s, Ppr-A and Ppr-c are first applied respectively to the entireties of the scan electrode S, auxiliary electrode A and sustainment electrode C. The reset pulse Ppr-s is positive in polarity, and the reset pulses Ppr-A and Ppr-c are negative in polarity. Due to these reset pulses, as shown in FIG. 81A, a reset discharge is generated between the adjacent scan electrode S and sustainment electrode C. Then, a space charge generated by reset discharge is accumulated as a negative polarity wall charge on the scan electrode S and accumulated as a positive polarity wall charge on each of the sustainment electrode C and auxiliary electrode A, as shown in FIG. 81B, so as to cancel the voltage applied to each electrode. During this period, as shown in FIG. 57 and FIG. 69, the signal "r-s", which is inputted to the reset driver Qr on the scan electrode side, and the signal "s-c", which is inputted to the sustainment voltage driver Qsc on the sustainment electrode and auxiliary electrode side, set to high level, whereby the drivers Qr and Qsc are turned ON, and the reset pulse are applied to each of the scan electrode, auxiliary electrode, and sustainment electrode.

Figure 58:
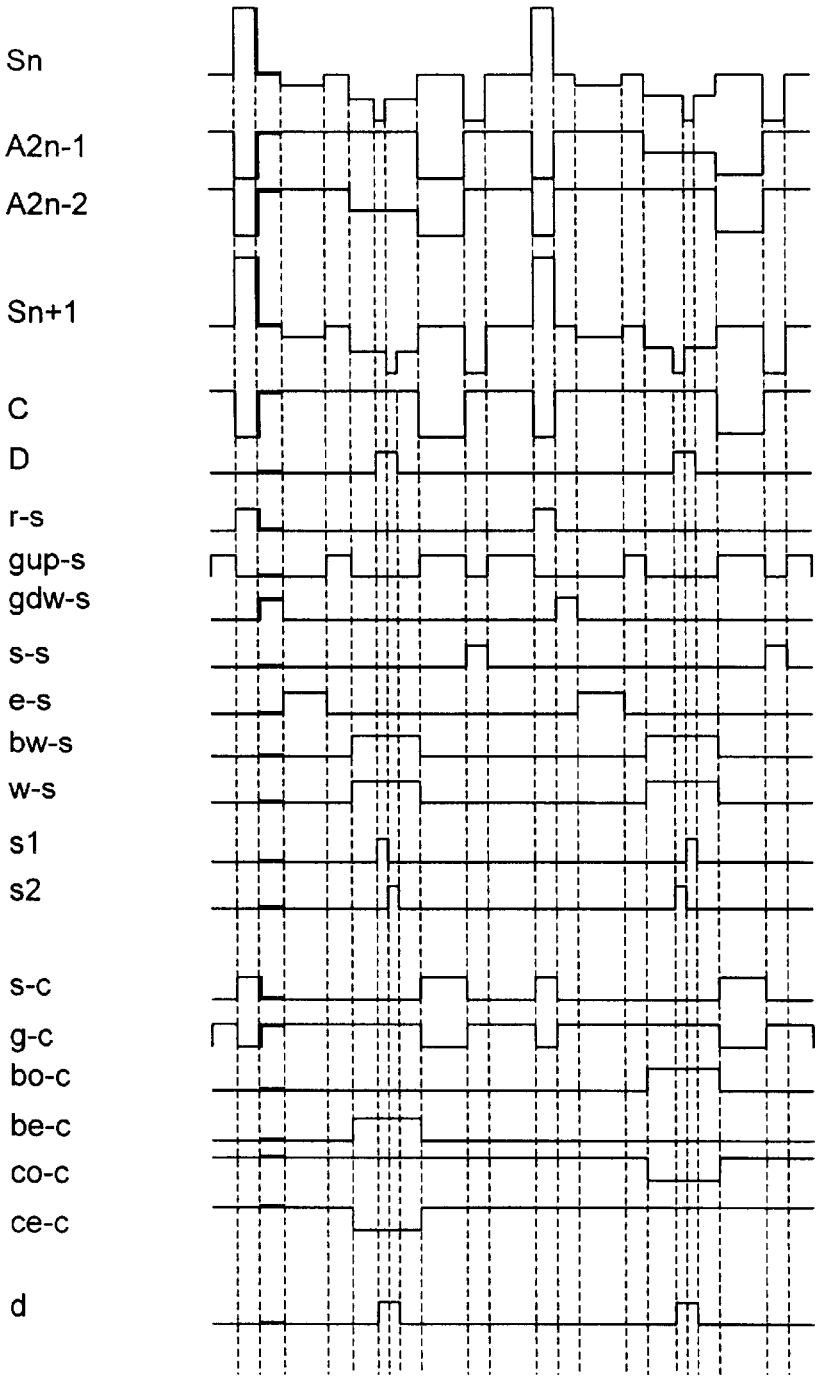
FIG. 58 is a timing chart specifying a next period to the period shown in FIG. 57 in the driving method of the second embodiment.
Figure 70:
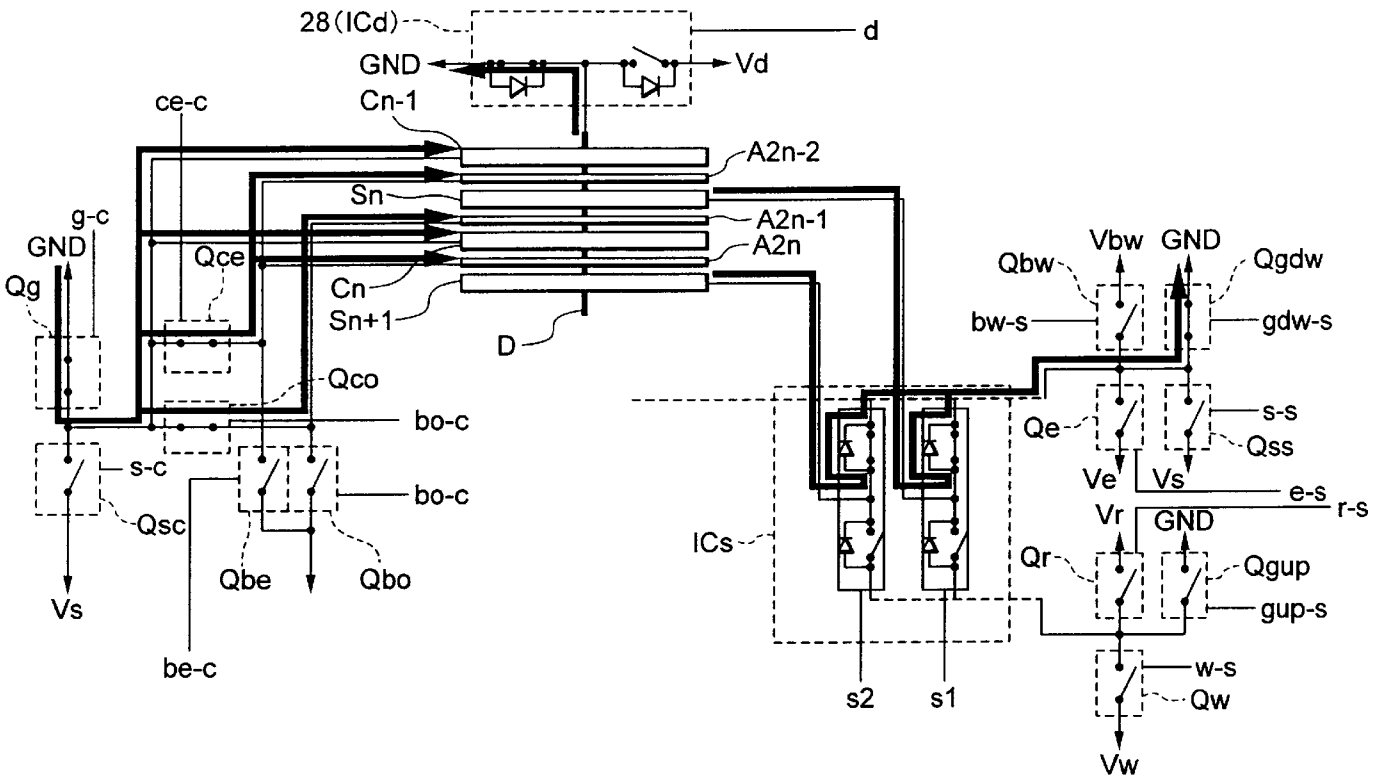
FIG. 70 is a schematic view depicting an operation of driving circuits in the period shown in FIG. 58.
Figure 82A:
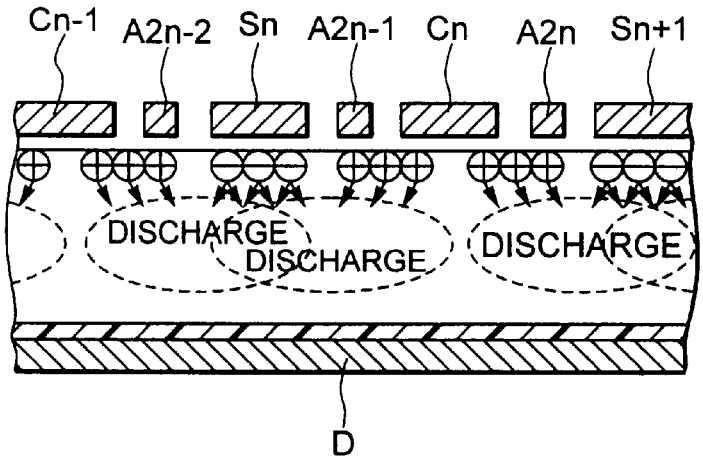
Figure 82B:
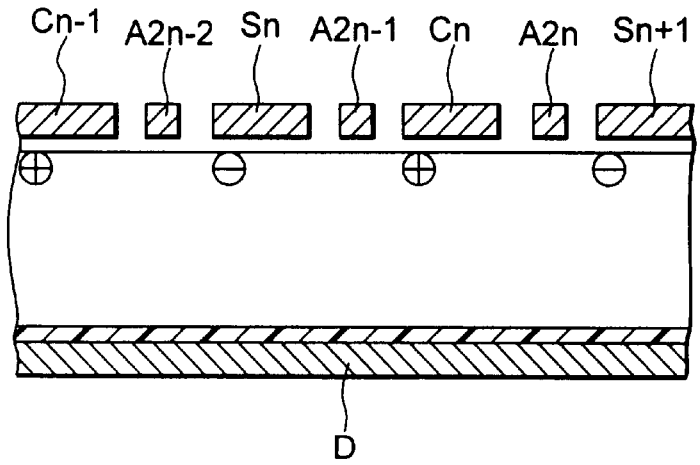

Then, as shown in FIG. 56 and FIG. 58, when the reset pulses are fallen down, a potential difference due to the accumulated wall charge exceeds a discharge start voltage. As shown in FIG. 82A, a self-erasing discharge is generated. As a result, as shown in FIG. 82B, almost of the wall charge is eliminated due to the self-erasing discharge. During this period, as shown in FIG. 58 and FIG. 70, the signal "gdw-s", which is inputted to the GND fall-down driver Qdwn on the scan electrode side, and the signal "g-c", which is inputted to the GND driver Qg on the sustainment electrode and auxiliary electrode side, are set to high level, whereby the drivers Qdwn and Qg are turned ON, and the scan electrode, auxiliary electrode, and sustainment electrode are held at a GND potential.

Figure 59:
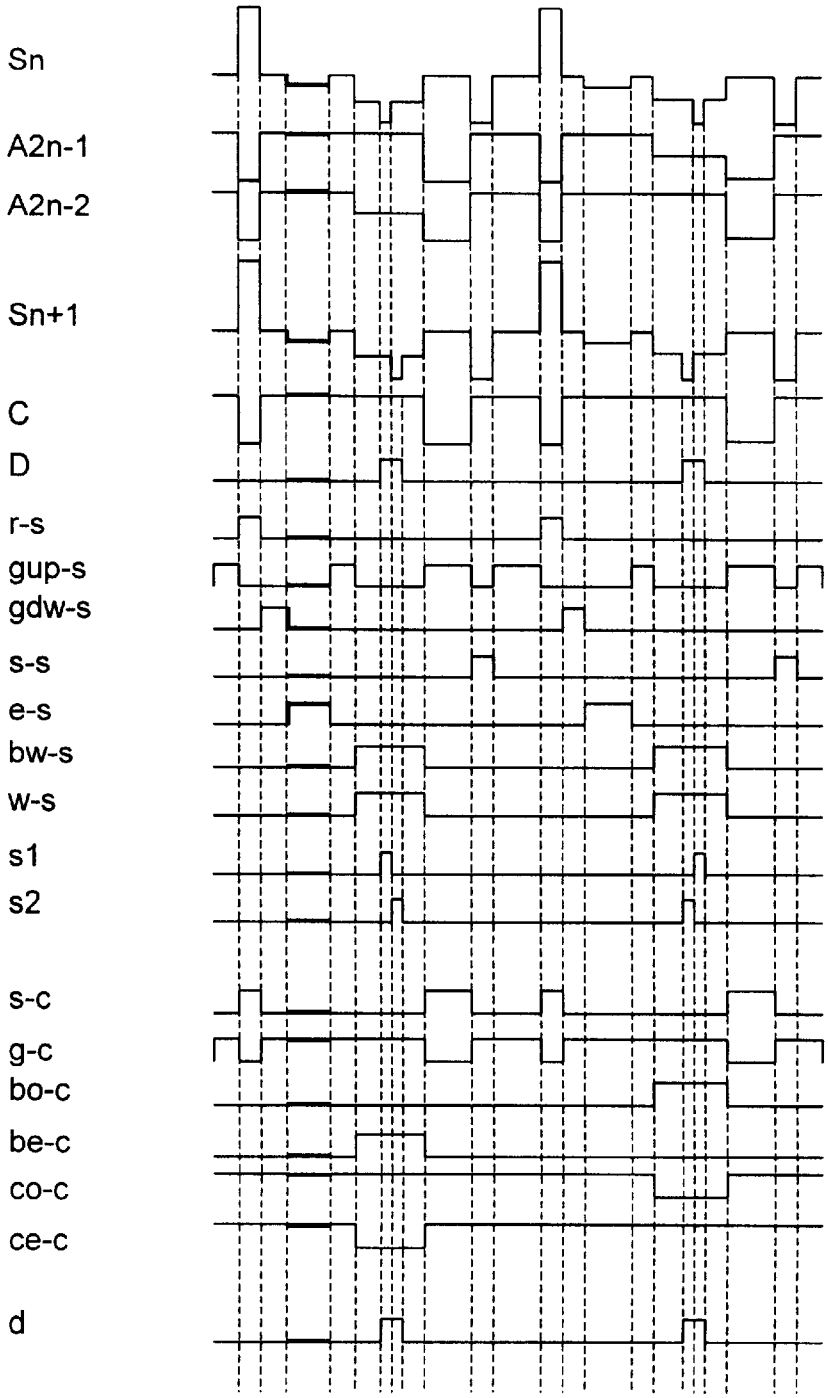
FIG. 59 is a timing chart specifying a next period to the period shown in FIG. 58 in the driving method of the second embodiment.
Figure 71:
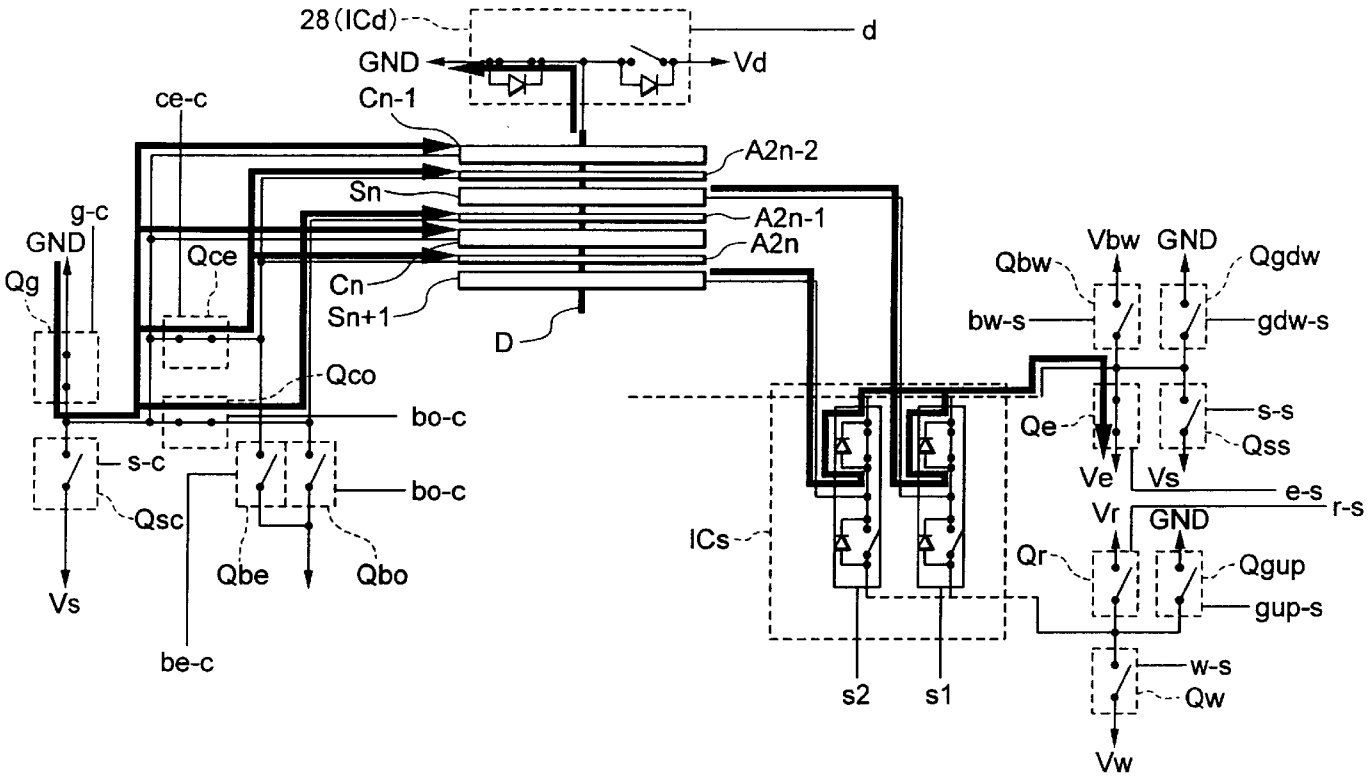
FIG. 71 is a schematic view depicting an operation of driving circuits in the period shown in FIG. 59.
Figure 83A:
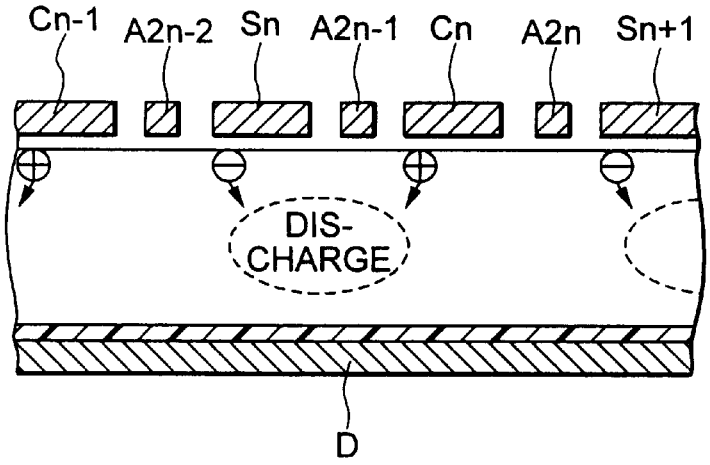
Figure 83B:
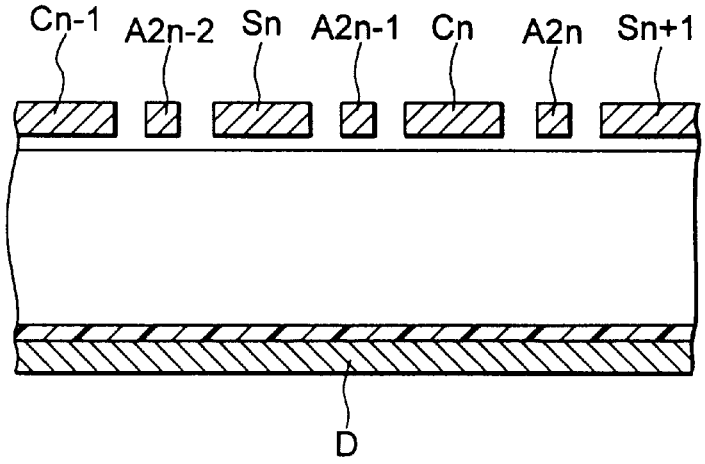

Further, as shown in FIG. 56 and FIG. 59, an erasing pulse Pe-s is applied to the entirety of the scan electrode S. As a result, as shown in FIG. 83A, a weak discharge occurs. As shown in FIG. 83B, a wall charge that has not been erased by the self-erasing discharge is completely erased. During this period, as shown in FIG. 59 and FIG. 71, the signal "e-s", which is inputted to the erasing driver Qe on the scan electrode side, is set to high level, whereby the driver Qe is turned ON, and the erasing pulse is applied to the scan electrode.

Figure 60:
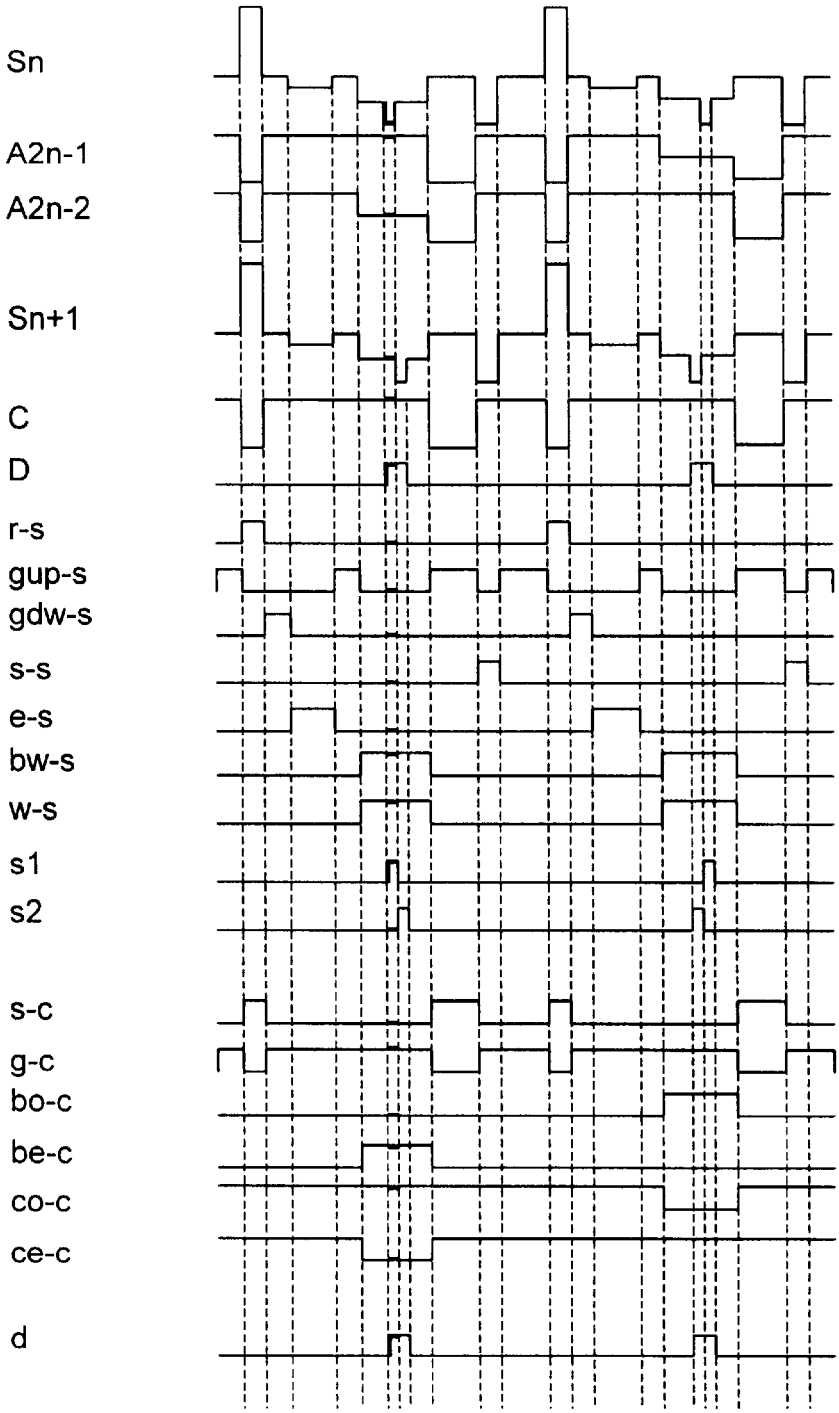
FIG. 60 is a timing chart specifying a next period to the period shown in FIG. 59 in the driving method of the second embodiment.

During an addressing period "2-f", as shown in FIG. 56 and FIG. 60, the entirety of the sustainment electrode C is held at a GND level, and the odd number auxiliary electrode group Aodd is held at a bias potential by means of the odd number bias driver Qbo.

Figure 84A:
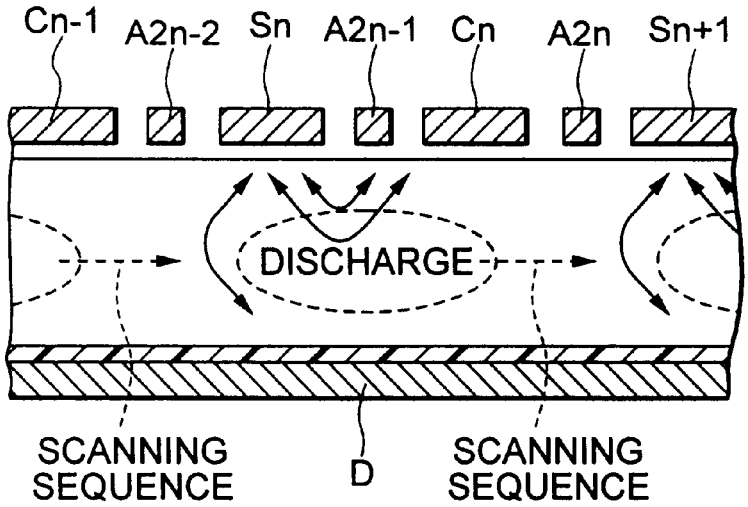
Figure 84B:
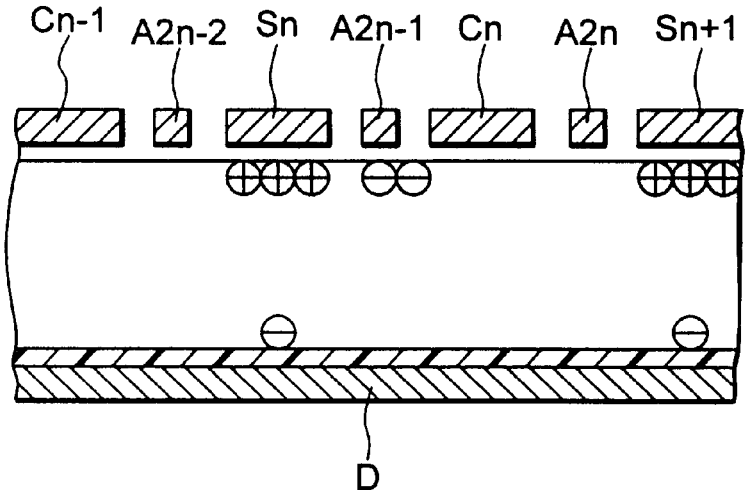

In addition, a negative polarity scan pulse Psc-s is applied to a scan electrode Sn in a row in which writing is performed, and the potential of the even number auxiliary electrode group Aeven is set at a GND level, which is equal to that of the sustainment electrode C by means of the even number connection driver Qce. As a result, as shown in FIG. 84A, an opposite discharge is generated between each of the scan electrode Sn and auxiliary electrode A2*n*-1, and the data electrode D in selected display cells. With this discharge being a trigger, a planar discharge is generated between the sustainment electrode Cn and the auxiliary electrode A2*n*-1, and further, a writing discharge is generated between the sustainment electrode Cn and the scan electrode Sn. Thus, as shown in FIG. 84B, a positive charge is accumulated on the scan electrode Sn, and a negative charge is accumulated on the auxiliary electrode A2*n*-1 and on the side of the auxiliary electrode A2*n*-1 in the sustainment electrode Cn.

Figure 72:
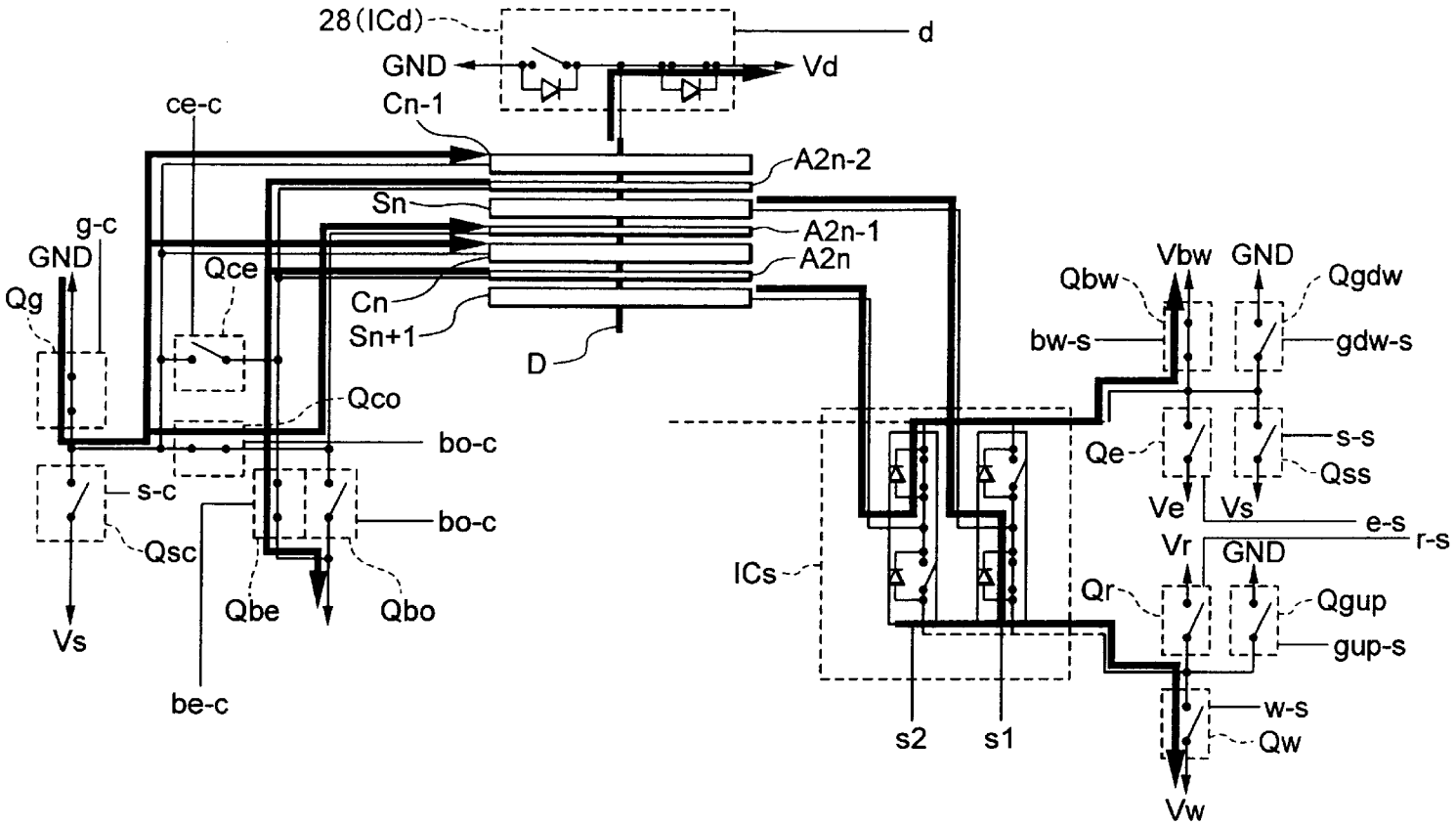
FIG. 72 is a schematic view depicting an operation of driving circuits in the period shown in FIG. 60.

During this period, as shown in FIG. 60 and FIG. 72, the signals "bw-s" and "w-s", which are inputted to the scan base driver Qbw and the scan voltage driver Qw respectively, are set to high level, whereby the drivers Qbw and Qw are turned ON. In addition, driver signal S1 for the scan pulse driver ICs connected to the selected scan electrode Sn is set to high level, whereby the fall-down side switch of the driver S1 is turned ON. Thus, the scan pulse is applied only to the selected scan electrode Sn and auxiliary electrode A2*n*-1, and the scan base pulse is applied to the other scan electrode and auxiliary electrode.

Figure 61:
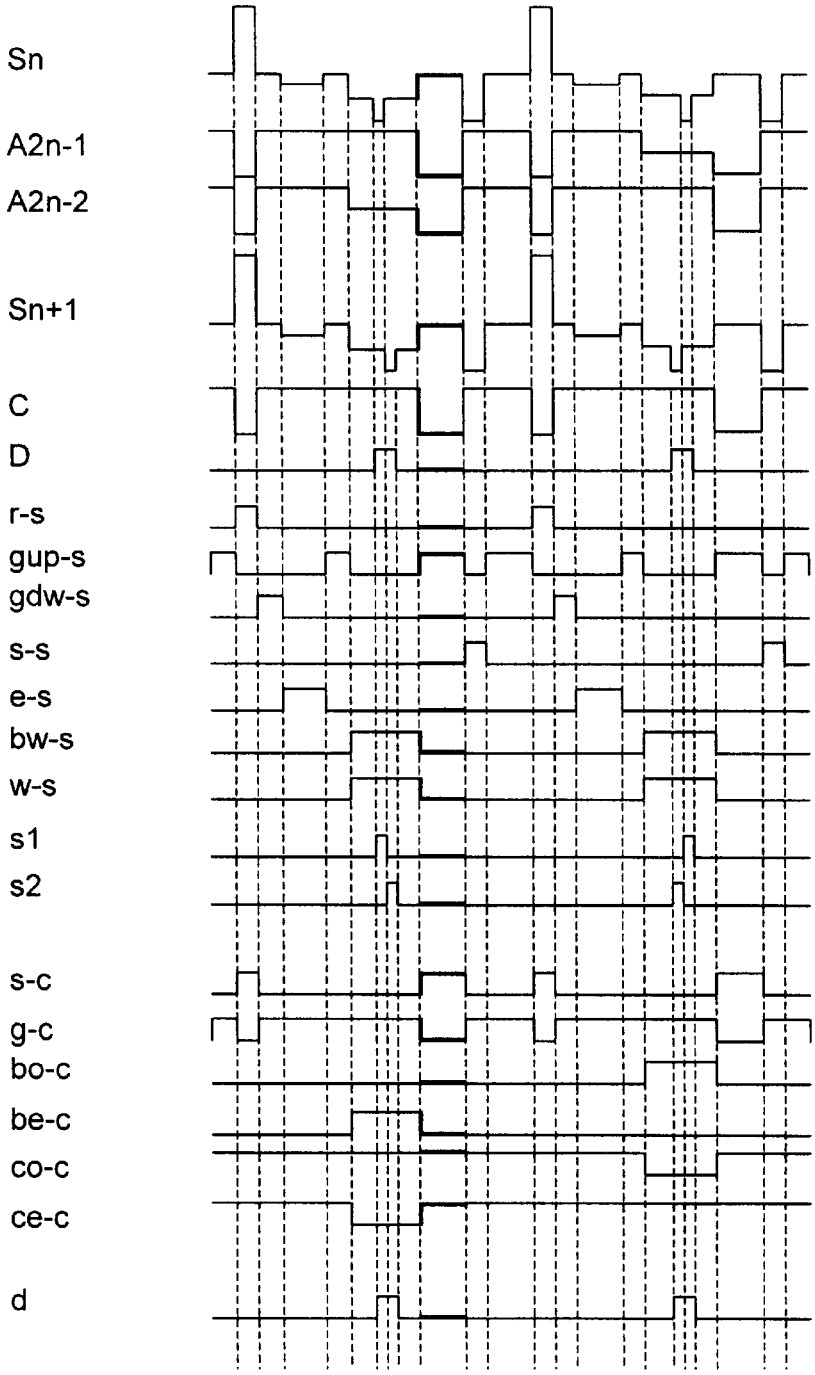
FIG. 61 is a timing chart specifying a next period to the period shown in FIG. 60 in the driving method of the second embodiment.
Figure 73:
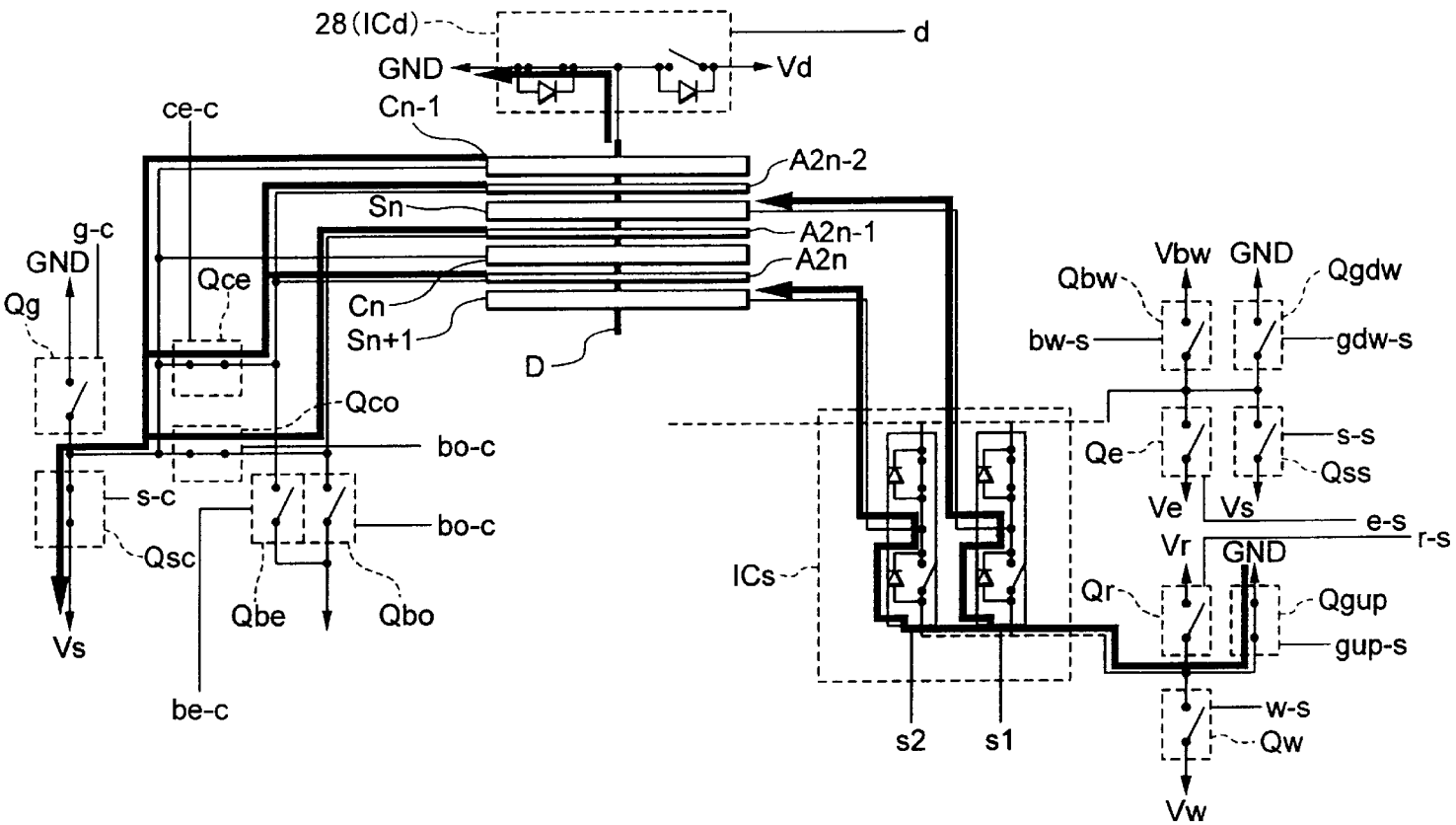
FIG. 73 is a schematic view depicting an operation of driving circuits in the period shown in FIG. 61.
Figure 85A:
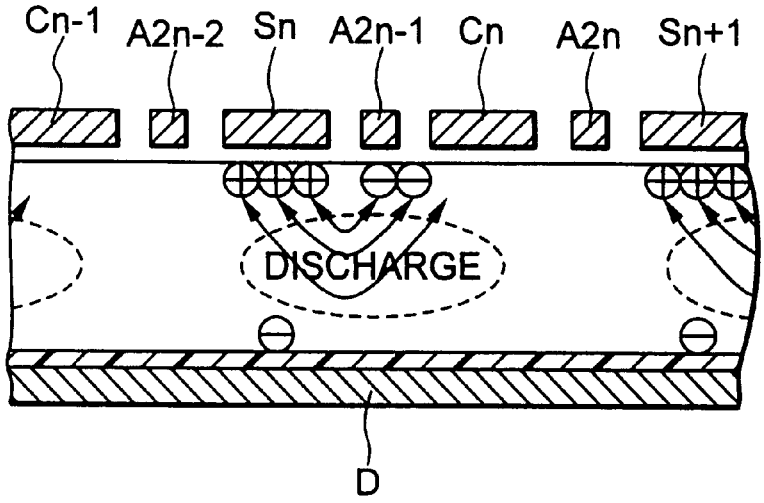
Figure 85B:
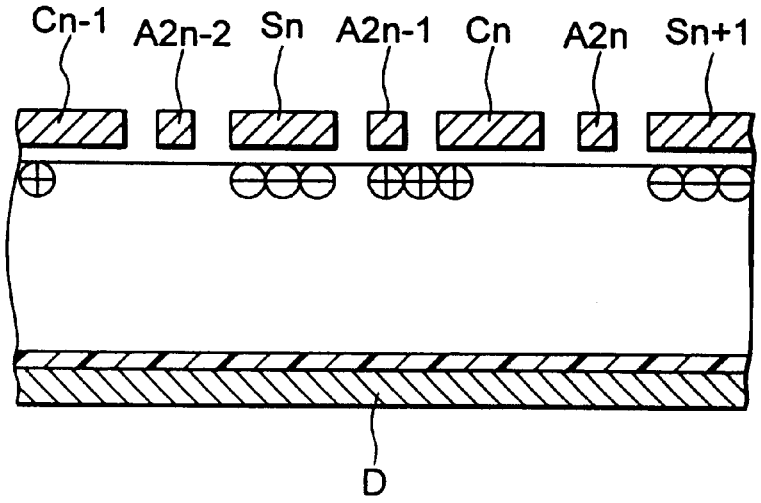

During a sustainment period "3-f", as shown in FIG. 56 and FIG. 61, negative polarity sustainment pulses Psus-c and Psus-A are first applied to the sustainment electrode C and the auxiliary electrode A respectively. At this time, in display cells selectively written during the addressing period "2-f", the positive charge has been accumulated on the scan electrode S, and the negative charge has been accumulated on the odd number auxiliary electrode and the odd number auxiliary electrode side of the sustainment electrode C. Thus, once a sustainment pulse is applied, a potential difference between electrodes exceeds a minimum discharge voltage. As shown in FIG. 85A, a discharge is generated. Once a discharge is generated, a wall charge is disposed so as to cancel the voltage applied to each electrode. Therefore, as shown in FIG. 85B, a positive charge is accumulated on each of the sustainment electrode C and auxiliary electrode A, and a negative charge is accumulated on the scan electrode S. During this period, as shown in FIG. 61 and FIG. 73, the signal "gup-s", which is inputted to the GND rise-up driver Qgup on the scan electrode side, and the signal "s-c", which is inputted to the sustainment voltage driver Qsc on the sustainment electrode and auxiliary electrode side, are set to high level, whereby the drivers Qgup and Qsc are turned ON, the scan electrode are held at a GND voltage, and the sustainment pulse is applied to each of the sustainment electrode and auxiliary electrode.

Figure 62:
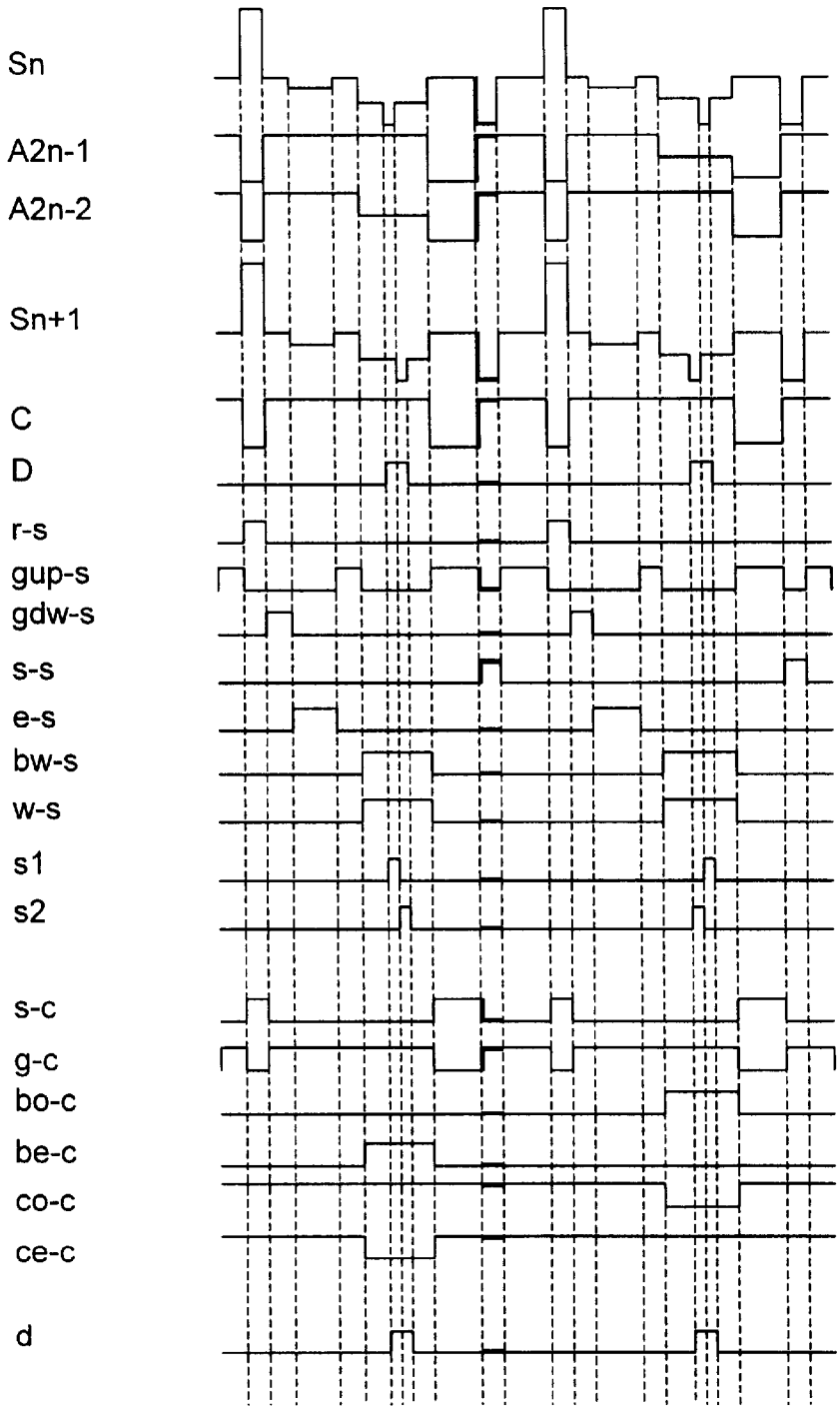
FIG. 62 is a timing chart specifying a next period to the period shown in FIG. 61 in the driving method of the second embodiment.
Figure 74:
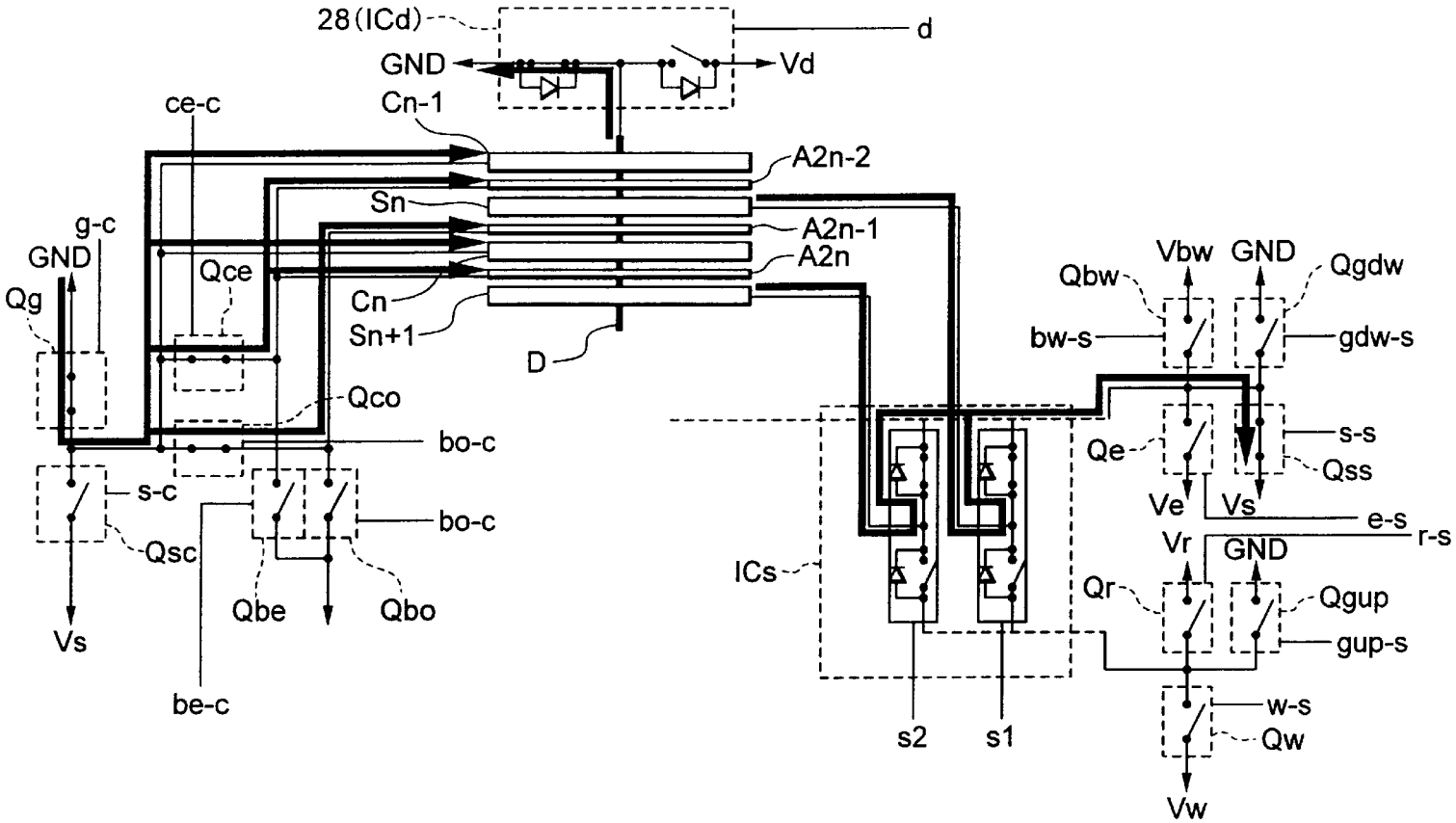
FIG. 74 is a schematic view depicting an operation of driving circuits in the period shown in FIG. 62.
Figure 86A:
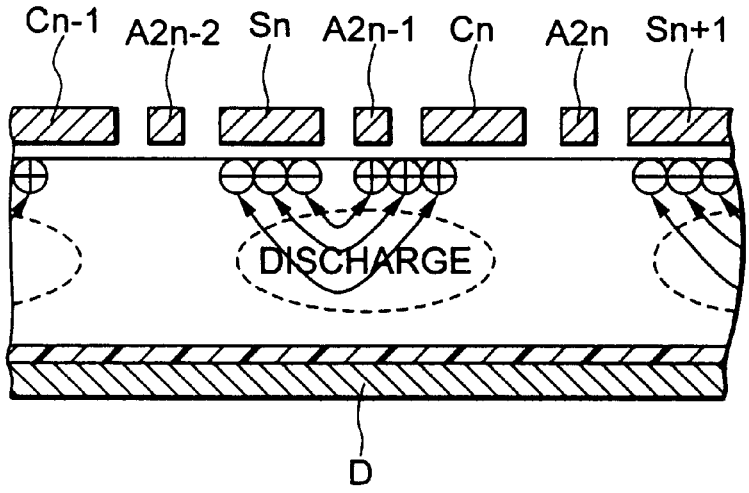
Figure 86B:
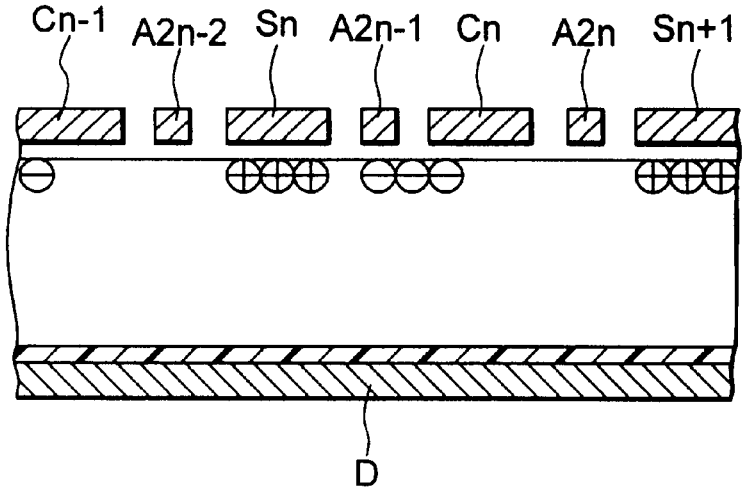

Next, as shown in FIG. 56 and FIG. 62, a negative polarity sustainment pulse Psus-s is applied to the scan electrodes. At this time, in display cells in which a discharge has been generated due to the application of the sustainment pulses Psus-c and Psus-A, the positive charge has been accumulated on each of the sustainment electrode C and auxiliary electrode A, and the negative charge has been accumulated on the scan electrode S. Thus, once a negative voltage pulse is applied to the scan electrode S, a potential difference between the electrodes exceeds a minimum discharge voltage, and a discharge is generated, as shown in FIG. 86A. Once a discharge is generated, a wall charge is disposed so as to cancel the voltage applied to each electrode. Therefore, as shown in FIG. 86B, a negative charge is accumulated on each of the sustainment electrode C and auxiliary electrode A, and a negative charge is accumulated on the scan electrode S. Then, during a sustainment period "3-f", the sustainment pulses Psus-c, Psus-A and Psus-s are repeatedly applied, whereby the light emission of selected display cells is sustained. During this period, as shown in FIG. 62 and FIG. 74, the signal "s—s", which is inputted to the sustainment voltage driver Qs on the scan electrode side, and the signal "g-c", which is inputted to the GND driver Qg on the sustainment electrode and auxiliary electrode side, are set to high level, whereby the drivers Qs and Qg are turned ON, the sustainment pulse is applied to the scan electrode, and each of the sustainment electrode and auxiliary electrode is held at a GND voltage.

Figure 63:
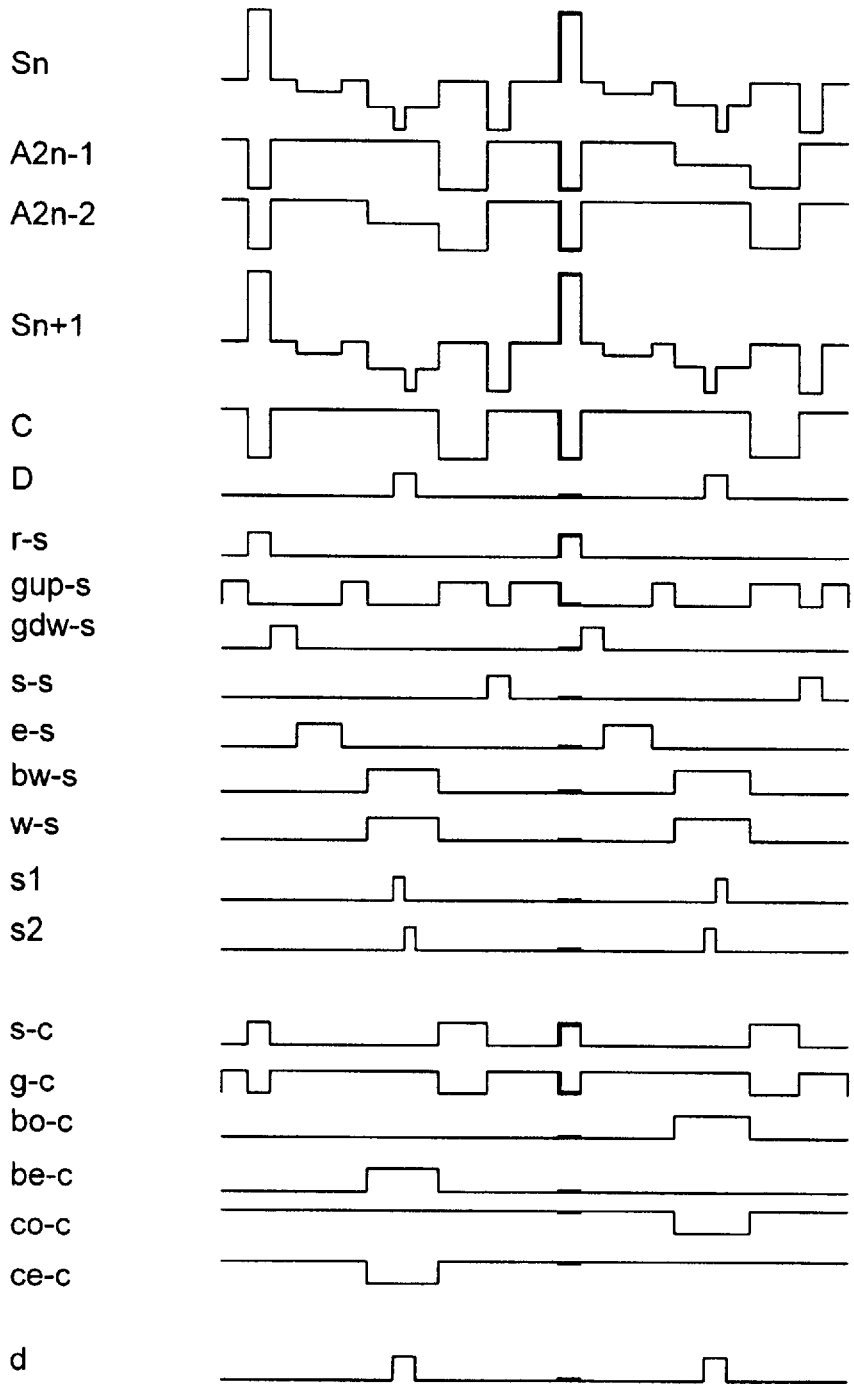
FIG. 63 is a timing chart specifying a next period to the period shown in FIG. 62 in the driving method of the second embodiment.
Figure 75:
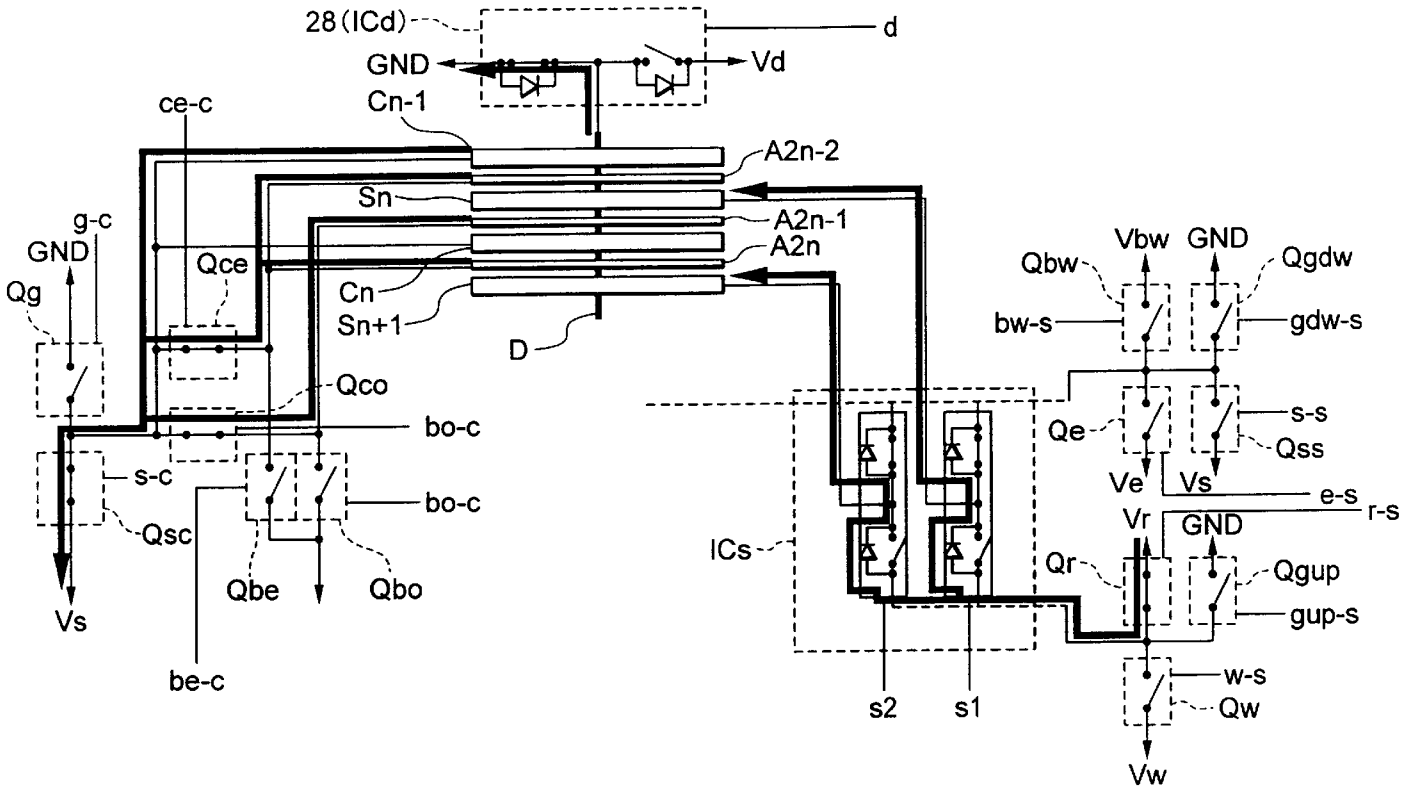
FIG. 75 is a schematic view depicting an operation of driving circuits in the period shown in FIG. 63.
Figure 87A:
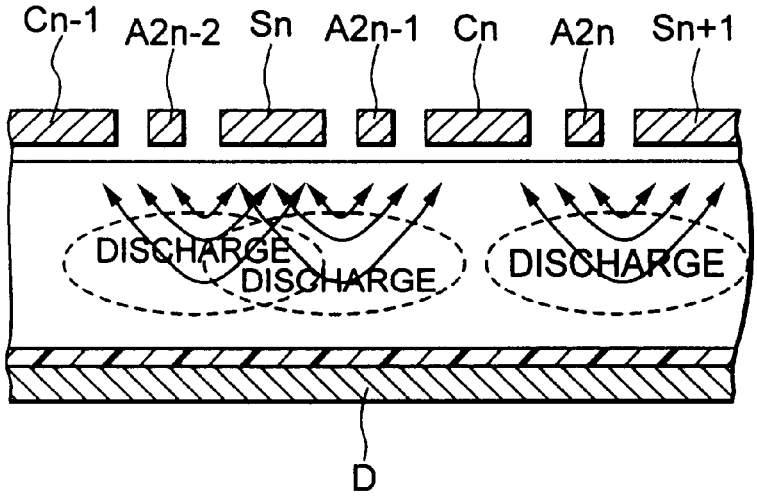
Figure 87B:
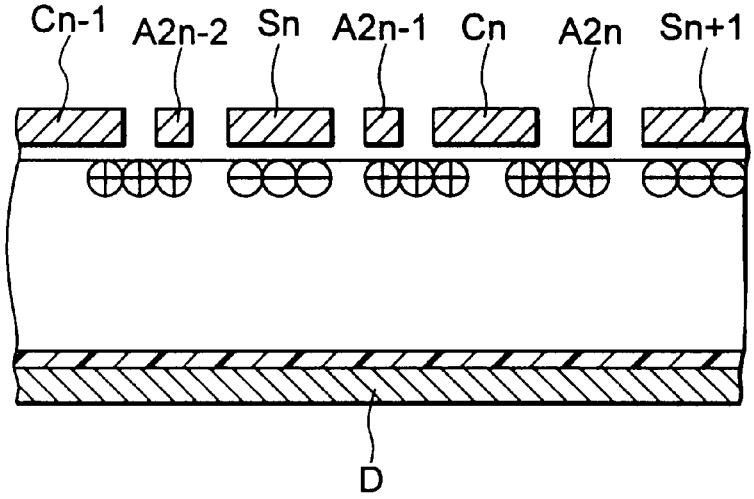

One sub-field of the frame "f" is configured in accordance with the steps in the periods "1-f" to "3-f", and this subframe is repeatedly formed to configure the frame During a reset period 1-(f+1) of the next frame "f+1", as shown in FIG. 56 and FIG. 63, reset pulses Ppr-s, Ppr-A and Ppr-c are first applied respectively to the entireties of the scan electrode S, auxiliary electrode A and sustainment electrode C. The reset pulse Ppr-s is positive in polarity, and the reset pulses Prp-A and Ppr-c are negative in polarity. Due to these reset pulses, as shown in FIG. 87A, a reset discharge is generated between the adjacent scan electrode S and sustainment electrode C. Then, a space charge generated due to the reset discharge is accumulated as a negative polarity wall charge on the scan electrode S and accumulated as a positive polarity wall charge on each of the sustainment electrode C and auxiliary electrode A, as shown in FIG. 87B, so as to cancel the voltage applied to each electrode. During this period, as shown in FIG. 63 and FIG. 75, the signal "r-s", which is inputted to the reset driver Qr on the scan electrode side, and the signal "s-c", which is inputted to the sustainment voltage driver Qsc on the sustainment electrode and auxiliary electrode side, are set to high level, whereby the drivers Qr and Qsc are turned ON, and the reset pulse is applied to each of the scan electrode, auxiliary electrode, and sustainment electrode.

Figure 64:
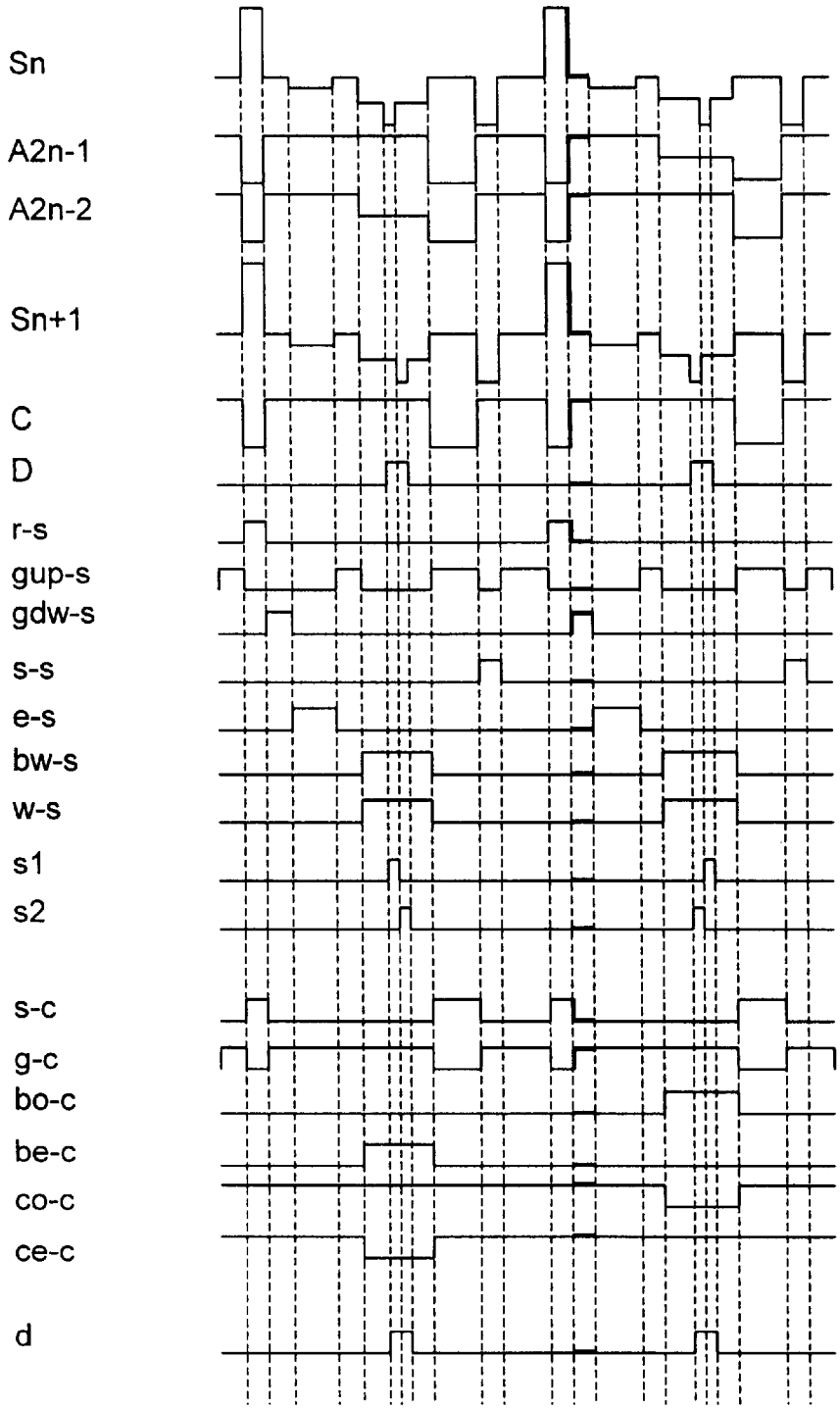
FIG. 64 is a timing chart specifying a next period to the period shown in FIG. 63 in the driving method of the second embodiment.
Figure 76:
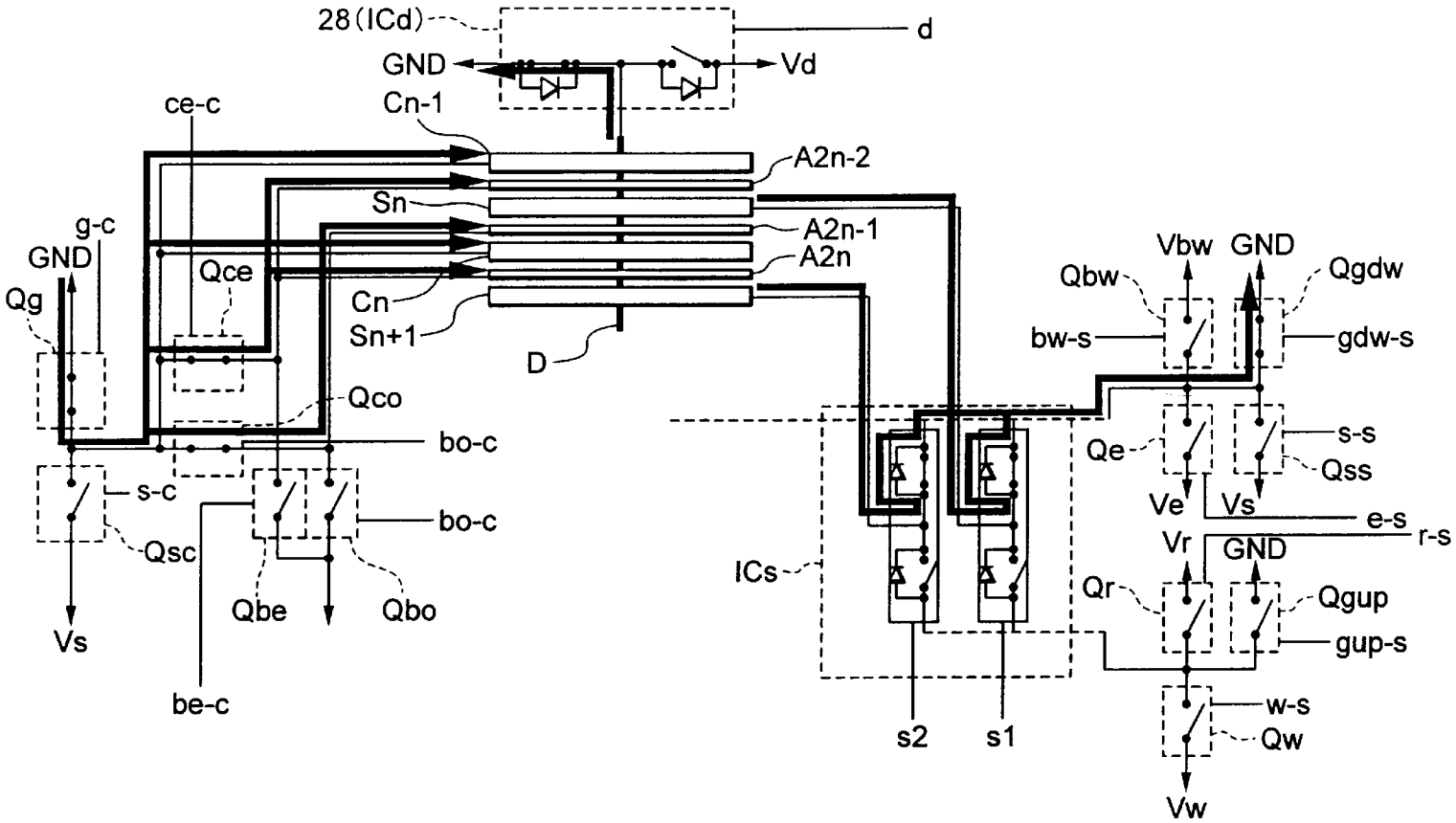
FIG. 76 is a schematic view depicting an operation of driving circuits in the period shown in FIG. 64.
Figure 88A:
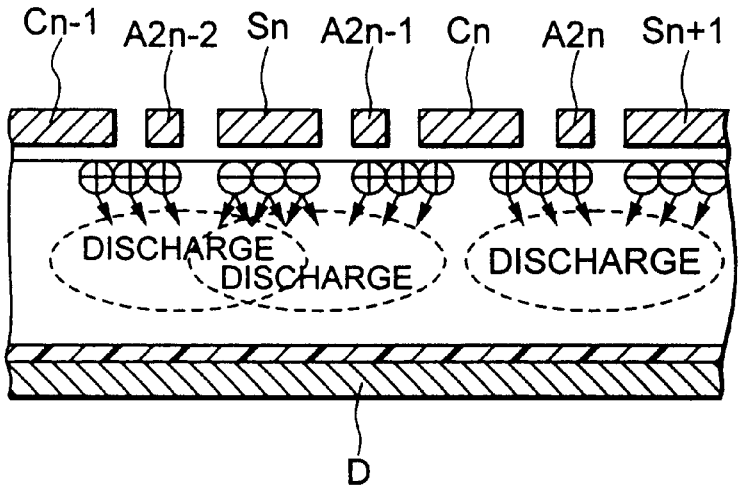
Figure 88B:
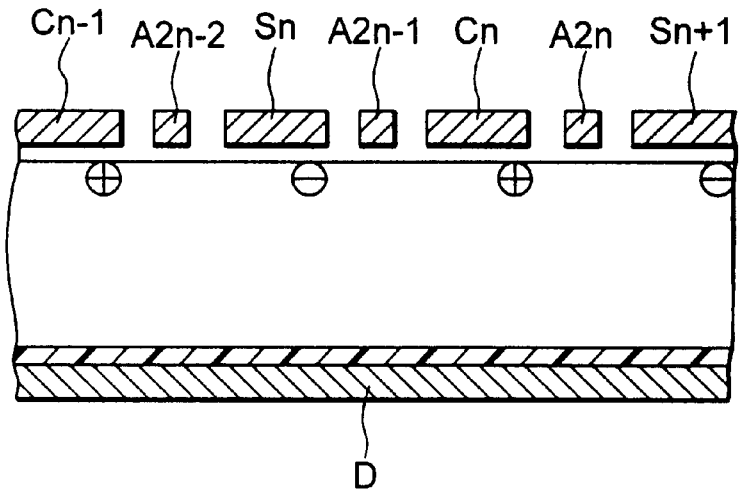

Then, as shown in FIG. 56 and FIG. 64, when the reset pulses are fallen down, a potential difference caused by the accumulated wall charge exceeds a discharge start voltage. As shown in FIG. 88A, a self-erasing discharge is generated. As a result, as shown in FIG. 88B, almost of the wall charge is eliminated due to the self-eliminating discharge. During this period, as shown in FIG. 64 and FIG. 76, the signal "gdw-s", which is inputted to the GND fall-down driver Qdwn on the scan electrode side, and the signal "g-c", which is inputted to the GND driver Qg at the sustainment electrode and auxiliary electrode side, are set to high level, whereby the drivers Qdwn and Qg are turned ON, and the scan electrode, auxiliary electrode, and sustainment electrode are held at a GND potential.

Figure 65:
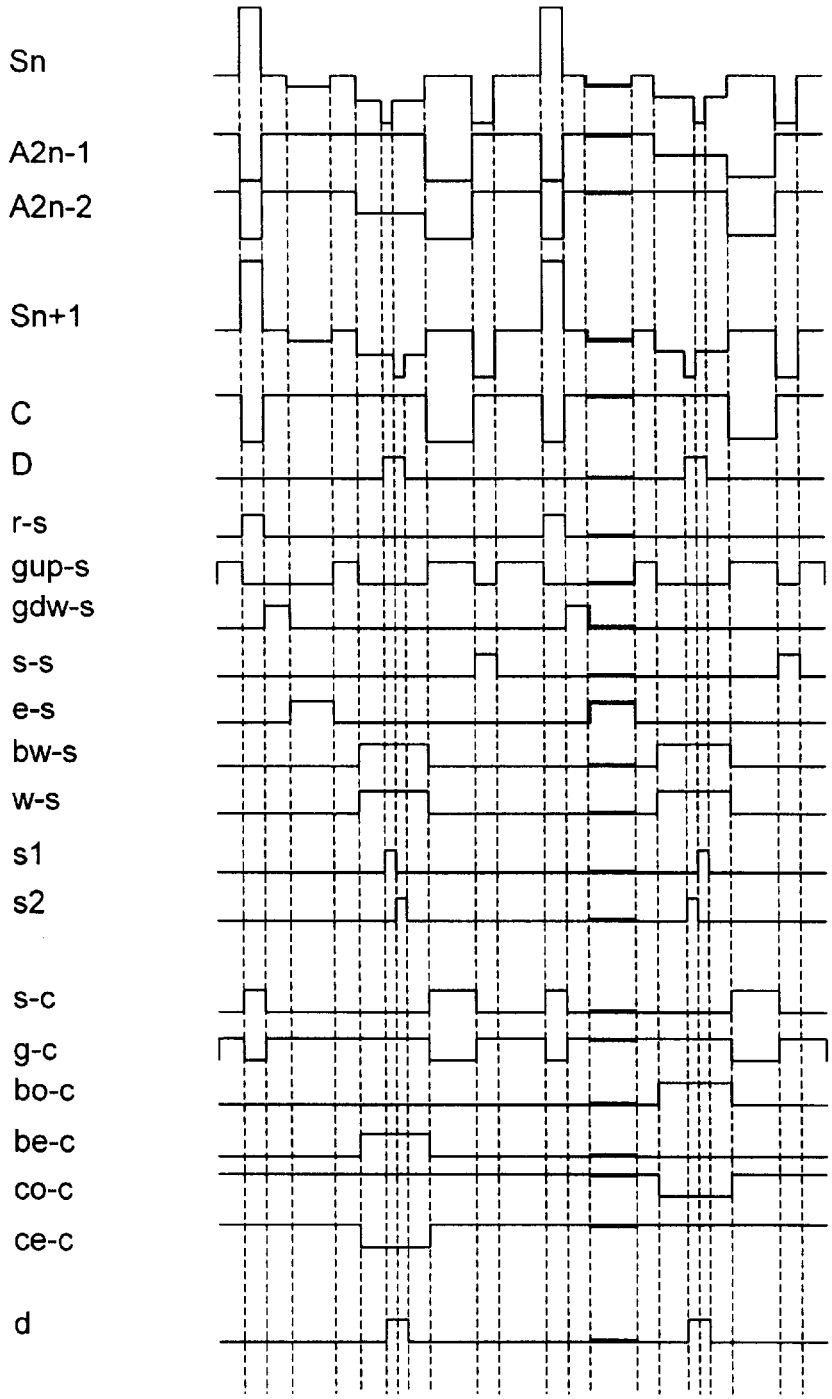
FIG. 65 is a timing chart specifying a next period to the period shown in FIG. 64 in the driving method of the second embodiment.
Figure 77:
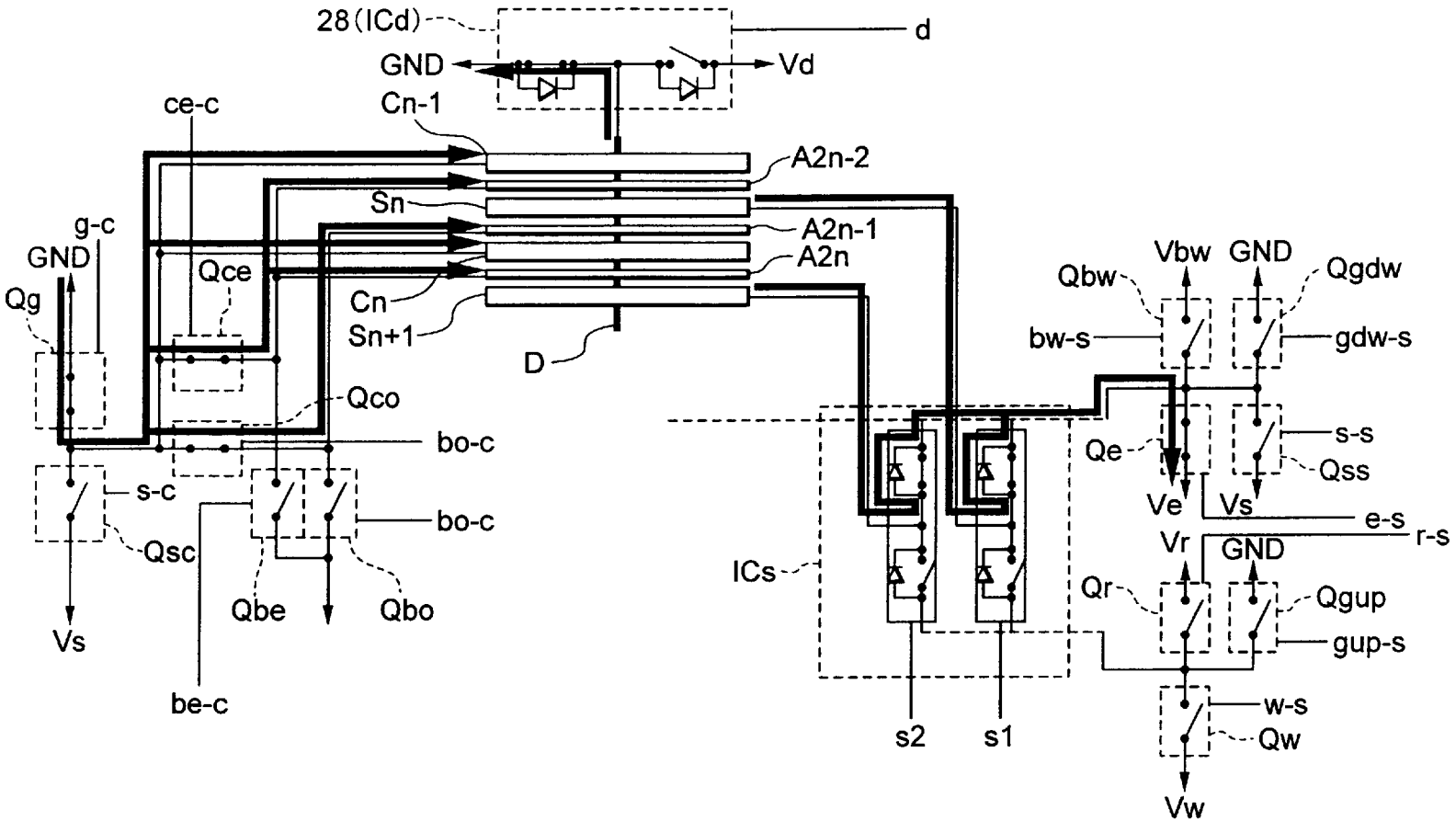
FIG. 77 is a schematic view depicting an operation of driving circuits in the period shown in FIG. 65.
Figure 89A:
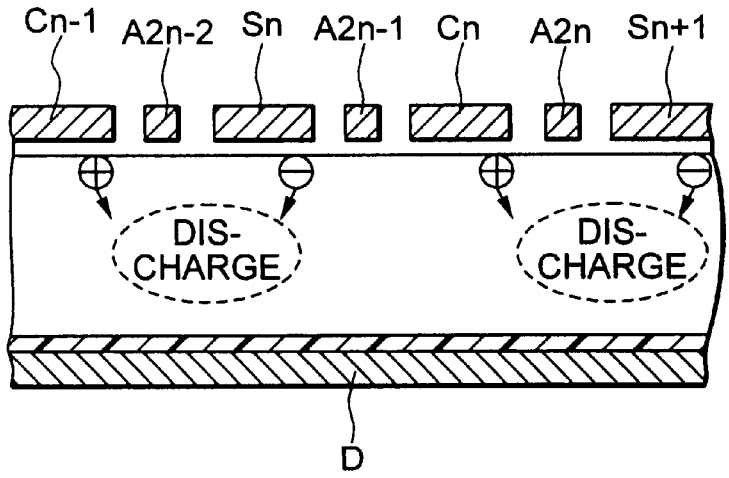
Figure 89B:
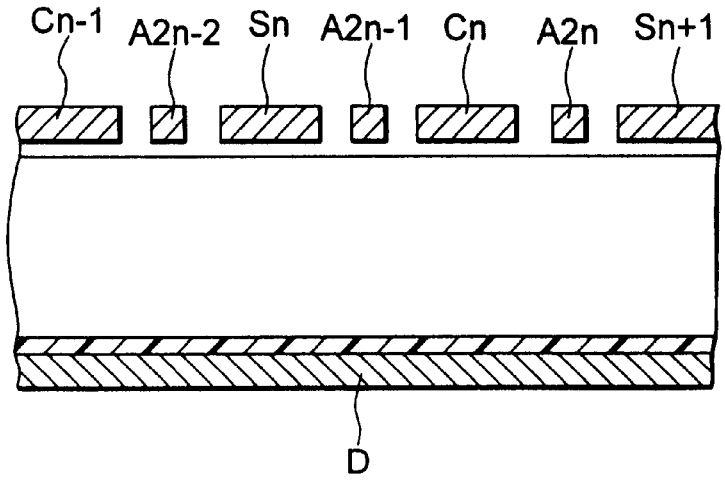

Further, as shown in FIG. 56 and FIG. 65, an erasing pulse Pe-s is applied to the entire of the scan electrode S. As a result, as shown in FIG. 89A, a weak discharge is generated, and the wall charge that has not been eliminated due to the self-erasing discharge is completely eliminated, as shown in FIG. 89B. During this period, as shown in FIG. 65 and FIG. 77, the signal "e-s", which is inputted to the erasing driver Qe on the scan electrode side, is set to high level, whereby the driver Qe is turned ON, and the erasing pulse is applied to the scan electrode.

Figure 66:
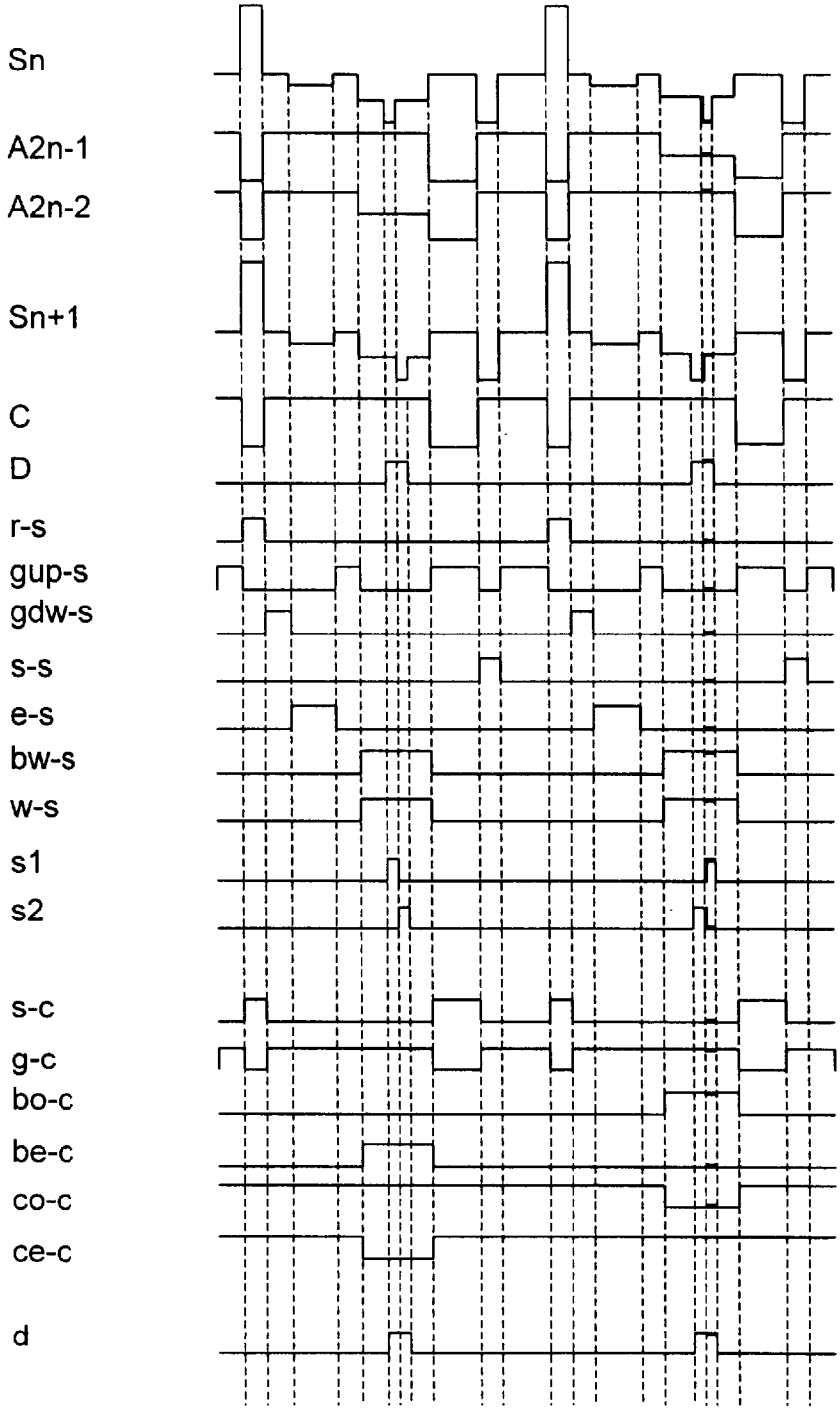
FIG. 66 is a timing chart specifying a next period to the period shown in FIG. 65 in the driving method of the second embodiment.

During an addressing period 2-(f+1), as shown in FIG. 56 and FIG. 66, the entirety of the sustainment electrode C is held at a GND level, and the even number auxiliary electrode group Aeven is held at a bias potential by means of the even number bias driver Qbe.

Figure 90A:
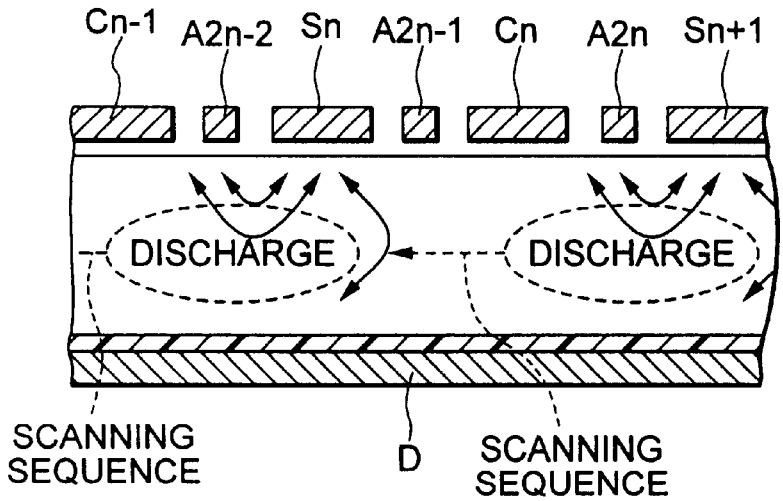
Figure 90B:
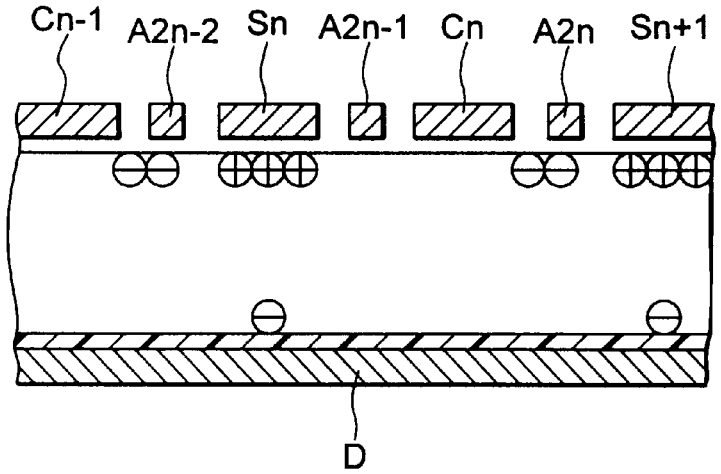

In addition, a negative polarity scan pulse Psc-s is applied to a scan electrode Sn in a row in which writing is performed, and the potential of the odd number auxiliary electrode group Aodd is set at a GND level, which is equal to that of the sustainment electrode C by means of the odd number connection driver Qco. As a result, as shown in FIG. 90A, in selected display cells, an opposite discharge is generated between each of the scan electrode Sn and auxiliary electrode A2*n*-2 and the data electrode D. With this discharge being a trigger, a planer discharge is generated between the sustainment electrode Cn-1 and the auxiliary electrode A2*n*-2, and further, a writing discharge is generated between the sustainment electrode Cn-1 and the scan electrode Sn. Thus, as shown in FIG. 90B, a positive charge is accumulated on the scan electrode Sn, and a negative charge is accumulated on the auxiliary electrode A2*n*-2 and on the side of the auxiliary electrode A2*n*-2 in the sustainment electrode Cn-1.

Figure 78:
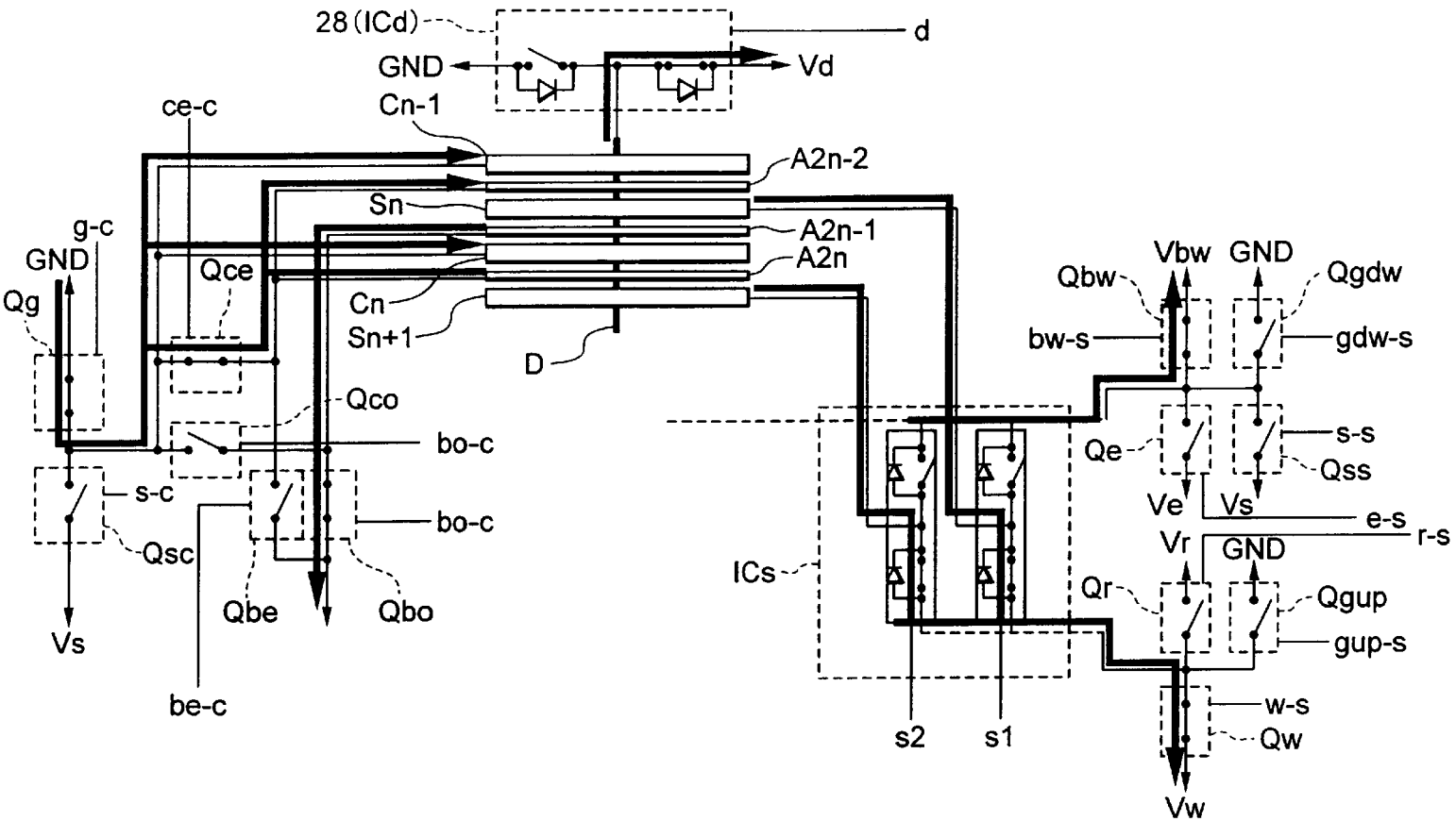
FIG. 78 is a schematic view depicting an operation of driving circuits in the period shown in FIG. 66.

During this period, as shown in FIG. 66 and FIG. 78, the signals "bw-s" and "w-s", which are inputted to the respective scan base driver Qbw and scan voltage driver Qw are set to high level, whereby the drivers Qbw and Qw are turned ON. In addition, driver signal S1 for the scan pulse driver ICs connected to the selected scan electrode Sn is set to high level, whereby the fall-down side switch of the driver S1 are turned ON. Thus, the scan pulse is applied only to the selected scan electrode Sn, and the scan base pulse is applied to the other scan electrode and auxiliary electrode.

Figure 67:
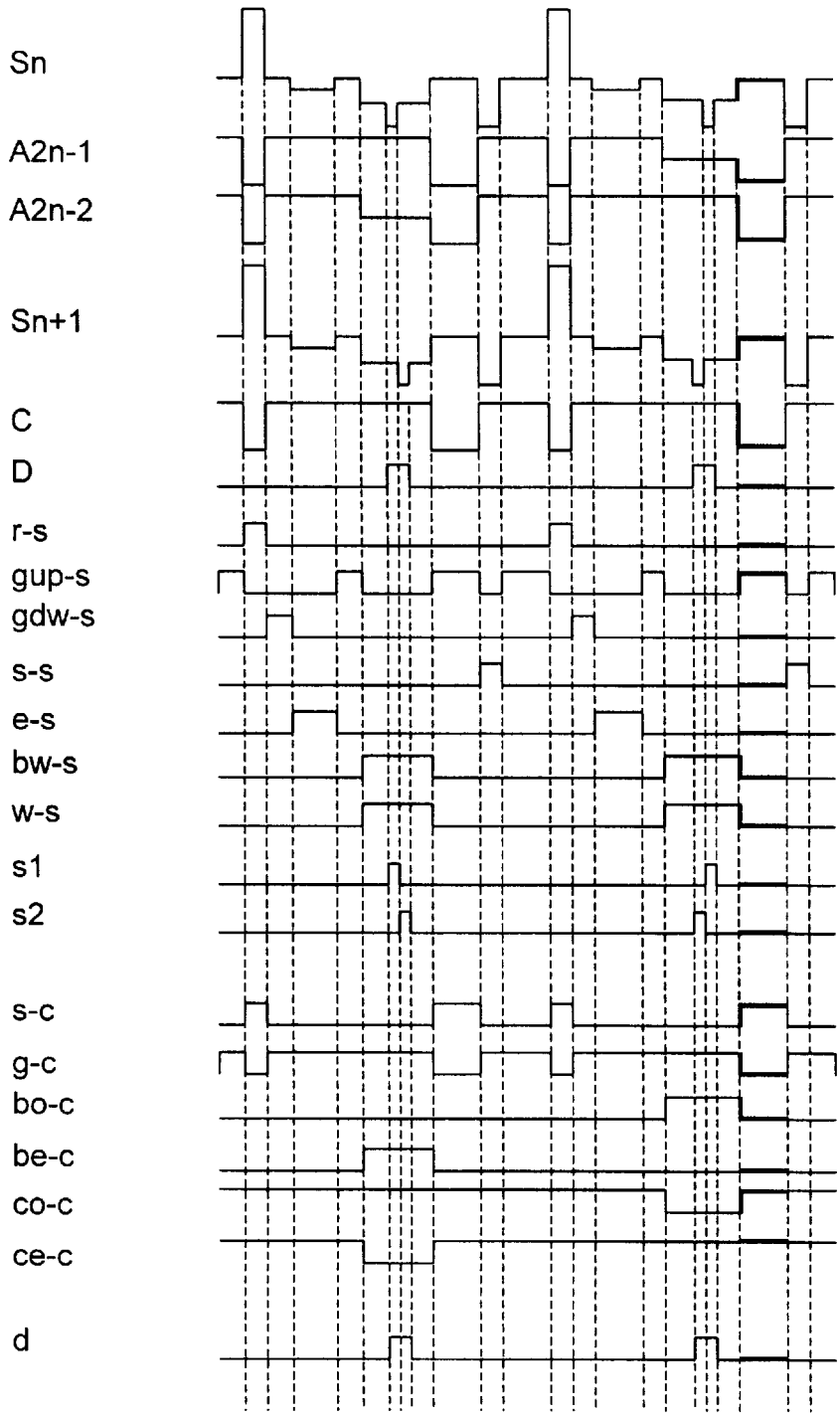
FIG. 67 is a timing chart specifying a next period to the period shown in FIG. 66 in the driving method of the second embodiment.
Figure 79:
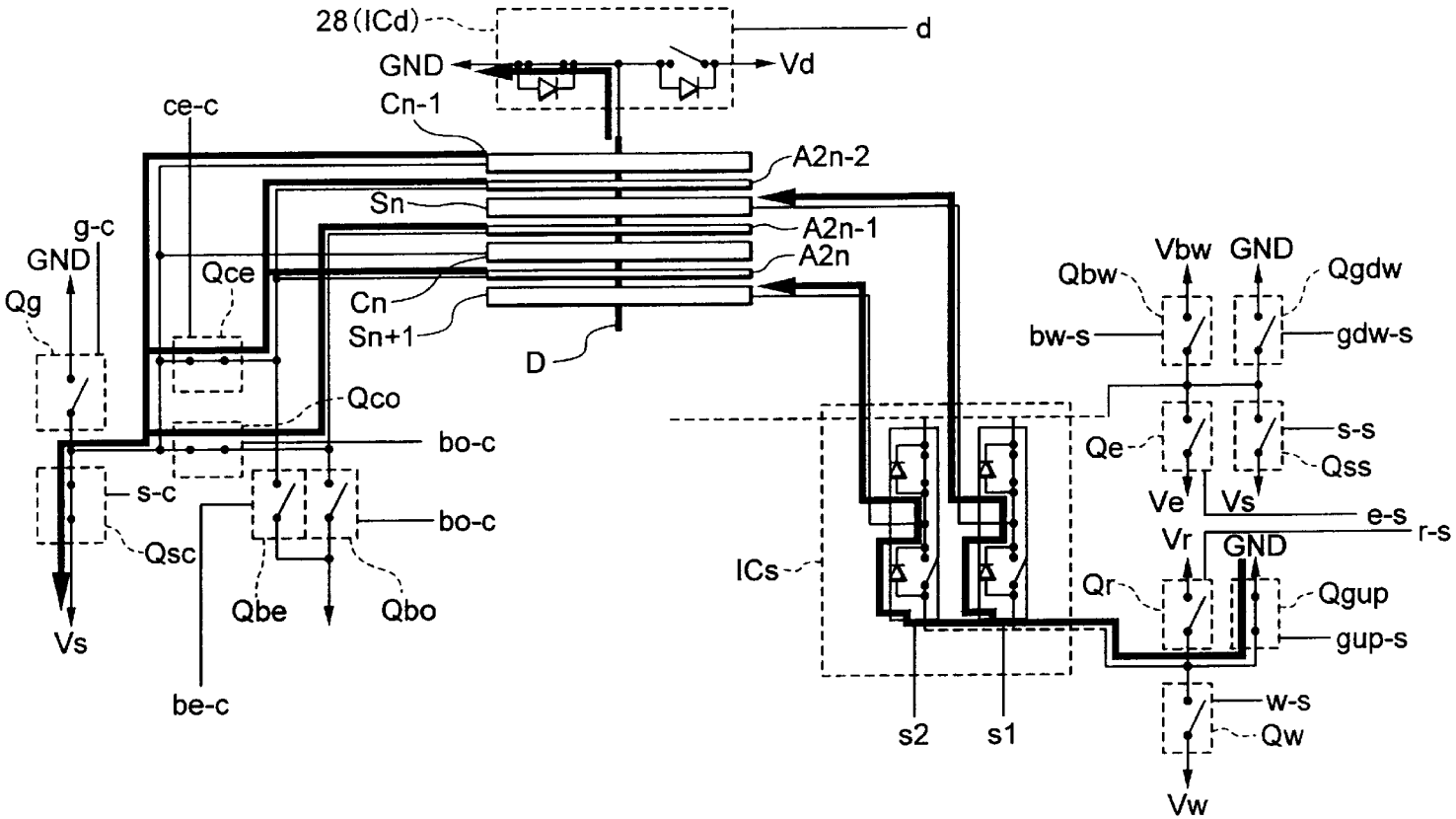
FIG. 79 is a schematic view depicting an operation of driving circuits in the period shown in FIG. 67.
Figure 91A:
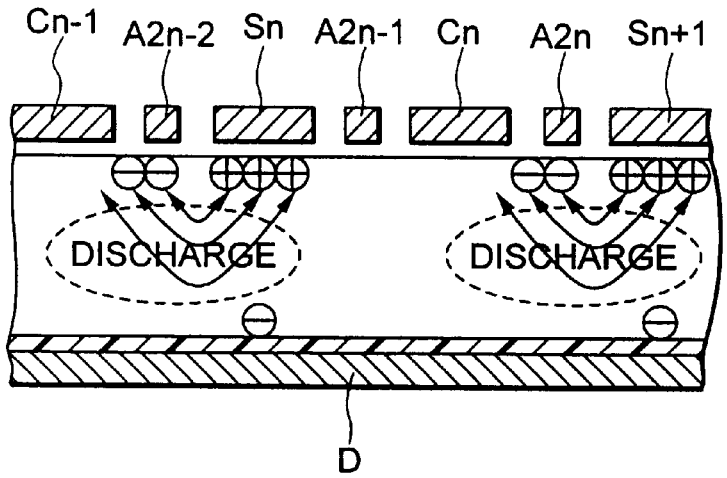
Figure 91B:
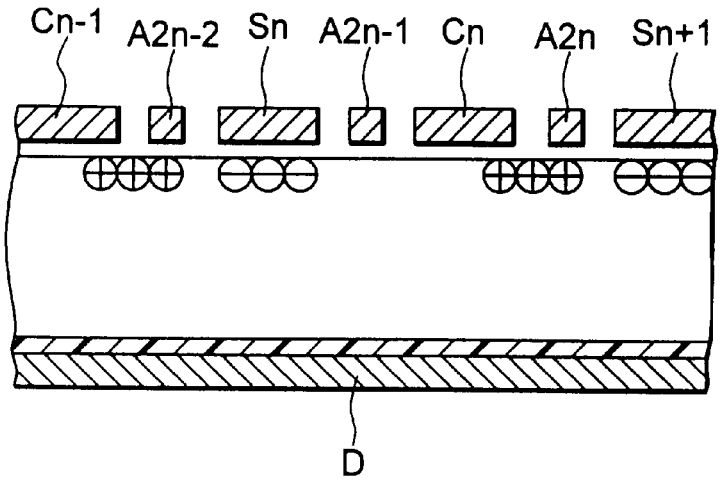

During a sustainment period 3-(f+1), as shown in FIG. 56 and FIG. 67, negative polarity sustainment pulses Psus-c and Psus-A are applied respectively to the sustainment electrode C and auxiliary electrode A. At this time, in display cells selected written during the addressing period 2-(f+1), the positive charge is accumulated on the scan electrode S, and the negative charge is accumulated on the even number auxiliary electrode and on the side of the even number auxiliary electrode in the sustainment electrode C. Thus, once a sustainment pulse is applied, a potential difference between the electrodes exceeds a minimum discharge voltage. As shown in FIG. 91A, a discharge is generated. Once a discharge is generated, a wall charge is disposed so as to cancel the voltage applied to each electrode. Therefore, as shown in FIG. 91B, a positive charge is accumulated on each of the sustainment electrode C and auxiliary electrode A, and a negative charge is accumulated on the scan electrode S. During this period, as shown in FIG. 67 and FIG. 79, the signal "gup-s", which is inputted to the GND rise-up driver Qgup on the scan electrode side, and the signal "s-c", which is inputted to the sustainment voltage driver Qsc on the sustainment electrode and auxiliary electrode side, are set to high level, whereby the drivers Qgup and Qsc are turned ON, the scan electrode are held at a GND voltage, and the sustainment pulse is applied to each of the sustainment electrode and auxiliary electrode.

Figure 68:
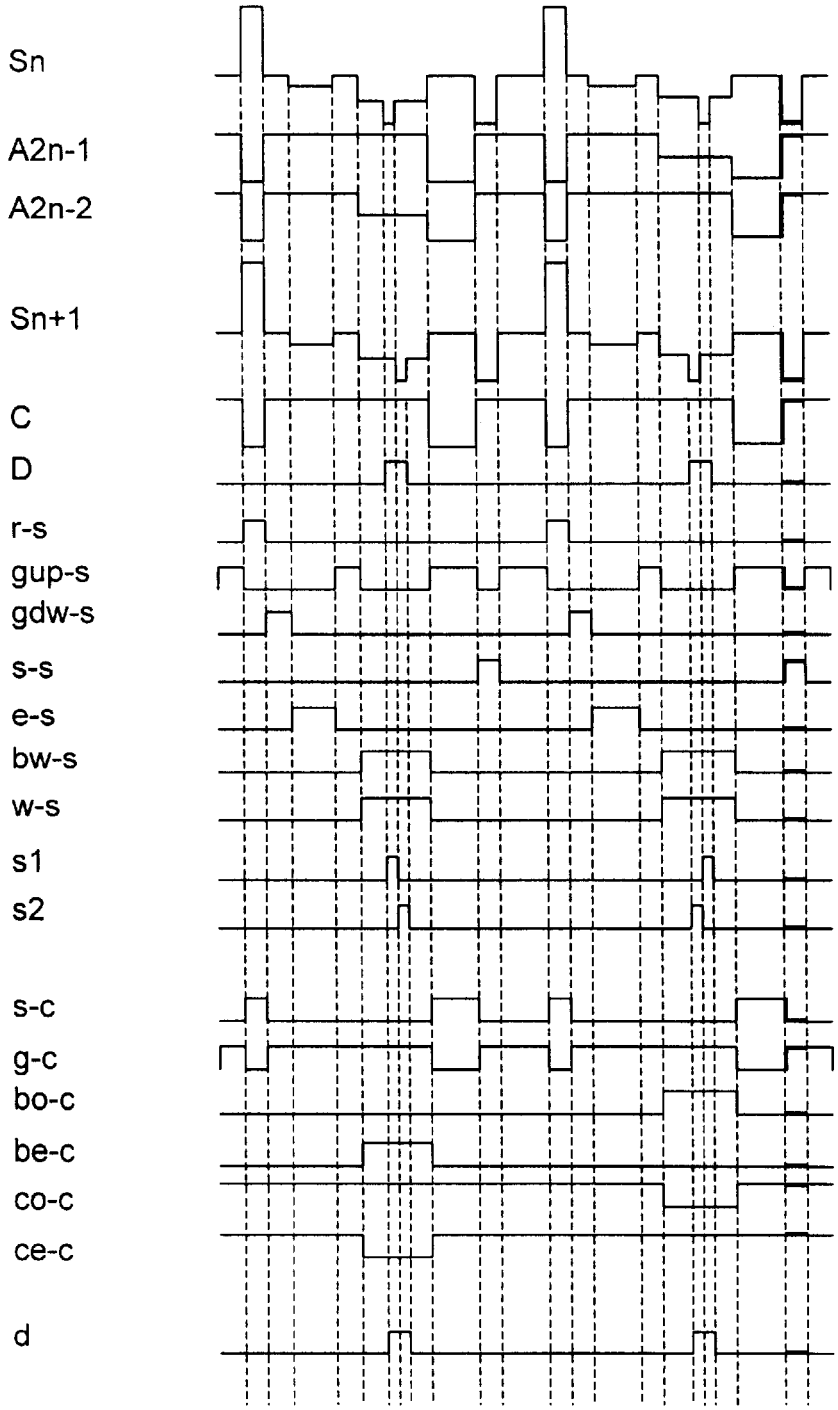
FIG. 68 is a timing chart specifying a next period to the period shown in FIG. 67 in the driving method of the second embodiment.
Figure 80:
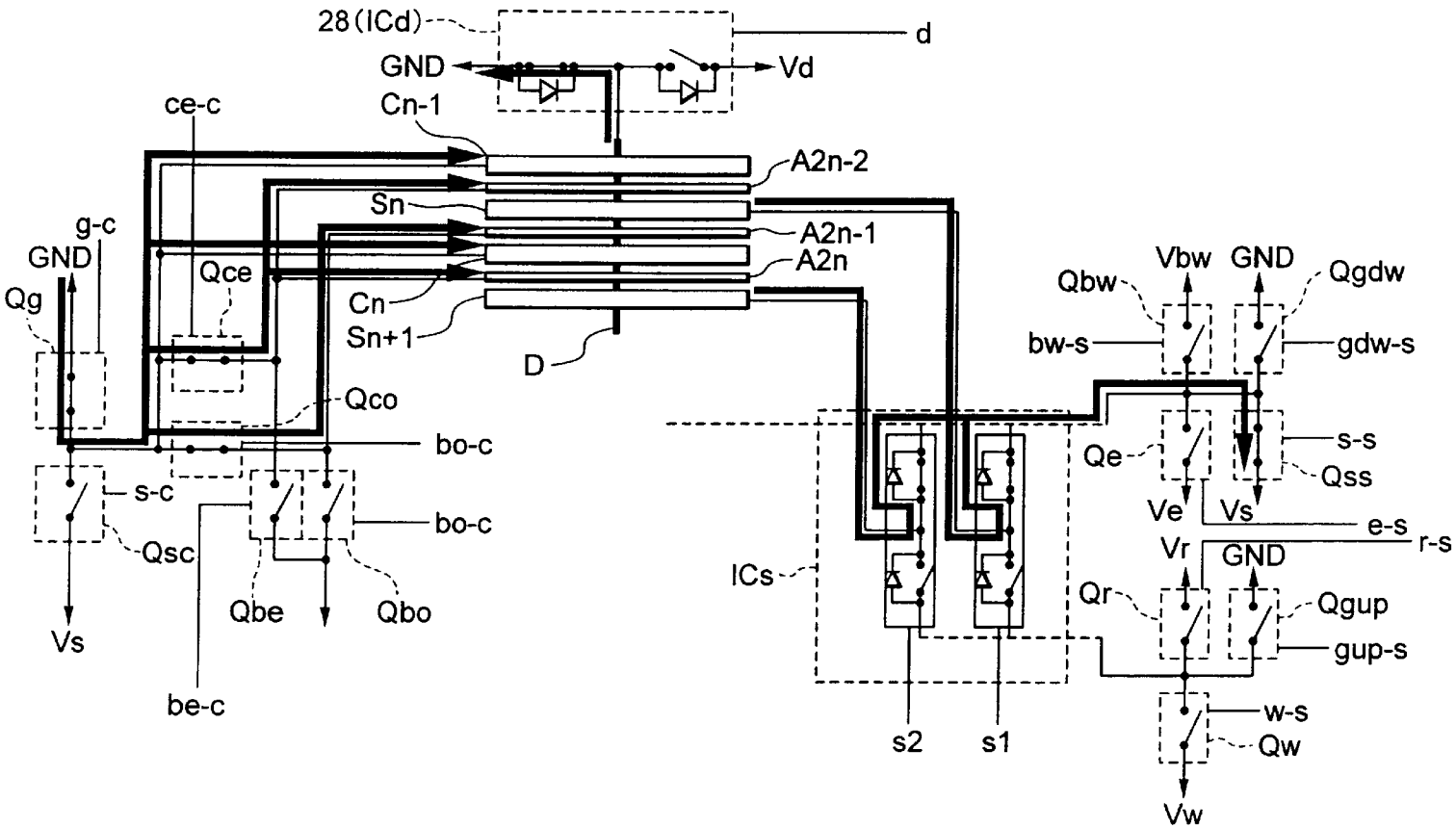
FIG. 80 is a schematic view depicting an operation of driving circuits in the period shown in FIG. 68.
Figure 92A:
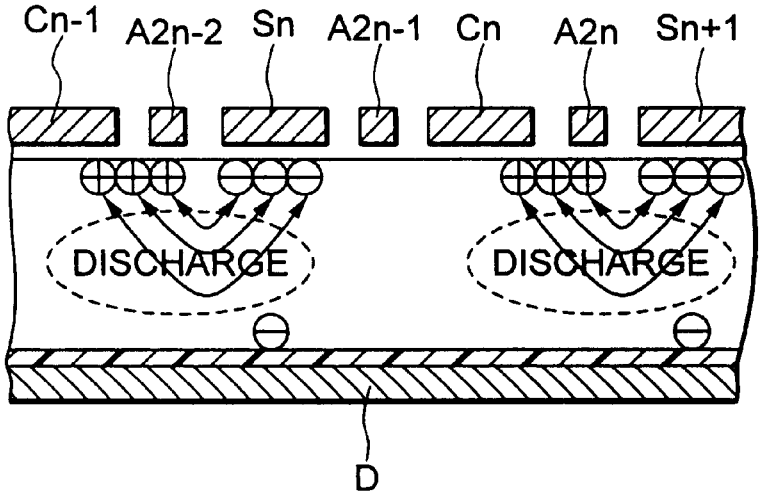
Figure 92B:
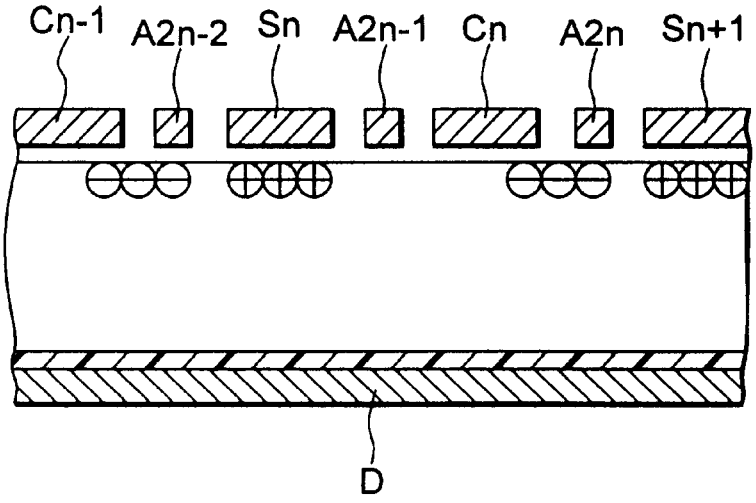

Next, as shown in FIG. 56 and FIG. 68, a negative polarity sustainment pulse Psus-s is applied to the scan electrode S. At this time, in display cells in which a discharge has been generated due to the application of the sustainment pulses Psus-c and Psus-A, the positive charge has been accumulated on each of the sustainment electrode C and auxiliary electrode A, and the negative charge has been accumulated on the scan electrode S. Thus, once a negative voltage pulse is applied to the scan electrode S, a potential difference exceeds a minimum discharge voltage due to the weighting with the wall charge. As shown in FIG. 92A, a discharge is generated. Once a discharge is generated, a wall charge is disposed so as to cancel the voltage applied to each electrode. Therefore, as shown in FIG. 92B, a negative charge is accumulated on each of the sustainment electrode C and auxiliary electrode A, and a positive charge is accumulated on the scan electrode S. Then, during the sustainment period 3-(f+1), the sustainment pulses Psus-c, Psus-A, and Psus-s are repeatedly applied, whereby the light emission of selected display cells is sustained. During this period, as shown in FIG. 68 and FIG. 80, the signal "s—s", which is inputted to the sustainment voltage driver Qs on the scan electrode side, and the signal "g-c", which is inputted to the GND driver Qg on the sustainment electrode and auxiliary electrode side, are set to high level, whereby the drivers Qs and Qg are turned ON, the sustainment pulse is applied to the scan electrode, and each of the sustainment electrode and auxiliary electrode is held at a GND voltage.

Then, one sub-field of the frame (f+1) is configured in accordance with the steps in the periods 1-(f+1) to 3-(f+1), and this sub-field is repeatedly formed to configure the frame "f+1".

In this manner, in the driving method of the plasma display according to the second embodiment, the potential of the odd number auxiliary electrode group Aodd containing the auxiliary electrode A2*n*-1, which is at the lower side of the scan electrode Sn that performs writing in a sub-field of a frame "f", is always equalized to that of the sustainment electrode Cn in the addressing period 2-f. In addition, the potential of the even number auxiliary electrode group Aeven containing the auxiliary electrode A2*n*-2, which is at the upper side of the scan electrode Sn, is always held at a bias potential in the addressing period 2-f. This bias voltage is set at an intermediate level between the sustainment voltage and the GND voltage. Thus, as in the first embodiment, as shown in FIG. 84A, a writing discharge is generated as a planar discharge between the scan electrode Sn and each of the sustainment electrode Cn and the odd number auxiliary electrode group Aodd containing the auxiliary electrode A2*n*-1, an opposite discharge generated between the scan electrode Sn and the data electrode D being employed as a trigger. In addition, since the potential of the even number auxiliary electrode group Aeven containing the auxiliary electrode A2*n*-2 is held at a bias potential, a planar discharge is not generated between the scan electrode Sn and the even number auxiliary electrode group Aeven.

Further, in the driving method of the plasma display according to the second embodiment, the potential of the even number auxiliary electrode group Aeven containing the auxiliary electrode A2*n*-2, which is at the upper side of the scan electrode Sn that performs writing in a sub-field of a frame "f+1", is always equalized to that of the sustainment electrode Cn-1 in the addressing period 2-(f+1). In addition, the potential of the odd number auxiliary electrode group Aodd containing the auxiliary electrode A2*n*-1, which is at the lower side of the scan electrode Sn, is always held at a bias potential during the addressing period 2-(f+1). As described previously, this bias voltage is set at an intermediate level between the sustainment voltage and the GND voltage. As in the first embodiment, as shown in FIG. 90A, a writing discharge is generated as a planar discharge between the scan electrode Sn and each of the sustainment electrode Cn-1 and the even number auxiliary electrode group Aeven containing the auxiliary electrode A2*n*-2, an opposite discharge generated between the scan electrode Sn and the data electrode D being employed as a trigger. In addition, since the potential of the odd number auxiliary electrode group Aodd containing the auxiliary electrode A2*n*-1 is held at a bias potential, a planar discharge is not generated between the scan electrode Sn and the odd number auxiliary electrode group Aodd.

Figure 93:
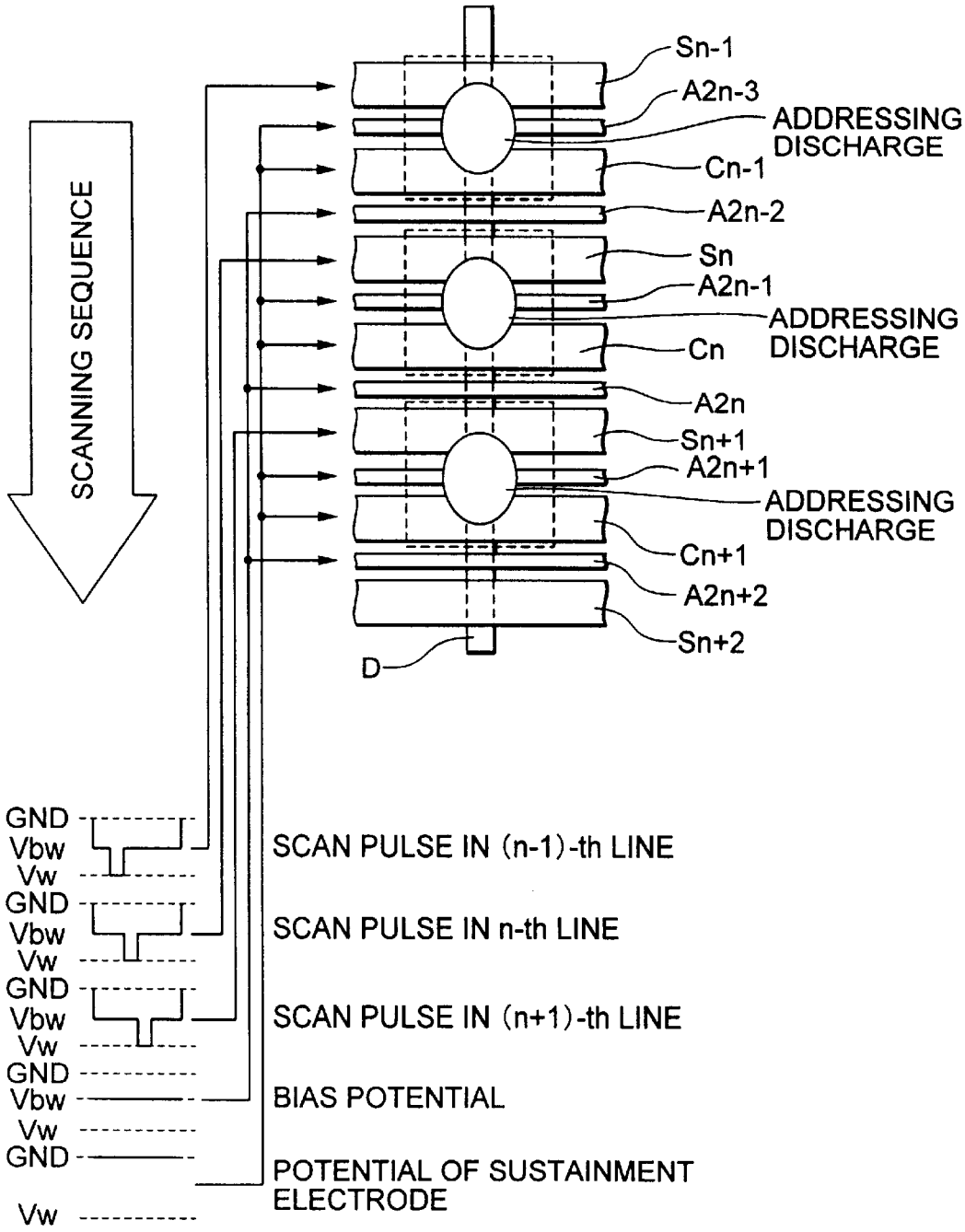
FIG. 93 is a schematic view illustrating a light emission portion during the scanning period in a frame "f" in the second embodiment.
Figure 94:
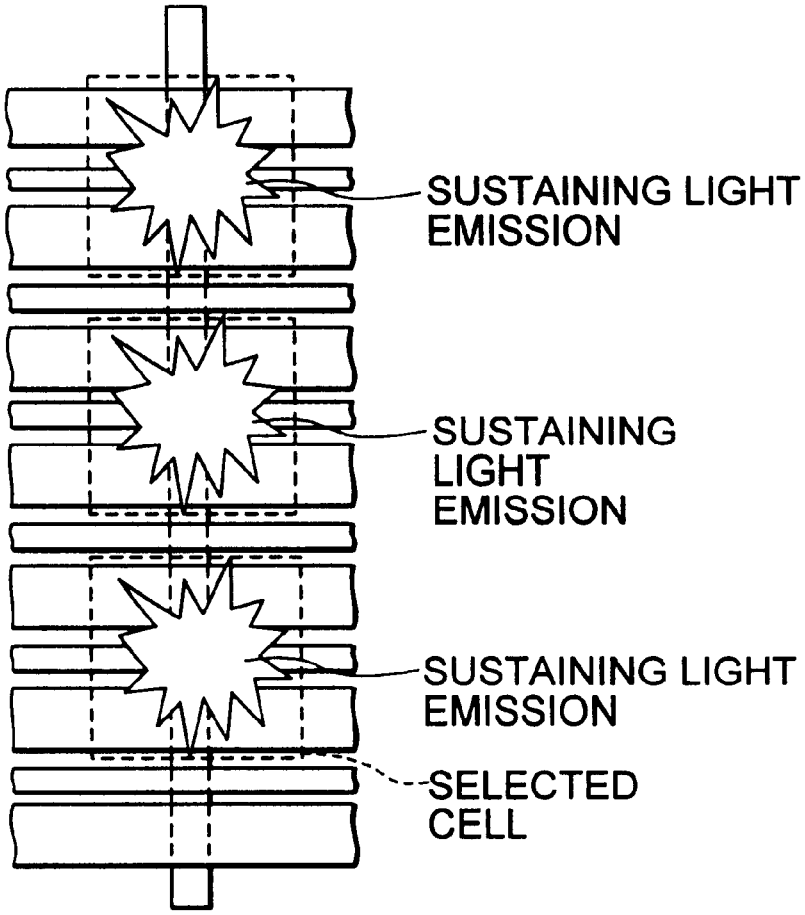
FIG. 94 is a schematic view illustrating a light emission portion during the sustainment period in a frame "f" in the second embodiment.
Figure 95:
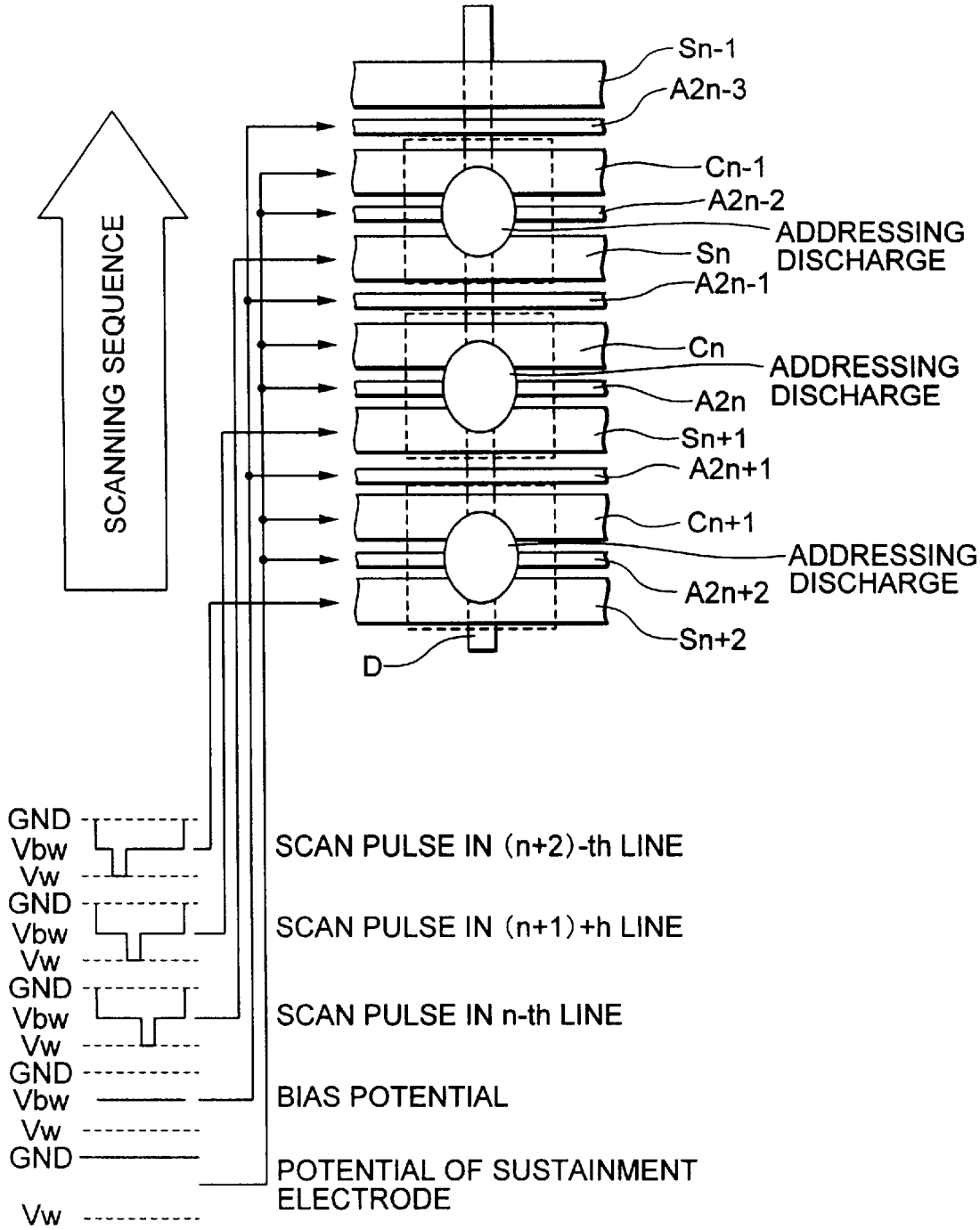
FIG. 95 is a schematic view illustrating a light emission portion during the scanning period in a frame "f+1" in the second embodiment.
Figure 96:
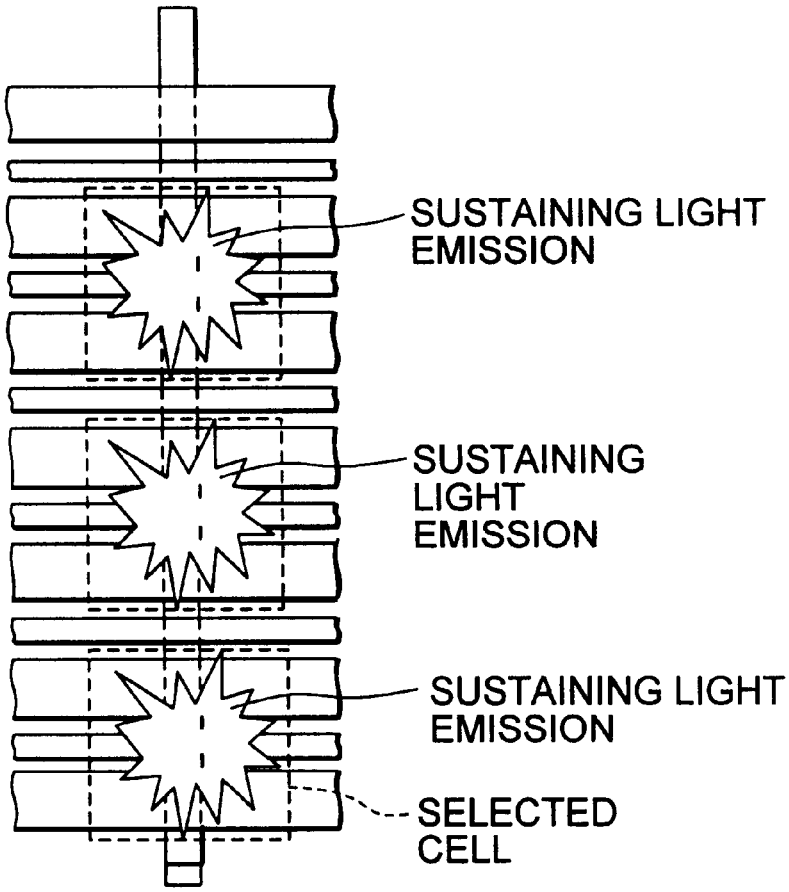
FIG. 96 is a schematic view illustrating a light emission portion during the sustainment period in a frame "f+1" in the second embodiment.

This results in interlace driving, in which a case in which the lower side of s scanning line is used by each frame is switched to a case in which the upper side is used and vice versa. FIG. 93 is a schematic view illustrating a light emission portion during the scanning period in a frame "f"; FIG. 94 is a schematic view illustrating a light emission portion during the sustainment period in a frame "f"; FIG. 95 is a schematic view illustrating a light emission portion during the scanning period in a frame "f+1"; and FIG. 96 is a schematic view illustrating a light emission portion during the sustainment period in a frame As shown in FIG. 93 to FIG. 96, in the frames "f", and "f+1", portions at which an addressing discharge and a sustainment discharge occur are shifted. In this manner, in the present embodiment as well, the frames "f" and "f+1" are repeatedly displayed.

In addition, in the second embodiment, the auxiliary electrodes A are divided into the odd number auxiliary electrode group Aodd and the even number auxiliary electrode group Aeven. During a scanning period in the addressing period, the potentials of the odd number auxiliary electrode group Aodd and the even number auxiliary electrode group Aeven each are switched to a potential equal to those of the bias potential and sustainment electrode every one frame.

There is no need to apply a scan pulse (Psc-A in the first embodiment) to an auxiliary electrode. Thus, the number of scan drivers is halved, and the cost of the driving circuits can be reduced. In addition, a scan base voltage and a bias voltage are separated from each other, thus making it possible to optimize the bias voltage and expand an operating voltage margin.

Figure 97:
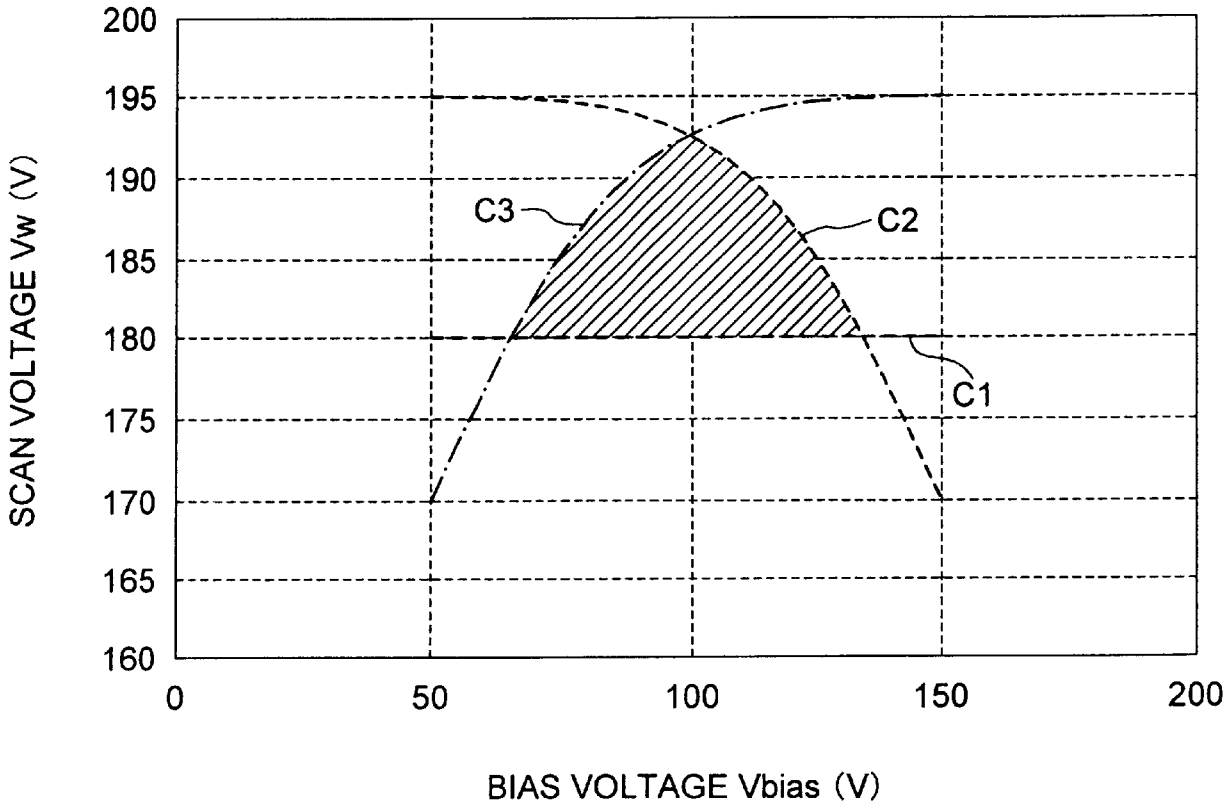
FIG. 97 is a graph showing a margin of a driving voltage.

FIG. 97 is a graph depicting a margin for a driving voltage, where a bias voltage Vbias is defined on a horizontal axis, and a scan voltage Vw is defined on a vertical axis.

In FIG. 97, a line C1 indicates a minimum scan voltage Vwmin at which a planar discharge is generated between the scan electrode Sn and the odd number auxiliary electrode group Aodd in the case where an opposite discharge is generated between the scan electrode Sn and the data electrode D in the scanning period of a sub-field of the frame "f". The scan voltage Vwmin is constant irrespective of the bias voltage Vbias.

A curve C2 indicates a scan voltage Vwmax1 at which an incorrect planar discharge occurs between the scan electrode Sn and the even number auxiliary electrode group Aeven in the case where an opposite discharge is generated between the scan electrode Sn and the data electrode D in the scanning period of a sub-field of the frame "f". In the case where the bias voltage Vbias is small, a potential difference between the scan voltage Vw and the bias voltage Vbias increases. As a result, an incorrect planar discharge is likely to occur between the scan electrode Sn and the even number auxiliary electrode group Aeven, and the voltage Vwmax1 is lowered. In contrast, when the bias voltage Vbias is increased, a potential difference between the scan voltage Vw and the bias voltage Vbias is reduced. As a result, an incorrect planar discharge is unlikely to occur between the scan electrode Sn and the even number auxiliary electrode group Aeven, and the voltage Vwmax1 increases.

A curve C3 indicates a scan voltage Vwmax2 at which an incorrect planar discharge occurs between the sustainment electrode Cn and the even number auxiliary electrode group Aeven in the case where an opposite discharge is generated between the scan electrode Sn and data electrode D in the scanning period of a sub-field of the frame "f". The potential of the sustainment electrode Cn in this period is set at a GND level. In the case where the bias voltage Vbias is small, a potential difference between the GND level and the bias voltage Vbias is reduced. Thus, an incorrect planar discharge is unlikely to occur between the sustainment electrode Cn and the even number auxiliary electrode group Aeven, and the voltage Vwmax2 increases. On the other hand, when a bias voltage Vbias is increased, a potential difference between the GND level and the bias voltage Vbias increases. Thus, an incorrect planar discharge is likely to occur between the sustainment electrode Cn and the even number auxiliary electrode group Aeven, and the voltage Vwmax2 is lowered.

An operating voltage margin corresponds to a shaded area of a region surrounded by the line 1 and the curves 2 and 3. The bias voltage Vbias can be independently controlled, thus making it possible to regulate the bias voltage Vbias at a point at which the operating voltage margin is the widest.

Figure 98:
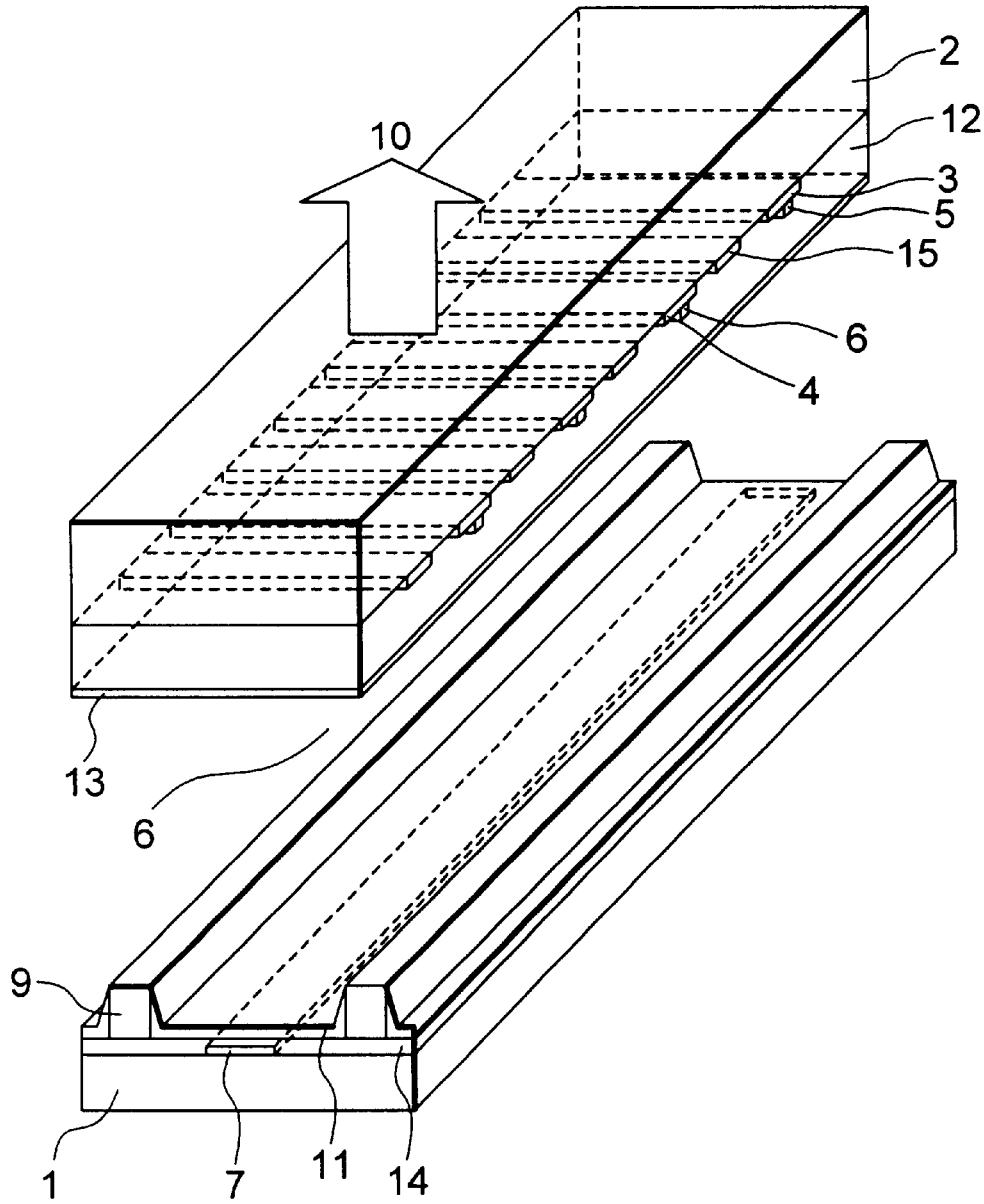
FIG. 98 is a schematic perspective view illustrating a configuration of display cells of an AC type plasma display according to a third embodiment of the present invention.

A third embodiment of the present invention will be described hereinafter. The third embodiment is different from the first and second embodiments in configuration of display cells, and is similar to the second embodiment in configuration of driving circuits. FIG. 98 is a schematic perspective view illustrating a configuration of display cells of an AC type plasma display according to the third embodiment of the present invention.

In the third embodiment, as shown in FIG. 98, a trace electrode for the auxiliary electrode 15 is not provided.

In the driving method according to the first embodiment, the potential of the auxiliary electrode is changed in a manner similar to that of the scan electrode. Therefore, in the driving method according to the first embodiment, in the case where a discharge peak current increases during addressing discharge for a reason a large number of discharge cells exists on the same scan electrode, for example, when a resistance of the scan electrode and auxiliary electrode is high, a voltage fall occurs due to a discharge peak current. Thus, a scan voltage Vw for constantly performing addressing discharge is necessary to be increased. Therefore, a trace electrode with its low resistance is required for an auxiliary electrode A.

On the other hand, in the driving method according to the second embodiment, the potential of the auxiliary electrode is mainly changed in a manner similar to that of the sustainment electrode. Thus, an addressing discharge is less affected by an effect of a panel electrode resistance due to a discharge peak current in an addressing period. Even if an electrode resistance of an auxiliary electrode is relatively high, when a trace electrode is not provided on the auxiliary electrodes Aodd and Aeven, an operating voltage margin is not suppressed.

In the third embodiment, the panel structure as described previously is provided, thereby eliminating a trace electrode that exists at a portion close to the center of display cells light emitting, and that interrupts light emission in the first and second embodiments, and the luminescence and efficiency of light emission can be improved.

Figure 99:
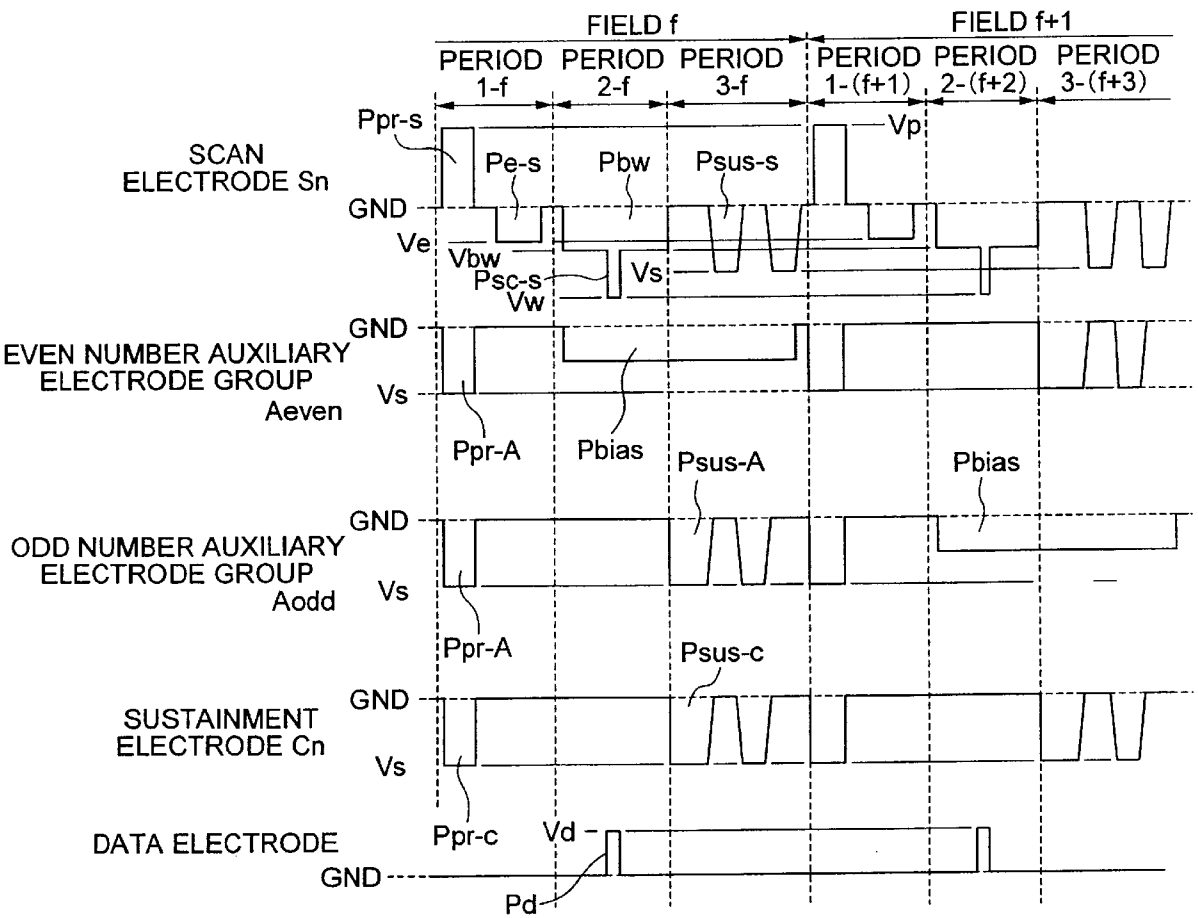
FIG. 99 is a timing chart showing a second driving method of the AC type plasma display according to each of the second and third embodiments.
Figure 100:
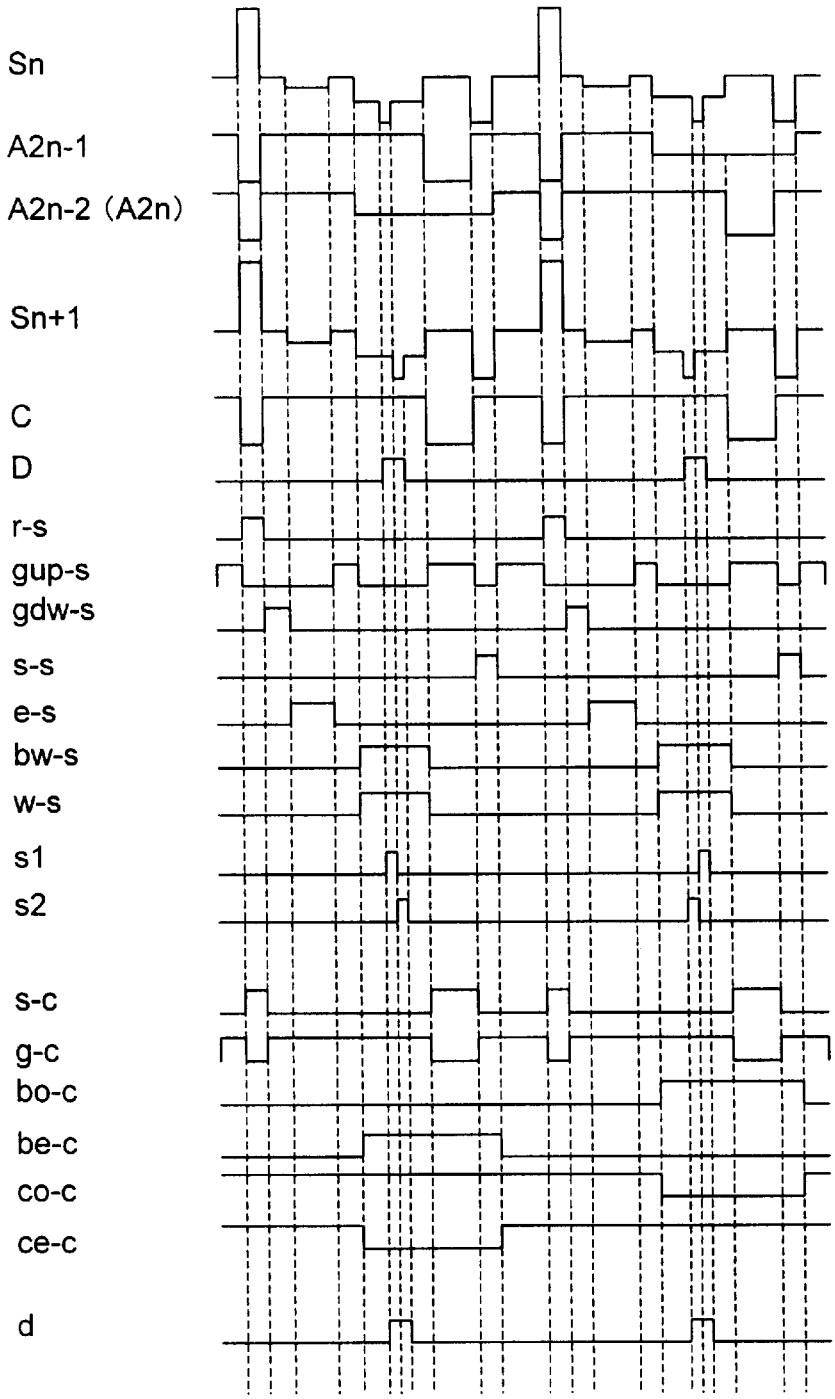
FIG. 100 is a timing chart showing an operation of drivers in the second driving method.

Another driving method of the plasma display according to the second and third embodiments will be described hereinafter. FIG. 99 is a timing chart illustrating a second driving method of the AC type plasma display according to the second and third embodiments. FIG. 100 is a timing chart showing an operation of each driver in the second driving method.

In this second driving method, during the addressing period and sustainment period for a sub-field that configures a frame "f", the potential of the odd number auxiliary electrode group Aodd is held at a bias potential, and the potential of the even number auxiliary electrode group Aeven is held to be at a potential equal to that of the sustainment electrode group. On the other hand, in the addressing period and sustainment period for a sub-field that configures a frame "f+1", the potential of the even number auxiliary electrode group Aeven is held at the bias potential, and the potential of the odd number auxiliary electrode group Aodd is held at the potential equal to that of the sustainment electrode group.

In this second driving method, the potential of an auxiliary electrode at which sustainment light emission is not performed at a certain frame is held at the bias potential during the sustainment period. Thus, the diffusion in the longitudinal direction of a charge is restricted on the scan electrode and sustainment electrode on which a sustainment discharge is performed, and the operating voltage margin for the sustainment voltage can expand.

Figure 101A:
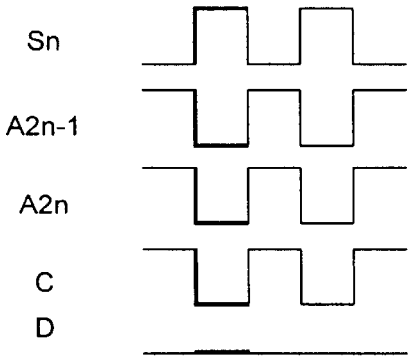
Figure 101B:
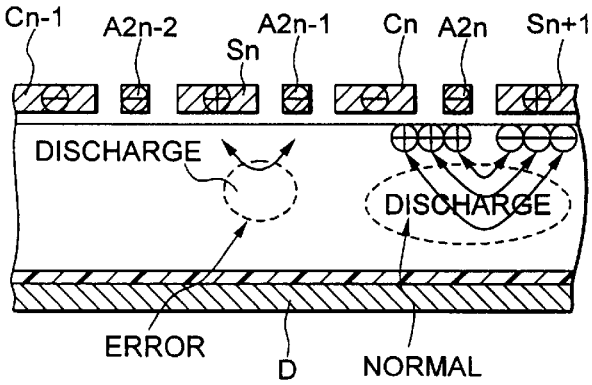
Figure 101C:
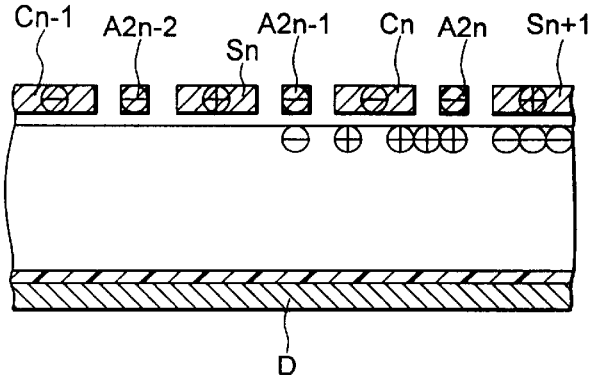
Figure 102A:
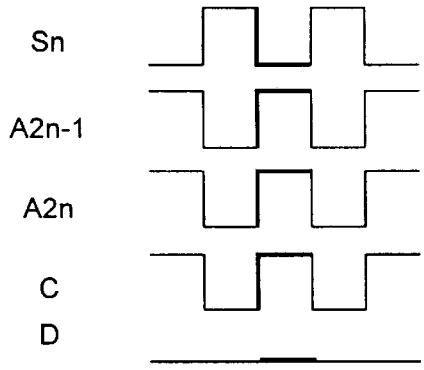
FIGS. 102A to 102C are views showing movement of the charge in the next period to the period shown in FIGS. 101A to 101C.
Figure 102B:
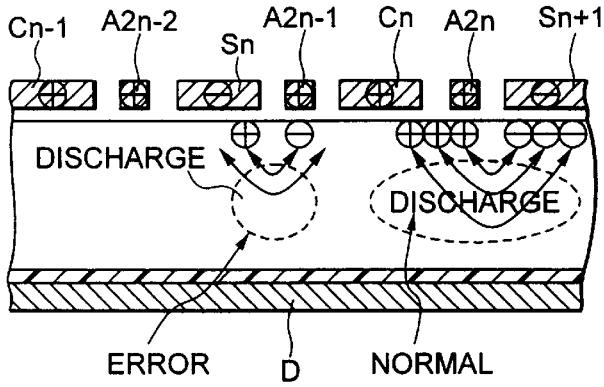
Figure 102C:
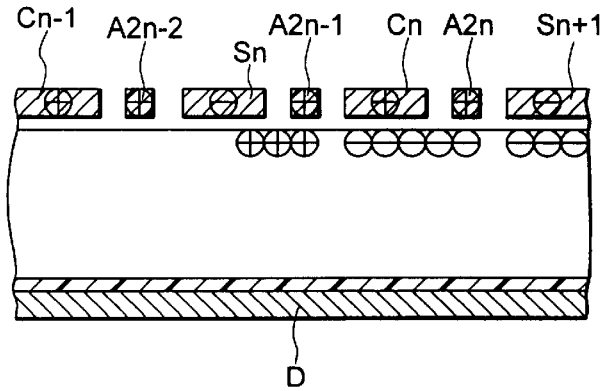
Figure 103A:
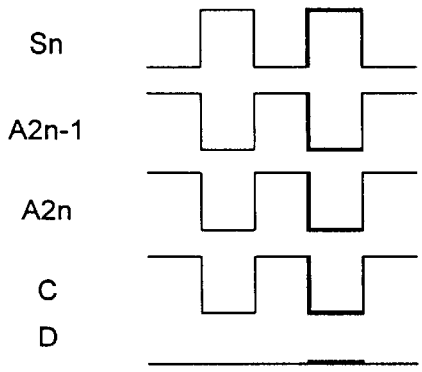
FIGS. 103A to 103C are views showing movement of the charge in the next period to the period shown in FIGS. 102A to 102C.
Figure 103B:
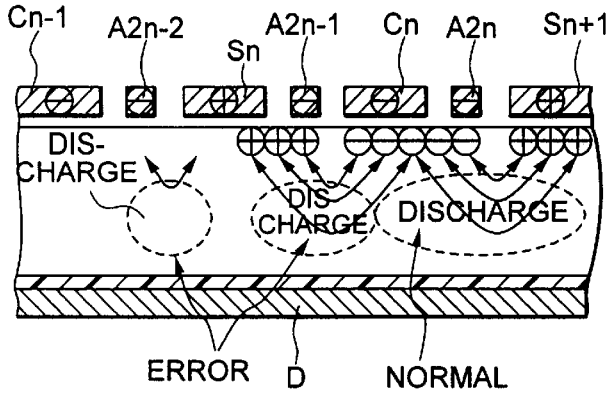
Figure 103C:
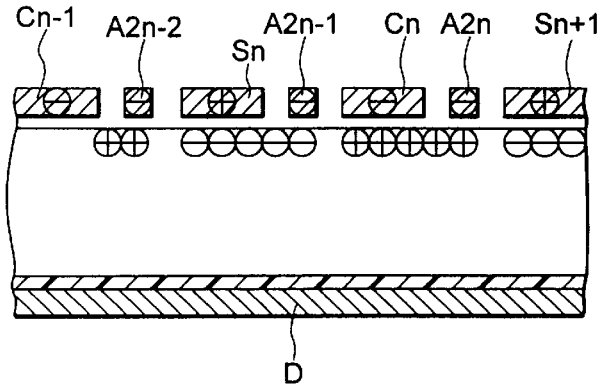
Figure 104A:
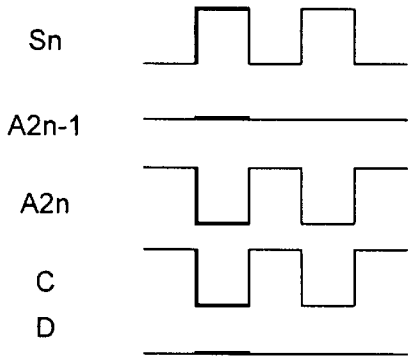
FIGS. 104A to 104C are views showing movement of the charge in the next period to the period shown in FIGS. 103A to 103C.
Figure 104B:
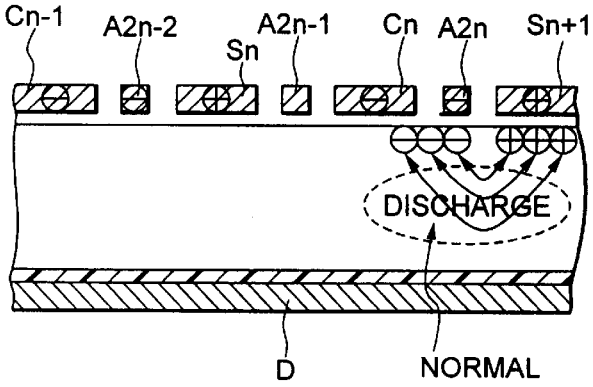
Figure 104C:
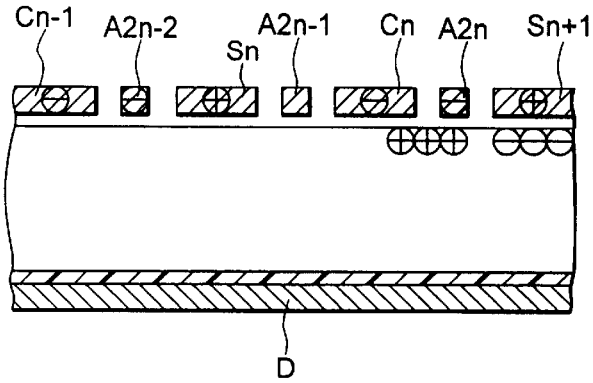
Figure 105A:
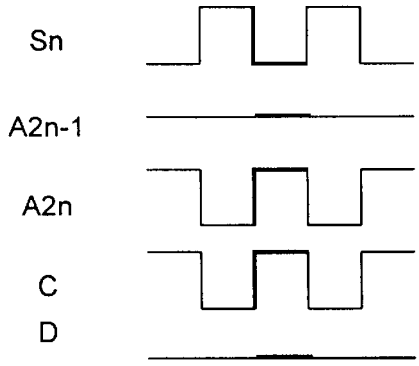
FIGS. 105A to 105C are views showing movement of the charge in the next period to the period shown in FIGS. 104A to 104C.
Figure 105B:
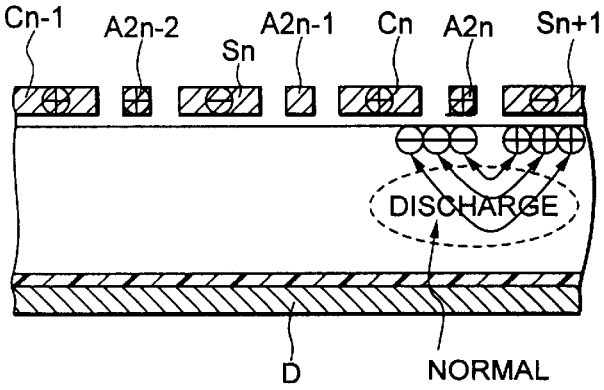
Figure 105C:
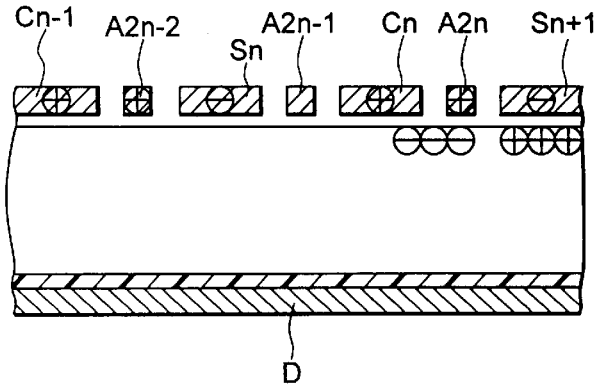
Figure 106A:
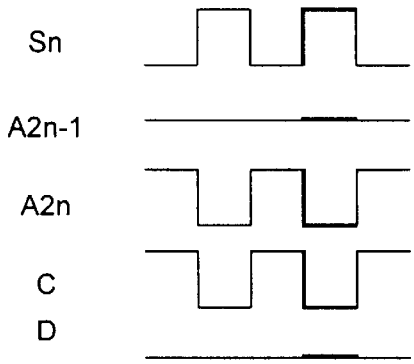
FIGS. 106A to 106C are views showing movement of the charge in the next period to the period shown in FIGS. 105A to 105C.
Figure 106B:
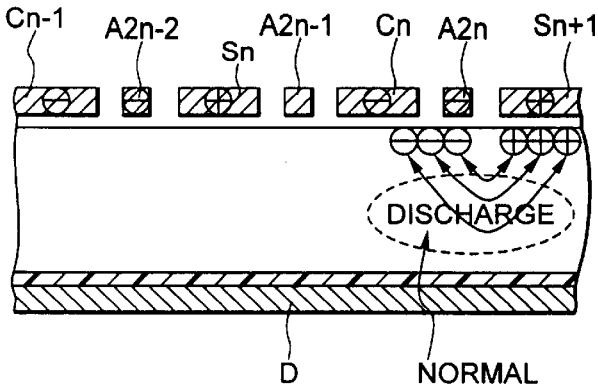
Figure 106C:
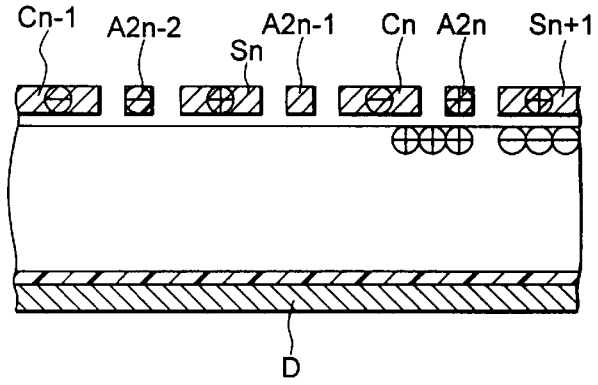

FIG. 101 to FIG. 103 are views showing movement of a charge during the sustainment period in the above-mentioned driving method (first driving method) according to the second embodiment. FIG. 104 to FIG. 106 are views showing movement of a charge during the sustainment period in the second driving method. FIG. 101A to FIG. 106A are timing charts each specifying each driving period; FIG. 101B to FIG. 106B are schematic views each showing a distribution of charges during discharge; and FIG. 101C to FIG. 106C are schematic views each showing a distribution of charges after discharge. In the timing charts shown in FIG. 101A to FIG. 106A, a corresponding driving period is indicated by thick line. In FIG. 101 to FIG. 106, there is shown a case in which sustainment light emission is performed between a scan electrode Sn+1 and each of an auxiliary electrode A2*n* and sustainment electrode Cn, and in which sustainment light emission is not performed between the scan electrode Sn and each of the auxiliary electrode A2*n*-2 and sustainment electrode Cn in a frame "f+1".

In the above-mentioned (first) driving method, sustainment light emission is performed between the scan electrode Sn+1 and each of the auxiliary electrode A2*n* and sustainment electrode Cn. During a sustainment period, a pulse identical to that of the sustainment electrode Cn is applied to the auxiliary electrodes A2*n*-1 and A2*n*, as shown in FIG. 101A to FIG. 103A. Therefore, a potential difference between the scan electrode Sn and the auxiliary electrode A2*n*-1 is large, and a gap between the electrodes is small. Thus, as shown in FIG. 101B and FIG. 101B, an incorrect discharge may occur between the scan electrode Sn and the auxiliary electrode A2*n*-1.

In addition, once incorrect discharge is generated between the scan electrode Sn and the auxiliary electrode A2*n*-1, as show n FIG. 102C, a wall charge is formed on the scan electrode Sn, and as shown in FIG. 103B, incorrect discharge may occur at application of the next sustainment pulse between the scan electrode Sn and the auxiliary electrode A2*n*-2.

In this manner, in the above-mentioned first driving method, discharge may be generated one after another even at a portion at which light emission is not selected, and correct display may not be obtained. This phenomenon is particularly likely to occur when a sustainment voltage is increased, and thus, a voltage at which a sustainment voltage can be set is restricted.

In contrast, in the second driving method, a sustainment discharge is performed between the scan electrode Sn+1 and each of the auxiliary electrode A2*n* and sustainment electrode Cn. During a sustainment period, as shown in FIG. 104A to FIG. 106A, the potential of the auxiliary electrode A2*n*-1 is held at a bias voltage. Thus, the potential of the auxiliary electrode A2*n*-1 is held at the bias voltage, thereby reducing a potential difference between the scan electrode Sn and the auxiliary electrode A2*n*-1 and a potential difference between the sustainment electrode Cn and the auxiliary electrode A2*n*-1. Therefore, as shown in FIG. 104B to FIG. 106B, incorrect discharge is not generated between the scan electrode Sn and the auxiliary electrode A2*n*-1 and between the sustainment electrode Cn and the auxiliary electrode A2*n*-1. Thus, a voltage that can be set as a sustainment voltage can be expanded.

Figure 107:
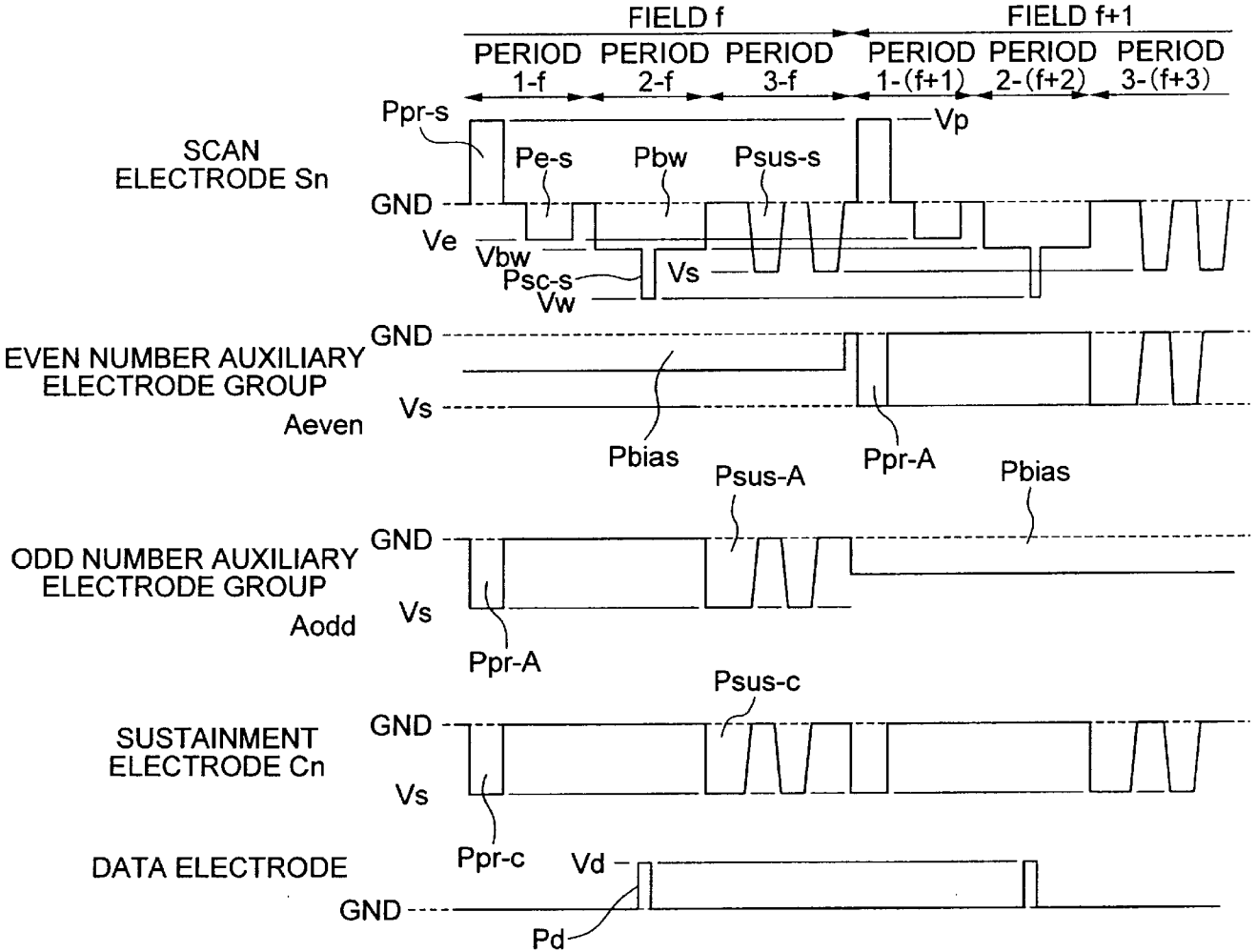
FIG. 107 is a timing chart showing a third driving method of the AC type plasma display according to each of the second and third embodiments.
Figure 108:
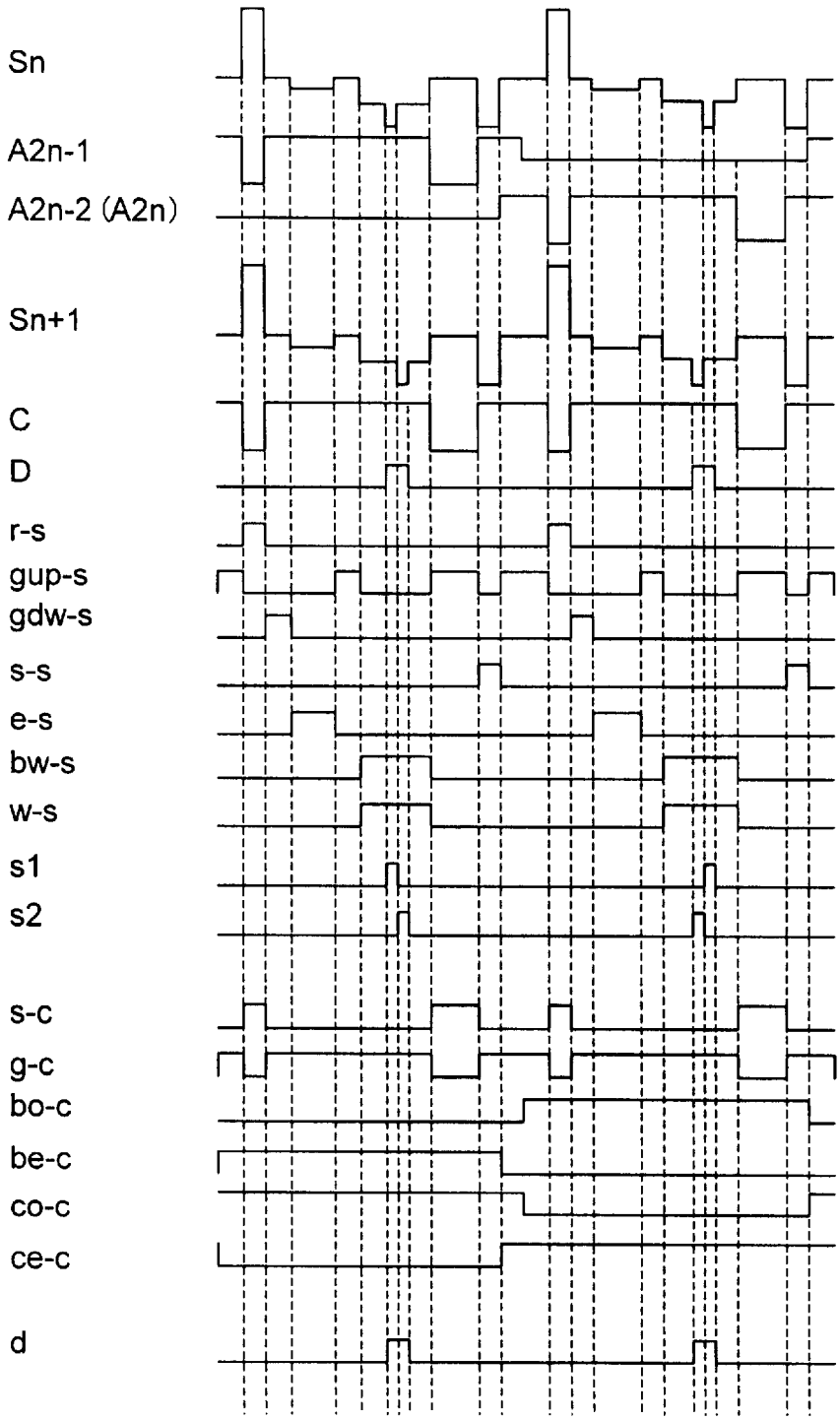
FIG. 108 is a timing chart showing an operation of drivers in the third driving method.

FIG. 107 is a timing chart showing a third driving method of the AC type plasma display according to the second and third embodiments. FIG. 108 is a timing chart showing an operation of each driver in the third driving method.

In this third driving method, during all the periods of a frame "f", the potential of the odd number auxiliary electrode group Aodd is held at a bias potential, and the potential of the even number auxiliary electrode group Aeven is held at a potential equal to that of the sustainment electrode group. On the other hand, during all the periods of a frame "f+1", the potential of the even number auxiliary electrode group Aeven is held at the bias potential, and the potential of the odd number auxiliary electrode group Aodd is held at the potential equal to that of the sustainment electrode group.

In this third driving method, during all the periods including reset period, the potential of the odd number auxiliary electrode group or even number auxiliary electrode group is held at the bias potential. Therefore, a reset discharge is restricted between the auxiliary electrode and scan electrode held at a bias potential. Thus, a discharge area for the reset discharge decreases, and the average luminescence indicated by black can be reduced.

Figure 109A:
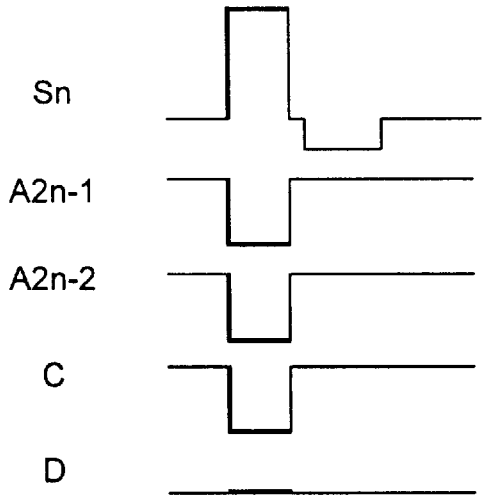
Figure 109B:
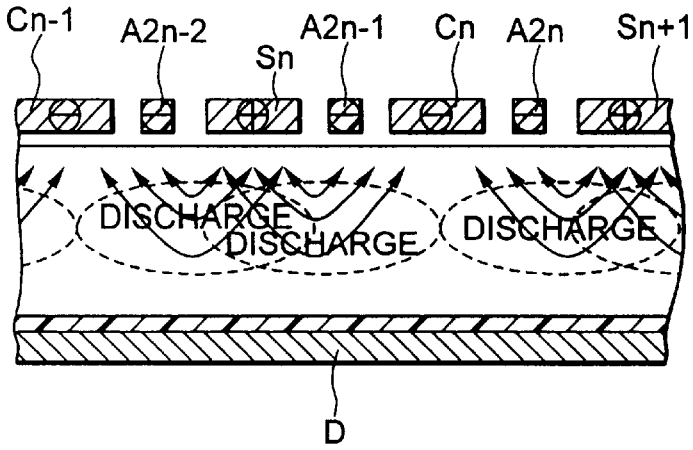
Figure 110A:
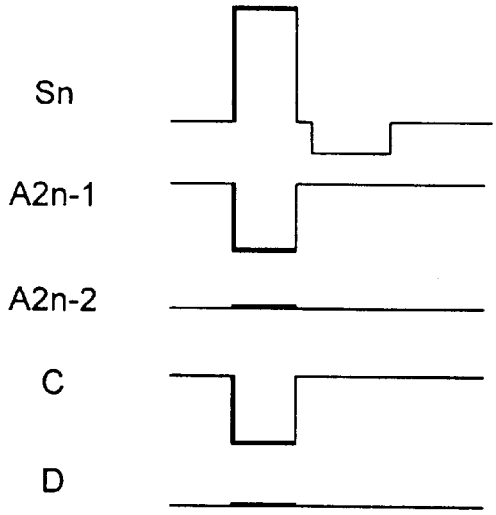
Figure 110B:
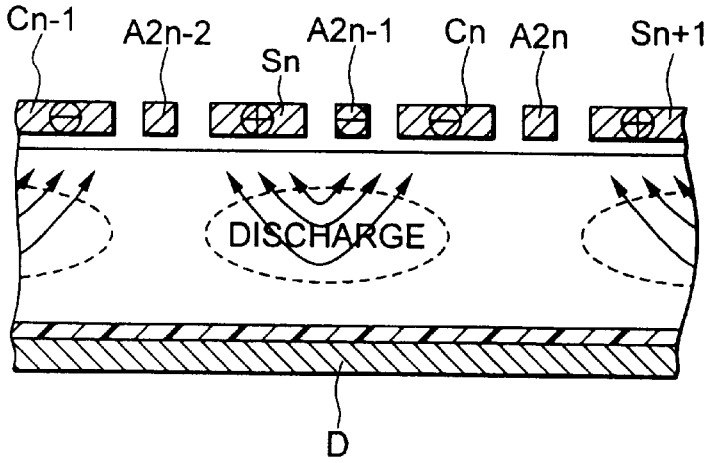

FIG. 109 is a view showing movement of a charge during a reset period in the aforementioned first driving method according to the second embodiment. FIG. 110 is a view showing movement of a charge during a reset period in the third driving method. FIG. 109A and FIG. 110A are timing charts each specifying each driving period. FIG. 109B and FIG. 110B are schematic views each showing a distribution of charges during discharge. In the timing charges each shown in FIG. 109A and FIG. 110A, a corresponding driving period is indicated by thick line.

In the aforementioned first driving method, when a reset pulse Ppr-s is applied to the scan electrode Sn, a reset pulse Ppr-A is applied to the adjacent auxiliary electrodes A2*n*-1 and A2*n*-2, which are next to the scan electrode Sn. Thus, as shown in FIG. 109B, a reset discharge may occur between the scan electrode Sn and each of the auxiliary electrodes A2*n*-1 and A2*n*-2. A reset discharge is generated at both ends of the scan electrode.

In contrast, in the third driving method, when a reset pulse Pdr-s is applied to the scan electrode Sn, a reset pulse Ppr-A is applied only to the lower auxiliary electrode A2*n*-1, and the potential of the upper auxiliary electrode A2*n*-2 is held at the bias voltage. A potential difference between the scan electrode Sn and the auxiliary electrode A2*n*-2 is reduced. Thus, a reset discharge may be generated only between the scan electrode Sn and the auxiliary electrode A2*n*-1. This discharge is not generated between the scan electrode Sn and the auxiliary electrode A2*n*-2. Therefore, an area in which a reset discharge is generated decreases, and thus, the average luminescence indicated by black is reduced.

The second and third driving methods may be combined with each other.

What is claimed is:

1. An AC type plasma display comprising:

first and second substrates disposed oppositely;

scan electrodes and sustainment electrodes provided alternately at an opposite face side to said second substrate in said first substrate, said scanning and sustainment electrodes extending in a row direction;

date electrodes provided at an opposite face side to said first substrate in said second substrate, said date electrodes extending in a column direction; and auxiliary electrodes provided at all of spaces between said scan electrodes and said sustainment electrodes, said auxiliary electrodes extending in a row direction;

a driving device;

wherein said driving device in each sub-field that configures a first frame:

holds a potential of auxiliary electrodes disposed at descending odd numbers at an arbitrary bias potential between a sustainment voltage applied to said sustainment electrodes during a sustainment discharge and a grounding potential at least during an addressing period, and applies a signal identical to a driving signal to be applied to one electrode selected from the group comprising said sustainment electrodes and scan electrodes to said auxiliary electrode disposed at the descending even numbers, and wherein said driving device in each sub-field that configures a second frame:

holds a potential of said auxiliary electrode disposed at even numbers at said arbitrary bias potential at least during said addressing period, and applies said signal identical to a driving signal to be applied to said one electrode to said auxiliary electrode disposed at odd numbers.

2. The AC type plasma display according to claim 1, wherein said driving device, in each sub-field that configures said first frame, holds a potential of said auxiliary electrode disposed at odd numbers at said bias potential during a sustainment period, and applies a signal identical to a driving signal to be applied to said sustainment electrode to said auxiliary electrode disposed at even numbers, and said driving device, in each sub-field that configures said second frame, holds a potential of said auxiliary electrode disposed at even numbers at said bias potential during a sustainment period, and applies a signal identical to a driving signal to be applied to said sustainment electrode to said auxiliary electrode disposed at odd number period.

3. An AC type plasma display according to claim 1, wherein said driving device applies a positive polarity reset pulse to said scan electrode, and applies a negative polarity reset pulse to said auxiliary electrode and said sustainment electrode during a reset period of said each sub-field.

4. The AC type plasma display according to claim 1, wherein said driving device, in each sub-field that configures said first frame, holds a potential of said auxiliary electrode disposed at odd numbers at said bias potential during a reset period, and applies a signal identical to a driving signal to be applied to said sustainment electrode to said auxiliary electrode disposed at even numbers, and said driving device, in each sub-field that configures said second frame, holds a potential of said auxiliary electrode disposed at even numbers at said bias potential during a reset period, and applies a signal identical to a driving signal to be applied to said sustainment electrode to said auxiliary electrode disposed at odd numbers.

5. The AC type plasma display according to claim 4, where in said driving device, during said reset period in each sub-field that configures said fist frame, applies a positive polarity reset pulse to said scan electrode, and applies a negative polarity reset pulse to said auxiliary electrode disposed at even number and said sustainment electrode, and said driving device, during said reset period in each sub-field that configures said second frame, applies a positive polarity reset pulse to said scan electrode, and applies a negative polarity reset pulse to said auxiliary electrode disposed at said odd number and said sustainment electrode.

6. An AC type plasma display, comprising:

first and second substrates disposed oppositely;

scan electrodes and sustainment electrodes provided aternatively at an opposite face side to said second substrate in said first substrate, said scanning and sustainment electrodes extending in a row direction;

data electrodes provided at an opposite face side to said first substrate in said second substrate, said data electrodes extending in a column direction; and auxiliary electrodes provided at all of spaces between said scan electrodes and said sustainment electrodes, said auxiliary electrodes extending in a row direction, wherein said sustainment electrodes and scan electrodes are composed of transparent electrodes, and said AC type plasma display further comprises:

first trace electrodes which are overlapped on said sustainment electrodes and have resistance lower than said transparent electrodes; and second trace electrodes which are overlapped on said scan electrode and have resistance lower than said transparent electrodes.

7. The AC type plasma display according to claim 6, wherein said auxiliary electrodes are composed of transparent electrodes, and said AC type plasma display further comprising third trace electrodes which are overlapped on said auxiliary electrodes and have resistance lower than said transparent electrodes.

8. An AC type plasma display comprising:

first and second substrates disposed oppositely;

scan electrodes and sustainment electrodes provided alternately at an opposite face side to said second substrate in said first substrate, said scanning and sustainment electrodes extending in a row direction;

data electrodes provided at an opposite face side to said first substrate in said second substrate, said data electrodes extending in a column direction;

auxiliary electrodes provided at all of spaces between said scan electrodes and said sustainment electrodes, said auxiliary electrodes extending in a row direction;

a driving portion connected to said sustainment electrodes, scan electrodes, and auxiliary electrodes; and a controller which controls operation of said driving portion to:

hold a potential of auxiliary electrodes disposed at descending odd numbers at an arbitrary bias potential between a sustainment voltage applied to said sustainment electrodes during a sustainment discharge and a grounding potential at least during an addressing period, and apply a signal identical to a driving signal to be applied to one electrode selected from the group comprising said sustainment electrodes and scan electrodes to said auxiliary electrode disposed at the descending even numbers in each sub-field that configures a first frame; and hold a potential of said auxiliary electrode disposed at even numbers at said arbitrary bias potential at least during said addressing period, and apply said signal identical to a driving signal to be applied to said one electrode to said auxiliary electrode disposed at odd numbers in each sub-field that configures a second frame.

9. The driving device according to claim 8, wherein said controller causes said driving portion to in each sub-field that configures said first frame, hold a potential of said auxiliary electrode disposed at odd numbers at said bias potential during a sustainment period, and apply a signal identical to a driving signal to be applied to said sustainment electrode to said auxiliary electrode disposed at even numbers, and in each sub-field that configures said second frame, hold a potential of said auxiliary electrode disposed at even numbers at said bias potential during a sustainment period, and apply a signal identical to a driving signal to be applied to said sustainment electrode to said auxiliary electrode disposed at odd number period.

10. The driving device according to claim 8, wherein said controller causes said driving portion to apply a positive polarity reset pulse to said scan electrode, and apply a negative polarity reset pulse to said auxiliary electrode and said sustainment electrode during a reset period of said each sub-field.

11. The driving device according to claim 8, wherein said controller causes said driving portion to, in each sub-field that configures said first frame, hold a potential of said auxiliary electrode disposed at odd numbers at said bias potential during a reset period, and apply a signal identical to a driving signal to be applied to said sustainment electrode to said auxiliary electrode disposed at even numbers, and in each sub-field that configures said second frame, hold a potential of said auxiliary electrode disposed at even numbers at said bias potential during a reset period, and apply a signal identical to a driving signal to be applied to said sustainment electrode to said auxiliary electrode disposed at odd numbers.

12. The driving device according to claim 11, wherein said controller causes said driving portion to during said reset period in each sub-field that configures said first frame, apply a positive polarity reset pulse to said scan electrode, and apply a negative polarity reset pulse to said auxiliary electrode disposed at even number and said sustainment electrode, and during said reset period in each sub-field that configures said second frame, apply a positive polarity reset pulse to said scan electrode, and apply a negative polarity reset pulse to said auxiliary electrode disposed at said odd number and said sustainment electrode.

13. An AC type plasma display comprising:

first and second substrates disposed oppositely;

scan electrodes and sustainment electrodes provided alternately at an opposite face side to said second substrate in said first substrate, said scanning and sustainment electrodes extending in a row direction;

data electrodes provided at an opposite face side to said first substrate in said second substrate, said data electrodes extending a column direction; and auxiliary electrodes provided at all of spaces between said scan electrodes and said sustainment electrodes, said auxiliary electrodes extending in a row direction, comprising the steps of:

holding a potential of auxiliary electrodes disposed at descending odd numbers at an arbitrary bias potential between a sustainment voltage applied to said sustainment electrodes during a sustainment discharge and a grounding potential at least during an addressing period, and applying a signal identical to a driving signal to be applied to one electrode selected from the group comprising said sustainment electrodes and scan electrodes to said auxiliary electrode disposed at the descending even numbers, in each sub-field that configures a first frame; and holding a potential of said auxiliary electrode disposed at even numbers at said arbitrary bias potential at least during said addressing period, and applying said signal identical to a driving signal to be applied to said one electrode to said auxiliary electrode disposed at odd numbers, in each sub-field that configures a second frame.

14. The driving method according to claim 13, further comprising the steps of:

holding a potential of said auxiliary electrode disposed at odd numbers at said bias potential during a sustainment period, and applying a signal identical to a driving signal to be applied to said sustainment electrode to said auxiliary electrode disposed at even numbers, in each sub-field that configures said first frame; and holding a potential of said auxiliary electrode disposed at even numbers at said bias potential during a sustainment period, and applying a signal identical to a driving signal to be applied to said sustainment electrode to said auxiliary electrode disposed at odd number period, in each sub-field that configures said second frame.

15. The driving method according to claim 14, further comprising the step of applying a positive polarity reset pulse to said scan electrode, and applies a negative polarity reset pulse to said auxiliary electrode and said sustainment electrode during a reset period of said each sub-field.

16. The driving method according to claim 13, further comprising the steps of:

holding a potential of said auxiliary electrode disposed at odd numbers at said bias potential during a reset period, and applying a signal identical to a driving signal to be applied to said sustainment electrode to said auxiliary electrode disposed at even numbers, in each sub-field that configures said first frame; and holding a potential of said auxiliary electrode disposed at even numbers at said bias potential during a reset period, and applying a signal identical to a driving signal to be applied to said sustainment electrode to said auxiliary electrode disposed at odd number period, in each sub-field that configures said second frame.

17. The driving method according to claim 16, further comprising the steps of:

applying a positive polarity reset pulse to said scan electrode, and applying a negative polarity reset pulse to said auxiliary electrode disposed at even number and said sustainment electrode, during said reset period in each sub-field that configures said first frame; and applying a positive polarity reset pulse to said scan electrode, and applying a negative polarity reset pulse to said auxiliary electrode disposed at said odd number and said sustainment electrode, during said reset period in each sub-field that configures said second frame.

* * * * *

UNITED STATES PATENT AND TRADEMARK OFFICE

CERTIFICATE OF CORRECTION

PATENT NO. : 6,717,557 B2
DATED : April 6, 2004
INVENTOR(S) : Ishizuka

It is certified that error appears in the above-identified patent and that said Letters Patent is hereby corrected as shown below:

Column 30,
Line 58, “date” should be -- data --.

Signed and Sealed this

Fifth Day of October, 2004

JON W. DUDAS
*Director of the United States Patent and Trademark Office*